US011654337B2

(12) United States Patent
Parsons et al.

(10) Patent No.: US 11,654,337 B2
(45) **Date of Patent: *May 23, 2023**

(54) GOLF CLUB HEADS AND METHODS TO MANUFACTURE GOLF CLUB HEADS

(71) Applicant: PARSONS XTREME GOLF, LLC, Scottsdale, AZ (US)

(72) Inventors: Robert R. Parsons, Scottsdale, AZ (US); Bradley D. Schweigert, Cave Creek, AZ (US); Michael R. Nicolette, Scottsdale, AZ (US)

(73) Assignee: PARSONS XTREME GOLF, LLC, Scottsdale, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/389,659

(22) Filed: Jul. 30, 2021

(65) Prior Publication Data

US 2021/0354009 A1 Nov. 18, 2021

Related U.S. Application Data

(63) Continuation-in-part of application No. 17/205,887, filed on Mar. 18, 2021, which is a continuation of (Continued)

(51) Int. Cl.
*A63B 53/04* (2015.01)
*A63B 60/02* (2015.01)
(Continued)

(52) U.S. Cl.
CPC ..... *A63B 53/0466* (2013.01); *A63B 53/04* (2013.01); *A63B 60/02* (2015.10);
(Continued)

(58) Field of Classification Search
CPC ..... A63B 53/0466; A63B 53/04; A63B 60/02; A63B 2053/0491; A63B 53/0408;
(Continued)

(56) References Cited

U.S. PATENT DOCUMENTS 1,133,129 A 3/1915 Govan
1,269,745 A 6/1918 Robertson
(Continued)

OTHER PUBLICATIONS

PCT/US15/42484: International Search Report and Written Opinion dated Oct. 19,2 015 (12 Pages).
(Continued)

*Primary Examiner* — Sebastiano Passaniti

(57) ABSTRACT

Embodiments of golf club heads and methods to manufacture golf club heads are generally described herein. In one example, a golf club head may include a body portion having a front portion, a rear portion, a toe portion, a heel portion, a bottom portion, a top portion, and a lightweight crown portion covering an opening in the top portion. The crown portion may include two or more integral ribs to stiffen the crown portion. The crown portion may be a composite crown portion formed in a mold by applying heat and pressure. Other examples and embodiments may be described and claimed.

19 Claims, 54 Drawing Sheets

Related U.S. Application Data application No. 16/820,366, filed on Mar. 16, 2020, now Pat. No. 10,981,037, which is a continuation of application No. 16/418,691, filed on May 21, 2019, now Pat. No. 10,653,928, which is a continuation of application No. 15/803,157, filed on Nov. 3, 2017, now Pat. No. 10,335,645, which is a continuation of application No. 15/290,859, filed on Oct. 11, 2016, now Pat. No. 9,814,945, which is a continuation of application No. 15/040,892, filed on Feb. 10, 2016, now Pat. No. 9,550,096, said application No. 16/820,366 is a continuation-in-part of application No. 16/372,009, filed on Apr. 1, 2019, now Pat. No. 10,821,334, which is a continuation of application No. 15/875,416, filed on Jan. 19, 2018, now Pat. No. 10,293,220, which is a continuation of application No. 15/446,842, filed on Mar. 1, 2017, now Pat. No. 9,895,582, which is a continuation of application No. 15/377,120, filed on Dec. 13, 2016, now Pat. No. 9,802,087, which is a continuation of application No. 14/939,849, filed on Nov. 12, 2015, now Pat. No. 9,555,295, which is a continuation of application No. 14/615,606, filed on Feb. 6, 2015, now Pat. No. 9,199,140, said application No. 16/820,366 is a continuation-in-part of application No. 16/290,610, filed on Mar. 1, 2019, now Pat. No. 10,617,918, which is a continuation of application No. 15/875,496, filed on Jan. 19, 2018, now Pat. No. 10,252,123, which is a continuation of application No. 15/457,627, filed on Mar. 13, 2017, now Pat. No. 9,895,583, which is a continuation of application No. 15/189,806, filed on Jun. 22, 2016, now Pat. No. 9,636,554, which is a continuation of application No. 14/667,546, filed on Mar. 24, 2015, now Pat. No. 9,399,158, which is a continuation-in-part of application No. 14/615,606, filed on Feb. 6, 2015, now Pat. No. 9,199,140, said application No. 16/820,366 is a continuation-in-part of application No. 16/375,553, filed on Apr. 4, 2019, now Pat. No. 10,695,623, which is a continuation of application No. 15/967,117, filed on Apr. 30, 2018, now Pat. No. 10,293,221, which is a continuation of application No. 15/457,618, filed on Mar. 13, 2017, now Pat. No. 9,887,526, which is a continuation of application No. 15/163,393, filed on May 24, 2016, now Pat. No. 9,662,547, which is a continuation of application No. 14/667,541, filed on Mar. 24, 2015, now Pat. No. 9,352,197, which is a continuation-in-part of application No. 14/615,606, filed on Feb. 6, 2015, now Pat. No. 9,199,140, application No. 17/389,659 is a continuation-in-part of application No. 17/231,832, filed on Apr. 15, 2021, which is a continuation of application No. 16/713,942, filed on Dec. 13, 2019, now Pat. No. 11,000,742, which is a continuation of application No. 16/198,128, filed on Nov. 21, 2018, now Pat. No. 10,532,257, which is a continuation of application No. 15/583,756, filed on May 1, 2017, now Pat. No. 10,143,899, which is a continuation of application No. 15/271,574, filed on Sep. 21, 2016, now Pat. No. 9,669,270, said application No. 17/389,659 is a continuation-in-part of application No. 17/138,797, filed on Dec. 30, 2020, now Pat. No. 11,344,774, which is a continuation of application No. 16/542,548, filed on Aug. 16, 2019, now Pat. No. 10,898,766, which is a continuation of application No. 15/967,098, filed on Apr. 30, 2018, now Pat. No. 10,420,989, which is a continuation of application No. 15/687,273, filed on Aug. 25, 2017, now Pat. No. 9,981,160, said application No. 16/542,548 is a continuation-in-part of application No. 16/222,580, filed on Dec. 17, 2018, now Pat. No. 10,722,764, which is a continuation of application No. 15/831,148, filed on Dec. 4, 2017, now Pat. No. 10,195,501, which is a continuation of application No. 15/453,701, filed on Mar. 8, 2017, now Pat. No. 9,833,667, said application No. 17/389,659 is a continuation-in-part of application No. 15/970,665, filed on May 3, 2018, now Pat. No. 11,173,356, which is a continuation of application No. 15/667,343, filed on Aug. 2, 2017, now Pat. No. 10,213,659, said application No. 15/970,665 is a continuation-in-part of application No. 15/808,552, filed on Nov. 9, 2017, now Pat. No. 10,099,093, which is a continuation of application No. 15/492,711, filed on Apr. 20, 2017, now Pat. No. 9,821,201, said application No. 15/970,665 is a continuation-in-part of application No. 15/724,035, filed on Oct. 3, 2017, now Pat. No. 9,999,814, which is a continuation of application No. 15/440,968, filed on Feb. 23, 2017, now Pat. No. 9,795,842, said application No. 15/970,665 is a continuation-in-part of application No. 15/807,201, filed on Nov. 8, 2017, now Pat. No. 10,010,770, which is a continuation of application No. 15/463,306, filed on Mar. 20, 2017, now Pat. No. 9,821,200, which is a continuation of application No. 15/249,857, filed on Aug. 19, 2016, now Pat. No. 9,630,070, said application No. 15/970,665 is a continuation-in-part of application No. 15/725,900, filed on Oct. 5, 2017, now Pat. No. 10,052,532, which is a continuation of application No. 15/445,253, filed on Feb. 28, 2017, now Pat. No. 9,795,843, which is a continuation of application No. 15/227,281, filed on Aug. 3, 2016, now Pat. No. 9,782,643, said application No. 15/970,665 is a continuation-in-part of application No. 15/477,972, filed on Apr. 3, 2017, now Pat. No. 9,914,029, which is a continuation of application No. 15/406,408, filed on Jan. 13, 2017, now Pat. No. 9,861,867, said application No. 17/389,659 is a continuation-in-part of application No. 17/155,486, filed on Jan. 22, 2021, which is a continuation of application No. 16/774,449, filed on Jan. 28, 2020, now Pat. No. 10,926,142, which is a continuation of application No. 16/179,406, filed on Nov. 2, 2018, now Pat. No. 10,583,336, said application No. 17/389,659 is a continuation of application No. 16/889,524, filed on Jun. 1, 2020, now Pat. No. 11,103,755, which is a continuation of application No. 16/419,639, filed on May 22, 2019, now Pat. No. 10,695,624, which is a continuation of application No. 16/234,169, filed on Dec. 27, 2018, now Pat. No. 10,376,754, which is a continuation of application No. 16/205,583, filed on Nov. 30, 2018, now abandoned, said application No. 16/419,639 is a continuation-in-part of application No. 15/981,094, filed on May 16, 2018, now Pat. No. 10,384,102, which is a continuation of application No. 15/724,035, filed on Oct. 3, 2017, now Pat. No. 9,999,814, which is a continuation of application No. 15/440,968, filed on Feb. 23, 2017, now Pat. No. 9,795,842, said application No. 16/889,524 is a continuation-in-part of application No. 16/533,352, filed on Aug. 6, 2019, now Pat. No. 10,843,051, which is a continuation of application No. 16/030,403, filed on Jul. 9, 2018, now Pat. No. 10,413,787.

(60) Provisional application No. 62/115,024, filed on Feb. 11, 2015, provisional application No. 62/120,760, filed on Feb. 25, 2015, provisional application No. 62/138,918, filed on Mar. 26, 2015, provisional application No. 62/184,757, filed on Jun. 25, 2015, provisional application No. 62/194,135, filed on Jul. 17, 2015, provisional application No. 62/195,211, filed on Jul. 21, 2015, provisional application No. 62/042,155, filed on Aug. 26, 2014, provisional application No. 62/048,693, filed on Sep. 10, 2014, provisional application No. 62/101,543, filed on Jan. 9, 2015, provisional application No. 62/105,123, filed on Jan. 19, 2015, provisional application No. 62/109,510, filed on Jan. 29, 2015, provisional application No. 62/291,793, filed on Feb. 5, 2016, provisional application No. 62/380,727, filed on Aug. 29, 2016, provisional application No. 62/356,539, filed on Jun. 30, 2016, provisional application No. 62/360,802, filed on Jul. 11, 2016, provisional application No. 62/512,275, filed on May 30, 2017, provisional application No. 62/329,662, filed on Apr. 29, 2016, provisional application No. 62/444,671, filed on Jan. 10, 2017, provisional application No. 62/445,878, filed on Jan. 13, 2017, provisional application No. 62/337,184, filed on May 16, 2016, provisional application No. 62/361,988, filed on Jul. 13, 2016, provisional application No. 62/281,639, filed on Jan. 21, 2016, provisional application No. 62/296,506, filed on Feb. 17, 2016, provisional application No. 62/301,756, filed on Mar. 1, 2016, provisional application No. 62/362,491, filed on Jul. 14, 2016, provisional application No. 62/406,856, filed on Oct. 11, 2016, provisional application No. 62/412,389, filed on Oct. 25, 2016, provisional application No. 62/419,242, filed on Nov. 8, 2016, provisional application No. 62/581,456, filed on Nov. 3, 2017, provisional application No. 62/662,112, filed on Apr. 24, 2018, provisional application No. 62/734,176, filed on Sep. 20, 2018, provisional application No. 62/734,922, filed on Sep. 21, 2018, provisional application No. 62/740,355, filed on Oct. 2, 2018, provisional application No. 62/745,113, filed on Oct. 12, 2018, provisional application No. 62/772,669, filed on Nov. 28, 2018, provisional application No. 62/621,948, filed on Jan. 25, 2018, provisional application No. 62/655,437, filed on Apr. 10, 2018, provisional application No. 62/444,671, filed on Jan. 10, 2017, provisional application No. 62/445,878, filed on Jan. 13, 2017, provisional application No. 62/530,734, filed on Jul. 10, 2017, provisional application No. 62/624,294, filed on Jan. 31, 2018.

(51) Int. Cl.
*A63B 60/54* (2015.01)
*A63B 53/06* (2015.01)

(52) U.S. Cl.
CPC ..... *A63B 53/0408* (2020.08); *A63B 53/0412* (2020.08); *A63B 53/0433* (2020.08); *A63B 53/0475* (2013.01); *A63B 53/06* (2013.01); *A63B 60/54* (2015.10); *A63B 2053/0491* (2013.01)

(58) Field of Classification Search
CPC . A63B 53/0412; A63B 53/0433; A63B 60/54; A63B 53/0475; A63B 53/06
USPC ..... 473/287–292, 324–350
See application file for complete search history.

(56) References Cited

U.S. PATENT DOCUMENTS

| | | | |
|---|---|---|---|
| 1,306,029 | A | 6/1919 | Robertson |
| D55,867 | S | 7/1920 | Matters |
| 1,534,600 | A | 4/1925 | Mattern |
| 1,538,312 | A | 5/1925 | Neish |
| D138,437 | S | 8/1944 | Link |
| D138,438 | S | 8/1944 | Link |
| D138,442 | S | 8/1944 | Link |
| 3,652,094 | A | 3/1972 | Glover |
| D240,748 | S | 7/1976 | Bock et al. |
| 4,085,934 | A | 4/1978 | Churchward |
| D253,778 | S | 12/1979 | Madison |
| D307,783 | S | 5/1990 | Iinuma |
| 5,106,094 | A | 4/1992 | Desbiolles et al. |
| D326,885 | S | 6/1992 | Paul |
| 5,219,408 | A | 6/1993 | Sun |
| D351,883 | S | 10/1994 | Solheim et al. |
| 5,351,958 | A | 10/1994 | Helmstetter |
| 5,499,819 | A | 3/1996 | Nagamoto |
| 5,518,243 | A | 5/1996 | Redman |
| D378,111 | S | 2/1997 | Parente et al. |
| 5,624,331 | A | 4/1997 | Lo et al. |
| D384,120 | S | 9/1997 | Cruz et al. |
| 5,788,584 | A | 8/1998 | Parente et al. |
| D400,625 | S | 11/1998 | Kubica et al. |
| D400,627 | S | 11/1998 | Kubica et al. |
| D405,492 | S | 2/1999 | Kubica et al. |
| D405,498 | S | 2/1999 | Laney |
| 5,997,415 | A | 12/1999 | Wood |
| 6,146,287 | A | 11/2000 | Rugge et al. |
| D444,830 | S | 7/2001 | Kubica et al. |
| 6,280,349 | B1 | 8/2001 | Cook |
| 6,290,609 | B1 | 9/2001 | Takeda |
| 6,306,048 | B1 | 10/2001 | McCabe et al. |
| 6,409,612 | B1 | 6/2002 | Evans et al. |
| D478,140 | S | 8/2003 | Burrows |
| 6,638,182 | B2 | 10/2003 | Kosmatka |
| 6,773,360 | B2 | 8/2004 | Willett et al. |
| D508,969 | S | 8/2005 | Hasebe |
| 6,969,326 | B2 | 11/2005 | Shiell et al. |
| D513,051 | S | 12/2005 | Barez et al. |
| D514,179 | S | 1/2006 | Chen et al. |
| D514,185 | S | 1/2006 | Barez et al. |
| 6,991,560 | B2 | 1/2006 | Tseng |
| D520,586 | S | 5/2006 | Bingman |
| D522,077 | S | 5/2006 | Schweiger et al. |
| D522,601 | S | 6/2006 | Schweiger et al. |
| D523,498 | S | 6/2006 | Chen et al. |
| D526,694 | S | 8/2006 | Schweigert et al. |
| 7,083,530 | B2 | 8/2006 | Wahl et al. |
| 7,121,956 | B2 | 10/2006 | Lo |
| D534,599 | S | 1/2007 | Barez et al. |
| 7,166,040 | B2 | 1/2007 | Hoffman et al. |
| D536,401 | S | 2/2007 | Kawami |
| D536,403 | S | 2/2007 | Kawami |
| 7,186,190 | B1 | 3/2007 | Beach et al. |
| 7,214,142 | B2 | 5/2007 | Meyer et al. |
| 7,223,180 | B2 | 5/2007 | Willett et al. |
| 7,261,646 | B2 | 8/2007 | Shiell et al. |
| 7,281,994 | B2 | 10/2007 | Shiell et al. |
| D563,498 | S | 3/2008 | Jertson et al. |
| D564,054 | S | 3/2008 | Jertson et al. |
| D564,055 | S | 3/2008 | Jertson et al. |
| 7,338,388 | B2 | 3/2008 | Schweigert et al. |
| 7,347,794 | B2 | 3/2008 | Schweiger |
| D567,317 | S | 4/2008 | Jertson et al. |
| D569,933 | S | 5/2008 | Jertson et al. |
| D569,934 | S | 5/2008 | Jertson et al. |
| D569,935 | S | 5/2008 | Schweigert et al. |

(56) References Cited

U.S. PATENT DOCUMENTS

D569,936 S 5/2008 Schweigert et al.
D569,942 S 5/2008 Jertson et al.
D570,937 S 6/2008 Schweigert et al.
D570,938 S 6/2008 Jertson et al.
7,407,447 B2 8/2008 Beach et al.
7,410,425 B2 8/2008 Willett et al.
7,410,426 B2 8/2008 Willett et al.
7,419,441 B2 9/2008 Hoffman et al.
7,435,190 B2 10/2008 Sugimoto
7,448,963 B2 11/2008 Beach et al.
7,448,964 B2 11/2008 Schweigert et al.
7,494,425 B2 2/2009 Shiell et al.
7,527,565 B1 5/2009 Ehlers et al.
7,530,904 B2 5/2009 Beach et al.
D594,520 S 6/2009 Schweigert et al.
D594,521 S 6/2009 Jertson et al.
D594,919 S 6/2009 Schweiger et al.
7,540,811 B2 6/2009 Beach et al.
D597,620 S 8/2009 Taylor et al.
7,568,985 B2 8/2009 Beach et al.
7,578,753 B2 8/2009 Beach et al.
D600,297 S 9/2009 Jertson et al.
7,584,531 B2 9/2009 Schweigert et al.
7,588,502 B2 9/2009 Nishino
7,591,738 B2 9/2009 Beach et al.
D603,472 S 11/2009 Schweigert et al.
7,611,424 B2 11/2009 Nagai et al.
7,621,823 B2 11/2009 Beach et al.
D605,715 S 12/2009 Barez et al.
7,632,194 B2 12/2009 Beach et al.
7,641,568 B2 1/2010 Hoffman et al.
7,658,666 B2 2/2010 Sung
7,713,142 B2 5/2010 Hoffman et al.
7,717,804 B2 5/2010 Beach et al.
7,717,805 B2 5/2010 Beach et al.
D618,746 S 6/2010 Jertson et al.
D618,747 S 6/2010 Schweigert et al.
D618,753 S 6/2010 Jertson et al.
D618,754 S 6/2010 Schweigert et al.
7,744,484 B1 6/2010 Chao
7,798,203 B2 9/2010 Schweigert et al.
7,846,041 B2 12/2010 Beach et al.
D635,626 S 4/2011 Nicolette
D636,893 S 4/2011 Nicholls et al.
7,927,229 B2 4/2011 Jertson et al.
D638,896 S 5/2011 Schweiger et al.
7,963,861 B2 6/2011 Beach et al.
8,007,369 B2 8/2011 Soracco
8,012,038 B1 9/2011 Beach et al.
D647,585 S 10/2011 Jertson et al.
8,096,896 B2 1/2012 Schiell et al.
D661,751 S 6/2012 Nicolette et al.
D661,756 S 6/2012 Nicolette et al.
8,197,357 B1 6/2012 Rice et al.
8,202,175 B2 6/2012 Ban
8,216,087 B2 7/2012 Breier et al.
8,257,196 B1 9/2012 Abbott et al.
8,257,197 B2 9/2012 Schweiger
8,262,506 B2 9/2012 Watson et al.
8,287,402 B2 10/2012 Shiell et al.
D673,630 S 1/2013 Schweiger
D673,632 S 1/2013 Schweigert et al.
8,353,783 B2 1/2013 Soracco
8,353,787 B2 1/2013 Meyer et al.
8,371,957 B2 2/2013 Schweigert et al.
D680,179 S 4/2013 Solheim et al.
8,414,422 B2 4/2013 Peralta et al.
8,444,506 B2 5/2013 Watson et al.
8,485,919 B2 7/2013 Rice et al.
8,540,590 B2 9/2013 Tsukada et al.
D691,230 S 10/2013 Chen et al.
8,562,457 B2 10/2013 Beach et al.
8,568,248 B2 10/2013 DeShiell et al.
8,608,587 B2 12/2013 Henrikson et al.
8,628,431 B2 1/2014 Schweiger et al.
8,651,975 B2 2/2014 Soracco
8,663,026 B2 3/2014 Blowers et al.
8,777,778 B2 7/2014 Solheim et al.
8,784,232 B2 7/2014 Jertson et al.
8,790,196 B2 7/2014 Solheim et al.
8,808,108 B2 8/2014 Schweiger
D712,989 S 9/2014 Gillig
8,826,512 B2 9/2014 Schweiger
8,858,362 B1 10/2014 Leposky et al.
8,961,336 B1 2/2015 Parsons et al.
D724,164 S 3/2015 Schweigert et al.
8,979,671 B1 3/2015 Demille et al.
D729,892 S 5/2015 Nicolette et al.
D733,234 S 6/2015 Nicolette
9,199,140 B1 12/2015 Schweiger et al.
9,199,143 B1 12/2015 Parsons et al.
D753,251 S 4/2016 Schweigert et al.
D756,471 S 5/2016 Nicolette et al.
9,352,197 B2 5/2016 Parsons et al.
D760,334 S 6/2016 Schweigert et al.
9,399,157 B2 7/2016 Greensmith et al.
9,399,158 B2 7/2016 Parsons et al.
9,399,352 B2 7/2016 Mizutani et al.
9,427,634 B2 8/2016 Parsons et al.
9,452,325 B2 9/2016 DeShiell et al.
9,555,294 B2 1/2017 Henrikson et al.
9,630,070 B2 4/2017 Parsons et al.
9,682,295 B1 6/2017 Dawson et al.
9,821,201 B1 11/2017 Parsons et al.
9,839,821 B2 12/2017 DeShiell et al.
10,376,754 B2 8/2019 Parsons et al.
10,695,624 B2 6/2020 Parsons et al.
10,722,765 B2 * 7/2020 Schweigert ..... A63B 60/02
10,960,274 B2 * 3/2021 Parsons ..... A63B 53/0466
11,103,755 B2 * 8/2021 Parsons ..... A63B 53/04
11,338,179 B2 * 5/2022 Takechi ..... A63B 53/0466
2003/0027662 A1 2/2003 Werner et al.
2003/0104878 A1 6/2003 Yabu
2004/0018891 A1 * 1/2004 Antonious ..... A63B 53/0466 473/349
2004/0033846 A1 2/2004 Caldwell
2004/0087388 A1 5/2004 Beach et al.
2004/0152539 A1 8/2004 Yabu
2004/0192468 A1 9/2004 Onoda et al.
2005/0096154 A1 5/2005 Chen
2005/0101408 A1 5/2005 Sanchez et al.
2005/0192116 A1 9/2005 Imamoto
2005/0250596 A1 11/2005 Chuang
2006/0052181 A1 3/2006 Serrano et al.
2006/0052185 A1 3/2006 Kawaguchi et al.
2006/0100031 A1 5/2006 Lan
2006/0105856 A1 5/2006 Lo
2006/0111200 A1 5/2006 Poynor
2007/0004527 A1 1/2007 Helmstetter
2007/0238551 A1 10/2007 Yokota
2007/0293344 A1 12/2007 Davis
2008/0004133 A1 1/2008 Schweiger
2008/0015049 A1 1/2008 Imamoto
2008/0188322 A1 8/2008 Anderson et al.
2008/0261715 A1 10/2008 Carter
2009/0029795 A1 1/2009 Schweigert et al.
2010/0144461 A1 6/2010 Ban
2010/0167837 A1 7/2010 Ban
2010/0331102 A1 12/2010 Golden et al.
2011/0143858 A1 6/2011 Peralta et al.
2012/0094782 A1 4/2012 Beach et al.
2012/0142445 A1 6/2012 Burnett et al.
2012/0190479 A1 7/2012 Rice et al.
2012/0202615 A1 8/2012 Beach et al.
2012/0220387 A1 8/2012 Beach et al.
2013/0130826 A1 5/2013 Soracco
2013/0210542 A1 8/2013 Harbert et al.
2013/0303304 A1 11/2013 Sato
2013/0318772 A1 12/2013 Wahl et al.
2013/0324281 A1 12/2013 Boyd et al.
2014/0235369 A1 8/2014 Willett et al.
2015/0018123 A1 1/2015 Cole et al.
2015/0231454 A1 8/2015 Parsons et al.
2015/0290503 A1 10/2015 Su

(56) References Cited

U.S. PATENT DOCUMENTS

| | | | |
|---|---|---|---|
| 2015/0360098 | A1 | 12/2015 | Parsons et al. |
| 2016/0059088 | A1 | 3/2016 | Parsons et al. |
| 2016/0256753 | A1 | 9/2016 | Westrum et al. |
| 2016/0339308 | A1 | 11/2016 | Parsons et al. |
| 2017/0312592 | A1 | 11/2017 | Parsons et al. |
| 2018/0296885 | A1 | 10/2018 | Nakamura |
| 2018/0296887 | A1 | 10/2018 | Motokawa |

OTHER PUBLICATIONS

PCT/US16/17474: International Search Report and Written Opinion dated May 12, 2016 (9 Pages).
PCT/US17/55155: International Search Report and Written Opinion dated Jan. 25, 2018 (9 Pages).
PCT/US2015/016666: International Search Report and Written Opinion dated May 14, 2015 (8 Pages).
PCT/US2015/042282: International Search Report and Written Opinion dated Oct. 13, 2 015 (12 Pages).
PCT/US2017/013513: International Search Report and Written Opinion dated Mar. 17, 2017 (18 Pages).
PCT/US2019/026099: International Search Report and Written Opinion dated May 7, 2019 (7 pages).
Spotted: Three New PXG Drivers Appear on the USGA Conforming List (GOLFWRX). Dec. 18, 2017. Retrieved From the Internet on Jan. 16, 2019. URL:. <http://www.golfwrx.com/482592/spotted-three-new-pxg-drivers-appear-on-the-usga-conforming-list/>.
U.S. Appl. No. 29/512,313, Nicolette, "Golf Club Head," filed Dec. 18, 2018.

* cited by examiner

GOLF CLUB HEADS AND METHODS TO MANUFACTURE GOLF CLUB HEADS

CROSS REFERENCE

This application is a continuation-in-part of application Ser. No. 17/205,887, filed Mar. 18, 2021, which is a continuation of application Ser. No. 16/820,366, filed Mar. 16, 2020, now U.S. Pat. No. 10,981,037, which is a continuation of application Ser. No. 16/418,691, filed May 21, 2019, now U.S. Pat. No. 10,653,928, which is a continuation of application Ser. No. 15/803,157, filed Nov. 3, 2017, now U.S. Pat. No. 10,335,645, which is a continuation of application Ser. No. 15/290,859, filed Oct. 11, 2016, now U.S. Pat. No. 9,814,945, which is a continuation of application Ser. No. 15/040,892, filed Feb. 10, 2016, now U.S. Pat. No. 9,550,096, which claims the benefit of U.S. Provisional Application No. 62/115,024, filed Feb. 11, 2015, U.S. Provisional Application No. 62/120,760, filed Feb. 25, 2015, U.S. Provisional Application No. 62/138,918, filed Mar. 26, 2015, U.S. Provisional Application No. 62/184,757, filed Jun. 25, 2015, U.S. Provisional No. 62/194,135, filed Jul. 17, 2015, and U.S. Provisional Application No. 62/195,211, filed Jul. 21, 2015.

U.S. application Ser. No. 16/820,366, filed Mar. 16, 2020, is a continuation-in-part of application Ser. No. 16/372,009, filed Apr. 1, 2019, now U.S. Pat. No. 10,821,334, which is a continuation of application Ser. No. 15/875,416, filed Jan. 19, 2018, now U.S. Pat. No. 10,293,220, which is a continuation of application Ser. No. 15/446,842, filed Mar. 1, 2017, now U.S. Pat. No. 9,895,582, which is a continuation of application Ser. No. 15/377,120, filed Dec. 13, 2016, now U.S. Pat. No. 9,802,087, which is a continuation of application Ser. No. 14/939,849, filed Nov. 12, 2015, now U.S. Pat. No. 9,555,295, which is a continuation of application Ser. No. 14/615,606, filed Feb. 6, 2015, now U.S. Pat. No. 9,199,140.

U.S. application Ser. No. 16/820,366, filed Mar. 16, 2020, is a continuation-in-part of application Ser. No. 16/290,610, filed Mar. 1, 2019, now U.S. Pat. No. 10,617,918, which is a continuation of application Ser. No. 15/875,496, filed Jan. 19, 2018, now U.S. Pat. No. 10,252,123, which is a continuation of application Ser. No. 15/457,627, filed Mar. 13, 2017, now U.S. Pat. No. 9,895,583, which is a continuation of application Ser. No. 15/189,806, filed Jun. 22, 2016, now U.S. Pat. No. 9,636,554, which is a continuation of application Ser. No. 14/667,546, filed Mar. 24, 2015, now U.S. Pat. No. 9,399,158, which is a continuation-in-part of application Ser. No. 14/615,606, filed Feb. 6, 2015, now U.S. Pat. No. 9,199,140, which claims the benefit of U.S. Provisional Application No. 62/042,155, filed Aug. 26, 2014, U.S. Provisional Application No. 62/048,693, filed Sep. 10, 2014, U.S. Provisional Application No. 62/101,543, filed Jan. 9, 2015, U.S. Provisional Application No. 62/105,123, filed Jan. 19, 2015, and U.S. Provisional Application No. 62/109,510, filed Jan. 29, 2015.

U.S. application Ser. No. 16/820,366, filed Mar. 16, 2020, is a continuation-in-part of application Ser. No. 16/375,553, filed Apr. 4, 2019, now U.S. Pat. No. 10,695,623, which is a continuation of application Ser. No. 15/967,117, filed Apr. 30, 2018, now U.S. Pat. No. 10,293,221, which is a continuation application Ser. No. 15/457,618, filed Mar. 13, 2017, now U.S. Pat. No. 9,987,526, which is a continuation of application Ser. No. 15/163,393, filed May 24, 2016, now U.S. Pat. No. 9,662,547, which is a continuation of application Ser. No. 14/667,541, filed Mar. 24, 2015, now U.S. Pat. No. 9,352,197, which is a continuation-in-part of application Ser. No. 14/615,606, filed Feb. 6, 2015, now U.S. Pat. No. 9,199,140, which claims the benefit of U.S. Provisional Application No. 62/042,155, filed Aug. 26, 2014, U.S. Provisional Application No. 62/048,693, filed Sep. 10, 2014, U.S. Provisional Application No. 62/101,543, filed Jan. 9, 2015, U.S. Provisional Application No. 62/105,123, filed Jan. 19, 2015, and U.S. Provisional Application No. 62/109,510, filed Jan. 29, 2015.

This application is a continuation-in-part application Ser. No. 17/231,832, filed Apr. 15, 2021, which is a continuation of application Ser. No. 16/713,942, filed Dec. 13, 2019, now U.S. Pat. No. 11,000,742, which is a continuation of application Ser. No. 16/198,128, filed Nov. 21, 2018, now U.S. Pat. No. 10,532,257, which is a continuation of application Ser. No. 15/583,756, filed May 1, 2017, now U.S. Pat. No. 10,143,899, which is a continuation of application Ser. No. 15/271,574, filed Sep. 21, 2016, now U.S. Pat. No. 9,669,270, which claims the benefit of U.S. Provisional Application No. 62/291,793, filed Feb. 5, 2016.

This application is a continuation-in-part of application Ser. No. 17/138,797, filed Dec. 30, 2020, which is a continuation of application Ser. No. 16/542,548, filed Aug. 16, 2019, now U.S. Pat. No. 10,898,766, which is a continuation of application Ser. No. 15/967,098, filed Apr. 30, 2018, now U.S. Pat. No. 10,420,989, which is a continuation of application Ser. No. 15/687,273, filed Aug. 25, 2017, now U.S. Pat. No. 9,981,160, which claims the benefit of U.S. Provisional Application No. 62/380,727, filed Aug. 29, 2016.

U.S. patent application Ser. No. 16/542,548, filed Aug. 16, 2019 is also a continuation-in-part of application Ser. No. 16/222,580, filed Dec. 17, 2018, now U.S. Pat. No. 10,722,764, which is a continuation of application Ser. No. 15/831,148, filed Dec. 4, 2017, now U.S. Pat. No. 10,195,101, which is a continuation of application Ser. No. 15/453,701, filed Mar. 8, 2017, now U.S. Pat. No. 9,833,667, which claims the benefit of U.S. Provisional Application No. 62/356,539, filed Jun. 30, 2016, and U.S. Provisional Application No. 62/360,802, filed Jul. 11, 2016.

This application is a continuation-in-part of application Ser. No. 15/970,665, filed May 3, 2018, which is a continuation of application Ser. No. 15/667,343, filed Aug. 2, 2017, now U.S. Pat. No. 10,213,659, which claims the benefit of U.S. Provisional Application No. 62/512,275, filed May 30, 2017.

U.S. patent application Ser. No. 15/970,665, filed May 3, 2018, is also a continuation-in-part application Ser. No. 15/808,552, filed Nov. 9, 2017, now U.S. Pat. No. 10,099,093, which is a continuation of application Ser. No. 15/492,711, filed Apr. 20, 2017, now U.S. Pat. No. 9,821,201, which claims the benefit of U.S. Provisional Application No. 62/329,662, filed Apr. 29, 2016.

U.S. patent application Ser. No. 15/970,665, filed May 3, 2018, is also a continuation-in-part of application Ser. No. 15/724,035, filed Oct. 3, 2017, now U.S. Pat. No. 9,999,814 which is a continuation of application Ser. No. 15/440,968, filed Feb. 23, 2017, now U.S. Pat. No. 9,795,842, which claims the benefit of U.S. Provisional Application No. 62/444,671, filed Jan. 10, 2017, and U.S. Provisional Application No. 62/445,878, filed Jan. 13, 2017.

U.S. patent application Ser. No. 15/970,665, filed May 3, 2018, is also a continuation-in-part of application Ser. No. 15/807,201, filed Nov. 8, 2017, now U.S. Pat. No. 10,010,770, which is a continuation of application Ser. No. 15/463,306, filed Mar. 20, 2017, now U.S. Pat. No. 9,821,200, which is a continuation of application Ser. No. 15/249,857, filed Aug. 29, 2016, now U.S. Pat. No. 9,630,070, which claims the benefit of U.S. Provisional Application No.

62/337,184, filed May 16, 2016, and U.S. Provisional Application No. 62/361,988, filed Jul. 13, 2016.

U.S. patent application Ser. No. 15/970,665, filed May 3, 2018, is also a continuation-in-part of application Ser. No. 15/725,900, filed Oct. 5, 2017, now U.S. Pat. No. 10,052,532, which is a continuation of application Ser. No. 15/445,253, filed Feb. 28, 2017, now U.S. Pat. No. 9,795,843, which is a continuation of application Ser. No. 15/227,281, filed Aug. 3, 2016, now U.S. Pat. No. 9,782,643, which claims the benefit of U.S. Provisional Application No. 62/281,639, filed Jan. 21, 2016, U.S. Provisional Application No. 62/296,506, filed Feb. 17, 2016, U.S. Provisional Application No. 62/301,756, filed Mar. 1, 2016, and U.S. Provisional Application No. 62/362,491, filed Jul. 14, 2016.

U.S. patent application Ser. No. 15/970,665, filed May 3, 2018, is also a continuation-in-part of application Ser. No. 15/477,972, filed Apr. 3, 2017, now U.S. Pat. No. 9,914,029, which is a continuation of application Ser. No. 15/406,408, filed Jan. 13, 2017, now U.S. Pat. No. 9,861,867, which claims the benefit of U.S. Provisional Application No. 62/406,856, filed Oct. 11, 2016, U.S. Provisional Application No. 62/412,389, filed Oct. 25, 2016, and U.S. Provisional Application No. 62/419,242, filed Nov. 8, 2016.

This application is a continuation-in-part of application Ser. No. 17/155,486, filed Jan. 22, 2021, which is a continuation of application Ser. No. 16/774,449, filed Jan. 28, 2020, now U.S. Pat. No. 10,926,142, which is a continuation of application Ser. No. 16/179,406, filed Nov. 2, 2018, now U.S. Pat. No. 10,583,336, which claims the benefit of U.S. Provisional Application No. 62/581,456, filed Nov. 3, 2017.

This application is a continuation of application Ser. No. 16/889,524, filed Jun. 1, 2020, which is a continuation of application Ser. No. 16/419,639, filed May 22, 2019, now U.S. Pat. No. 10,695,624, which is a continuation of application Ser. No. 16/234,169, filed Dec. 27, 2018, now U.S. Pat. No. 10,376,754, which is a continuation of application Ser. No. 16/205,583, filed Nov. 30, 2018, now abandoned, which claims the benefit of U.S. Provisional Application No. 62/662,112, filed Apr. 24, 2018, U.S. Provisional Application No. 62/734,176, filed Sep. 20, 2018, U.S. Provisional Application No. 62/734,922, filed Sep. 21, 2018, U.S. Provisional Application No. 62/740,355, filed Oct. 2, 2018, U.S. Provisional Application No. 62/745,113, filed Oct. 12, 2018, U.S. Provisional Application No. 62/751,456, filed Oct. 26, 2018, U.S. Provisional Application No. 62/772,669, filed Nov. 29, 2018.

U.S. application Ser. No. 16/234,169, filed Dec. 27, 2018, now U.S. Pat. No. 10,376,754, also claims the benefit of U.S. Provisional Application No. 62/621,948, filed Jan. 25, 2018, and U.S. Provisional Application No. 62/655,437, filed Apr. 10, 2018.

U.S. application Ser. No. 16/419,639, filed May 22, 2019, now U.S. Pat. No. 10,695,624, is a continuation-in-part of application Ser. No. 15/981,094, filed May 16, 2018, now U.S. Pat. No. 10,384,102, which is a continuation of application Ser. No. 15/724,035, filed Oct. 3, 2017, now U.S. Pat. No. 9,999,814 which is a continuation of application Ser. No. 15/440,968, filed Feb. 23, 2017, now U.S. Pat. No. 9,795,842, which claims the benefit of U.S. Provisional Application No. 62/444,671, filed Jan. 10, 2017, and U.S. Provisional Application No. 62/445,878, filed Jan. 13, 2017.

U.S. application Ser. No. 16/889,524 is a continuation-in-part of application Ser. No. 16/533,352, filed Aug. 6, 2019, now U.S. Pat. No. 10,843,051, which is a continuation of application Ser. No. 16/030,403, filed Jul. 9, 2018, now U.S. Pat. No. 10,413,787, which claims the benefit of U.S. Provisional Application No. 62/530,734, filed Jul. 10, 2017, and U.S. Provisional Application No. 62/624,294, filed Jan. 31, 2018.

COPYRIGHT AUTHORIZATION

The present disclosure may be subject to copyright protection. The copyright owner has no objection to the facsimile reproduction by anyone of the present disclosure and its related documents, as they appear in the Patent and Trademark Office patent files or records, but otherwise reserves all applicable copyrights.

The disclosures of all of the above-referenced applications are incorporated herein by reference in their entireties.

FIELD

The present disclosure generally relates to sports equipment, and more particularly, to golf club heads and methods to manufacture golf club heads.

BACKGROUND

In golf, various factors may affect the distance and direction that a golf ball may travel. In particular, the center of gravity (CG) and/or the moment of inertia (MOI) of a golf club head may affect the launch angle, spin rate, and direction of the golf ball at impact. Such factors may vary significantly based a type of golf swing.

Figure 1:
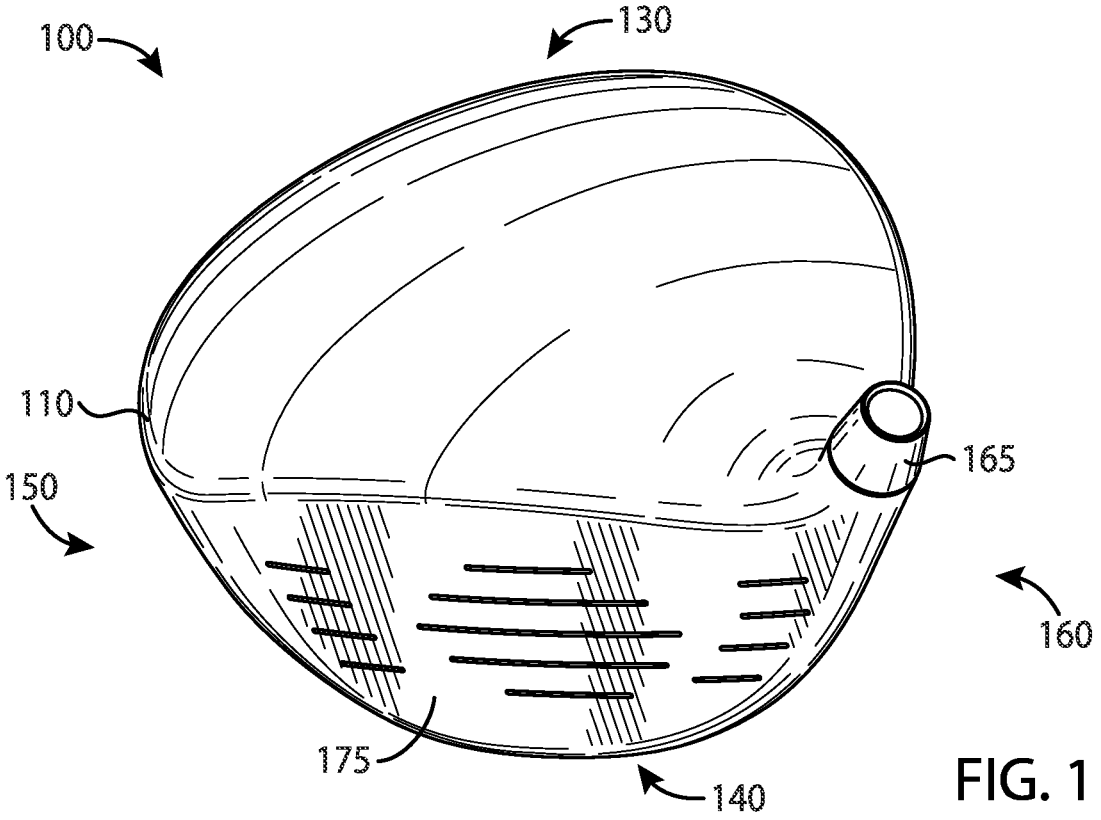
FIG. 1 is top perspective view of an example golf club head according to an embodiment of the apparatus, methods, and articles of manufacture described herein.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure.

DESCRIPTION

Figure 2:
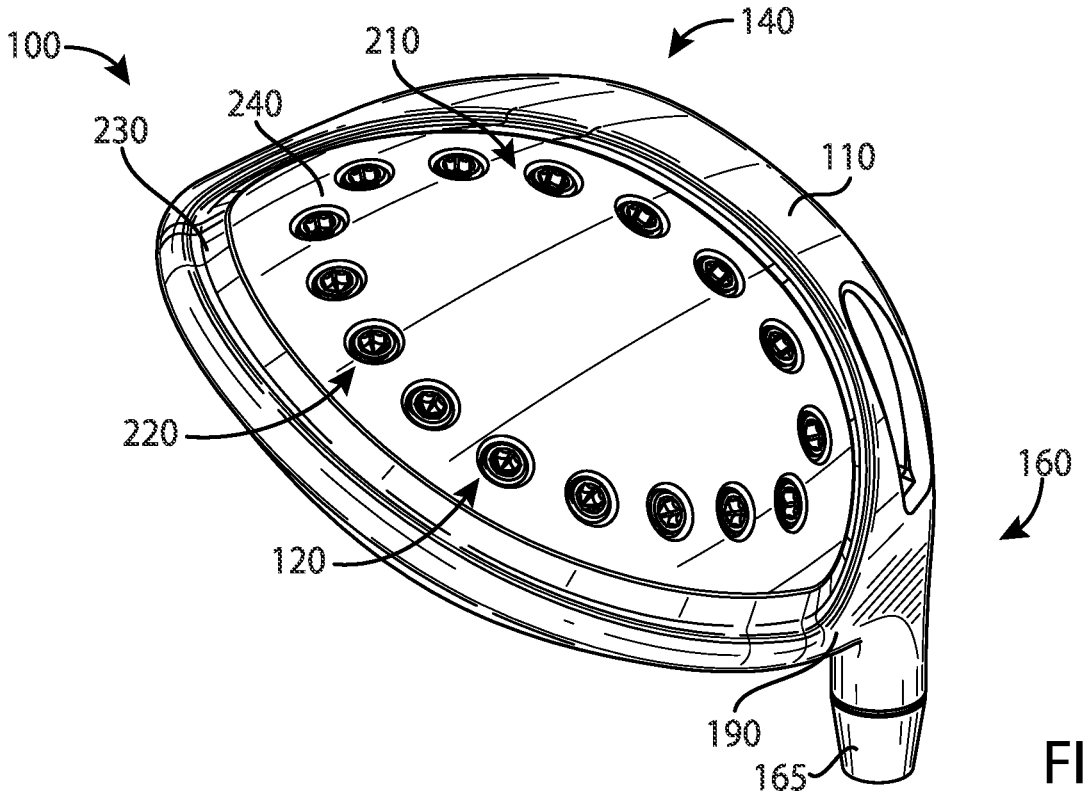
FIG. 2 depicts a bottom perspective view of the example golf club head of FIG. 1.
Figure 3:
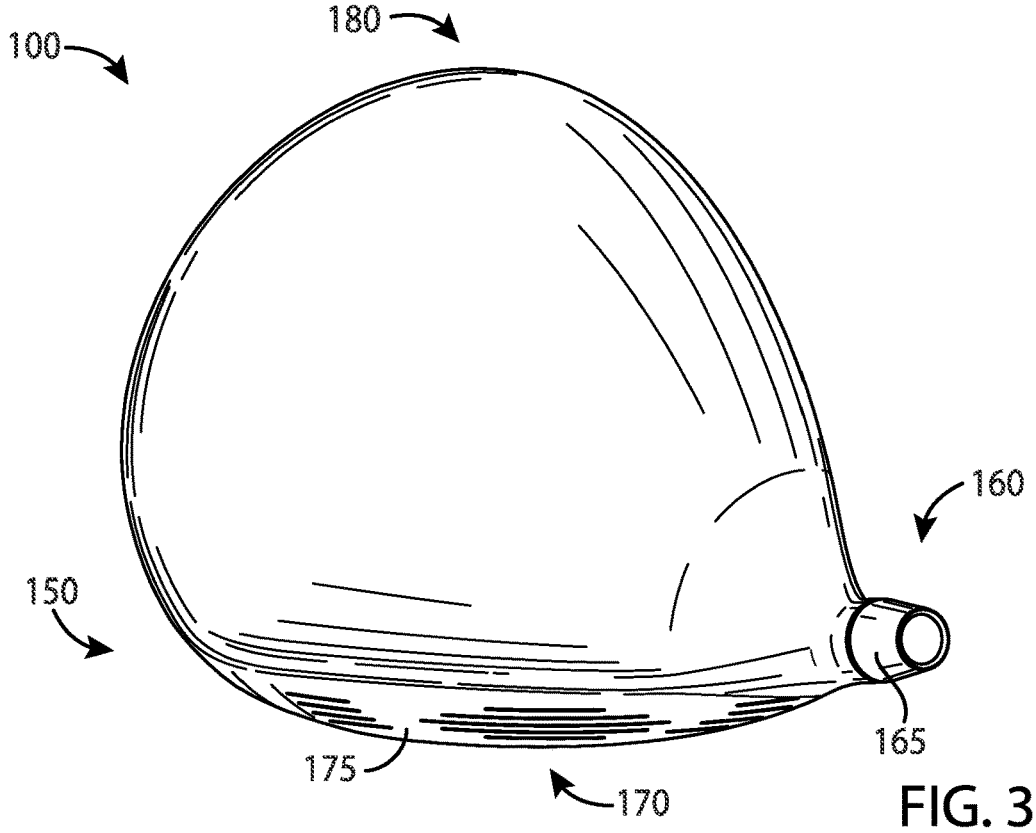
FIG. 3 depicts a top view of the example golf club head of FIG. 1.

In general, golf club heads and methods to manufacture golf club heads are described herein. The apparatus, methods, and articles of manufacture described herein are not limited in this regard. In the example of FIGS. 1-13, a golf club head 100 may include a body portion 110, and a plurality of weight portions 120, generally, shown as a first set of weight portions 210 (FIG. 2) and a second set of weight portions 220 (FIG. 2). The body portion 110 may include a top portion 130, a bottom portion 140, a toe portion 150, a heel portion 160, a front portion 170, and a rear portion 180. The bottom portion 140 may include a skirt portion 190 defined as a side portion of the golf club head 100 between the top portion 130 and the bottom portion 140 excluding the front portion 170 and extending across a periphery of the golf club head 100 from the toe portion 150, around the rear portion 180, and to the heel portion 160. The bottom portion 140 may include a transition region 230 and a weight port region 240. For example, the weight port region 240 may be a D-shape region. The weight port region 240 may include a plurality of weight ports 900 (FIG. 9) to receive the plurality of weight portions 120. The front portion 170 may include a face portion 175 to engage a golf ball (not shown). The body portion 110 may also include a hosel portion 165 to receive a shaft (not shown). Alternatively, the body portion 110 may include a bore instead of the hosel portion 165. For example, the body portion 110 may be made partially or entirely of an aluminum-based material, a magnesium-type material, a steel-based material, a titanium-based material, any combination thereof, or any other suitable material. In another example the body portion 110 may be made partially or entirely of a non-metal material such as a ceramic material, a composite material, any combination thereof, or any other suitable material.

The golf club head 100 may have a club head volume greater than or equal to 300 cubic centimeters ($cm^3$ or cc). In one example, the golf club head 100 may be about 460 cc. Alternatively, the golf club head 100 may have a club head volume less than or equal to 300 cc. In particular, the golf club head 100 may have a club head volume between 100 cc and 200 cc. The club head volume of the golf club head 100 may be determined by using the weighted water displacement method (i.e., Archimedes Principle). For example, procedures defined by golf standard organizations and/or governing bodies such as the United States Golf Association (USGA) and/or the Royal and Ancient Golf Club of St. Andrews (R&A) may be used for measuring the club head volume of the golf club head 100. Although FIG. 1 may depict a particular type of club head (e.g., a driver-type club head), the apparatus, methods, and articles of manufacture described herein may be applicable to other types of club head (e.g., a fairway wood-type club head, a hybrid-type club head, an iron-type club head, a putter-type club head, etc.). The apparatus, methods, and articles of manufacture described herein are not limited in this regard.

Each of the first set of weight portions 210, generally shown as 405, 410, 415, 420, 425, 430, and 435 (FIG. 4), may be associated with a first mass. Each of the second set of weight portions 220, generally shown as 440, 445, 450, 455, 460, 465, 470, 475, and 480 (FIG. 4), may be associated with a second mass. The first mass may be greater than the second mass or vice versa. In one example, the first set of weight portions 210 may be made of a tungsten-based material whereas the second set of weight portions 220 may be made of an aluminum-based material. As described in detail below, the first and second set of weight portions 210 and 220, respectively, may provide various weight configurations (e.g., FIGS. 15-18).

Figure 5:
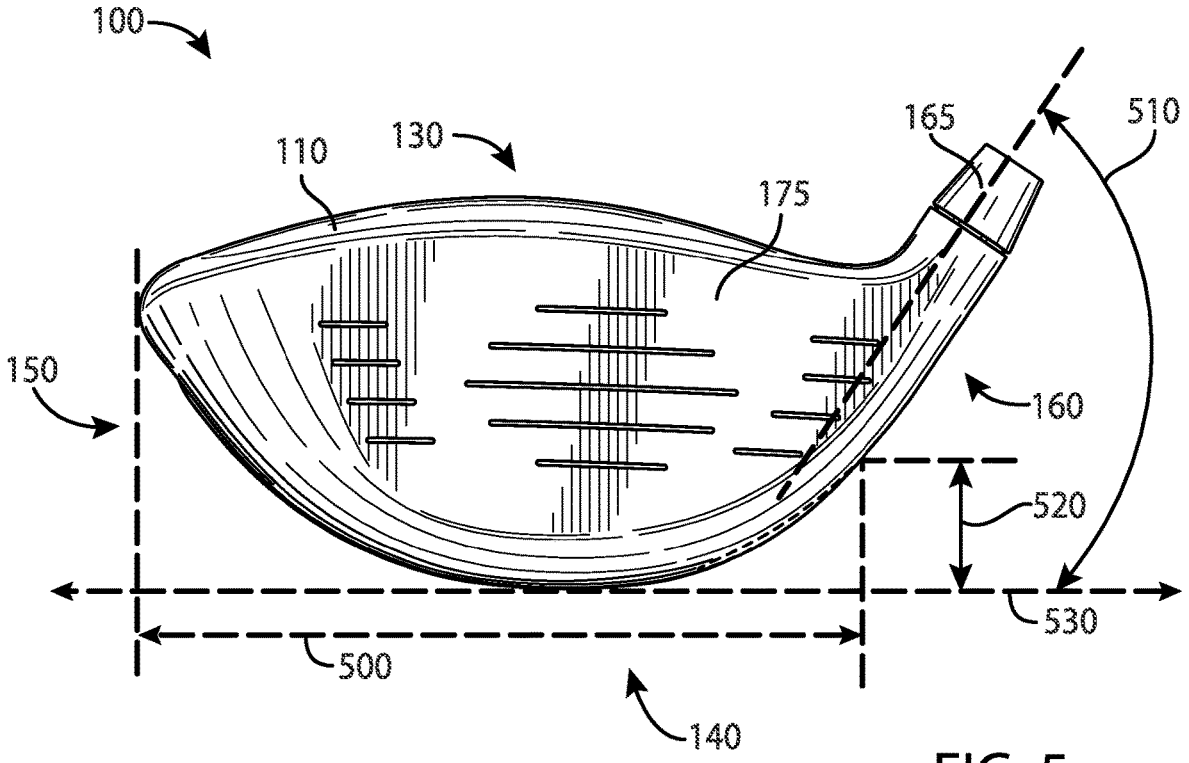
FIG. 5 depicts a front view of the example golf club head of FIG. 1.
Figure 6:
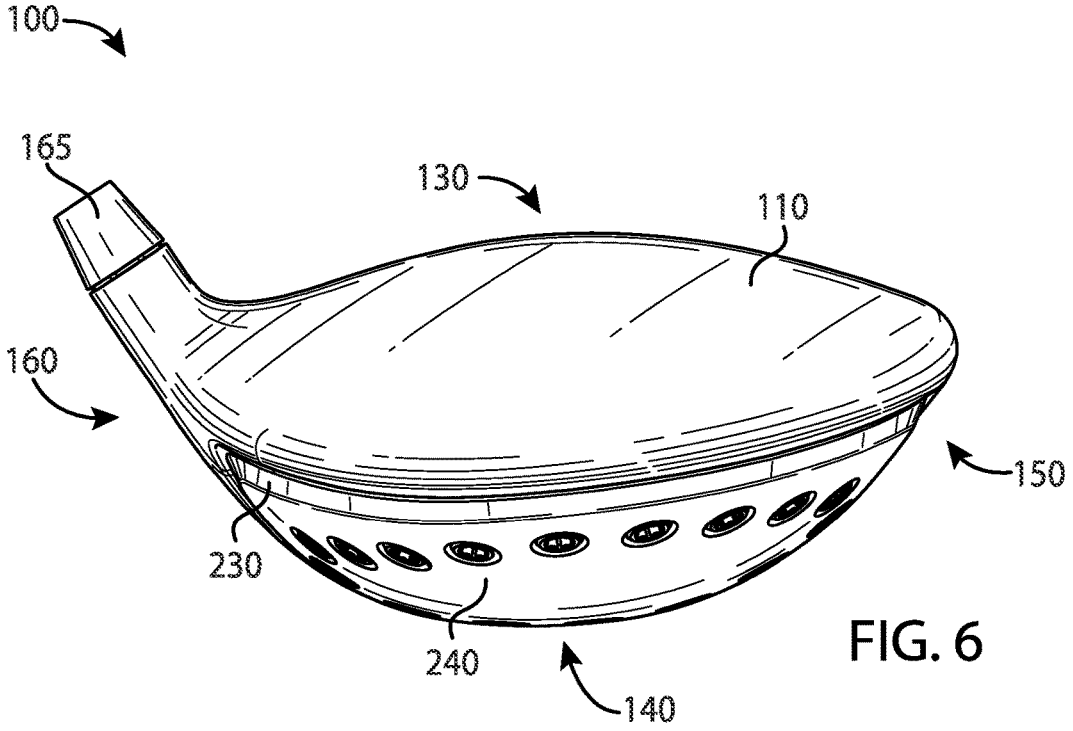
FIG. 6 depicts a rear view of the example golf club head of FIG. 1.
Figure 7:
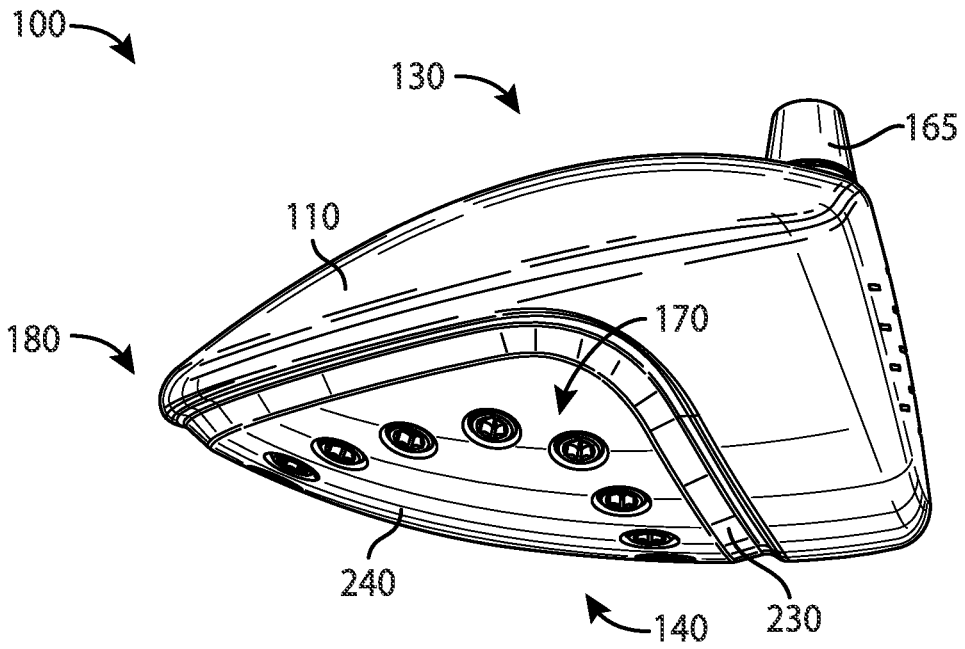
FIG. 7 depicts a toe view of the example golf club head of FIG. 1.
Figure 8:
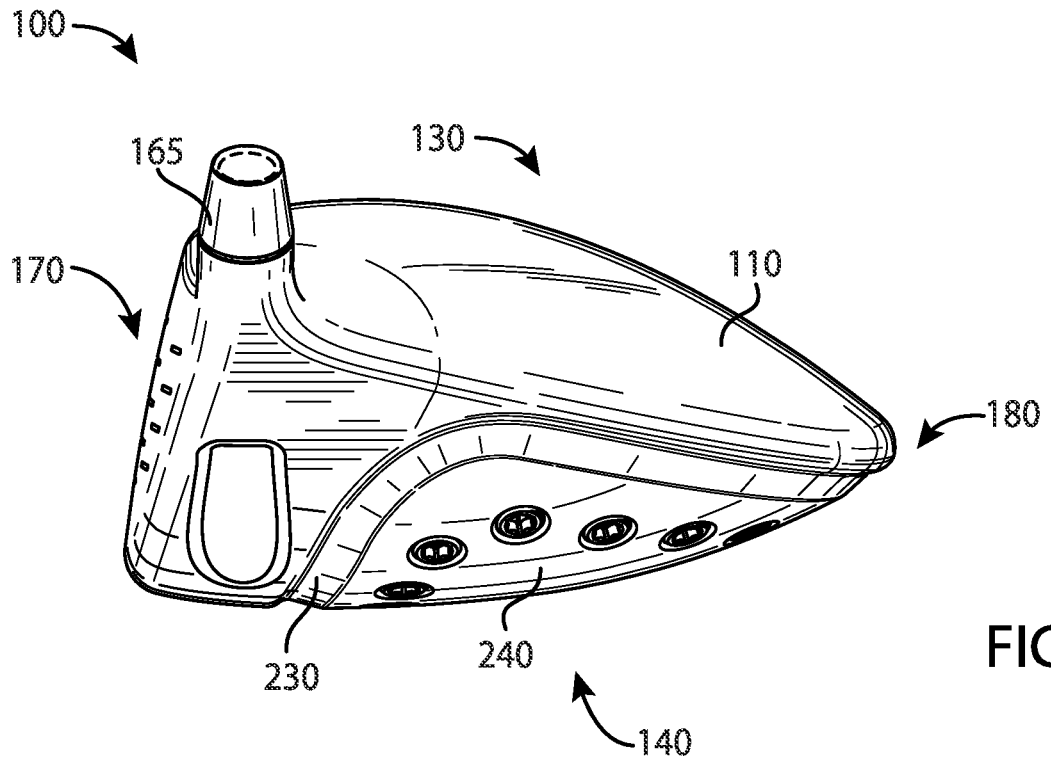
FIG. 8 depicts a heel view of the example golf club head of FIG. 1.
Figure 9:
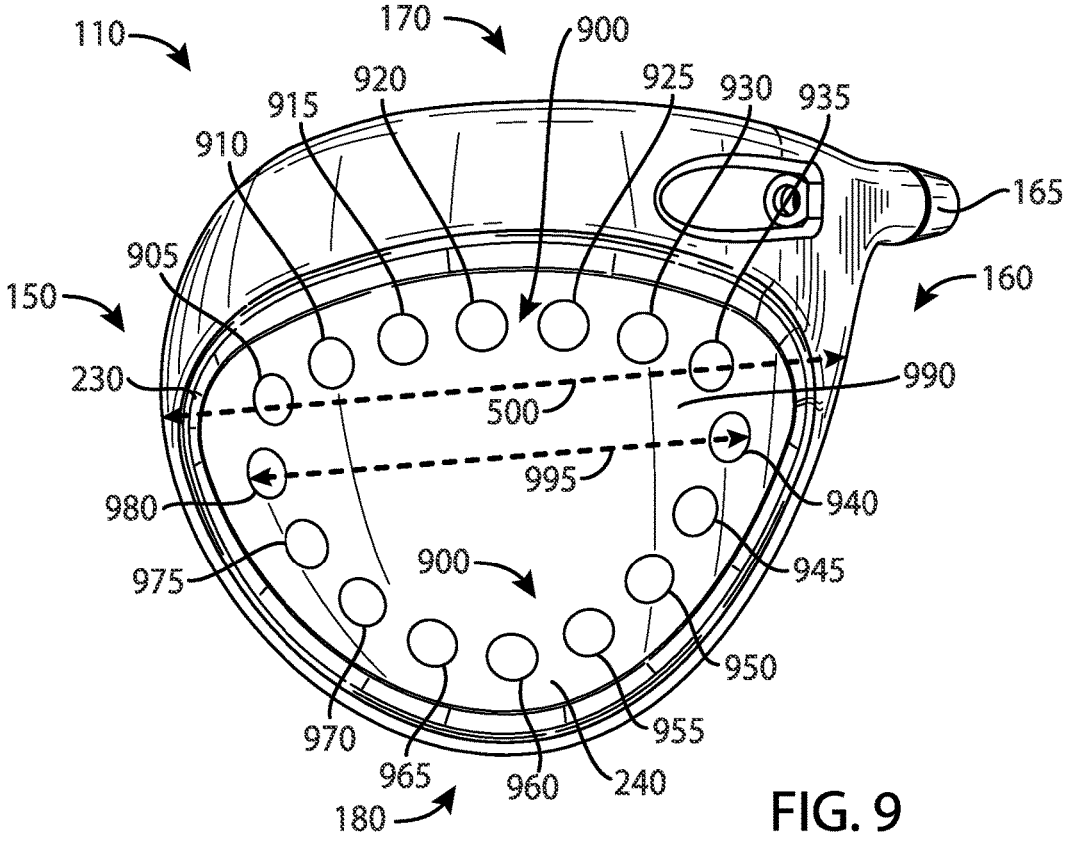
FIG. 9 depicts a bottom view of an example body portion of the example golf club head of FIG. 1.
Figure 10:
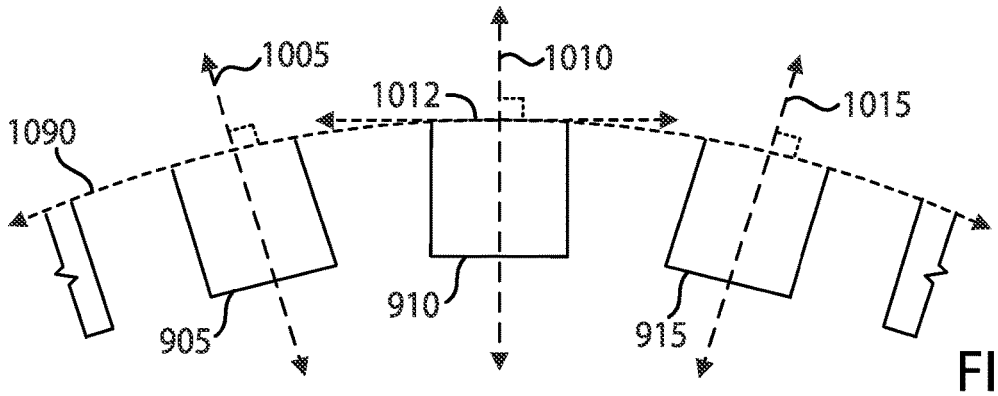
FIG. 10 depicts a cross-sectional view of the example body portion of the example golf club head of FIG. 1.
Figure 11:
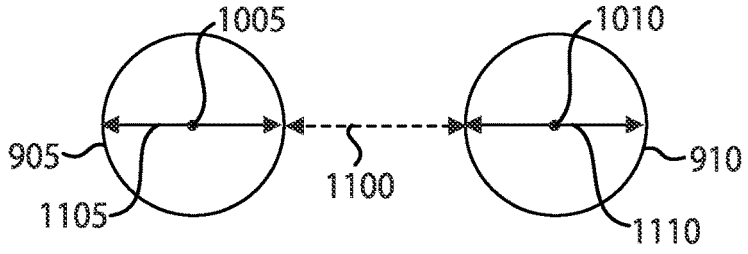
FIG. 11 depicts two weight ports of the example golf club head of FIG. 1.

Referring to FIGS. 9-11, for example, the bottom portion 140 of the body portion 110 may include a plurality of weight ports 900. The plurality of weight ports 900, generally shown as 905, 910, 915, 920, 925, 930, 935, 940, 945, 950, 955, 960, 965, 970, 975, and 980, may be located along a periphery of the weight port region 240 of the bottom portion 140. The plurality of weight ports 900 may extend across the bottom portion 140. In particular, the plurality of weight ports 900 may extend between the toe and heel portions 150 and 160, respectively, across the bottom portion 140. The plurality of weight ports 900 may also extend between the front and rear portions 170 and 180, respectively, across the bottom portion 140. The plurality of weight ports 900 may be arranged across the bottom portion 140 along a path that defines a generally D-shaped loop. In one example, the plurality of weight ports 900 may extend more than 50% of a maximum toe-to-heel distance 500 between of the toe and heel portions 150 and 160, respectively, across the bottom portion 140. The maximum toe-to-heel distance 500 of the golf club head 100 may be measured from transition regions between the top and bottom portions 130 and 140, respectively, at the toe and heel portions 150 and 160, respectively. Alternatively, the maximum toe-to-heel distance 500 may be a horizontal distance between vertical projections of the outermost points of the toe and heel portions 150 and 160, respectively. For example, the maximum toe-to-heel distance 500 may be measured when the golf club head 100 is at a lie angle 510 of about 60 degrees. Referring to FIG. 5, if the outermost point of the heel portion 160 is not readily defined, the outermost point of the heel portion 160 may be located at a height 520 of about 0.875 inches (22.23 millimeters) above a ground plane 530 (i.e., a horizontal plane on which the golf club head 100 is lying on). Referring to FIGS. 9-11, the plurality of weight ports 900 may extend more than 50% of a maximum toe-to-heel club head distance 500 of the golf club head 100. In particular, the plurality of weight ports 900 may extend between the toe portion 150 and the heel portion 160 at a maximum toe-to-heel weight port distance 995, which may be more than 50% of the maximum toe-to-heel club head distance 500 of the golf club head 100. In one example, the maximum toe-to-heel club head distance 500 of the golf club head 100 may be no more than 5 inches (127 millimeters). Accordingly, the plurality of weight ports 900 may extend a weight port maximum toe-to-heel weight port distance of at least 2.5 inches between the toe and heel portions 150 and 160, respectively. A maximum toe-to-heel weight port distance 995 may be the maximum distance between the heel-side boundary of the weight port farthest from the toe portion 150 and the toe-side boundary of the weight port farthest from the heel portion 160. In the example of FIG. 9, the weight port maximum toe-to-heel weight port distance 995 may be the maximum distance between the heel-side boundary of the weight port 940 and toe-side boundary of the weight port 980. For example, the maximum toe-to-heel weight port distance 995 may be about 3.7 inches. As the rules of golf may change from time to time (e.g., new regulations may be adopted or old rules may be eliminated or modified by golf standard organizations and/or governing bodies), the lie angle 510 and/or the height 520 for measuring the maximum toe-to-heel club head distance 500 may also change. The apparatus, methods, and articles of manufacture described herein are not limited in this regard.

Each of the plurality of weight ports 900 may be associated with a port diameter ($D_{port}$) (e.g., two shown as 1105 and 1110 in FIG. 11). For example, the port diameter of each weight port of the plurality of weight ports 900 may be about 0.3 inch (7.65 millimeters). Alternatively, the port diameters of adjacent weight ports may be different. In one example, the weight port 905 may be associated with a port diameter 1105, and the weight port 910 may be associated with a port diameter 1110. In particular, the port diameter 1105 of the weight port 905 may be larger than the port diameter 1110 of the weight port 910 or vice versa. The apparatus, methods, and articles of manufacture described herein are not limited in this regard.

The bottom portion 140 may also include an outer surface 990. As illustrated in FIG. 10, for example, the plurality of weight ports 900 may be formed on the bottom portion 140 relative to an outer surface curve 1090 formed by the outer surface 990. In particular, each of the plurality of weight ports 900 may be associated with a port axis generally shown as 1005, 1010, and 1015. A center of a weight port may define the port axis of the weight port. Each port axis may be perpendicular or substantially perpendicular to a plane that is tangent to the outer surface curve 1090 at the point of intersection of the port axis and the outer surface curve 1090. In one example, substantially perpendicular may refer to a deviation of ±5° from perpendicular. In another example, substantially perpendicular may refer to a deviation of ±3° from perpendicular. The deviation from perpendicular may depend on manufacturing tolerances.

In one example, the port axis 1010 may be perpendicular or substantially perpendicular (i.e., normal) to a tangent plane 1012 of the outer surface curve 1090. Multiple fixtures may be used to manufacture the plurality of weight ports 900 by positioning the golf club head 100 in various positions. Alternatively, the weight ports may be manufactured by multiple-axis machining processes, which may be able to rotate the golf club head around multiple axes to mill away excess material (e.g., by water jet cutting and/or laser cutting) to form the plurality of weight ports 900. In another example, the golf club head may remain in a fixed position while a tool of the multiple-axis machining process moves relative to the golf club head and forms the plurality of weight ports 900. Multiple-axis machining processes may provide a suitable surface finish because the milling tool may be moved tangentially about a surface. Accordingly, the apparatus, methods, and articles of manufacture described herein may use a multiple-axis machining process to form each of the plurality of weight ports 900 on the bottom portion 140. For example, a five-axis milling machine may form the plurality of weight ports 900 so that the port axis 1000 of each of the plurality weight ports 900 may be perpendicular or substantially perpendicular to the outer surface curve 1090. The tool of the five-axis milling machine may be moved tangentially about the outer surface curve 1090 of the outer surface 990.

Turning to FIG. 11, for example, two adjacent weight ports may be separated by a port distance 1100, which may be the shortest distance between two adjacent weight ports on the outer surface 990. In particular, the port distance 1100 may be less than or equal to the port diameter of any of the two adjacent weight ports. In one example, the port distance 1100 between the weight ports 905 and 910 may be less than or equal to either the port diameter 1105 or the port diameter 1110. The apparatus, methods, and articles of manufacture described herein are not limited in this regard.

The plurality of weight portions 120 may have similar or different physical properties (e.g., density, shape, mass, volume, size, color, etc.). In one example, the first set of weight portions 210 may be a black color whereas the second set of weight portions 220 may be a gray color or a steel color. Some or all of the plurality of weight portions 120 may be partially or entirely made of a metal material such as a steel-based material, a tungsten-based material, an aluminum-based material, any combination thereof or suitable types of materials. Alternatively, some or all of the plurality of weight portions 120 may be partially or entirely made of a non-metal material (e.g., composite, plastic, etc.).

Figure 12:
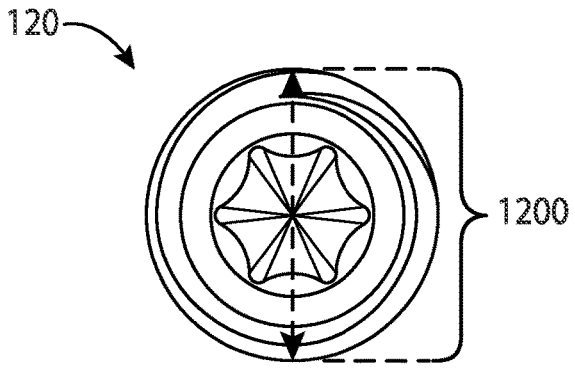
FIG. 12 depicts a top view of an example weight portion of the example golf club head of FIG. 1.
Figure 13:
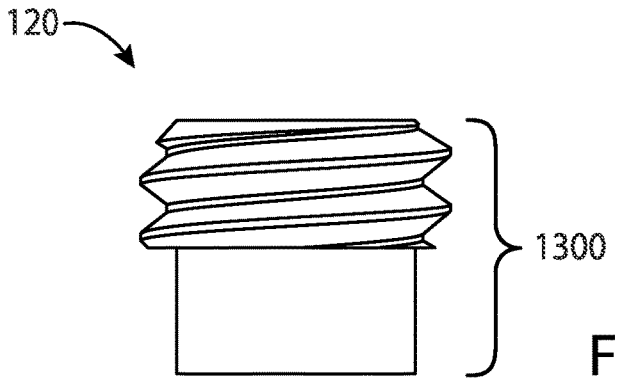
FIG. 13 depicts a side view of the example weight portion of FIG. 12.

In the illustrated example as shown in FIGS. 12 and 13, each weight portion of the plurality of weight portions 120 may have a cylindrical shape (e.g., a circular cross section). Although the above examples may describe weight portions having a particular shape, the apparatus, methods, and articles of manufacture described herein may include weight portions of other suitable shapes (e.g., a portion of or a whole sphere, cube, cone, cylinder, pyramid, cuboidal, prism, frustum, or other suitable geometric shape). Each weight portion of the plurality of weight portions 120 may be associated with a diameter 1200 and a height 1300. In one example, each weight portion of the plurality of weight portions 120 may have a diameter of about 0.3 inch (7.62 millimeters) and a height of about 0.2 inch (5.08 millimeters). Alternatively, the first and second sets of weight portions 210 and 220, respectively, may be different in width and/or height.

Instead of a rear-to-front direction as in other golf club heads, each weight portion of the plurality of weight portions 120 may engage one of the plurality of weight ports 400 in a bottom-to-top direction. The plurality of weight portions 120 may include threads to secure in the weight ports. For example, each weight portion of the plurality of weight portions 120 may be a screw. The plurality of weight portions 120 may not be readily removable from the body portion 110 with or without a tool. Alternatively, the plurality of weight portions 120 may be readily removable (e.g., with a tool) so that a relatively heavier or lighter weight portion may replace one or more of the plurality of weight portions 120. In another example, the plurality of weight portions 120 may be secured in the weight ports of the body portion 110 with epoxy or adhesive so that the plurality of weight portions 120 may not be readily removable. In yet another example, the plurality of weight portions 120 may be secured in the weight ports of the body portion 110 with both epoxy and threads so that the plurality of weight portions 120 may not be readily removable. The apparatus, methods, and articles of manufacture described herein are not limited in this regard.

Figure 14:
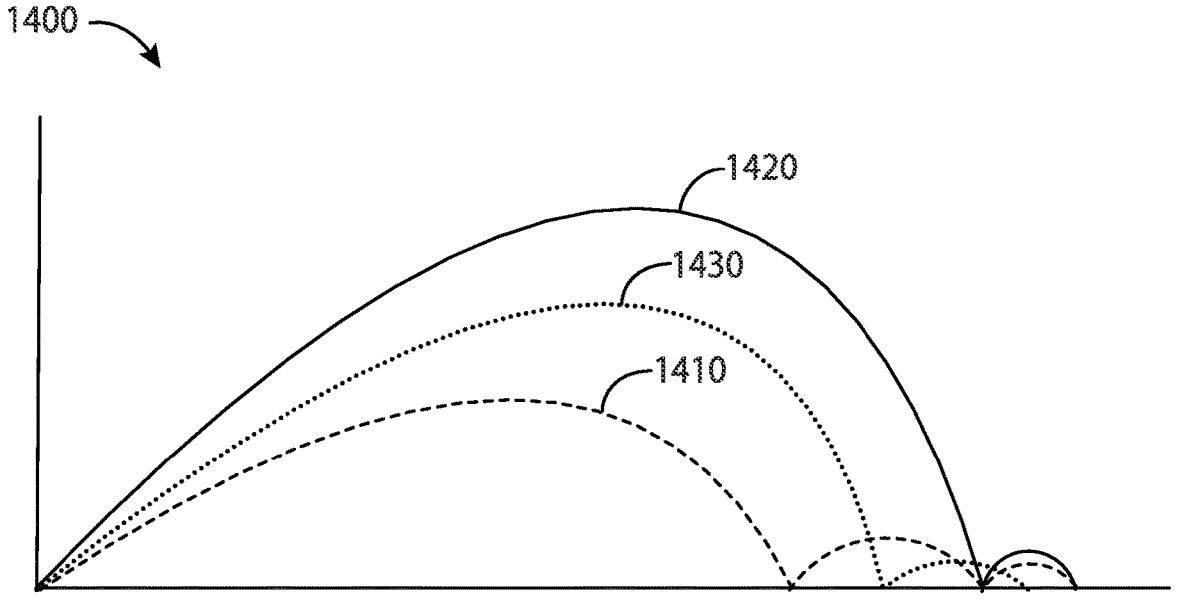
FIG. 14 depicts example launch trajectory profiles of the example golf club head of FIG. 1.
Figure 15:
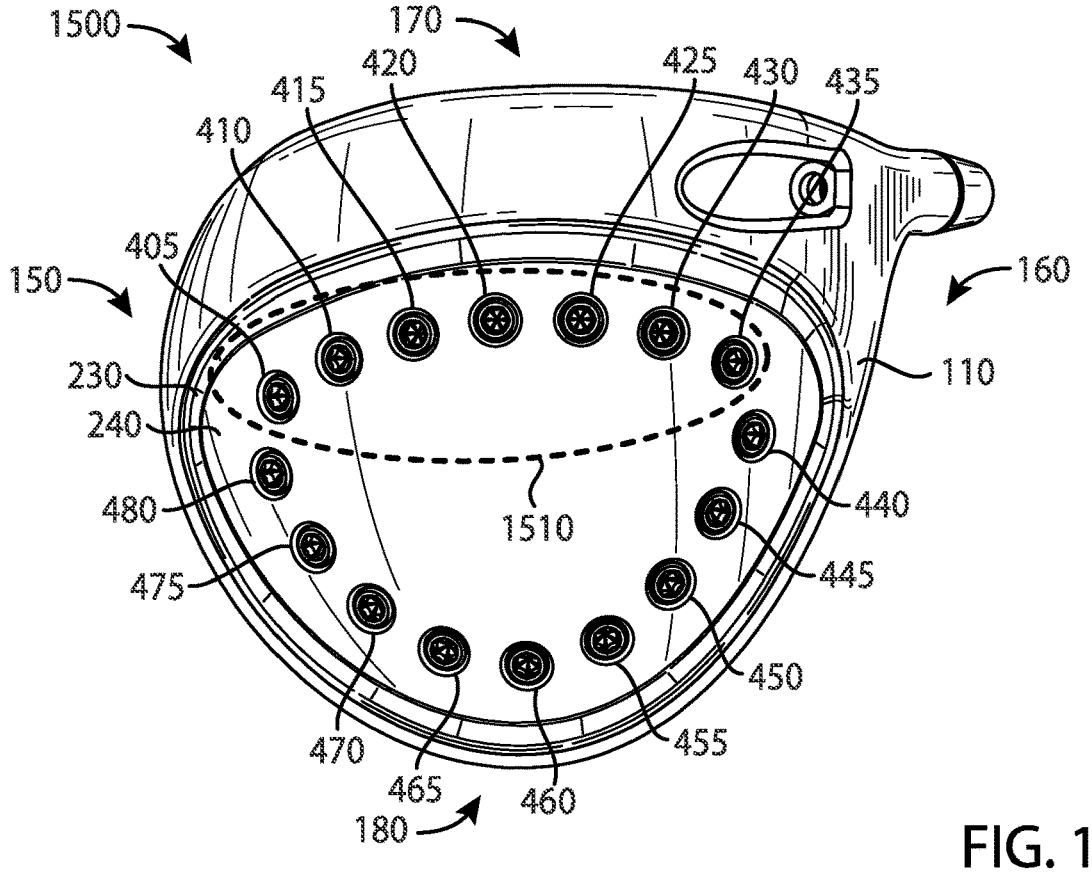
FIG. 15 depicts a first weight configuration of the example weight portions.

In contrast to other golf club heads, the golf club head 100 may accommodate at least four different types of golf swings. As illustrated in FIG. 14, for example, each weight configuration may be associated with one of the plurality of launch trajectory profiles 1400, generally shown as 1410, 1420, and 1430. Referring to FIG. 15, for example, a first weight configuration 1500 may be associated with a configuration of a first set of weight ports 1510. The first set of weight ports 1510 may be located at or proximate to the front portion 170 (e.g., weight ports 905, 910, 915, 920, 925, 930, and 935 shown in FIG. 9). In the first weight configuration 1500, a first set of weight portions may be disposed toward the front portion 170 according to the configuration of the first set of weight ports 1510, whereas a second set of weight portions may be disposed toward the rear portion 180. In particular, the first set of weight portions may form a cluster according to the configuration of the first set of weight ports 1510 at or proximate to the front portion 170. The weight portions 405, 410, 415, 420, 425, 430, and 435 may define the first set of weight portions and may be disposed in weight ports 905, 910, 915, 920, 925, 930, and 935, respectively. The weight portions 440, 445, 450, 455, 460, 465, 470, 475, and 480 may define the second set of weight portions and may be disposed in weight ports 940, 945, 950, 955, 960, 965, 970, 975, and 980, respectively. The first weight configuration 1500 may be associated with the first launch trajectory profile 1410 (FIG. 14). In particular, the first weight configuration 1500 may decrease spin rate of a golf ball. By placing relatively heavier weight portions (i.e., the first set of weight portions) towards the front portion 170 of the golf club head 100 according to the configuration of the first set of weight ports 1510, the center of gravity (GC) of the golf club head 100 may move relatively forward and lower to produce a relatively lower launch and spin trajectory. As a result, the first launch trajectory profile 1410 may be associated with a relatively greater roll distance (i.e., distance after impact with the ground). While the above example may describe the weight portions being disposed in certain weight ports, any weight portion of the first set of weight portions 210 may be disposed in any weight port of the first set of weight ports 1510.

Figure 16:
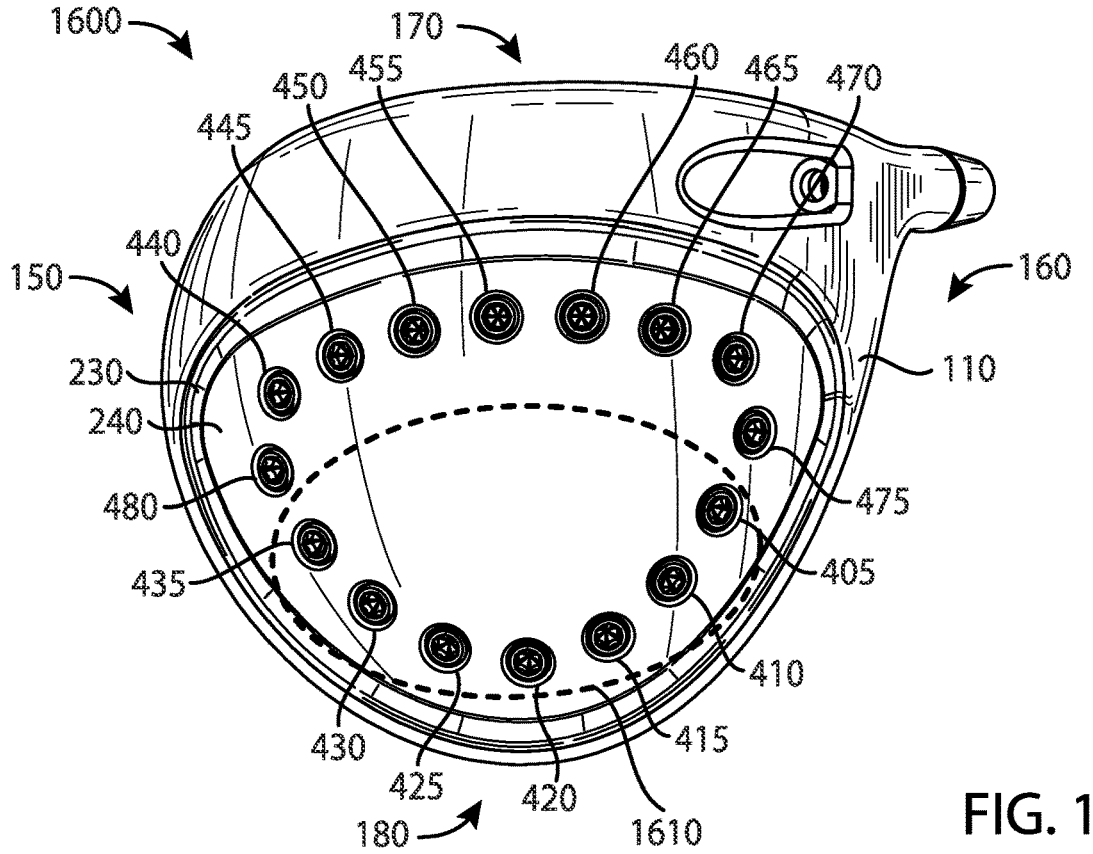
FIG. 16 depicts a second weight configuration of the example weight portions.

Turning to FIG. 16, for example, a second weight configuration 1600 may be associated with a configuration of a second set of weight ports 1610. The second set of weight ports 1610 may be located at or proximate to the rear portion 180 (e.g., weight ports, 945, 950, 955, 960, 965, 970, and 975 shown in FIG. 9). In a second weight configuration 1600 as illustrated in FIG. 16, for example, a first set of weight portions may be disposed toward the rear portion 180 whereas a second set of weight portions may be disposed toward the front portion 170. In particular, the first set of weight portions may form a cluster 1610 at or proximate to the rear portion 180 according to the configuration of the second set of weight ports 1610. The weight portions 405, 410, 415, 420, 425, 430, and 435 may define the first set of weight portions and may be disposed in weight ports 945, 950, 955, 960, 965, 970, and 975, respectively. The weight portions 440, 445, 450, 455, 460, 465, 470, 475, and 480 may define the second set of weight portions and may be disposed in weight ports 905, 910, 915, 920, 925, 930, 935, 940, and 980, respectively. The second weight configuration 1600 may be associated with the second launch trajectory profile 1420 (FIG. 14). In particular, the second weight configuration 1600 may increase launch angle of a golf ball and maximize forgiveness. By placing the relatively heavier weight portion (i.e., the first set of weight portions) towards the rear portion 180 of the golf club head 100 according to the configuration of the second set of weight ports 1610, the center of gravity (GC) of the golf club head 100 may move relatively back and up to produce a relatively higher launch and spin trajectory. Further, the moment of inertia (MOI) of the golf club head 100 may increase in both the horizontal (front-to-back axis) and vertical axes (top-to-bottom axis), which in turn, provides relatively more forgiveness on off-center hits. As a result, the second launch trajectory profile 1420 may be associated with a relatively greater carry distance (i.e., in-the-air distance).

Figure 17:
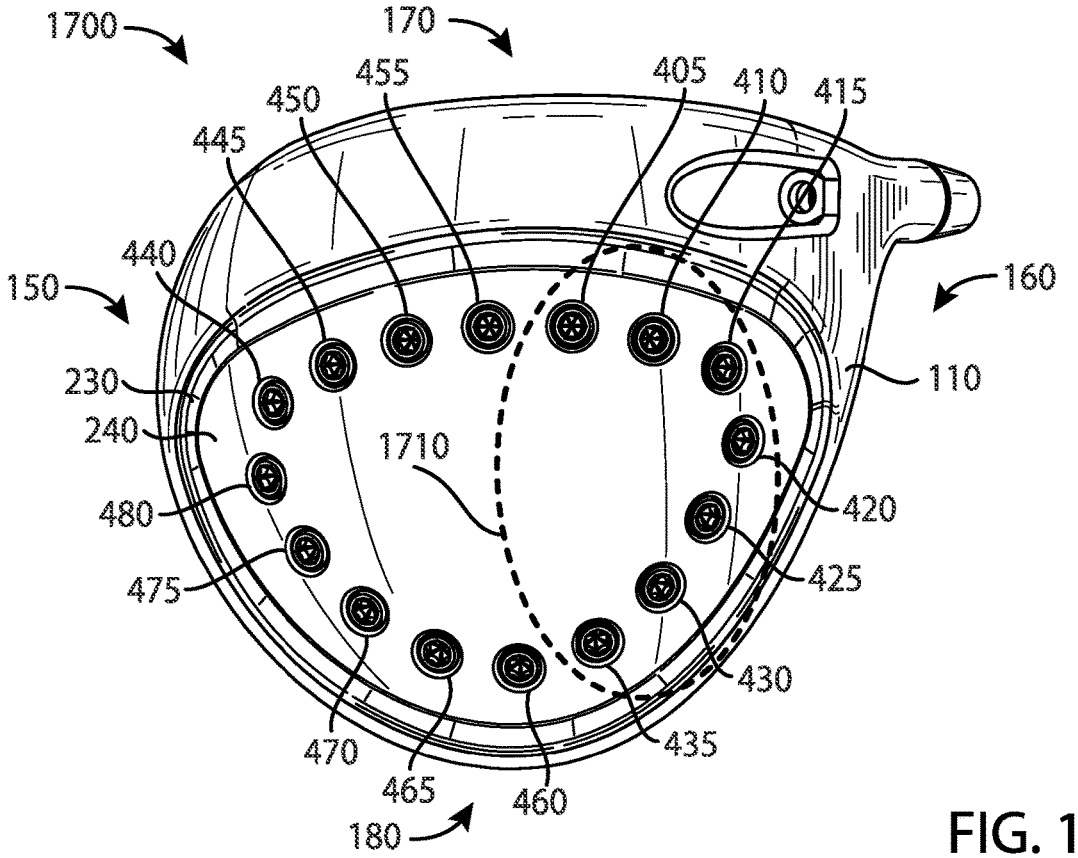
FIG. 17 depicts a third weight configuration of the example weight portions.

Turning to FIG. 17, for example, a third weight configuration 1700 may be associated with a configuration of a third set of weight ports 1710. In the third weight configuration 1700, for example, a first set of weight portions may be disposed toward the heel portion 160 whereas a second set of weight portions may be disposed toward the toe portion 150. In particular, the first set of weight portions may form a cluster of weight portions at or proximate to the heel portion 160 according to the configuration of the third set of weight ports 1710. The weight portions 405, 410, 415, 420, 425, 430, and 435 may define the first set of weight portions and may be disposed in weight ports 925, 930, 935, 940, 945, 950, and 955, respectively. The weight portions 440, 445, 450, 455, 460, 465, 470, 475, and 480 may define the second set of weight portions and may be disposed in weight ports 905, 910, 915, 920, 960, 965, 970, 975, and 980, respectively. The third weight configuration 1700 may be associated with a third launch trajectory profile 1430 (FIG. 14). In particular, the third weight configuration 1700 may allow an individual to turn over the golf club head 100 relatively easier (i.e., square up the face portion 175 to impact a golf ball). By placing the relatively heavier weight portions (i.e., the first set of weight portions) towards the heel portion 160 of the golf club head 100, the center of gravity (GC) of the golf club head 100 may move relatively closer to the axis of the shaft.

Figure 18:
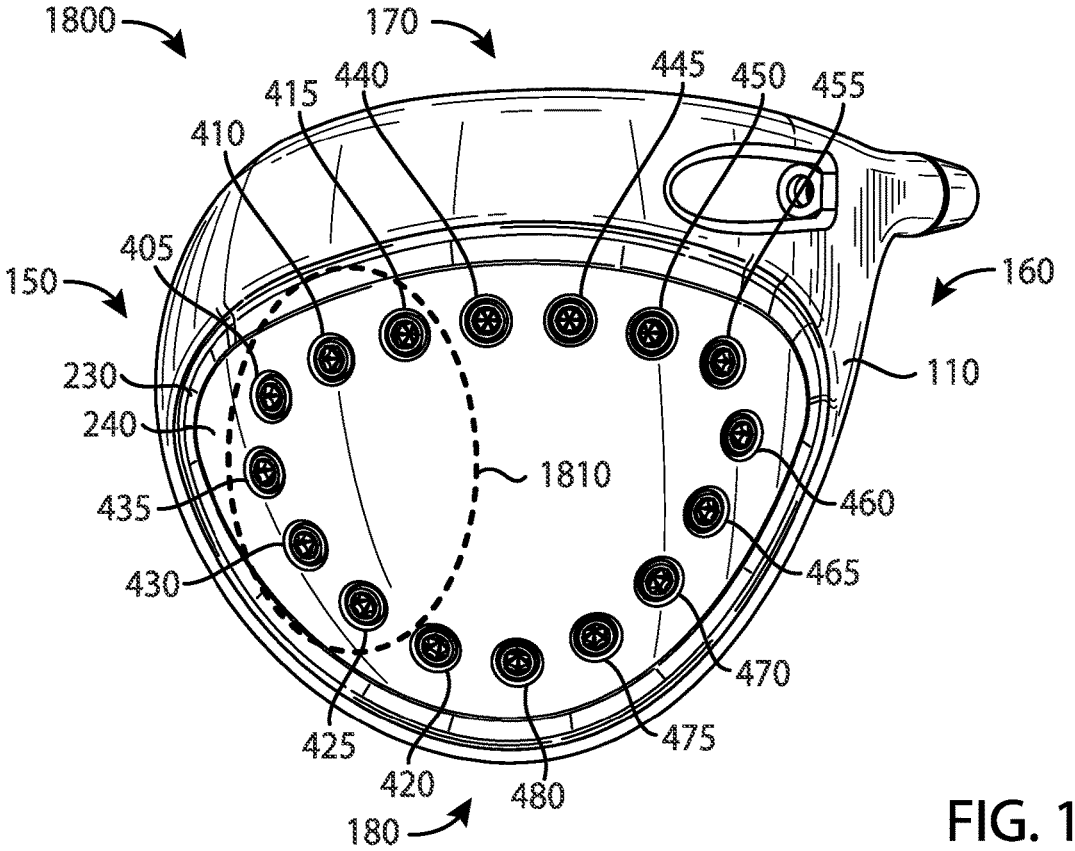
FIG. 18 depicts a fourth weight configuration of the example weight portions.
Figure 19:
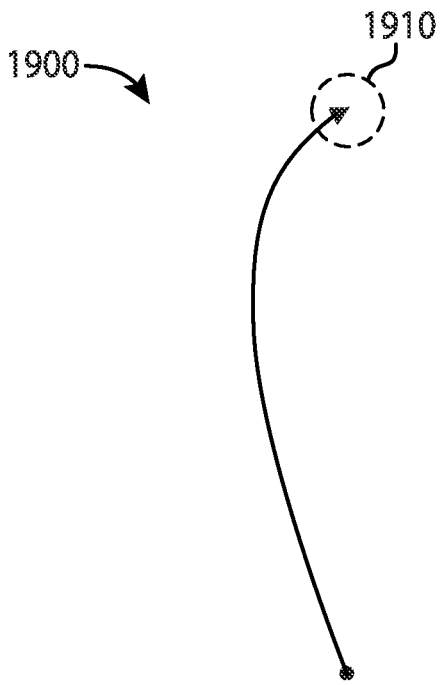
FIG. 19 depicts an example launch trajectory profile of the example golf club head of FIG. 18.

Turning to FIG. 18, for example, a fourth weight configuration 1800 may be associated with a configuration of a fourth set of weight ports 1810. In a fourth weight configuration 1800, for example, a first set of weight portions may be disposed toward the toe portion 150 whereas a second set of weight portions may be disposed toward the heel portion 160. In particular, the first set of weight portions may form a cluster of weight portions at or proximate to the toe portion 150 according to the configuration of the fourth set of weight ports 1810. The weight portions 405, 410, 415, 420, 425, 430, and 435 may define the first set of weight portions and may be disposed in weight ports 905, 910, 915, 965, 970, 975, and 980, respectively. The weight portions 440, 445, 450, 455, 460, 465, 470, 475, and 480 may define the second set of weight portions and may be disposed in weight ports 920, 925, 930, 935, 940, 945, 950, 955, and 960, respectively. The fourth weight configuration 1800 may be associated with the third launch trajectory profile 1430 (FIG. 14). In particular, the fourth weight configuration 1800 may prevent an individual from turning over the golf club head 100 (i.e., the face portion 175 may be more open to impact a golf ball). By placing the relatively heavier weight portions (i.e., the first set of weight portions) towards the toe portion 150 of the golf club head 100, the center of gravity (GC) of the golf club head 100 may move relatively farther away from the axis of the shaft. The fourth weight configuration 1800 may result in a fade golf shot (as shown in FIG. 19, for example, a trajectory or ball flight in which a golf ball travels to the left of a target 1910 and curving back to the right of the target for a right-handed individual). The apparatus, methods, and articles of manufacture described herein are not limited in this regard.

Figure 20:
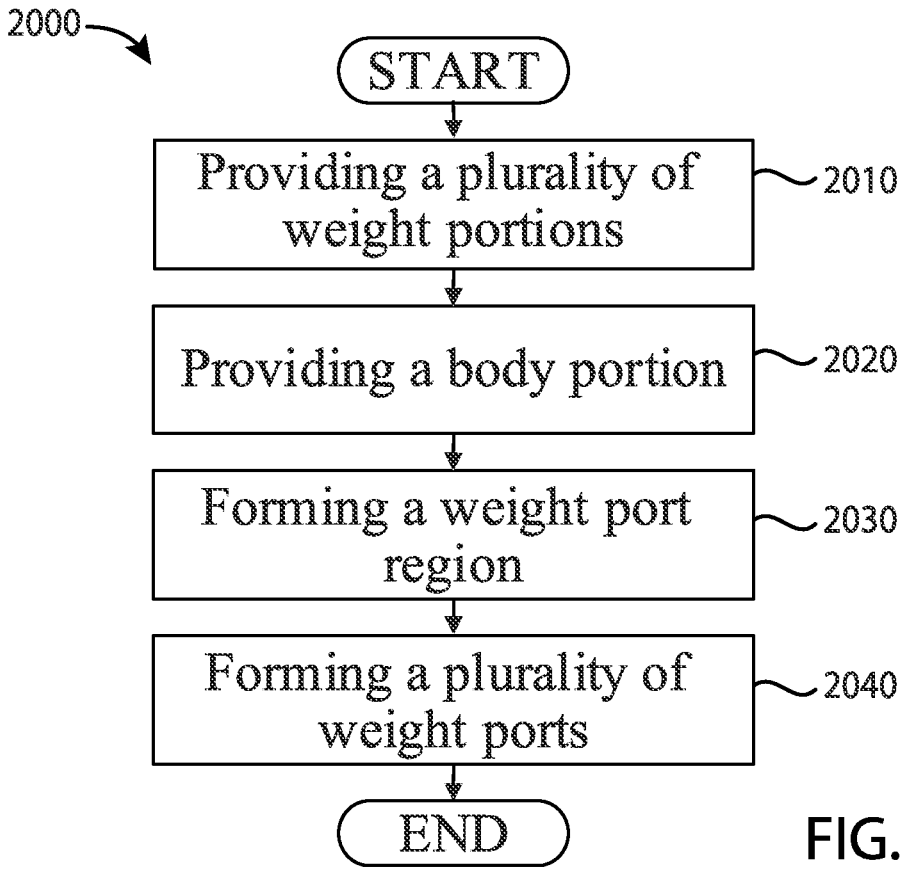
FIG. 20 depicts one manner in which the example golf club heads described herein may be manufactured.

FIG. 20 depicts one manner in which the golf club head 100 may be manufactured. In the example of FIG. 20, the process 2000 may begin with providing a plurality of weight portions (block 2010). The plurality of weight portions may include a first set of weight portions and a second set of weight portions. Each weight portion of the first set of weight portions may be associated with a first mass whereas each weight portion of the second set of weight portions may be associated with a second mass. The first mass may be greater than the second mass. In one example, each weight portion of the first set of weight portions may be made of a tungsten-based material with a mass of about 2-5, 3.0-4.5, 3.5-4.25, 4, or 2.6 grams whereas each weight portion of the second set of weight portions may be made of an aluminum-based material with a mass of 0.4 grams. The first set of weight portions may have a gray color or a steel color whereas the second set of weight portions may have a black color.

The process 2000 may provide a body portion of a golf club head (block 2020). The body portion may include a front portion, a rear portion, a toe portion, a heel portion, a top portion, a bottom portion having an outer surface associated with outer surface curve, and a skirt portion between the top and bottom portion.

The process 2000 may form a weight port region located at or proximate to the bottom and skirts portions (block 2030). A transition region may surround the weight port region.

The process 2000 may form a plurality of weight ports along a periphery of the weight port region (block 2040). Each weight port of the plurality of weight ports may be associated with a port diameter and configured to receive at least one weight portion of the plurality of weight portions. Two adjacent weight ports may be separated by less than or equal to the port diameter. Further, each weight port of the plurality of weight ports may be associated with a port axis. The port axis may be perpendicular or substantially perpendicular relative to a tangent plane of the outer surface curve of the bottom portion of the golf club head.

The example process 2000 of FIG. 20 is merely provided and described in conjunction with FIGS. 1-19 as an example of one way to manufacture the golf club head 100. While a particular order of actions is illustrated in FIG. 20, these actions may be performed in other temporal sequences. For example, two or more actions depicted in FIG. 20 may be performed sequentially, concurrently, or simultaneously. Although FIG. 20 depicts a particular number of blocks, the process may not perform one or more blocks. The apparatus, methods, and articles of manufacture described herein are not limited in this regard.

Figure 4:
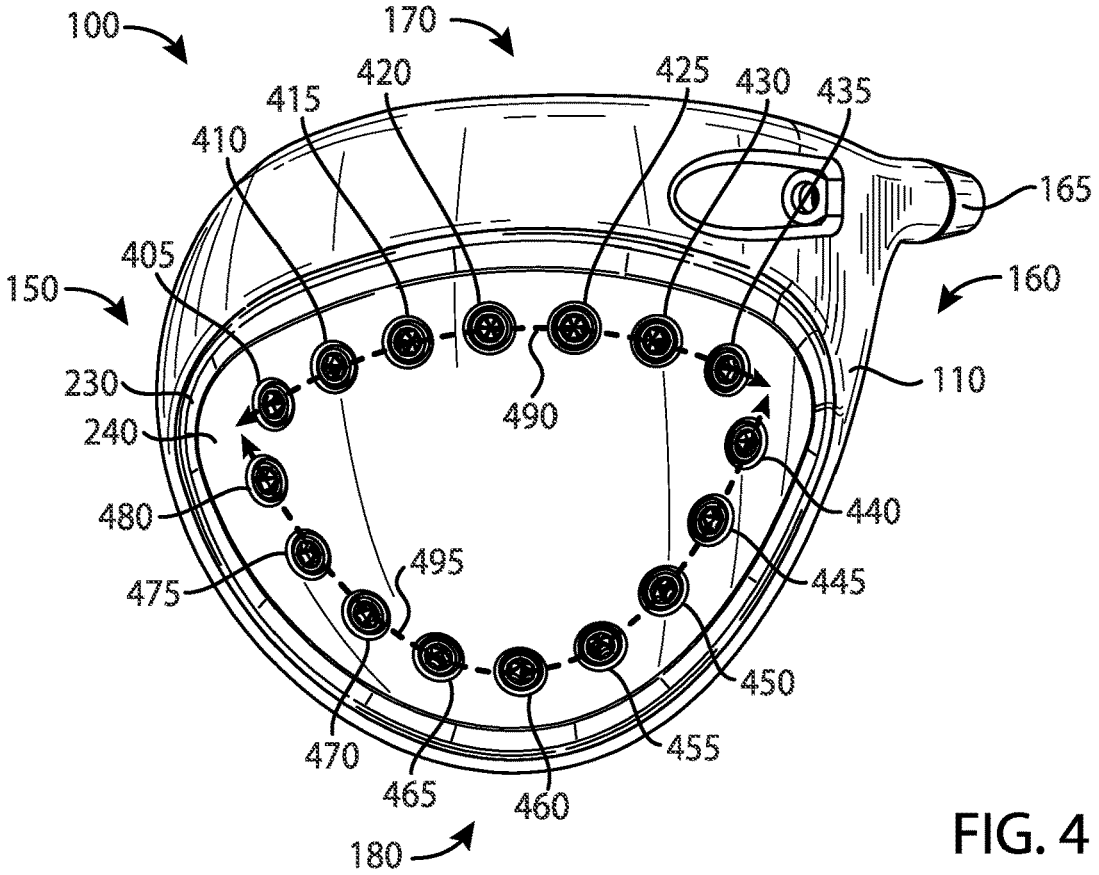
FIG. 4 depicts a bottom view of the example golf club head of FIG. 1.

As shown in the above examples, the plurality of weight portions 120 and the plurality of weight ports 900 may be located on a periphery of the weight port region 240 along a path that defines a generally D-shaped loop formed with two arcs, generally shown as 490 and 495 in FIG. 4. For example, the weight portions 405, 410, 415, 420, 425, 430, and 435 (FIG. 4), and the weight ports 905, 910, 915, 920, 925, 930, and 935 (FIG. 9) may form the first arc 490. In particular, the first arc 490 may extend between the toe and heel portions 150 and 160, respectively, across the bottom portion 140. The weight portions 440, 445, 450, 455, 460, 465, 470, 475, and 480 (FIG. 4), the weight ports 940, 945, 950, 955, 960, 965, 970, 975, and 980 (FIG. 9) may form the second arc 495. The second arc 495 may generally follow the contour of the rear portion 180 of the body portion 110. Alternatively, the first and second arcs 490 and 495 may define loops with other shapes that extend across the bottom portion 140 (e.g., a generally O-shaped loop). The apparatus, methods, and articles of manufacture described herein are not limited in this regard.

Figure 21:
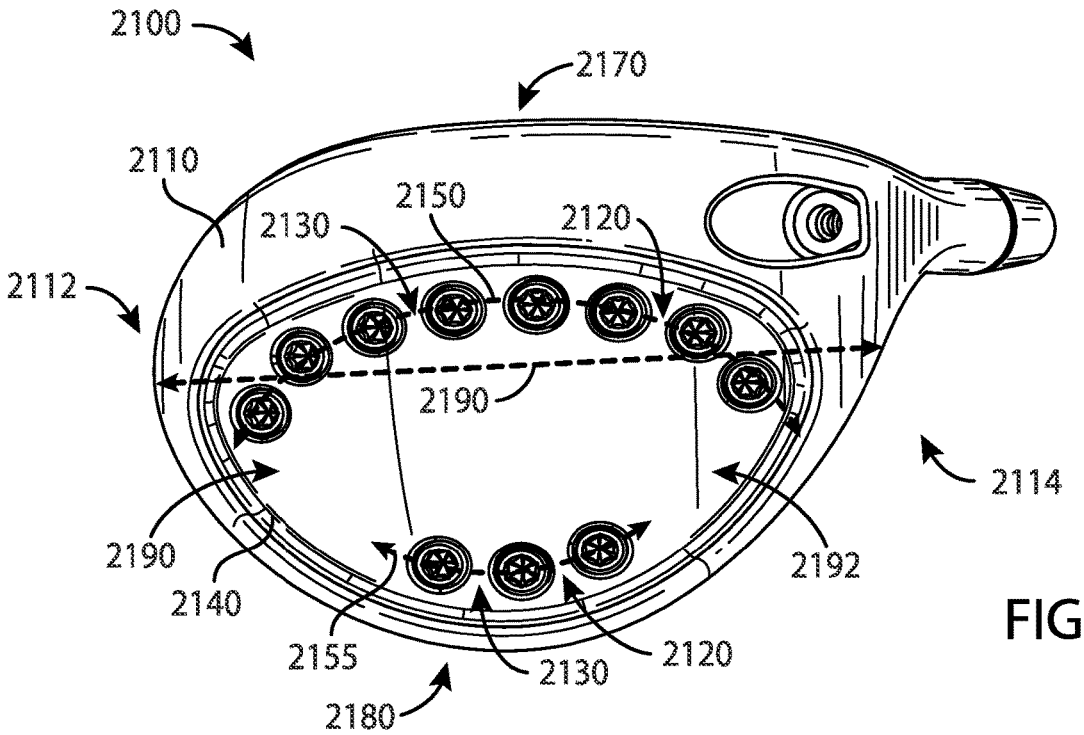
FIG. 21 depicts a bottom view of another example golf club head.

Although the above examples may depict the plurality of weight portions 120 and the plurality of weight ports 900 forming a particular geometric shape, the apparatus, methods, and articles of manufacture described herein may have weight portions and weight ports located along a periphery of a weight portion region to form other geometric shapes. Turning to FIG. 21, for example, a golf club head 2100 may include a bottom portion 2110, and a plurality of weight portions 2120 disposed in a plurality of weight ports 2130. The plurality of weight ports 2130 may be located along a periphery of a weight port region 2140 of the bottom portion 2110 (i.e., the plurality of weight ports 2130 may extend between the toe and heel portions 2112 and 2114, respectively, across the bottom portion 2110). In contrast to the plurality of weight portions 120 and the plurality of weight ports 900 (e.g., FIGS. 4 and 9), the plurality of weight ports 2130 may form two discrete arcs, generally shown as 2150 and 2155, extending across the bottom portion 2110.

The first arc 2150 may extend between the toe portion 2112 and the heel portion 2114. The first arc 2150 may curve toward the front portion 2170 of the golf club head 2100 (i.e., concave relative to the front portion 2170). According to the example of FIG. 21, the first arc 2150 may extend from a region proximate the toe portion 2112 to a region proximate to the front portion 2170 and from the region proximate to the front portion 2170 to a region proximate to the heel portion 2114 (i.e., concave relative to the front portion 2170). Accordingly, the first arc 2150 may appear as a C-shaped arc facing the rear portion 2180 of the golf club head 2100 that extends between the toe portion 2112 and the heel portion 2114. The second arc 2155 may also extend between the toe portion 2112 and the heel portion 2114. The second arc 2155 may curve toward the rear portion 2180 of the golf club head 2100 (i.e., concave relative to the rear portion 2180). Accordingly, the second arc 2155 may appear as a C-shaped arc facing the front portion 2170 of the golf club head 2100 that extends between the toe portion 2112 and the heel portion 2114. Further, the first arc 2150 may be closer to the front portion 2170 than the second arc 2155. The first arc 2150 and the second arc 2155 may be discrete so that the first and second arcs 2150 and 2155, respectively, may be spaced apart along the periphery of the bottom portion 2110. Accordingly, the bottom portion 2110 may include gaps 2190 and 2192 along the periphery of the bottom portion 2110 between the weight ports 2130 of the first arc 2150 and the weight ports 2130 of the second arc 2155. The gaps 2190 and/or 2192 may be greater than or equal to the port diameter of any of the weight ports 2130 such as the weight ports 2130 that are adjacent to the gaps 2190 and/or 2192. According to one example as shown in FIG. 21, the gaps 2190 and 2192 may be several orders or magnitude larger than the diameters of the weight ports 2130 that are adjacent to the gaps 2190 and 2192. The apparatus, methods, and articles of manufacture described herein are not limited in this regard.

Referring to FIG. 21, for example, the first arc 2150 may include a greater number of weight ports 2130 than the second arc 2155, which may be suitable for certain golf club heads (e.g., a fairway wood-type golf club head and/or a hybrid-type golf club head). Alternatively, the second arc 2155 may include the same or a greater number of weight ports 2130 than the first arc 2150. The number of weight ports 2130 in each of the first and second arcs 2150 and 2155, respectively, the weight portions 2120 associated with each weight port 2130 and the spacing between adjacent weight ports 2130 may be determined based on the type of golf club, a preferred weight distribution of the golf club head 2100, and/or a center of gravity location of the golf club head 2100.

The weight ports 2130 of the first arc 2150 and/or the second arc 2155 may be spaced from each other at the same or approximately the same distance along the first arc 2150 and/or the second arc 2155, respectively. Any variation in the spacing between the weight ports 2130 of the first arc 2150 or the second arc 2155 or any of the weight ports described herein may be due to different manufacturing considerations, such as manufacturing tolerances and/or cost effectiveness associated with manufacturing precision. For example, the variation in the spacing between the weight ports 2130 of the first arc 2150 and/or the second arc 2155 may be between 1/16 of an inch to 0.001 inch. As described herein, the distance between adjacent weight ports 2130 (i.e., port distance) may be less than or equal to the port diameter of any of the two adjacent weight ports. The plurality of weight ports 2130 may extend between the toe portion 2112 and the heel portion 2114 at a maximum toe-to heel weight port distance that is more than 50% of a maximum toe-to-heel club head distance 2195 of the golf club head 2100. The maximum toe-to-heel weight port distance may be the maximum distance between the heel-side boundary of the weight port farthest from the toe portion 2112 and the toe-side boundary of the weight port farthest from the heel portion 2114.

In particular, the golf club head 2100 may have a volume of less than 430 cc. In example, the golf club head 2100 may have a volume ranging from 100 cc to 400 cc. In another example, the golf club head 2100 may have a volume ranging from 150 cc to 350 cc. In yet another example, the golf club head 2100 may have a volume ranging from 200 cc to 300 cc. The golf club head 2100 may have a mass ranging from 100 grams to 350 grams. In another example, the golf club head 2100 may have a mass ranging from 150 grams to 300 grams. In yet another example, the golf club head 2100 may have a mass ranging from 200 grams to 250 grams. The golf club head 2100 may have a loft angle ranging from 10° to 30°. In another example, the golf club head 2100 may have a loft angle ranging from 13° to 27°. For example, the golf club head 2100 may be a fairway wood-type golf club head. Alternatively, the golf club head 2100 may be a smaller driver-type golf club head (i.e., larger than a fairway wood-type golf club head but smaller than a driver-type golf club head). The apparatus, methods, and articles of manufacture described herein are not limited in this regard.

Figure 22:
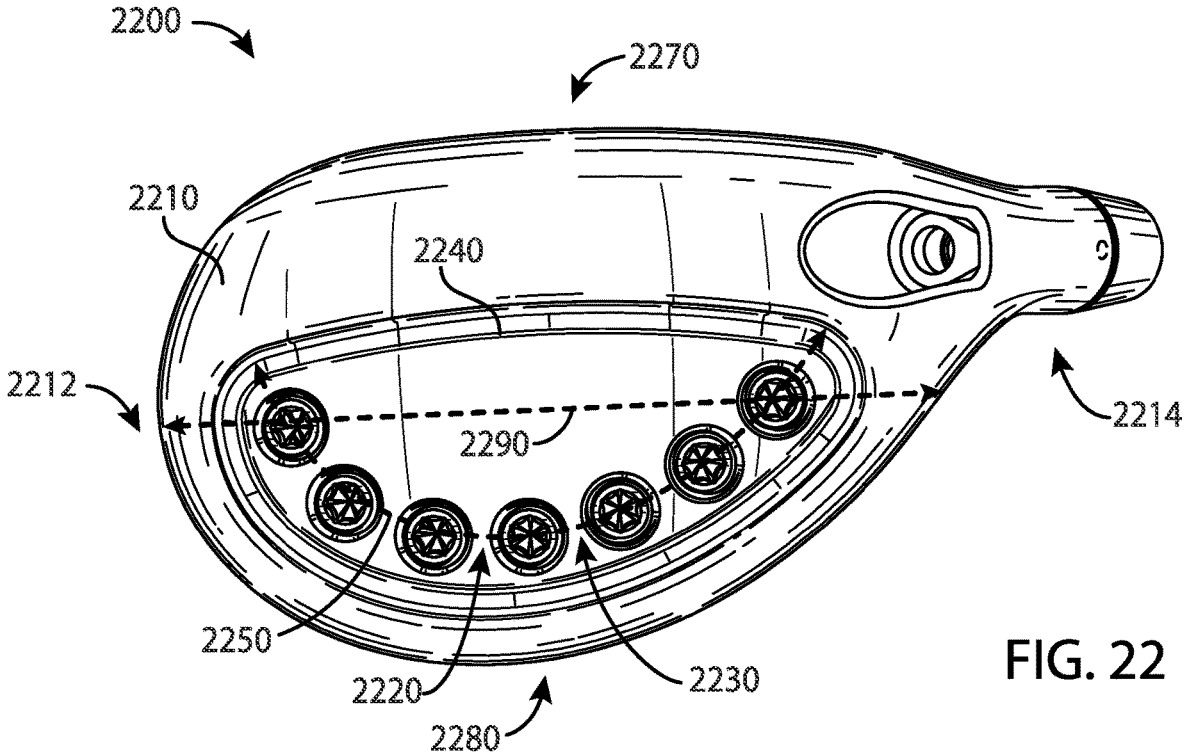
FIG. 22 depicts a bottom view of yet another example golf club head.
Figure 23:
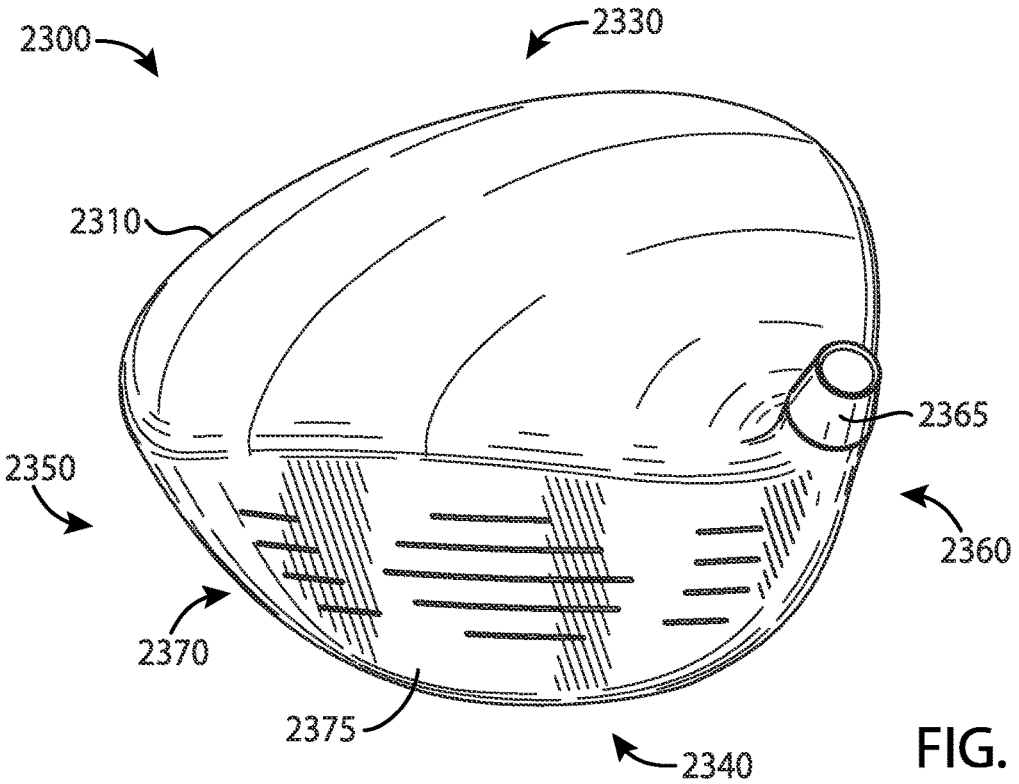
FIG. 23 is top perspective view of an example golf club head according to an embodiment of the apparatus, methods, and articles of manufacture described herein.

As illustrated in FIG. 22, for example, a golf club head 2200 may include a bottom portion 2210, and a plurality of weight portions 2220 disposed in a plurality of weight ports 2230. The plurality of weight ports 2230 located along a periphery of a weight port region 2240 may be arranged along a path that defines an arc, generally shown as 2250, extending across the bottom portion 2210 (i.e., the plurality of weight ports 2230 may extend between the toe and heel portions 2212 and 2214, respectively, across the bottom portion 2210). The arc 2250 may curve toward the rear portion 2280 of the golf club head 2200 (i.e., concave relative to the rear portion 2280). According to the example of FIG. 22, the arc 2250 may extend from a region proximate the toe portion 2212 to a region proximate to the rear portion 2280 and from the region proximate to the rear portion 2280 to a region proximate to the heel portion 2214 (i.e., concave relative to the rear portion 2280). Accordingly, the arc 2250 may appear as a C-shaped arc facing the front portion 2270 of the golf club head 2200 that extends from near the heel portion 2214 to near the toe portion 2212. Further, the curvature of the arc 2250 is substantially similar to or generally follows the contour of the rear portion 2280 of the golf club head 2200. The number of weight ports 2230 in the arc 2250, the weight portions 2220 associated with each weight port 2230 and the spacing between adjacent weight ports 2230 may be determined based on the type of golf club, a preferred weight distribution of the golf club head 2200, and/or a center of gravity location of the golf club head 2200.

The weight ports 2230 of the arc 2250 may be spaced from each other at the same or approximately the same distance along the arc 2250 (e.g., the weight ports 2230 may be substantially similarly spaced apart from each other). Any variation in the spacing between the weight ports 2230 of the arc 2250 or any of the weight ports described herein may be due to different manufacturing considerations, such as manufacturing tolerances and/or cost effectiveness associated with manufacturing precision. For example, the variation in the spacing between the weight ports 2130 of the arc 2250 may be between 1/16 of an inch to 0.001 inch. As described herein, the distance between adjacent weight ports 2230 (i.e., port distance) may be less than or equal to the port diameter of any of the two adjacent weight ports. The plurality of weight ports 2230 may extend between the toe portion 2212 and the heel portion 2214 at a maximum toe-to heel weight port distance that is more than 50% of a maximum toe-to-heel club head distance of 2290 the golf club head 2200. The maximum toe-to-heel weight port distance may be the maximum distance between the heel-side boundary of the weight port farthest from the toe portion 2212 and the toe-side boundary of the weight port farthest from the heel portion 2214.

In particular, the golf club head 2200 may have a volume of less than 200 cc. In example, the golf club head 2200 may have a volume ranging from 50 cc to 150 cc. In another example, the golf club head 2200 may have a volume ranging from 60 cc to 120 cc. In yet another example, the golf club head 2200 may have a volume ranging from 70 cc to 100 cc. The golf club head 2200 may have a mass ranging from 180 grams to 275 grams. In another example, the golf club head 2200 may have a mass ranging from 200 grams to 250 grams. The golf club head 2200 may have a loft angle ranging from 15° to 35°. In another example, the golf club head 2200 may have a loft angle ranging from 17° to 33°. For example, the golf club head 2200 may be a hybrid-type golf club head. The apparatus, methods, and articles of manufacture described herein are not limited in this regard.

Figure 24:
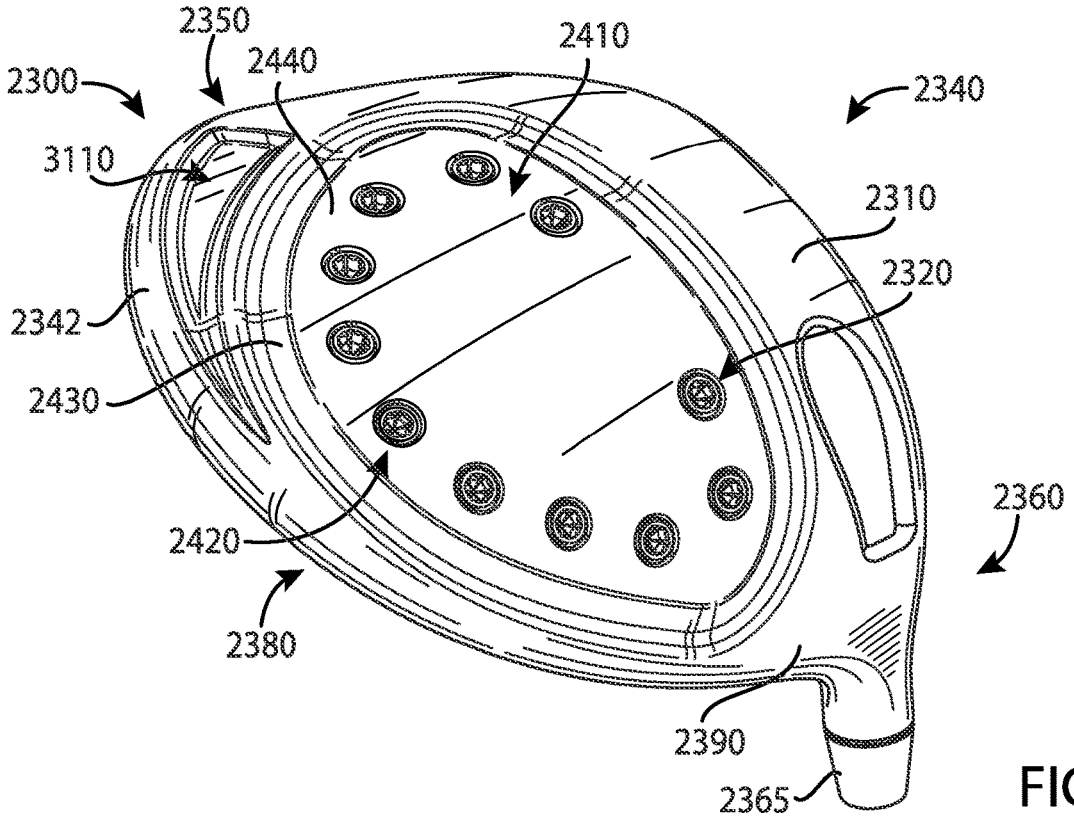
FIG. 24 depicts a bottom perspective view of the example golf club head of FIG. 23.
Figure 25:
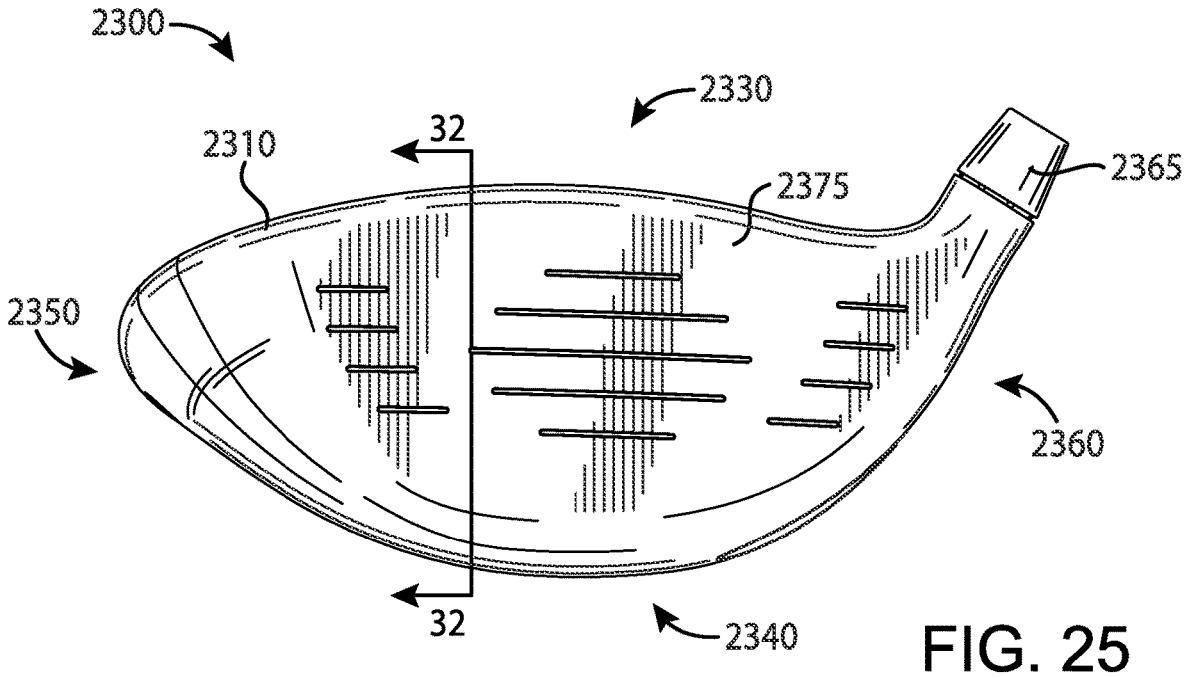
FIG. 25 depicts a front view of the example golf club head of FIG. 23.
Figure 26:
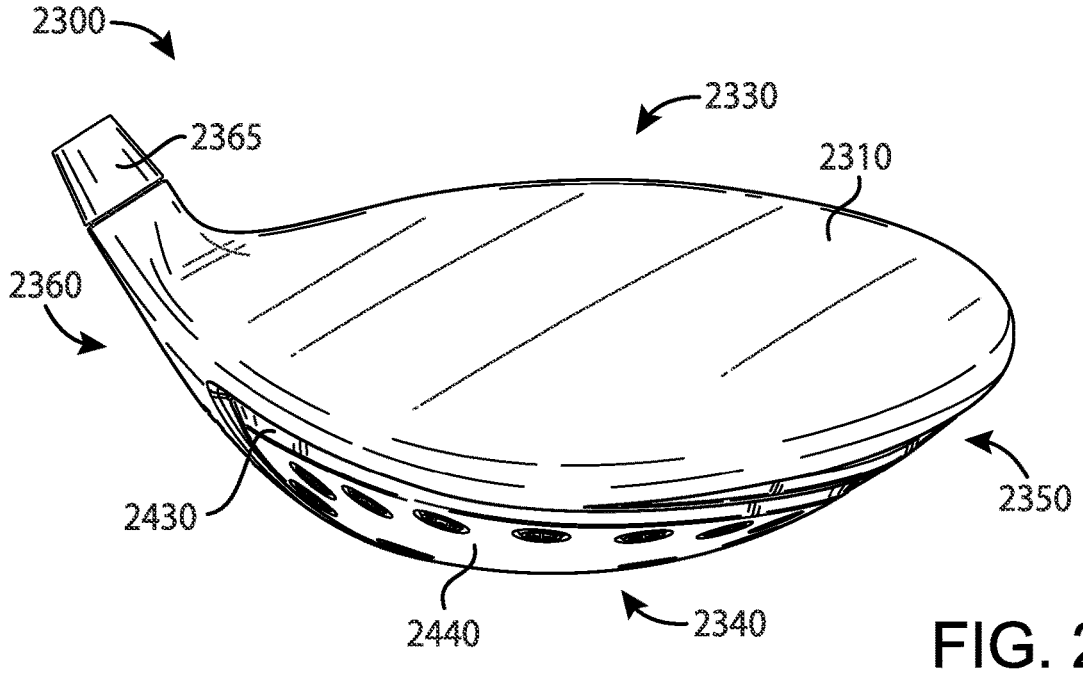
FIG. 26 depicts a rear view of the example golf club head of FIG. 23.
Figure 27:
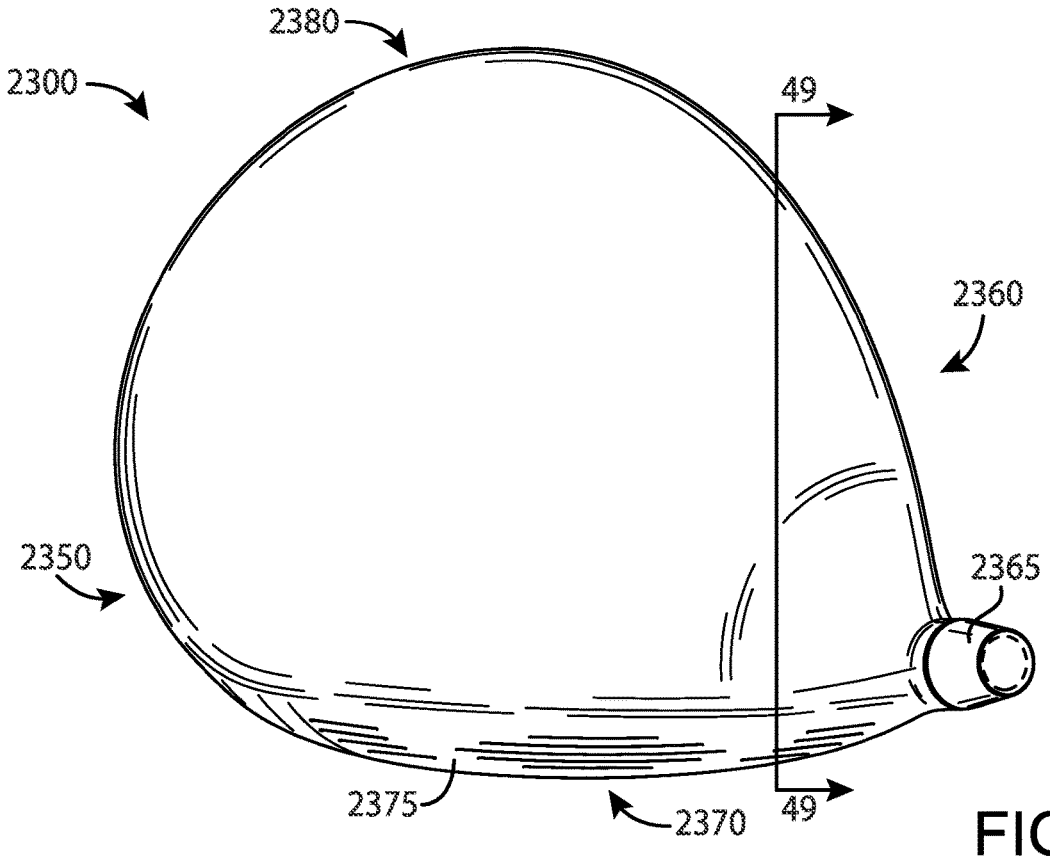
FIG. 27 depicts a top view of the example golf club head of FIG. 23.

In the example of FIGS. 23-32, a golf club head 2300 may include a body portion 2310, and a plurality of weight portions 2320, generally, shown as a first set of weight portions 2410 and a second set of weight portions 2420 (FIG. 24). The body portion 2310 may include a top portion 2330, a bottom portion 2340, a toe portion 2350, a heel portion 2360, a front portion 2370, and a rear portion 2380. The bottom portion 2340 may include a skirt portion 2390 defined as a side portion of the golf club head 2300 between the top portion 2330 and the bottom portion 2340 excluding the front portion 2370 and extending across a periphery of the golf club head 2300 from the toe portion 2350, around the rear portion 2380, and to the heel portion 2360. The bottom portion 2340 may include a transition region 2430 and a weight port region 2440. For example, the weight port region 2440 may be a D-shape region. The weight port region 2440 may include a plurality of weight ports 2800 (FIG. 28) to receive the plurality of weight portions 2320. The front portion 2370 may include a face portion 2375 to engage a golf ball (not shown). The body portion 2310 may also include a hosel portion 2365 to receive a shaft (not shown). The hosel portion 2365 may be an integral portion or a separate portion of the body portion 2310. For example, the hosel portion 2365 may include a hosel sleeve with one end to receive a shaft and an opposite end that may be inserted into the body portion 2310. Alternatively, the body portion 2310 may include a bore instead of the hosel portion 2365. The golf club head 2300 may be constructed from similar material, may have a similar volume and be the same type of golf club head as the golf club head 100 or any of the golf club heads described herein. The apparatus, methods, and articles of manufacture described herein are not limited in this regard.

Each of the first set of weight portions 2410, generally shown as 2605, 2610, 2615, and 2620 may be associated with a first mass. Each of the second set of weight portions 2420, generally shown as 2640, 2645, 2650, 2655, 2660, 2665, and 2670 may be associated with a second mass. The first mass may be greater than the second mass or vice versa. The first and second set of weight portions 2410 and 2420, respectively, may provide various weight configurations for the golf club head 2300 that may be similar to the various weight configurations for the golf club head 100 or any of the golf club heads described herein. Alternatively, all of the weight portions of the first and second set of weight portions 2410 and 2420, respectively, may have the same mass. That is, the first and second masses may be equal to each other. The plurality of weight portions 2320 may have similar or different physical properties (e.g., density, shape, mass, volume, size, color, etc.). The weight portions 2320 may be similar in many respects to the weight portions 120 of the golf club head 100 or any of the golf club heads described herein. The apparatus, methods, and articles of manufacture described herein are not limited in this regard. The apparatus, methods, and articles of manufacture described herein are not limited in this regard.

Figure 28:
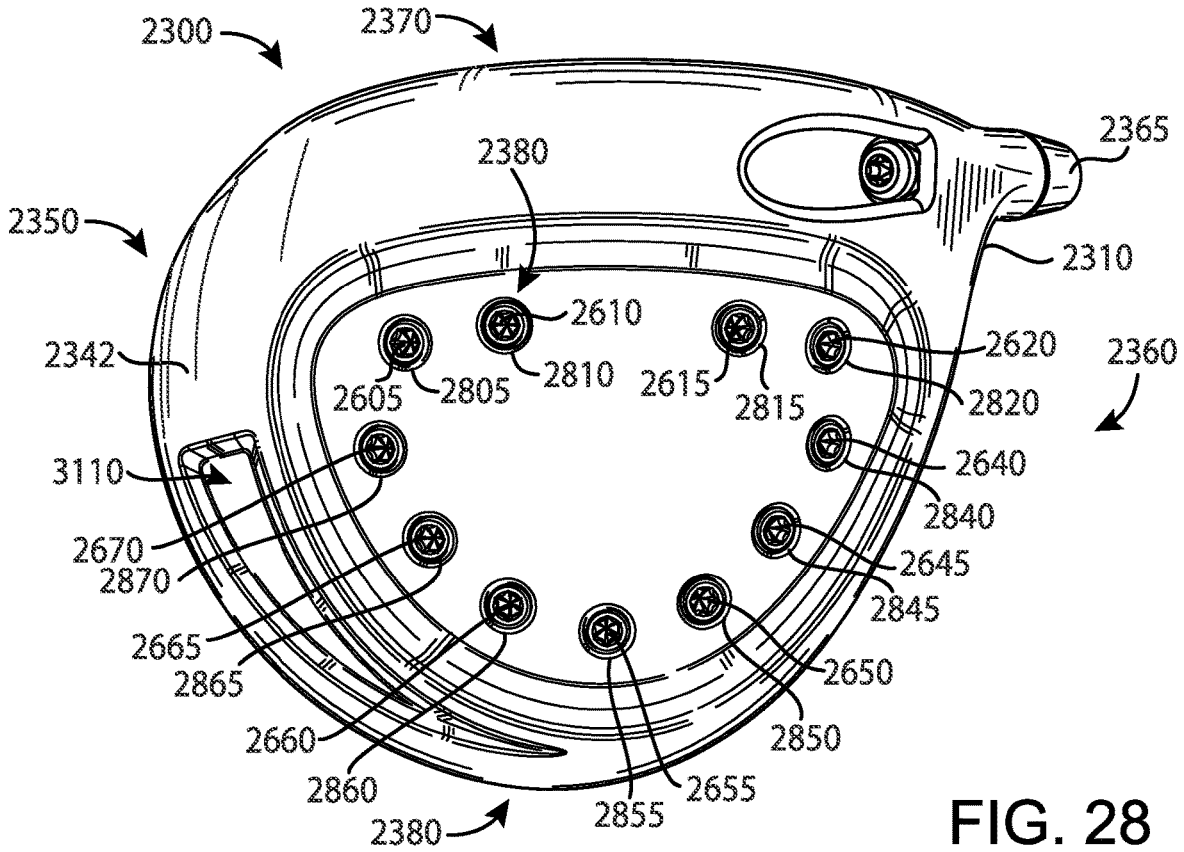
FIG. 28 depicts a bottom view of the example golf club head of FIG. 23.
Figure 29:
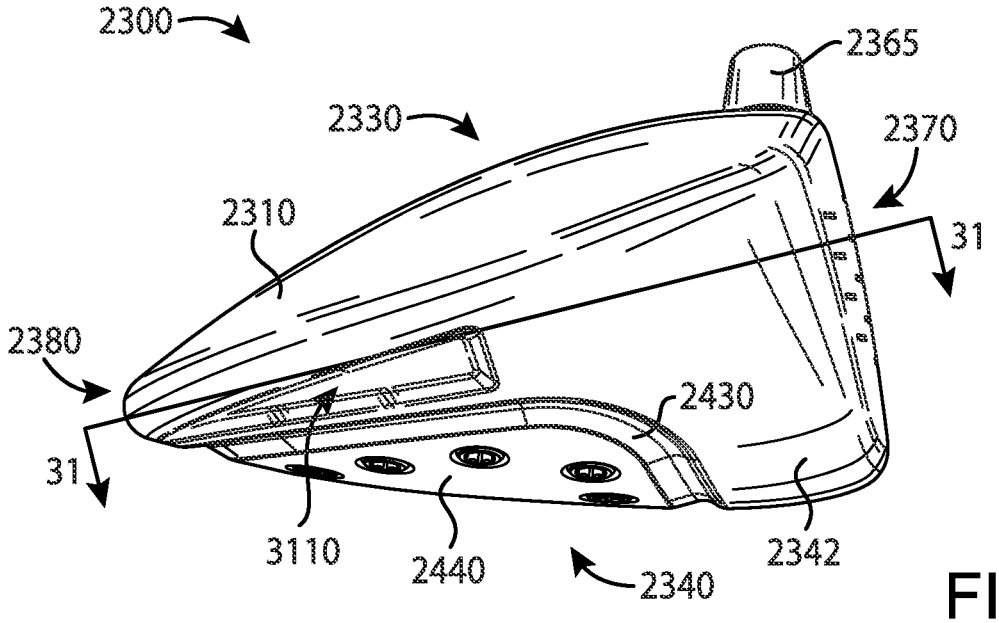
FIG. 29 depicts a toe view of the example golf club head of FIG. 23.
Figure 30:
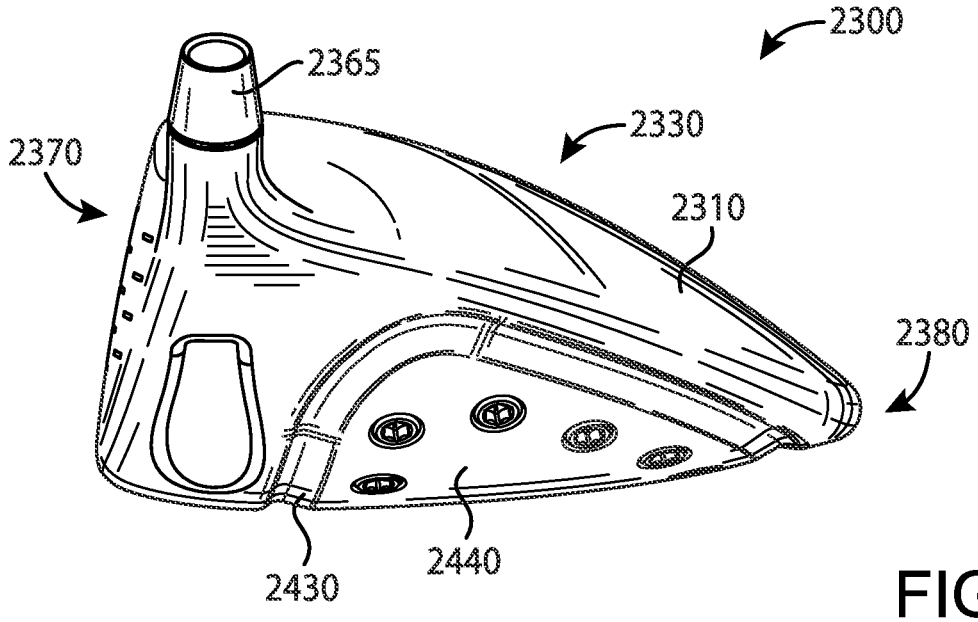
FIG. 30 depicts a heel view of the example golf club head of FIG. 23.

Referring to FIG. 28, for example, the bottom portion 2340 of the body portion 2310 may include a plurality of weight ports 2800. The plurality of weight ports 2800, generally shown as 2805, 2810, 2815, 2820, 2840, 2845, 2850, 2855, 2860, 2865, and 2870 may be located on and/or along a periphery of the weight port region 2440 of the bottom portion 2340. Each of the plurality of weight ports 2800 may be similar in many respects (e.g., port diameter) to any of the weight ports of the golf club head 100 or any of the golf club heads described herein. Further, each of the plurality of weight ports 2800 may be formed on the bottom portion 2340 similar to the formation of the weight ports 900 of the golf club head 100 or any of the golf club heads described herein. Further yet, the plurality of weight ports 2800 may extend across the bottom portion 2340 similar to the configuration of the weight ports 900 of the golf club head 100 or any of the golf club heads described herein. However, the configuration of the weight ports 2800 on the bottom portion 2340 may be different than the configuration of the weight ports 900 of the golf club head 100 or any of the golf club heads described herein. The apparatus, methods, and articles of manufacture described herein are not limited in this regard.

In one example shown in FIGS. 23-32, the bottom portion 2340 may include an outer surface 2342 and an inner surface 2344. Each of the outer surface 2342 and the inner surface 2344 may include one or a plurality of support portions, generally shown as 3110, 3120, and 3140. The outer surface 2342 may include at least one outer support portion 3110 and the inner surface 2344 may include a first set of inner support portions 3120 (generally shown as inner support portions 3121, 3122, 3123, 3124, 3125, 3126, 3127, 3128, 3129, 3130, 3131, 3132 and 3133), and a second set of inner support portions 3140 (generally shown as inner support portions 3141, 3142, 3143, 3144, 3145, and 3146). The apparatus, methods, and articles of manufacture described herein are not limited in this regard.

Figure 31:
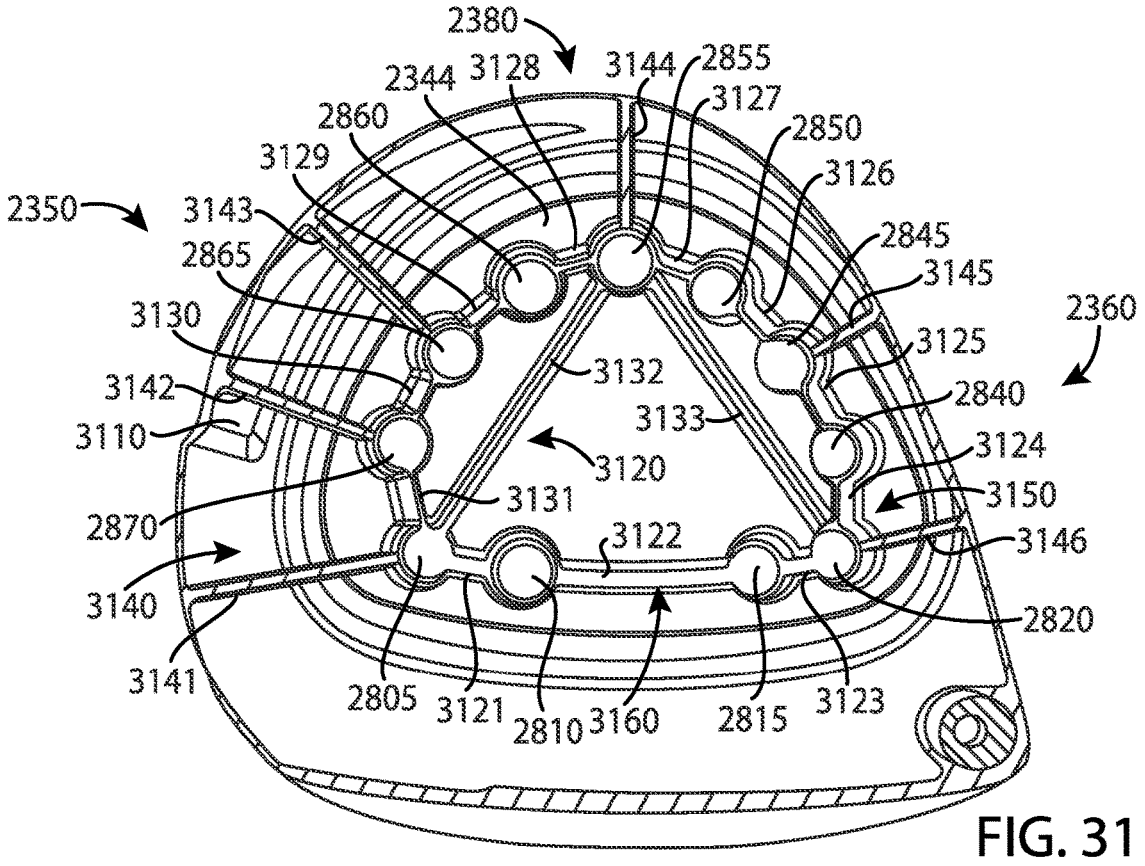
FIG. 31 depicts a cross-sectional view of the example golf club head of FIG. 23 taken at section line 31-31 of FIG. 29
Figure 32:
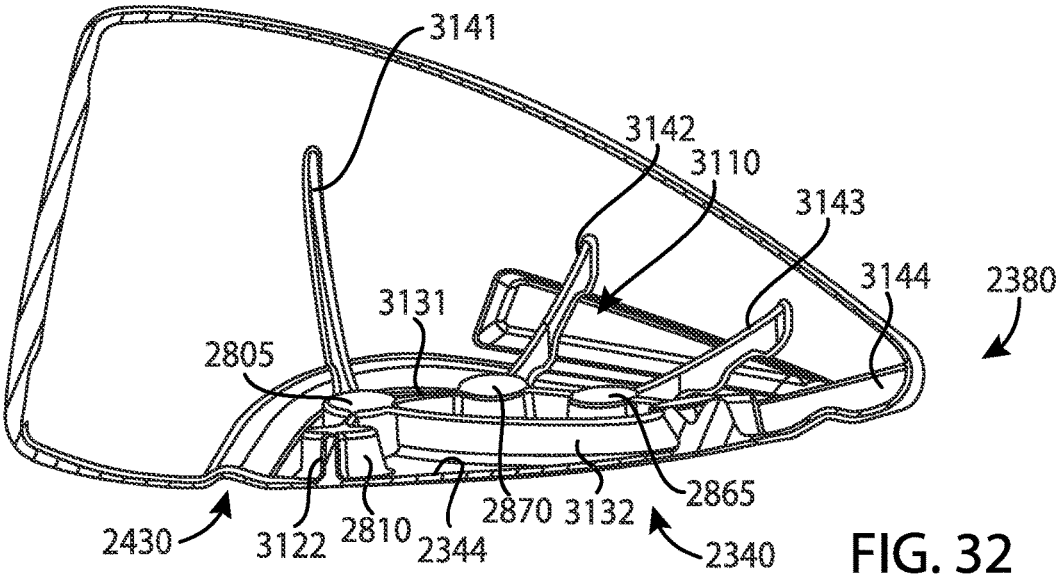
FIG. 32 depicts a cross-sectional view of the example golf club head of FIG. 23 taken at section line 32-32 of FIG. 25.

The outer support portion 3110 may be positioned on the bottom portion 2340 and/or the skirt portion 2390 between any of the weight ports 2800 and/or a periphery of the body portion 2310 as defined by the toe portion 2350, the heel portion 2360, the front portion 2370, and the rear portion 2380. However, the outer support portion 3110 may be positioned at any location on the golf club head 2300 for structural support of the golf club head 2300. As an example shown in FIGS. 23-32, the outer support portion 3110 may be defined by a groove or indentation that extends on the bottom portion 2340 and/or the skirt portion 2390 from the rear portion 2380 toward and/or to the toe portion 2350 proximate to a periphery of the body portion 2310. The outer support portion 3110 may have any configuration. As illustrated in FIG. 31, a width of the outer support portion 3110 may increase from the rear portion 2380 toward the toe portion 2350 while the outer support portion 3110 may follow a contour of the periphery of the body portion 2310 between the rear portion 2380 and the toe portion 2350. Accordingly, the outer support portion 3110 may resemble a curved triangular groove on the bottom portion 2340. The depth of the outer support portion 3110 may also vary. Alternatively, the depth of the outer support portion 3110 may be constant. Further, the depth of the outer support portion 3110 may be determined based on the thickness of the bottom portion 2340 and the material from which the bottom portion 2340 is formed. The apparatus, methods, and articles of manufacture described herein are not limited in this regard.

Each inner support portion of the first set of inner support portions 3120 may include walls, ribs and/or any projection from the inner surface 2344 of the bottom portion 2340. Each inner support portion of the first set of inner support portions 3120 may extend from and connect each weight port 2800 to an adjacent weight port or to one or more other non-adjacent weight ports 2800. As shown in FIG. 31, for example, the inner support portion 3121 may include a wall projecting from the inner surface 2344 of the bottom portion 2340 and connecting the weight ports 2805 and 2810. Similarly, as shown in FIG. 31, each pair of adjacent weight ports 2810 and 2815, 2815 and 2820, 2820 and 2840, 2840 and 2845, 2845 and 2850, 2850 and 2855, 2855 and 2860, 2860 and 2865, 2865 and 2870, 2870 and 2805 may be connected by inner support portions 3122, 3123, 3124, 3125, 3126, 3127, 3128, 3129, 3130, 3131, respectively. Accordingly, the inner support portions 3121 through 3131 of the first set of inner support portions 3120 may define a loop-shaped support region 3150 on the inner surface 2344 of the bottom portion 2340. The apparatus, methods, and articles of manufacture described herein are not limited in this regard.

Further, the inner support portion 3132 may include a wall projecting from the inner surface 2344 of the bottom portion 2340 and connecting two non-adjacent weight ports such as the weight ports 2805 and 2855. The inner support portion 3133 may include a wall projecting from the inner surface 2344 of the bottom portion 2340 and connecting two non-adjacent weight ports such as the weight ports 2820 and 2855. Accordingly, the inner support portions 3121, 3122, 3123, 3132 and 3133 may define a triangular support region 3160 on the inner surface 2344 of the bottom portion 2340 partially within the loop-shaped support region 3150 and partially overlapping the loop-shaped support region 3150. The weight ports 2805, 2820 and 2855 may define the vertices of the triangular support region 3160. The first set of inner support portions 3120 may have any configuration, connect any two or more of the weight ports, and/or define any shape. The apparatus, methods, and articles of manufacture described herein are not limited in this regard.

Each inner support portion of the second set of inner support portions 3140 may include walls, ribs and/or any projections on the inner surface 2344 of the bottom portion 2340. Each inner support portion of the second set of inner support portions 3140 may extend from one or more of the weight ports 2800 toward the periphery and/or the skirt portion 2390 of the body portion 2310. In one example shown in FIG. 31, the inner support portion 3141 may include a wall connected to the weight port 2805 and extending from the weight port 2805 toward and/or to the toe portion 2350. The inner support portion 3142 may include a wall connected to the weight port 2870 and extending from the weight port 2870 toward and/or to the toe portion 2350. The inner support portion 3143 may include a wall connected to the weight port 2865 and extending from the weight port 2865 toward and/or to the toe portion 2350 or the rear portion 2380. The length, height, thickness, orientation angle, and/or cross-sectional configuration of each of the inner support portions 3141, 3142 and 3143 may be configured such that the inner support portions 3141, 3142 and 3143 may provide or substantially provide structural support to the bottom portion 2340, the skirt portion 2390, the toe portion 2350, the front portion 2370 and/or the rear portion 2380. The apparatus, methods, and articles of manufacture described herein are not limited in this regard.

As illustrated in FIG. 31, the inner support portion 3144 may include a wall that may be connected to the weight port 2855 and may extend from the weight port 2855 toward and/or to the rear portion 2380. The inner support portion 3145 may include a wall connected to the weight port 2845 and extending from the weight port 2845 toward and/or to the heel portion 2360. The inner support portion 3146 may include a wall connected to the weight port 2820 and extending from the weight port 2820 toward and/or to the heel portion 2360. The length, height, thickness, orientation angle, and/or cross-sectional configuration of each of the inner support portions 3144, 3145 and 3146 may be configured such that the inner support portions 3144, 3145 and 3146 may provide or substantially provide structural support to the bottom portion 2340, the skirt portion 2390, the heel portion 2360, the front portion 2370 and/or the rear portion 2380. The apparatus, methods, and articles of manufacture described herein are not limited in this regard.

The first set of inner support portions 3120 may structurally support the bottom portion 2340 by distributing the impact loads exerted on the bottom portion 2340 throughout the bottom portion 2340 when the golf club head 2300 strikes a golf ball (not shown). The second set of inner support portions 3140 may further distribute the impact loads throughout the bottom portion 2340, the skirt portion 2390, toe portion 2350, the heel portion 2360, the front portion 2370, and/or the rear portion 2380. In one example, the second set of inner support portions 3140 may include additional walls, ribs and/or projections (not shown) that connect to any of the weight ports such as weight ports 2840, 2850 and 2860 to further distribute impact loads throughout the body portion 2310. While the above examples may depict a particular number of inner support portions, the bottom portion 2340 may include additional inner support portions (not shown). For example, the bottom portion 2340 may include a plurality of inner support portions (not shown) that connect non-adjacent weight ports 2800 (e.g., weight ports 2815 and 2860) and/or the second set of inner support portions 3140. The apparatus, methods, and articles of manufacture described herein are not limited in this regard.

The width (i.e., thickness), length, height, orientation angle, and/or cross-sectional shape of the inner support portions of the first set of inner support portions 3120 and/or the second set of inner support portions 3140 may be similar or vary and be configured to provide structural support to the golf club head 2300. For example, the materials from which the bottom portion 2340 and/or the body portion 2310 may be constructed may determine the width, length, height, orientation angle, and/or cross-sectional shape of the inner support portions of the first set of inner support portions 3120 and/or the second set of inner support portions 3140. For example, the inner support portions of the first set of inner support portions 3120 and/or the second set of inner support portions 3140 may be defined by walls with rectangular cross sections having heights that are similar to the depths of the weight portions 2800. The length of each inner support portion of the second set of inner support portions 3140 may be configured such that one or more inner support portions of the second set of inner support portions 3140 extend from the bottom portion 2340 to the skirt portion 2390. The apparatus, methods, and articles of manufacture described herein are not limited in this regard.

Any of the golf club heads described herein may have different configurations of outer support portions and/or inner support portions to provide structural support for the golf club head during impact with a golf ball depending on the size, thickness, materials of construction and/or other characteristics of any portions and/or parts of the golf club head. The different configurations of the outer support portions and/or inner support portions may affect vibration, dampening, and/or noise characteristics of the golf club head when striking a golf ball. Further, the different configurations of the outer support portions and/or the inner support portions may provide structural support to portions of the golf club head that may require additional structural support. For example, a golf club head as described herein may include more inner support portions in addition to the first set of inner support portions and the second set of inner support portions as described herein. For example, a golf club head as described herein may include fewer inner support portions than the first set of inner support portions and the second set of inner support portions as described herein.

Figure 33:
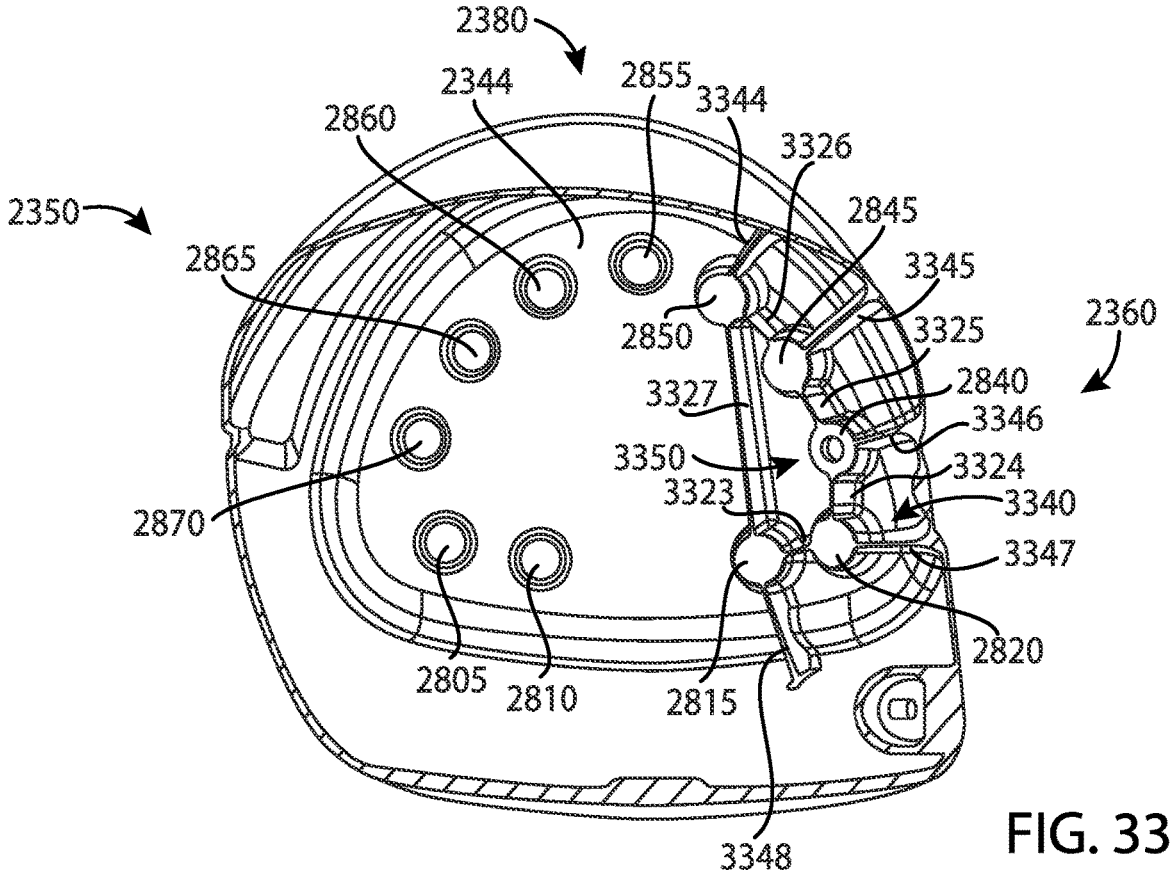
FIG. 33 depicts a cross-sectional view of an example golf club head of FIG. 23 taken at section line 31-31 of FIG. 29 according to an embodiment of the apparatus, methods, and articles of manufacture described herein.
Figure 34:
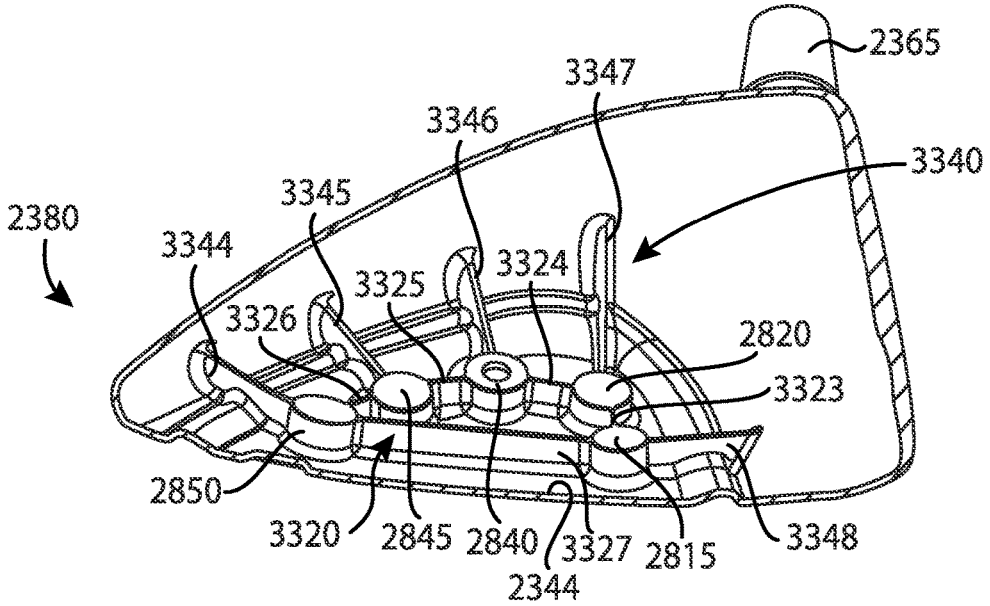
FIG. 34 depicts a cross-sectional view of the golf club head of FIG. 33 taken at section line 32-32 of FIG. 25.

FIGS. 33 and 34 show another example of the golf club head 2300 with a different configuration of inner support portions. The inner surface 2344 of the bottom portion 2340 may include a first set of inner support portions 3320 (generally shown as inner support portions 3323, 3324, 3325, 3326, and 3327), and a second set of inner support portions 3340 (generally shown as inner support portions 3344, 3345, 3346, 3347 and 3348). The first set of inner support portions 3320 and the second set of inner support portions 3340 are closer to the heel portion 2360 than to the toe portion 2350. For example, the first set of inner support portions 3320 and the second set of inner support portions 3340 may be located on the bottom portion 2340 between a midpoint (not shown) of the body portion 2310 and the heel portion 2360. The apparatus, methods, and articles of manufacture described herein are not limited in this regard.

The first set of inner support portions 3320 may be similar in many respects to any of the inner support portions described herein such as the inner support portions of the first set of inner support portions 3120 shown in FIG. 31. As shown in FIGS. 33 and 34, for example, the inner support portion 3323 may include a wall projecting from the inner surface 2344 of the bottom portion 2340 and connecting the weight ports 2815 and 2820. Similarly, each pair of adjacent weight ports 2815 and 2820, 2820 and 2840, 2840 and 2845, 2845 and 2850, and 2850 and 2815 may be connected by inner support portions 3323, 3324, 3325, 3326, and 3327, respectively. Accordingly, the inner support portions 3323 through 3327 of the first set of inner support portions 3320 may define a loop-shaped support region 3350 on the inner surface 2344 of the bottom portion 2340. The loop-shaped support region 3350 may be closer to the heel portion 2360 than to the toe portion 2350. The loop-shaped support region 3350 may be located between a midpoint (not shown) of the body portion 2310 and the heel portion 2360. The apparatus, methods, and articles of manufacture described herein are not limited in this regard.

The second set of inner support portions 3340 may be similar in many respects to any of the inner support portions described herein such as the second set of inner support portions 3140 shown in FIG. 31. As shown in FIGS. 33 and 34, for example, the inner support portion 3344 may include a wall connected to the weight port 2850 and extend from the weight port 2850 toward and/or to the rear portion 2380. The inner support portion 3345 may include a wall connected to the weight port 2845 and extend from the weight port 2845 toward and/or to the heel portion 2360 and the rear portion 2380. The inner support portion 3346 may include a wall connected to the weight port 2840 and extend from the weight port 2840 toward and/or to the heel portion 2360. The inner support portion 3347 may include a wall connected to the weight port 2820 and extend from the weight port 2820 toward and/or to the heel portion 2360. The inner support portion 3348 may include a wall connected to the weight port 2815 and extend from the weight port 3815 toward and/or to the front portion 2370. The length, height, thickness, orientation angle, and/or cross-sectional configuration of each of the inner support portions 3344, 3345, 3346, 3347 and 3348 may be configured such that the inner support portions 3344, 3345, 3346, 3347 and 3348 may provide or substantially provide structural support to the bottom portion 2340, the skirt portion 2390, the heel portion 2360, the front portion 2370 and/or the rear portion 2380. The apparatus, methods, and articles of manufacture described herein are not limited in this regard.

Figure 35:
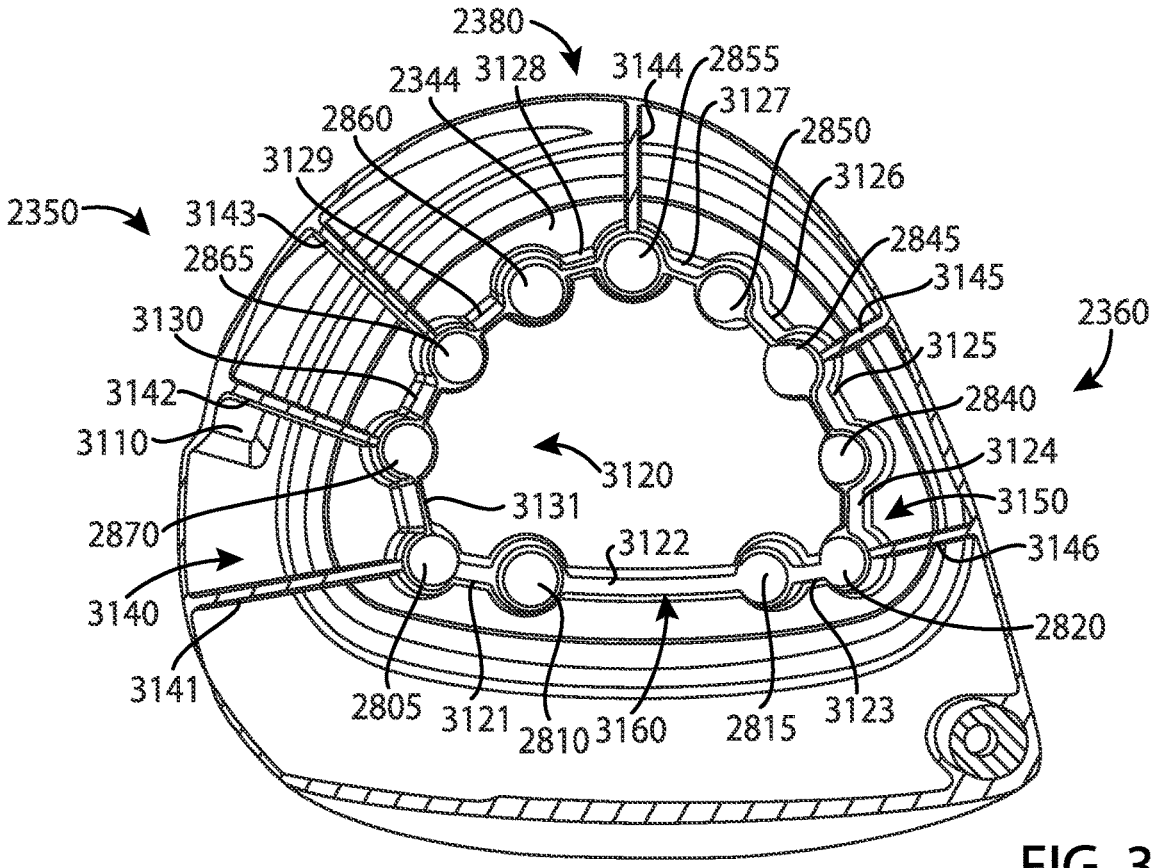
FIG. 35 depicts a cross-sectional view of an example golf club head of FIG. 23 taken at section line 31-31 of FIG. 29 according to an embodiment of the apparatus, methods, and articles of manufacture described herein.
Figure 43:
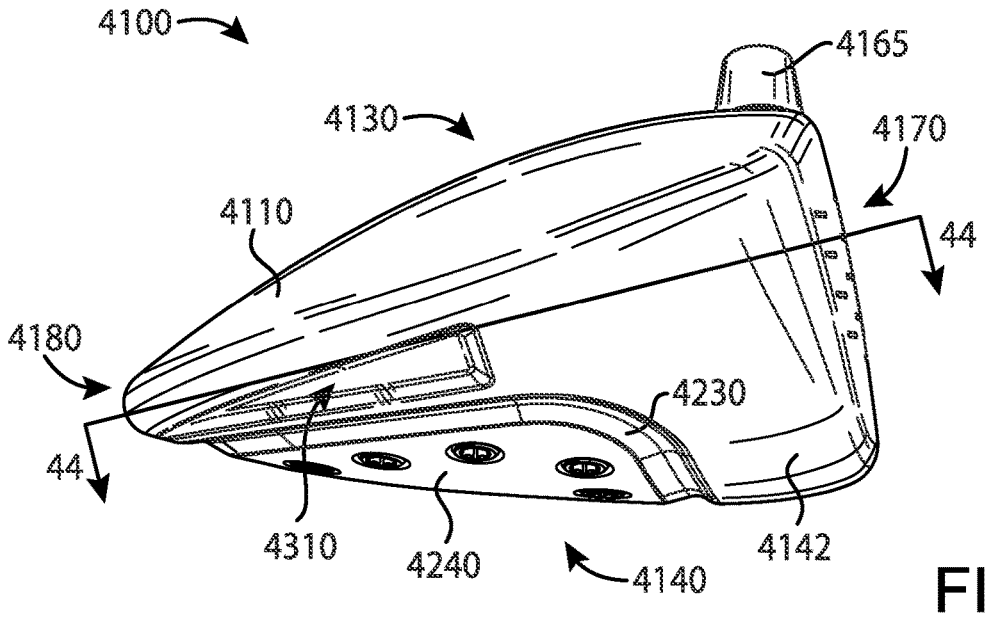
FIG. 43 depicts a toe view of the example golf club head of FIG. 41.
Figure 44:
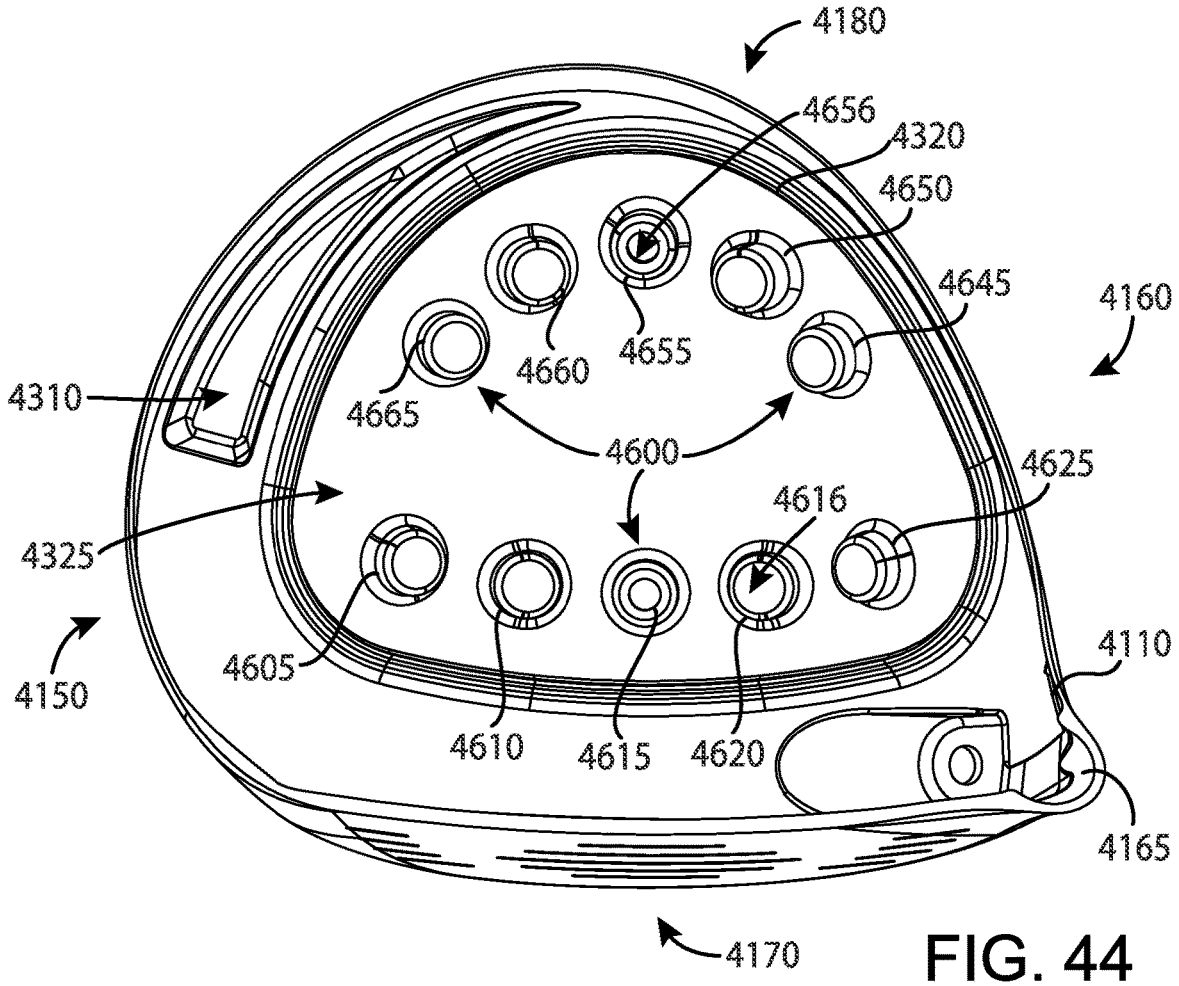
FIG. 44 depicts a top perspective cross-sectional view of the golf club head of FIG. 41 taken at section line 44-44 of FIG. 43.

FIG. 35 shows another example of the golf club head 2300 with a different configuration of the inner support portions. The inner surface 2344 may include a first set of inner support portions 3120 (generally shown as inner support portions 3121, 3122, 3123, 3124, 3125, 3126, 3127, 3128, 3129, 3130 and 3131), and a second set of inner support portions 3140 (generally shown as inner support portions 3141, 3142, 3143, 3144, 3145, and 3146). Accordingly, the golf club head 2300 of FIG. 43 may be similar to the golf club head 2300 of FIG. 31, except that the golf club head 2300 of FIG. 43 does not include the inner support portions 3132 and 3133. The apparatus, methods, and articles of manufacture described herein are not limited in this regard.

In addition to any of the golf club heads described herein having different configurations of outer support portions and/or inner support portions, any of the golf club heads described herein may have different configurations of weight ports in combination with different configurations of the outer support portions and/or the inner support portions. The different configurations of the weight ports may affect the weight distribution of the golf club head. The different configurations of the outer support portions and/or inner support portions may affect stiffness, vibration, dampening, and/or noise characteristics of the golf club head when striking a golf ball. Further, the different configurations of the outer support portions and/or the inner support portions may provide structural support to portions of the golf club head that may require additional structural support. For example, a golf club head as described herein may include more or less weight ports than some of the example golf club heads described herein. For example, a golf club head as described herein may include more inner support portions in addition to the first set of inner support portions and the second set of inner support portions as described herein. For example, a golf club head as described herein may include fewer inner support portions than the first set of inner support portions and the second set of inner support portions as described herein. The apparatus, methods, and articles of manufacture described herein are not limited in this regard.

Figure 36:
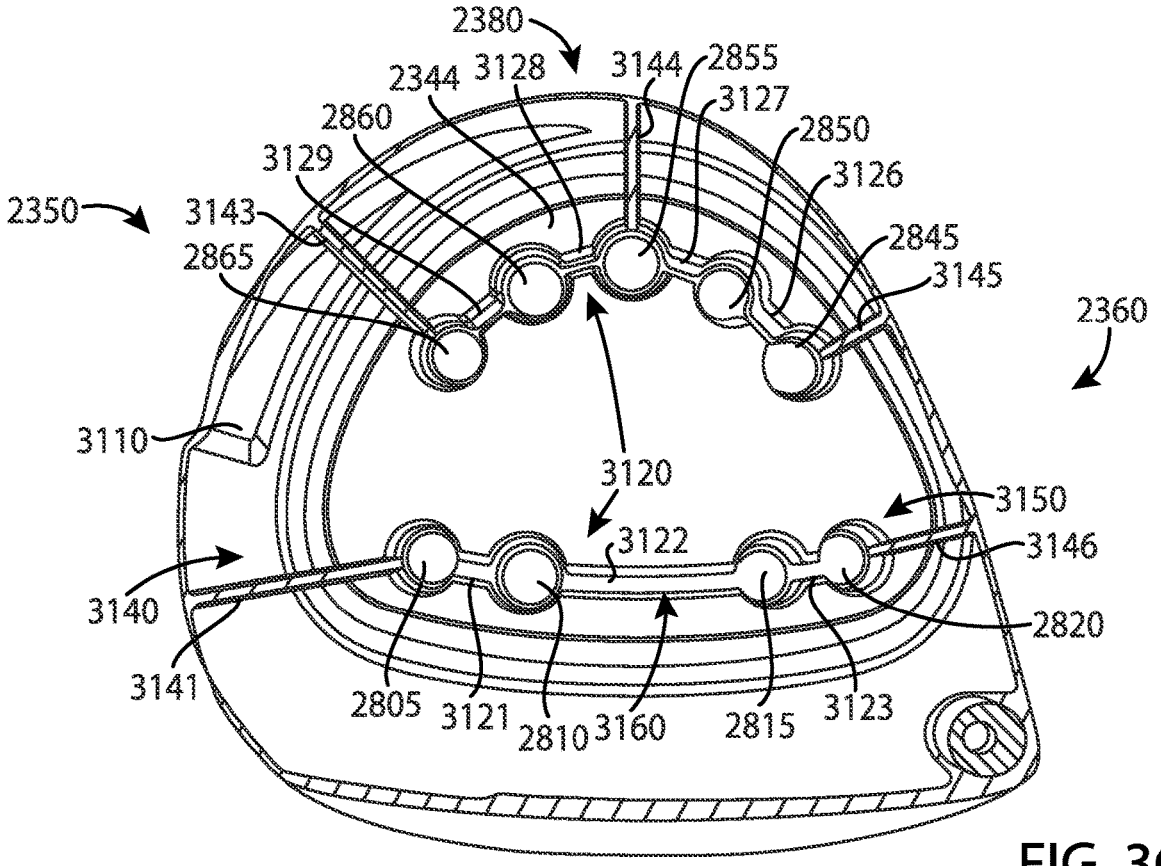
FIG. 36 depicts a cross-sectional view of an example golf club head of FIG. 23 taken at section line 31-31 of FIG. 29 according to an embodiment of the apparatus, methods, and articles of manufacture described herein.

FIG. 36 shows another example of the golf club head 2300 with a different configuration of the weight ports and different configuration of inner support portions. The bottom portion 2340 may include a plurality of weight ports 2800, which are generally shown as 2805, 2810, 2815, 2820, 2845, 2850, 2855, 2860, and 2865. Accordingly, the golf club head 2300 of FIG. 36 is similar to the golf club head 2300 of FIG. 31, except that the golf club head 2300 of FIG. 36 does not include weight ports 2840 and 2870. Also, in the example of FIG. 36, the inner surface 2344 of the bottom portion 2340 may include a first set of inner support portions 3120 (generally shown as inner support portions 3121, 3122, 3123, 3126, 3127, 3128, and 3129), and a second set of inner support portions 3140 (generally shown as inner support portions 3141, 3143, 3144, 3145, and 3146). Accordingly, the golf club head 2300 of FIG. 36 may be similar to the golf club head 2300 of FIG. 31, except that the golf club head 2300 of FIG. 36 does not include the inner support portions 3124, 3125, 3130, 3131, 3132, 3133 and 3142. The apparatus, methods, and articles of manufacture described herein are not limited in this regard.

Figure 37:
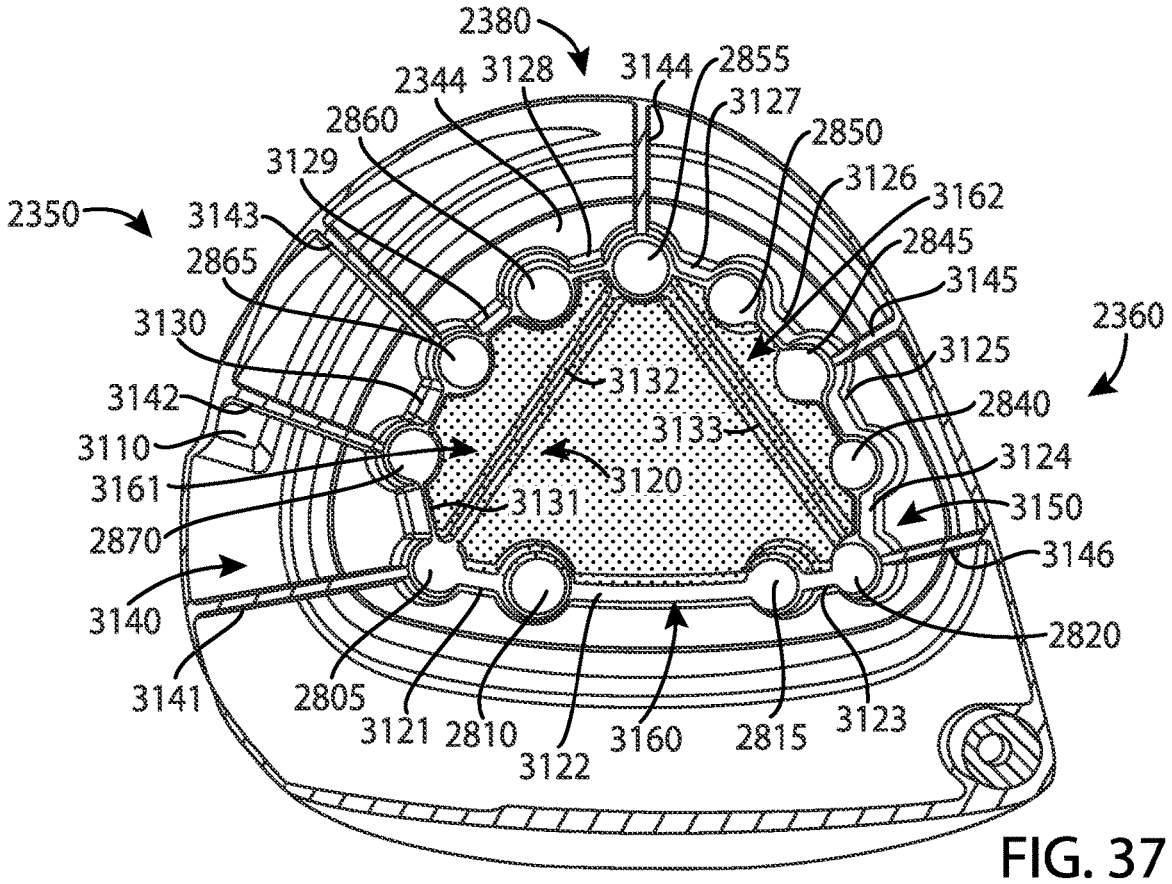
FIG. 37 depicts a cross-sectional view of an example golf club head of FIG. 23 taken at section line 31-31 of FIG. 29 according to an embodiment of the apparatus, methods, and articles of manufacture described herein.

In one example shown in FIG. 37, certain regions of the interior of the body portion 2310 of the golf club head 2300 may include an elastic polymer material or an elastomer material, which may be referred to herein as the filler material. The filler material may dampen vibration, dampen noise, lower the center of gravity and/or provide a better feel and sound for the golf club head 2300 when striking a golf ball (not shown). According to one example, the triangular support region 3160 may be filled with the filler material. The filler material may extend from the inner surface 2344 of the bottom portion 2340 up to a height of any of the inner support portions 3122, 3132 and/or 3133. However, the filler material may extend below or above the height of any of the inner support portions 3122, 3132 and/or 3133. Further, the thickness of the filler material, which may be defined as the distance the filler material extends from the inner surface 2344 of the bottom portion 2340, may vary. In one example, the thickness of the filler material may be greater around a center portion of the triangular support region 3160 than the sides of the triangular support region 3160. In another example, the thickness of the filler material may be less around a center portion of the triangular support region 3160 than the sides of the triangular support region 3160. The apparatus, methods, and articles of manufacture described herein are not limited in this regard.

According to another example, a support region 3161 defined by the inner support portions 3128, 3129, 3130, 3131 and 3132; and a support region 3162 defined by the inner support portions 3124, 3125, 3136, 3137 and 3133 may be filled with the filler material. The filler material may extend from the inner surface 2344 of the bottom portion 2340 up to a height of any of the inner support portions defining the support regions 3161 and/or 3162. However, the filler material may extend below or above the height of any of the inner support portions defining the support regions 3161 and 3162. Further, the thickness of the filler material, which may be defined as the distance the filler material extends from the inner surface 2344 of the bottom portion 2340, may vary. In one example, the thickness of the filler material may be greater around a center portion of the support region 3161 and/or the support region 3162 than the sides of the support region 3161 and/or the support region 3162, respectively. In another example, the thickness of the filler material may be less around a center portion of the support region 3161 and/or support region 3162 than the sides of the support region 3161 and/or 3162, respectively. According to one example, any one or a combination of the support regions 3160, 3161 and/or 3162 may be filled with the filler material as described herein. The apparatus, methods, and articles of manufacture described herein are not limited in this regard.

Figure 38:
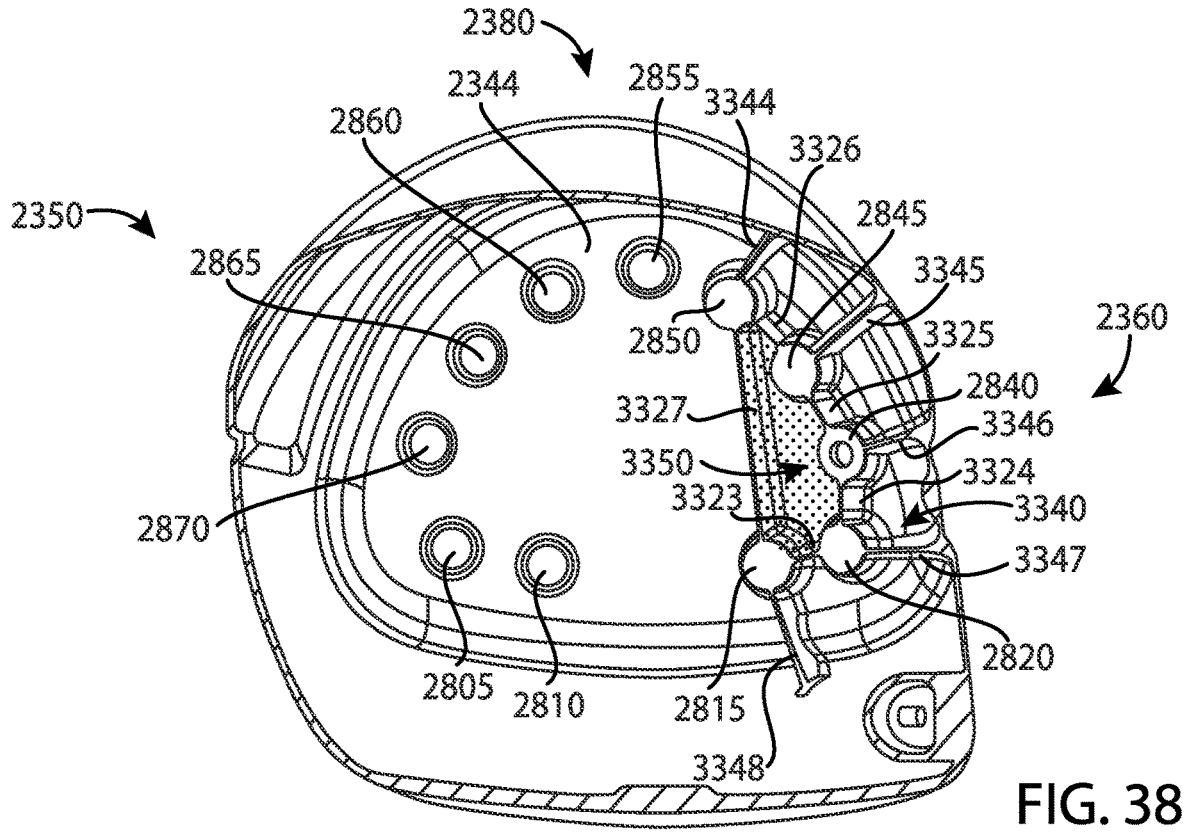
FIG. 38 depicts a cross-sectional view of an example golf club head of FIG. 23 taken at section line 31-31 of FIG. 29 according to an embodiment of the apparatus, methods, and articles of manufacture described herein.

In one example shown in FIG. 38, which is similar to many respects to the golf club head 2300 shown in FIG. 33, certain regions of the interior of the body portion 2310 of the golf club head 2300 may include the filler material, which may be an elastic polymer material or an elastomer material as described. The filler material may dampen vibration, dampen noise, lower the center of gravity and/or provide a better feel and sound for the golf club head 2300 when striking a golf ball (not shown). According to one example, the support region 3350 may be filled with the filler material. The filler material may extend from the inner surface 2344 of the bottom portion 2340 up to a height of any of the inner support portions 3323, 3324, 3325, 3326 and/or 3327. However, the filler material may extend below or above the height of any of the inner support portions 3323, 3324, 3325, 3326 and/or 3327. Further, the thickness of the filler material, which may be defined as the distance the filler material extends from the inner surface 2344 of the bottom portion 2340, may vary. In one example, the thickness of the filler material may be greater around a center portion of the support region 3350 than the sides of the support region 3350. In another example, the thickness of the filler material may be less around a center portion of the support region 3350 than the sides of the support region 3350. The apparatus, methods, and articles of manufacture described herein are not limited in this regard.

Figure 39:
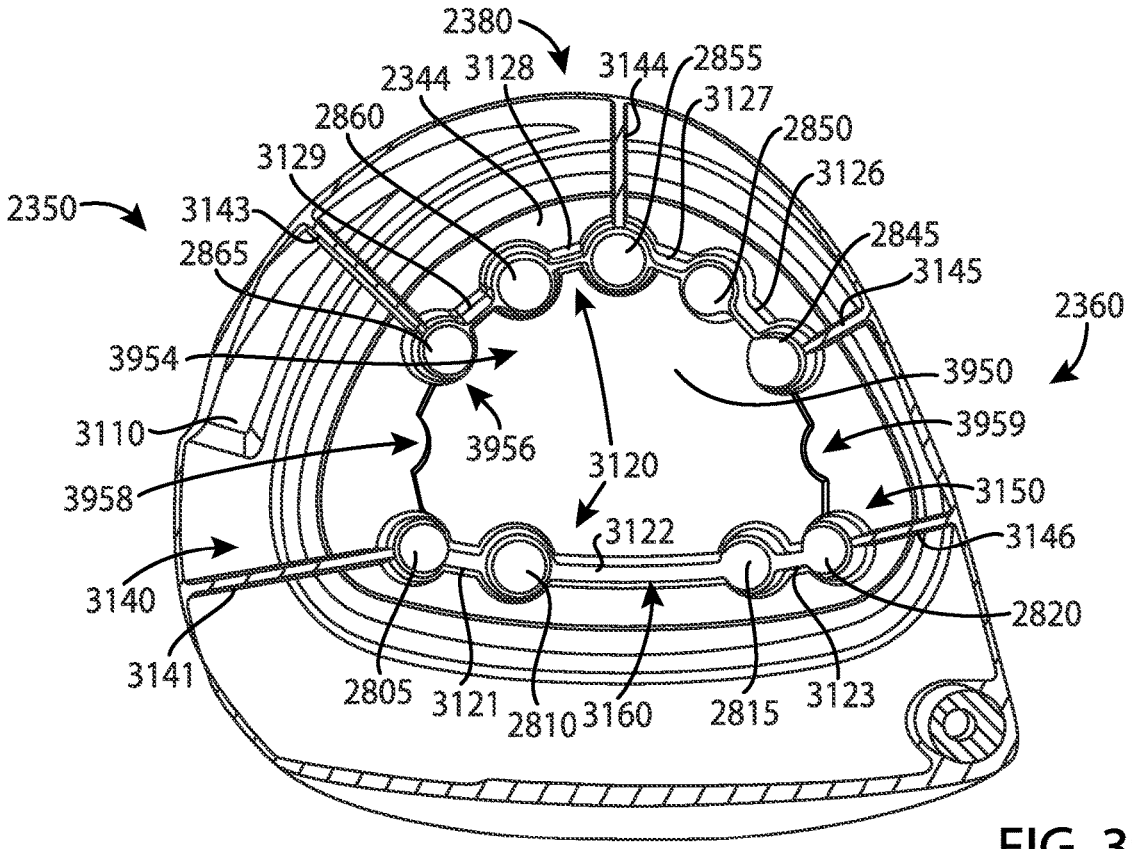
FIG. 39 depicts a cross-sectional view of an example golf club head of FIG. 23 taken at section line 31-31 of FIG. 29 according to an embodiment of the apparatus, methods, and articles of manufacture described herein.

Any of the golf club heads described herein may have one or more interior regions that may include a filler material as described. In one example, the filler material be injected into a region of the golf club head from one or more ports on the golf club head to cover or fill the region. The one or more ports that may be used to inject the filler material may be one or more of the weight ports described herein. Accordingly, the filler material may be molded to the shape of the region in which the filler material is injected to cover or fill the region. Alternatively, one or more inserts may be formed from elastic polymer material or an elastomer material (i.e., filler material) and placed in one or more regions of the interior of golf club head. FIG. 39 shows an example of the golf club head 2300 of FIG. 36 with an insert 3950, which may be constructed from an elastic polymer material or an elastomer material. The insert 3950 may be manufactured to have a similar shape as the shape of a region 3954 on the inner surface 2344 of the bottom portion 2340. Accordingly, the insert 3950 may have a curvature similar to the curvature of the bottom portion 2340 at the region 3954 to lay generally flat and in contact with the inner surface 2344 of the bottom portion 2340, have a shape that may be similar to the shape of the region 3954 to be inserted in the region 3954 and generally fit within the region 3954, and/or have a plurality of cutout portions 3956 to generally match the shape and/or contour of sidewall portions of each of the weight ports 2800. The apparatus, methods, and articles of manufacture described herein are not limited in this regard.

The insert 3950 may have a thickness that may be similar to the height of any of the weight ports 2800. Accordingly, when the insert 3950 is in the region 3954, the top portion of the insert 3950 at or proximate to the weight ports 2800 may be at the same height or substantially the same height as the weight ports 2800. However, the thickness of the insert 3950 may be constant or vary such that the thickness of the insert 3950 at any location of the insert 3950 may be more or less than the height of any of the weight ports 2800. The insert 3950 may dampen vibration, dampen noise, lower the center of gravity and/or provide a better feel and sound for the golf club head 2300 of FIG. 39 when striking a golf ball (not shown). The apparatus, methods, and articles of manufacture described herein are not limited in this regard.

The insert 3950 may be manufactured for use with any of the golf club heads described herein. As shown in FIG. 39, the insert 3950 may include a plurality of cutout portions 3956 that may generally match the shape of the outer wall portions of the weight ports 2800. The insert 3950 shown in FIG. 39 further includes cutout portions 3958 and 3959. Referring back to FIG. 35, when the insert 3950 is used with the golf club head 2300 of FIG. 35, the cut out portions 3958 and 3959 may generally match the shape of the outer wall portions of the weigh ports 2870 and 2840, respectively. Accordingly, the insert 3950 may be used in both the golf club head 2300 of FIG. 35 and the golf club head 2300 of FIG. 36. The apparatus, methods, and articles of manufacture described herein are not limited in this regard.

Referring back to FIG. 31, the insert 3950 may include channels, grooves or slots (not shown) that may be sized and shaped to receive the inner support portions 3132 and 3133 therein. Accordingly, an insert 3950 may be manufactured with the described channels, grooves or slot for use with the golf club heads 2300 of FIGS. 31, 33, 35 and 36. Alternatively, one or more inserts may be manufactured that may only fit one of the golf club heads described herein. For example, each of the golf club heads described herein may include one or more inserts that may have a certain shape for fitting only within one or more regions in the golf club head. Referring back to FIG. 31, for example, the golf club head 2300 may include a first insert (not shown) for fitting in the support region 3161, a second insert (not shown) for fitting in the triangular support region 3160, and a third insert (not shown) for fitting in the support region 3162. Referring back to FIG. 33, for example, the golf club head 3300 may include an insert (not shown) for fitting in the support region 3350. The apparatus, methods, and articles of manufacture described herein are not limited in this regard.

Figure 40:
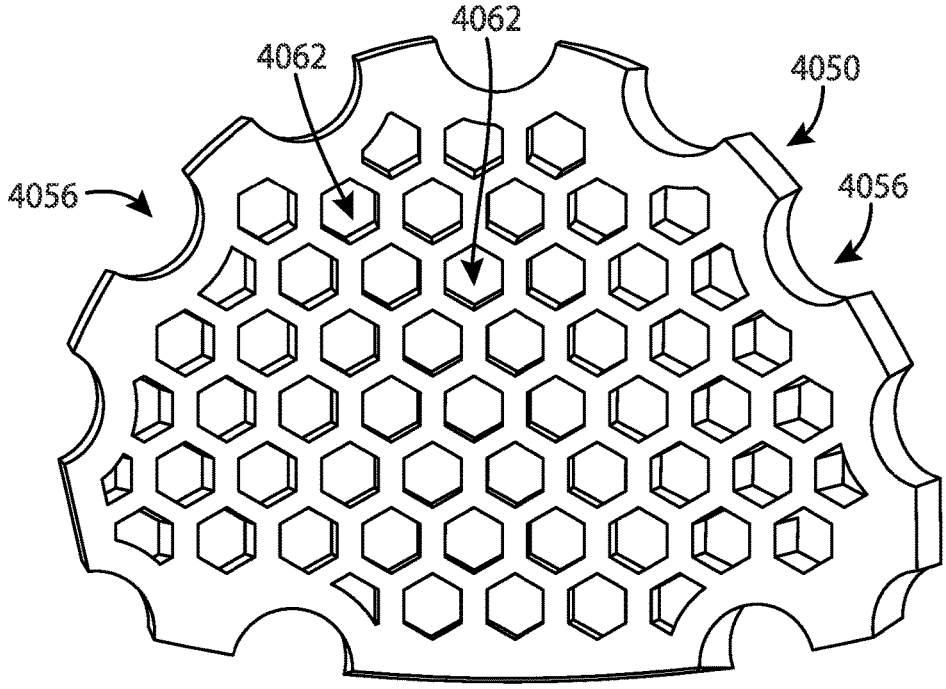
FIG. 40 depicts a perspective view of an elastic polymer insert according to an embodiment of the apparatus, methods, and articles of manufacture described herein.
Figure 41:
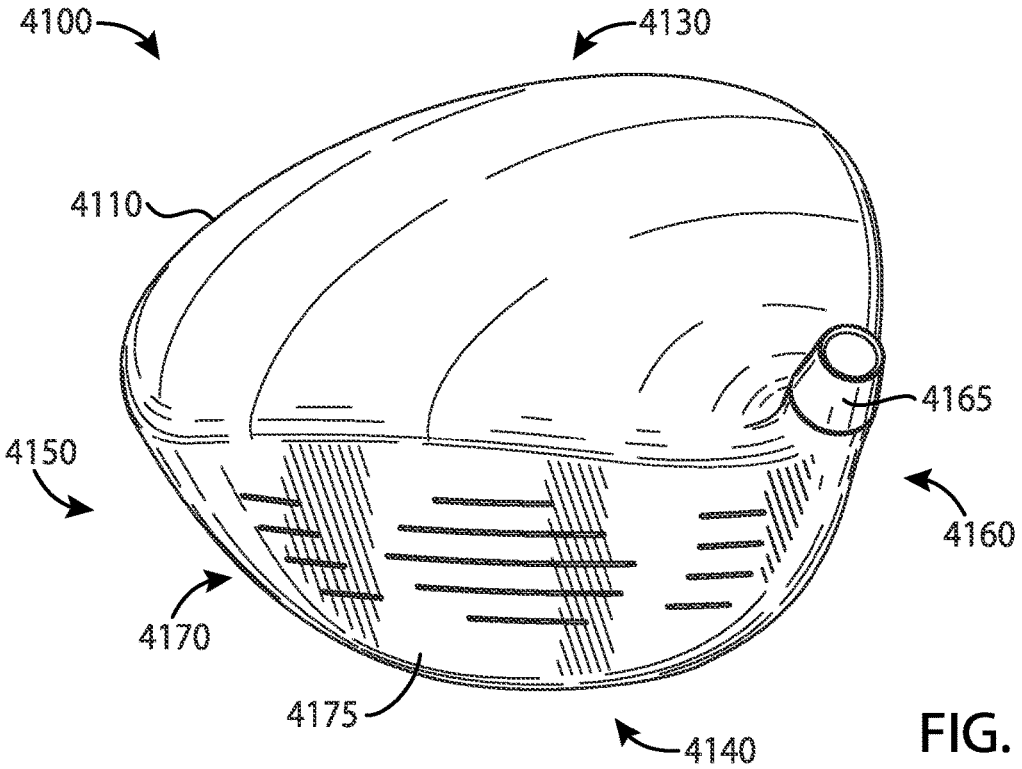
FIG. 41 is top perspective view of an example golf club head according to an embodiment of the apparatus, methods, and articles of manufacture described herein.
Figure 42:
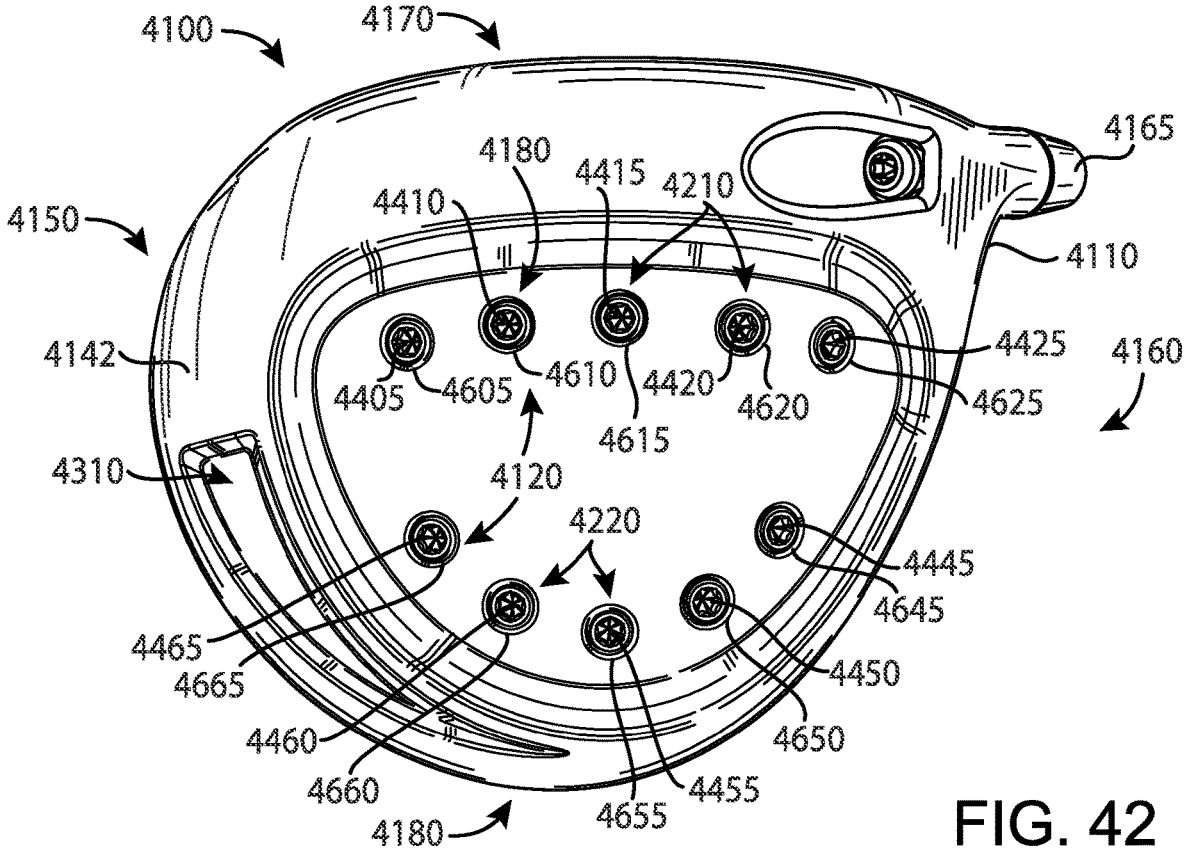
FIG. 42 depicts a bottom view of the example golf club head of FIG. 41.
Figure 96:
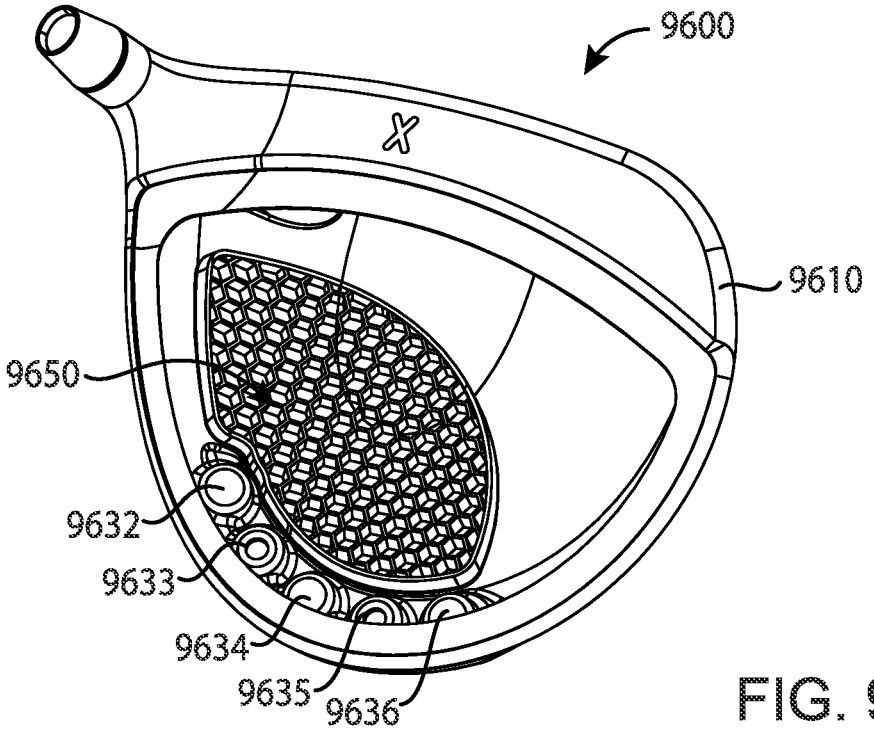
FIG. 96 is top perspective view of an example golf club head prior to attachment of a crown portion and according to an embodiment of the apparatus, methods, and articles of manufacture described herein.

Any of the inserts described herein may be manufactured from an elastic polymer material as a one-piece continuous part. In the example of FIG. 39, the insert 3950 may be a one-piece continuous part without any recesses and/or holes. FIG. 40 illustrates an insert 4050 that is similar in many respects to the insert 3950. Accordingly, in one example, the insert 4050 may be manufactured to have a similar shape as the shape of the region 3954 on the inner surface 2344 of the bottom portion 2340 of the golf club head 23 of FIG. 39 and further include a plurality of cutout portions 4056 similar to the cutout portions 3956, 3958 and 3959 as described herein. The insert 4050 further includes a plurality of holes 4062 that may reduce the weight of the insert 4050 and/or the amount of material used for the construction of the insert 4050. The insert 4050 may include any number of holes 4062 arranged in any configuration on the insert 4050. In the example of FIG. 40, the insert 4050 includes a plurality of hexagonal holes 4062 that extend through the thickness of the insert 4050 and are arranged on the insert 4050 to define a pattern similar to a honeycomb pattern. The holes 4062 may have any shape or spacing. Although the above example may describe holes having a particular shape, the apparatus, methods, and articles of manufacture described herein may include holes of other suitable shapes (e.g., circular, triangular, octagonal, or other suitable geometric shape). Further, the holes 4062 may be similar or different in shape, size and/or arrangement on the insert 4050. In one example, the insert 4050 may include a plurality of round holes (not shown). In another example, the insert 4050 may include a plurality of slots, grooves and/or slits (not shown). In yet another example, the insert 4050 may include recesses (not shown) that do not extend through the insert 4050. In the example in FIG. 96, a golf club head 9600 is shown prior to attachment of a crown portion to a body portion 9610. An insert 9650 is provided within an interior region of the golf club head. The insert 9650 may be formed from elastic polymer material or an elastomer material (i.e., filler material) as described herein. The apparatus, methods, and articles of manufacture described herein are not limited in this regard.

Figure 97:
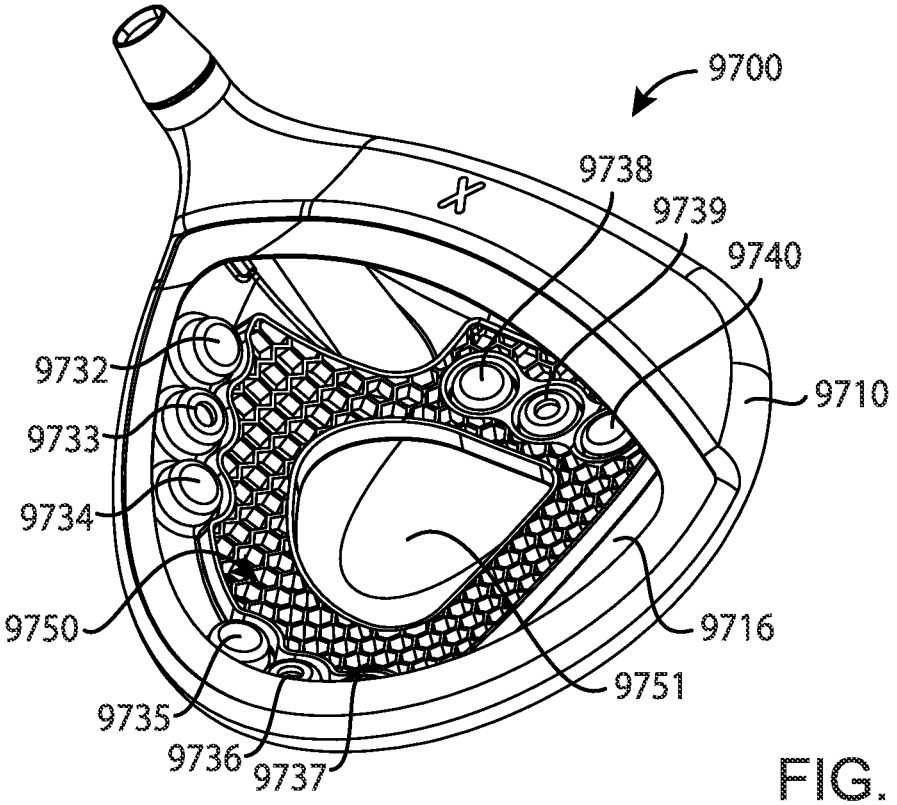
FIG. 97 is top perspective view of an example golf club head prior to attachment of a crown portion and according to an embodiment of the apparatus, methods, and articles of manufacture described herein.

In the example in FIG. 97, a golf club head 9700 is shown prior to attachment of a crown portion to a body portion 9710. An insert 9750 is provided within an interior region of the golf club head 9700. The insert 9750 may dampen vibrations within the golf club head 9700 resulting from impact with a golf ball, which may improve sound or feel perceived by an individual. The insert 9750 may be formed from elastic polymer material or an elastomer material (i.e., filler material) as described herein. The insert 9750 may include a central opening 9751. The central opening 9751 may improve weight distribution of the insert within the golf club head. The size and location of the central opening 9751 in the insert 9650 may increase MOI of the golf club head 9700 by reducing weight in a central sole region of the golf club head 9600. The central opening 9751 may have an area that is greater than or equal to about 10% of a total interior surface area 9716 of a sole portion of the golf club head. The central opening 9751 may have an area that is greater than or equal to about 15% of a total interior surface area 9716 of a sole portion of the golf club head. The central opening 9751 may have an area that is greater than or equal to about 20% of a total interior surface area 9716 of a sole portion of the golf club head. The central opening 9751 may have an area that is greater than or equal to about 25% of a total interior surface area 9716 of a sole portion of the golf club head. The insert 9750 may be adjacent to one or more of the weight ports (e.g. 9732-9740). The insert 9750 may surround one or more of the weight ports (e.g. 9732-9740). The insert 9750 may surround the first set of weight ports (e.g. 9738-9740). The insert 9750 may abut the second set of weight ports (e.g. 9732-9734). The insert 9750 may abut the third set of weight ports (e.g. 9735-9737). The apparatus, methods, and articles of manufacture described herein are not limited in this regard.

Any of the filler materials and or inserts described herein may be an elastic polymer or elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), and/or other suitable types of materials to absorb shock, isolate vibration, and/or dampen noise. In another example, the filler material may be a high density ethylene copolymer ionomer, a fatty acid modified ethylene copolymer ionomer, a highly amorphous ethylene copolymer ionomer, an ionomer of ethylene acid acrylate terpolymer, an ethylene copolymer comprising a magnesium ionomer, an injection moldable ethylene copolymer that may be used in conventional injection molding equipment to create various shapes, an ethylene copolymer that can be used in conventional extrusion equipment to create various shapes, and/or an ethylene copolymer having high compression and low resilience similar to thermoset polybutadiene rubbers. For example, the ethylene copolymer may include any of the ethylene copolymers associated with DuPont™ High-Performance Resin (HPF) family of materials (e.g., DuPont™ HPF AD1172, DuPont™ HPF AD1035, DuPont® HPF 1000 and DuPont™ HPF 2000), which are manufactured by E.I. du Pont de Nemours and Company of Wilmington, Del. The DuPont™ HPF family of ethylene copolymers are injection moldable and may be used with conventional injection molding equipment and molds, provide low compression, and provide high resilience. The apparatus, methods, and articles of manufacture described herein are not limited in this regard.

The filler material including any of the inserts that may be manufactured from the filler material as described herein may be bonded, attached and/or connected to any of the golf club heads described herein by a bonding portion (not shown) to improve adhesion and/or mitigate delamination between the body portion of any of the golf club heads described herein and the filler material. The bonding portion may be a bonding agent, an epoxy, a combination of bonding agents, a bonding structure or attachment device, a combination of bonding structures and/or attachment devices, and/or a combination of one or more bonding agents, one or more bonding structures and/or one or more attachment devices. In one example, the bonding portion may be low-viscosity, organic, solvent-based solutions and/or dispersions of polymers and other reactive chemicals such as MEGUM™, ROBOND™, and/or THIXON™ materials manufactured by the Dow Chemical Company, Auburn Hills, Mich. In another example, the bonding portion may be LOCTITE® materials manufactured by Henkel Corporation, Rocky Hill, Conn. The apparatus, methods, and articles of manufacture are not limited in this regard.

In the example of FIGS. 41-47, a golf club head 4100 may include a body portion 4110 with a top portion 4130, a bottom portion 4140, a toe portion 4150, a heel portion 4160, a front portion 4170, and a rear portion 4180. The bottom portion 4140 may include a skirt portion (not shown) defined as a side portion of the golf club head 4100 between the top portion 4130 and the bottom portion 4140 excluding the front portion 4170 and extending across a periphery of the golf club head 4100 from the toe portion 4150, around the rear portion 4180, and to the heel portion 4160. The bottom portion 4140 may include a transition region 4230 and a weight port region 4240. The transition region 4230 may be defined by a groove or a channel on the bottom portion 4140. Further, the transition region 4230 may define the boundary of the weight port region 4240. The front portion 4170 may include a face portion 4175 to engage a golf ball (not shown). The body portion 4110 may also include a hosel portion 4165 that may be similar in many respects to any of the hosel portions described herein. Alternatively, the body portion 4110 may include a bore instead of the hosel portion 4165. The body portion 4110 may be made partially or entirely from any of the materials described herein. Further, the golf club head 4100 may be any type of golf club head having a club head volume similar to the club head volume of any of the golf club heads described herein. The apparatus, methods, and articles of manufacture described herein are not limited in this regard.

The body portion 4110 may include a plurality of weight portions 4120 (FIG. 42), generally, shown as a first set of weight portions 4210 (generally shown as weight portions 4405, 4410, 4415, 4420 and 4425) and a second set of weight portions 4220 (generally shown as weight portions 4445, 4450, 4455, 4460 and 4465). The weight port region 4240 may have a shape similar to the weight port regions of any of the golf club heads described herein. The weight port region 4240 may include a plurality of weight ports 4600 (generally shown as weight ports 4605, 4610, 4615, 4620, 4625, 4645, 4650, 4655, 4660 and 4665) to receive the plurality of weight portions 4120. The characteristics (e.g., density, shape, volume, size, color, dimensions, depth, diameter, materials of construction, mass, method of formation, etc.), location on the golf club head (e.g., location relative to the periphery of the golf club head and/or location relative to other weight portions and/or weight ports), and/or any other properties of each weight portion of the plurality of weight portions 4120 and each weight port of the plurality of weight ports 4600 may be similar in many respects to each weight portion and weight port, respectively, of any of the golf club heads described herein. The apparatus, methods, and articles of manufacture described herein are not limited in this regard.

The outer surface 4142 and/or the inner surface 4144 of the bottom portion 4140 may include one or a plurality of support portions similar to any of the inner or outer support portions described herein. The outer surface 4142 may include at least one outer support portion 4310. The outer support portion 4310 may be similar in many respects including the function thereof to the outer support portion 3110 of the golf club head 2300. The apparatus, methods, and articles of manufacture described herein are not limited in this regard.

The inner surface 4144 may include an inner support portion 4320, which may be also referred to herein as the inner wall portion 4320. The inner support portion 4320 may include a wall, a rib and/or any projection extending from the inner surface 4144 of the bottom portion 4140. The inner support portion 4320 may extend around some or all of the weight ports 4600 to partially or fully surround the weight ports 4600. In the example of FIGS. 41-47, the inner support portion 4320 fully surrounds the weight ports 4600. Accordingly, the inner support portion 4320 may define an inner port region 4325 on the inner surface 4144 of the bottom portion 4140. The inner support portion 4320 may structurally support the bottom portion 4140 by distributing the impact loads exerted on the bottom portion 4140 throughout the bottom portion 4140 when the golf club head 100 strikes a golf ball (not shown). While the above examples may depict a particular inner support portion, the bottom portion 4140 may include additional inner support portions and/or any type of support portions (not shown). The apparatus, methods, and articles of manufacture described herein are not limited in this regard.

The width (i.e., thickness), length, height, orientation angle, and/or cross-sectional shape of the inner support portion 4320 may be similar or vary along the length of the inner support portion 4320 and be configured to provide structural support to the golf club head 4100. For example, characteristics of the body portion 4110 and/or the bottom portion 4140 including the materials from which the bottom portion 4140 and/or the body portion 4110 is constructed may determine the width, length, height, orientation angle, and/or cross-sectional shape of the inner support portion 4320 along the length of the inner support portion 4320. In one example, the inner support portion 4320 may be defined by a wall having a height that may be similar to the depths of the weight portions 4600. In another example, the inner support portion 4320 may be defined by a wall having a height that may be greater than the depths of the weight portions 4600. In yet another example, the inner support portion 4320 may be defined by a wall having a height that may be smaller than the depths of the weight portions 4600. The apparatus, methods, and articles of manufacture described herein are not limited in this regard.

Figure 45:
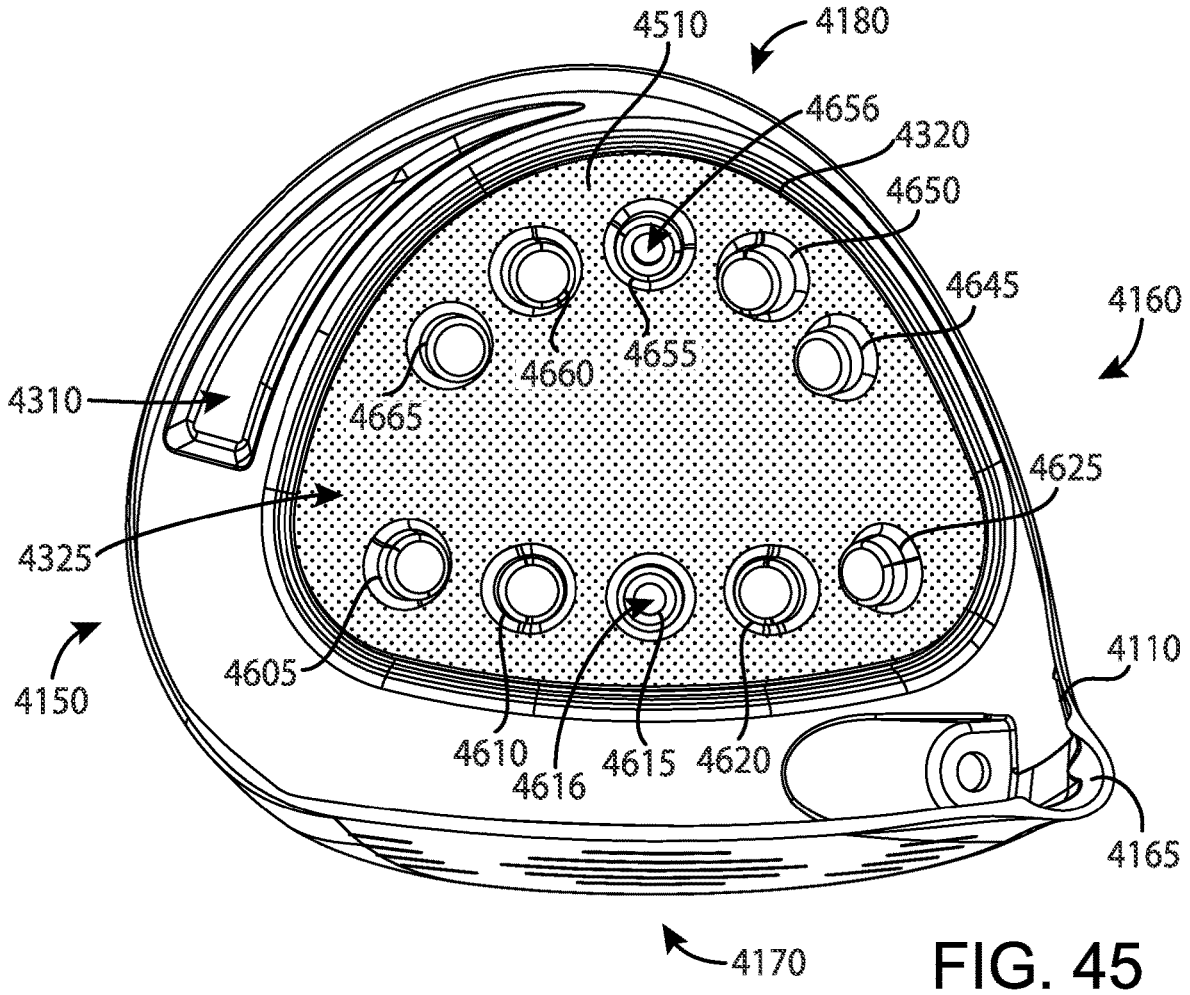
FIG. 45 depicts a top perspective cross-sectional view of an example of the golf club head of FIG. 41 taken at section line 44-44 of FIG. 43 according to an embodiment of the apparatus, methods, and articles of manufacture described herein.

In one example shown in FIG. 45, certain regions of the interior of the body portion 4110 of the golf club head 4100 may include an elastic polymer material or an elastomer material, which may be referred to herein as the filler material 4510. The filler material 4510 may dampen vibration, dampen noise, lower the center of gravity and/or provide a better feel and sound for the golf club head 4100 when striking a golf ball (not shown). According to one example, the inner port region 4325, which may be defined by the inner surface 4144 of the bottom portion 4140 and the inner support portion 4320, may partially or fully include the filler material 4510. The filler material 4510 may extend from the inner surface 4144 of the bottom portion 4140 up to the height of the inner support portion 4320. However, the filler material 4510 may extend below or above the inner support portion 4320. Accordingly, if the height of the inner support portion 4320 is greater than or equal to the depth of the weight ports 4600, the weight ports 4600 may be surrounded and/or covered by the filler material 4510, respectively, which may provide vibration dampening, noise dampening, and/or a better feel and sound for the golf club head 4100 when striking a golf ball (not shown). The apparatus, methods, and articles of manufacture described herein are not limited in this regard.

The height or thickness of the filler material 4510 in the inner port region 4325 may be constant or may vary. In one example, the thickness of the filler material 4510 may be greater around a center portion of the inner port region 4325 than at one or more perimeter portions of the inner port region 4325. In another example, the thickness of the filler material 4510 may be less around a center portion of the inner port region 4325 than at one or more perimeter portions of the inner port region 4325. In yet another example, the thickness of the filler material 4510 may be greater at or around the weight ports 4600 than at other locations of the inner port region 4325. In one example, the entire inner port region 4325 may be filled with a filler material 4510. In another example, only portions of the inner port region 4325 may be filled with a filler material 4510. Accordingly, some of the weight ports 4600 may not be partially or fully surrounded and/or covered with the filler material 4510. The apparatus, methods, and articles of manufacture described herein are not limited in this regard.

Any of the golf club heads described herein, including the golf club head 4100, may have one or more interior regions that may include a filler material as described herein. In one example, the filler material 4510 may be injected into the inner port region 4325 of the body portion 4110 from one or more of the weight ports 4600. In the example of FIGS. 41-47, each of the weight ports 4615 and 4655 may include an opening 4616 and 4656, respectively, into the inner port region 4325 or the interior of the body portion 4110. Accordingly, the openings 4616 and 4656 may be used to inject the filler material 4510 into the inner port region 4325. In one example, one of the openings 4616 or 4656 may be used to inject filler material into inner port region 4325, while the other opening 4656 or 4616, respectively, may be used for the air that is displaced by the filler material injected into the body portion 4110 to escape. The inner support portion 4320 may provide a boundary or a holding perimeter for the filler material 4510 when the filler material 4510 is injected into the body portion 4110. The filler material 4510 may be injected into the inner port region 4325 until the height of the filler material 4510 is similar, substantially similar, or greater than to the height of the inner support portion 4320. Accordingly, the filler material may be molded to the shape of the inner port region 4325. Alternatively, the inner port region 4325 may be partially filled with the filler material 4510. The apparatus, methods, and articles of manufacture described herein are not limited in this regard.

Figure 46:
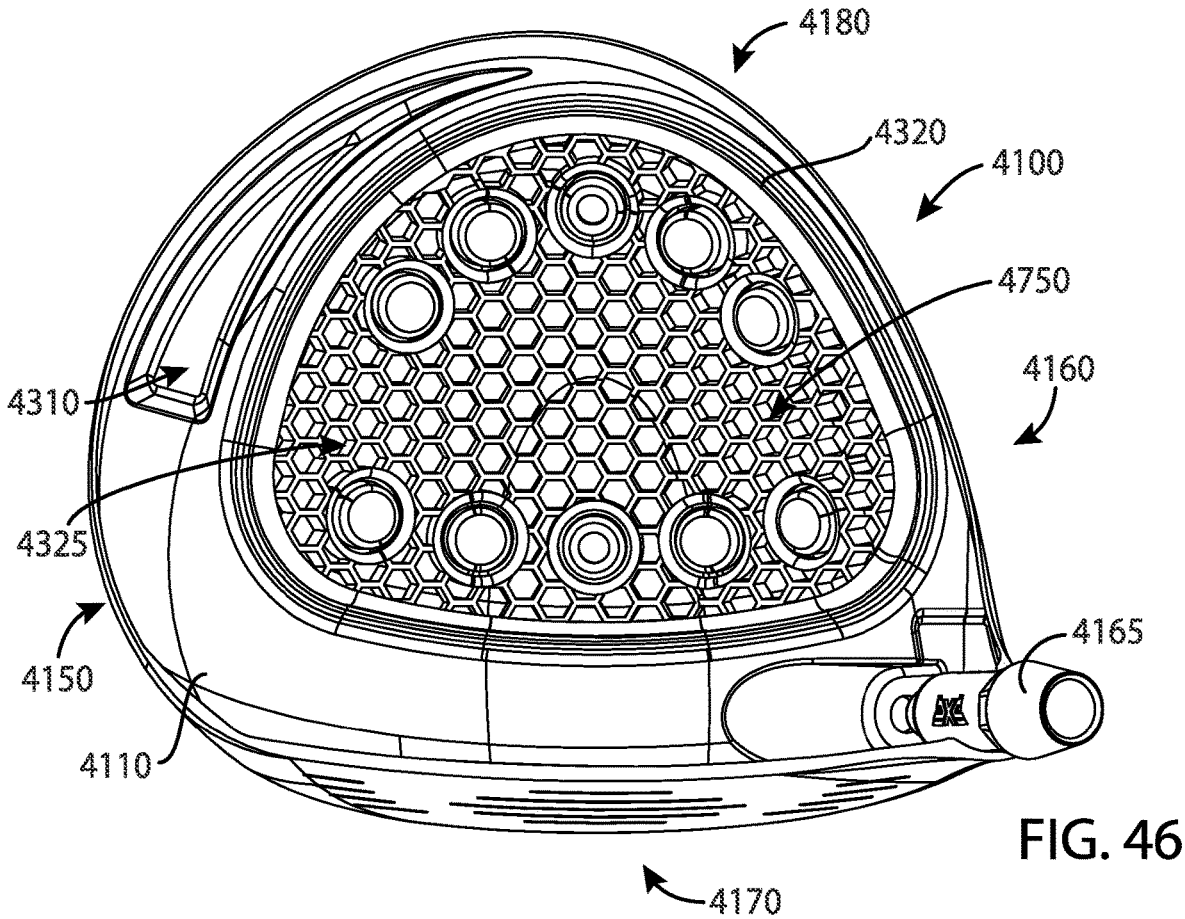
FIG. 46 depicts a top perspective cross-sectional view an example of the golf club head of FIG. 41 taken at section line 44-44 of FIG. 43 according to an embodiment of the apparatus, methods, and articles of manufacture described herein.

Alternatively, one or more inserts may be formed from an elastic polymer material or an elastomer material (e.g., filler material) and placed in one or more regions of the interior of golf club head. FIG. 46 shows an example of the golf club head 4100 of FIG. 41 with an insert 4750, which may be constructed from an elastic polymer material or an elastomer material. The insert 4750 may be manufactured to have a similar shape as the shape of the inner port region 4325. Accordingly, the insert 4750 may have a curvature similar to the curvature of the bottom portion 4140 at the inner port region 4325 to lay generally flat and in contact with the inner surface 4144 of the bottom portion 4140. The insert 4750 may have a shape that may be similar to the shape of the inner port region 4325 to be inserted in the inner port region 4325 and generally fit within the inner port region 4325. Further, the insert 4750 may be surrounded and/or in contact with the inner support portion 4320. The inner support portion 4320 may engage all or portions of the perimeter of the insert 4750 to assist in maintaining the insert in the inner port region 4325 or maintain the insert in the inner port region 4325. The insert 4750 may have a plurality of cutout portions 4756 to generally match the shape and/or contour of the sidewall portions of each of the weight ports 4600. Accordingly, when the insert 4750 is placed in the inner port region 4325, each port of the plurality of weight ports 4600 is received in a corresponding cutout portion 4756. The apparatus, methods, and articles of manufacture described herein are not limited in this regard.

The insert 4750 may have a thickness that may be similar or substantially similar to the height of any of the weight ports 4600. Accordingly, when the insert 4750 is in the inner port region 4325, the top portion of the insert 4750 at or proximate to the weight ports 4600 may be at the same or substantially the same height as the weight ports 4600. However, the thickness of the insert 4750 may vary such that the thickness of the insert 4750 at any location of the insert 4750 may be more or less than the height of any of the weight ports 4600. The insert 4750 may dampen vibration, dampen noise, lower the center of gravity and/or provide a better feel and sound for the golf club head 4100 when striking a golf ball (not shown). The apparatus, methods, and articles of manufacture described herein are not limited in this regard.

Figure 47:
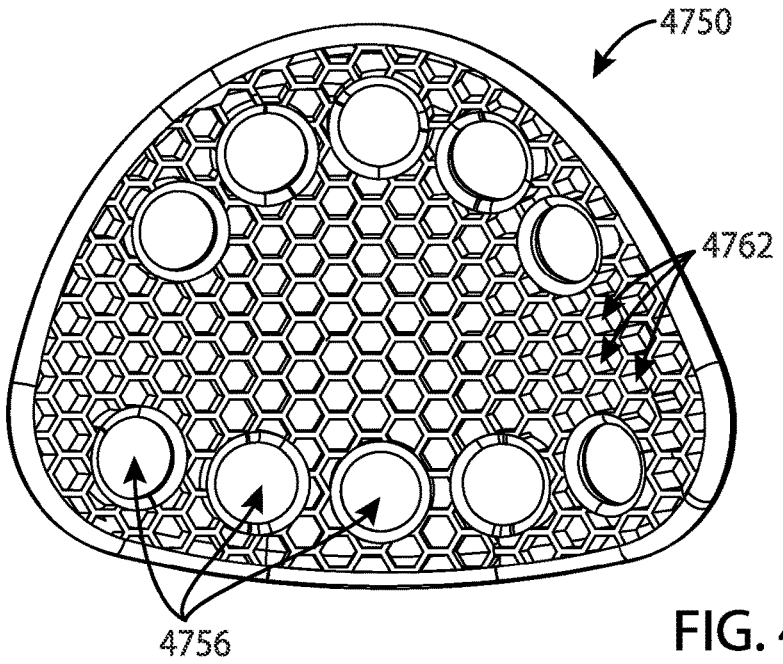
FIG. 47 depicts a perspective view of an elastic polymer insert according to an embodiment of the apparatus, methods, and articles of manufacture described herein.

Any of the inserts described herein may be manufactured from an elastic polymer material as a one-piece continuous part. The insert 4750 may be a one-piece continuous part without any recesses and/or holes. According to the example shown in FIG. 47, the insert 4750 may include a plurality of holes 4762 that may reduce the weight of the insert 4750. The insert 4750 may include any number of holes 4762 arranged in any configuration on the insert 4750. In the example of FIG. 47, the insert 4750 includes a plurality of hexagonal holes 4762 that extend through the thickness of the insert 4750 and are arranged on the insert 4750 to define a pattern that is similar to a honeycomb pattern. The holes 4762 may have any shape or spacing. Although the above example may describe holes having a particular shape, the apparatus, methods, and articles of manufacture described herein may include holes of other suitable shapes (e.g., circular, triangular, octagonal, or other suitable geometric shape). Further, the openings may be similar or different in shape, size and or arrangement on the insert 4750. In one example, the insert 4750 may include a plurality of round holes (not shown). In another example, the insert 4750 may include a plurality of slots, grooves and/or slits (not shown). In yet another example, the insert 4750 may include recesses (not shown) instead of holes that do not extend through the insert 4750. The apparatus, methods, and articles of manufacture described herein are not limited in this regard.

The filler material 4510 and or the insert 4750 may be manufactured from any of the materials described herein. The filler material 4510 or the insert 4750 may be bonded, attached and/or connected to the body portion 4110 of the golf club head 4100 by a bonding portion (not shown) to improve adhesion and/or mitigate delamination between the body portion 4110 and the filler material 4510 or the insert 4750. Further, as described herein, the inner support portion 4320 may engage the insert 4750 to partially or fully maintain the insert 4750 in the inner port region 4325. In one example, the insert 4750 may be maintained in the inner port region 4325 by frictionally engaging the inner support portion 4320 and/or a bonding portion bonding the insert 4750 to the inner support portion 4320 and/or the inner surface 4144 of the bottom portion 4140. The bonding portion may be any of the bonding portions described herein such as a bonding agent, an epoxy, a combination of bonding agents, a bonding structure or attachment device, a combination of bonding structures and/or attachment devices, and/or a combination of one or more bonding agents, one or more bonding structures and/or one or more attachment devices. The apparatus, methods, and articles of manufacture described herein are not limited in this regard.

In the example of FIGS. 48-55, a golf club head 4800 may include a body portion 4810 with a top portion 4830 having a crown portion 4835, a bottom portion 4840, a toe portion 4850, a heel portion 4860, a front portion 4870, and a rear portion 4880. The bottom portion 4840 may include a skirt portion (not shown) defined as a side portion of the golf club head 4800 between the top portion 4830 and the bottom portion 4840 excluding the front portion 4870 and extending across a periphery of the golf club head 4800 from the toe portion 4850, around the rear portion 4880, and to the heel portion 4860. The front portion 4870 may include a face portion 4875 to engage a golf ball (not shown). The body portion 4810 may also include a hosel portion 4865 that may be similar in many respects to any of the hosel portions described herein. Alternatively, the body portion 4810 may include a bore instead of the hosel portion 4865. The body portion 4810 may be made partially or entirely from any of the materials described herein. Further, the golf club head 4800 may be any type of golf club head having a club head volume similar to the club head volume of any of the golf club heads described herein. The apparatus, methods, and articles of manufacture described herein are not limited in this regard.

The crown portion 4835 may be a separately formed piece that may be attached to the top portion 4830. The crown portion 4835 may be constructed from one or more different materials than the body portion 4810. In one example (not shown), the crown portion 4835 may be at least partially constructed from a composite material such as a graphite-based composite material. In another example (not shown), the crown portion 4835 may include two outer layers constructed from a composite material, such as a graphite epoxy composite material, and an inner layer constructed from an elastic polymer material. The apparatus, methods, and articles of manufacture described herein are not limited in this regard.

The bottom portion 4840 may include a plurality of weight port regions, which are shown for example as a first weight port region 4910, a second weight port region 4920 and a third weight port region 4930. The first weight port region 4910 may be near the heel portion 4860 or be closer to the heel portion 4860 than the toe portion 4850 and include a first set of weight ports 4911 (generally shown as weight ports 4912, 4914 and 4916). The second weight port region 4920 may be near the front portion 4870 or be closer to the front portion 4870 than the rear portion 4880 and include a second set of weight ports 4921 (generally shown as weight ports 4922, 4924 and 4926). The third weight port region 4930 may be near the rear portion 4880 or be closer to the rear portion 4880 than the front portion 4870 and include a third set of weight ports 4931 (generally shown as weight ports 4932, 4934 and 4936). The bottom portion may include more than three weight port regions or less than three weight port regions with each weight port region including any number of weight ports. The body portion 4810 may include a plurality of weight portions, shown as a first set of weight portions 4960 (generally shown as weight portions 4962, 4964, and 4966), a second set of weight portions 4970 (generally shown as weight portions 4972, 4974, and 4976), and a third set of weight portions 4980 (generally shown as weight portions 4982, 4984 and 4986). Each weight port may receive a weight portion similar to any of the golf club heads described herein. In one example, one or more weight ports may not include weight portions. The characteristics (e.g., density, shape, volume, size, color, dimensions, depth, diameter, materials of construction, mass, method of formation, etc.) and/or any other properties of each weight portion of the plurality of weight portions and each weight port of the plurality of weight ports may be similar in many respects to each weight portion and weight port, respectively, of any of the golf club heads described herein. In one example, the weight ports and the weight portions of the golf club head of FIGS. 48-55 may have greater dimensions (i.e., length, width, diameter, depth, etc.) than any of the weight ports and/or weight portions, respectively, described herein. The apparatus, methods, and articles of manufacture described herein are not limited in this regard.

The weight portions of the first set of weight portions 4960, the second set of weight portions 4970 and/or the third set of weight portions 4980 may have similar or different masses. In one example, the overall mass of the first set of weight portions 4960 may be greater than the overall mass of the second set of weight portions 4970 and/or the third set of weight portions 4980. In another example, the overall mass of the second set of weight portions 4970 may be greater than the overall mass of the first set of weight portions 4960 and/or the third set of weight portions 4980. In yet another example, the overall mass of the third set of weight portions 4980 may be greater than the overall mass of the second set of weight portions 4970 and/or the first set of weight portions 4960. The masses of the weight portions in each of the first set of weight portion 4960, the second set of weight portions 4970 and/or the third set of weight portions 4980 may be similar or different. Accordingly, by using weight portions having similar or different masses in each of the weight port regions 4910, 4920 and/or 4930, the overall mass in each weight port region and/or the mass distribution in each weight port region may be adjusted to generally optimize and/or adjust the swing weight, center of gravity, moment of inertia, and/or an overall feel of the golf club head for an individual using the golf club head 4800. The apparatus, methods, and articles of manufacture described herein are not limited in this regard.

The outer surface 4842 and/or the inner surface 4844 of the bottom portion 4840 may include one or more inner support portions (not shown) and/or one or more outer support portion (not shown) similar to any of the inner support portions and the outer support portions described herein. The apparatus, methods, and articles of manufacture described herein are not limited in this regard.

Certain regions of the interior of the body portion 4810 may include an elastic polymer material or an elastomer material similar to any of the golf club heads described herein. The filler material may dampen vibration, dampen noise, lower the center of gravity and/or provide a better feel and sound for the golf club head 4800 when striking a golf ball (not shown). The golf club head 4800, may have one or more interior regions that may include a filler material as described herein. In one example, the filler material may be injected into the body portion 4810 from one or more of the weight ports as described herein. In the example of FIGS. 48-55, each of the weight ports 4924 and 4934 may include an opening 4925 and 4935, respectively, into the interior of the body portion 4810. Accordingly, the openings 4925 and/or 4935 may be used to inject the filler material into the body portion 4810. In one example, one of the openings 4925 or 4935 may be used to inject filler material into the body portion 4810, while the other opening 4935 or 4925, respectively, may be used for the air that is displaced by the filler material injected into the body portion 4810 to escape. The body portion may include one or more inner support portions (not shown) similar to any of the inner support portions described herein that may provide a boundary or a holding perimeter for the filler material when the filler material is injected into the body portion 4810. The filler material may be injected into the body portion 4810 until the height of the filler material is similar, substantially similar, or greater than to the height of one or of the weight ports of the first set of weight ports 4911, second set of weight ports 4921 and/or third set of weight ports 4931. Accordingly, the filler material may be molded to the shape of one or more portions of the bottom portion 4840 or the entire bottom portion 4840. The apparatus, methods, and articles of manufacture described herein are not limited in this regard.

Figure 55:
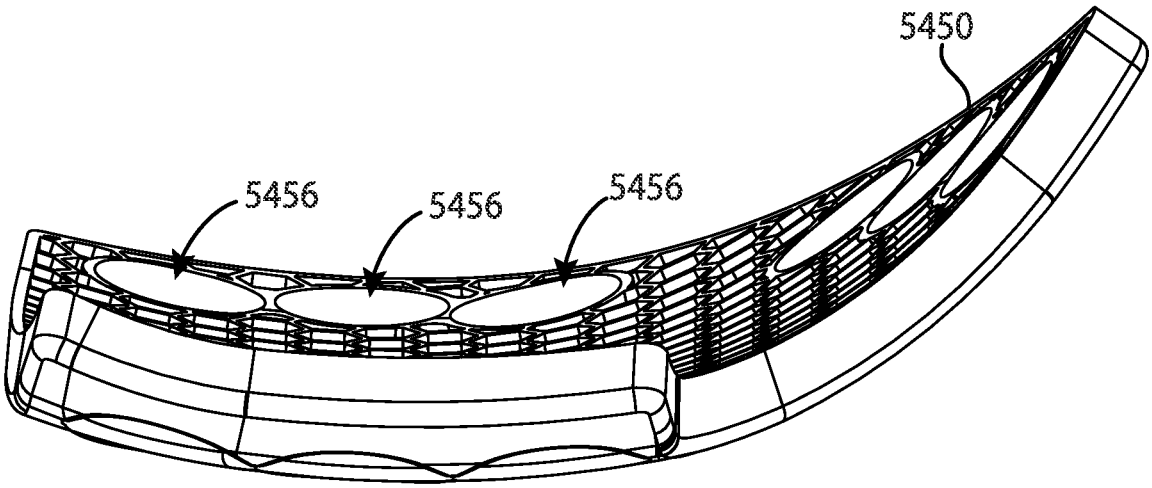
FIG. 55 depicts a side perspective view of the elastic polymer insert of FIG. 54.
Figure 56:
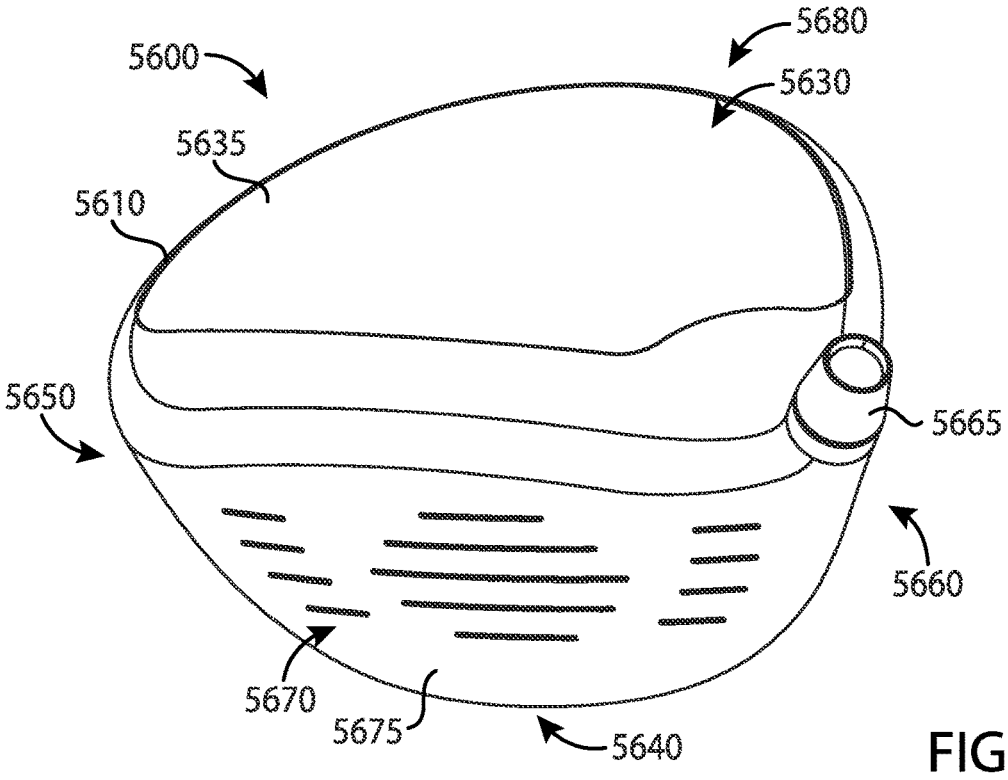
FIG. 56 is a top perspective view of an example golf club head according to an embodiment of the apparatus, methods, and articles of manufacture described herein.

Alternatively, one or more inserts may be formed from an elastic polymer material or an elastomer material (e.g., filler material) and placed in one or more regions of the interior of golf club head 4800. FIGS. 52-55 show an example of the golf club head 4800 of FIG. 48 with an insert 5450, which may be constructed from an elastic polymer material or an elastomer material. The insert 5450 may be manufactured to have a similar shape as the shape of all or portions of the inner surface 4844 of the bottom portion 4840. Accordingly, as shown in FIG. 55, the insert 5450 may have a curvature similar to the curvature of the bottom portion 4840 so as to lay generally flat and in contact with the inner surface 4844 of the bottom portion 4840. The insert 5450 may be partially and/or fully surrounded and/or in contact with any inner support portions (not shown) on the inner surface 4844 of the body portion 4810. The insert 5450 may have a plurality of cutout portions 5456 to generally match the shape and/or contour of the sidewall portions of each of the weight ports of the first set of weight ports 4911, second set of weight ports 4921 and/or third set of weight ports 4931. Accordingly, when the insert 5450 is placed on the inner surface 4844 of the bottom portion 4840, each port of the plurality of weight ports is received in a corresponding cutout portion 5456. Each weight port extending through a corresponding cutout portion 5456 may assist in maintaining the position of the insert 5450 on the inner surface 4844 of the bottom portion 4840. The apparatus, methods, and articles of manufacture described herein are not limited in this regard.

Figure 52:
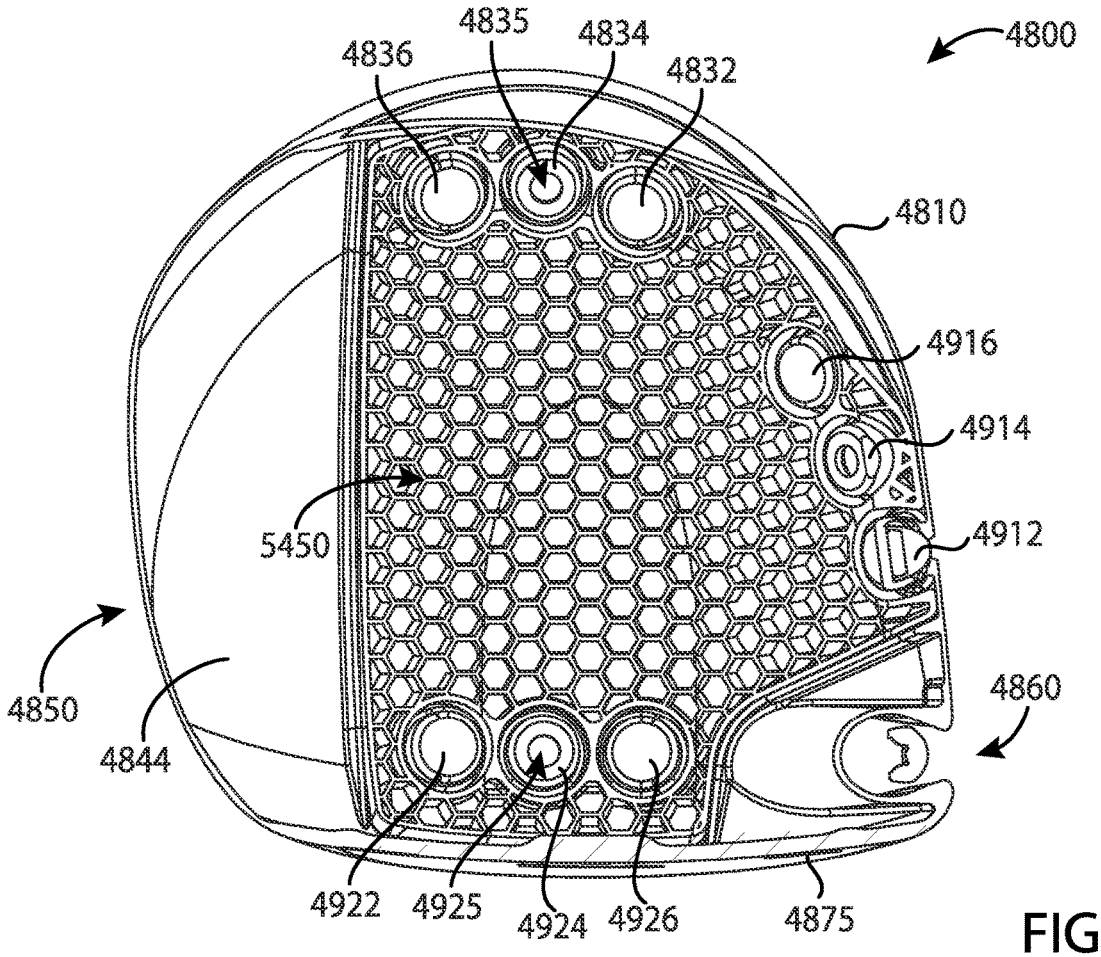
FIG. 52 depicts a top perspective cross-sectional view of the golf club head of FIG. 48 taken at section line 52-52 of FIG. 51.
Figure 53:
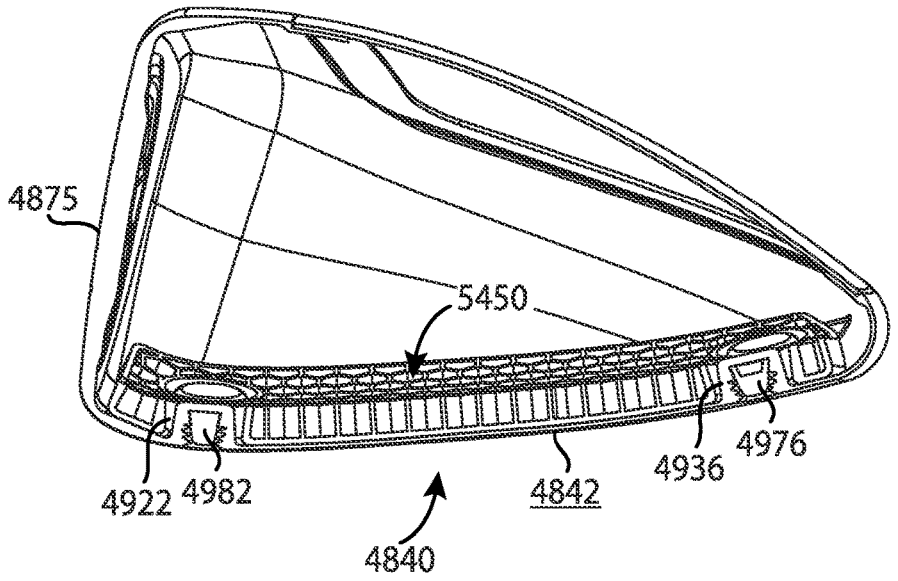
FIG. 53 depicts a top perspective cross-sectional view of the golf club head of FIG. 48 taken at section line 53-53 of FIG. 49.
Figure 54:
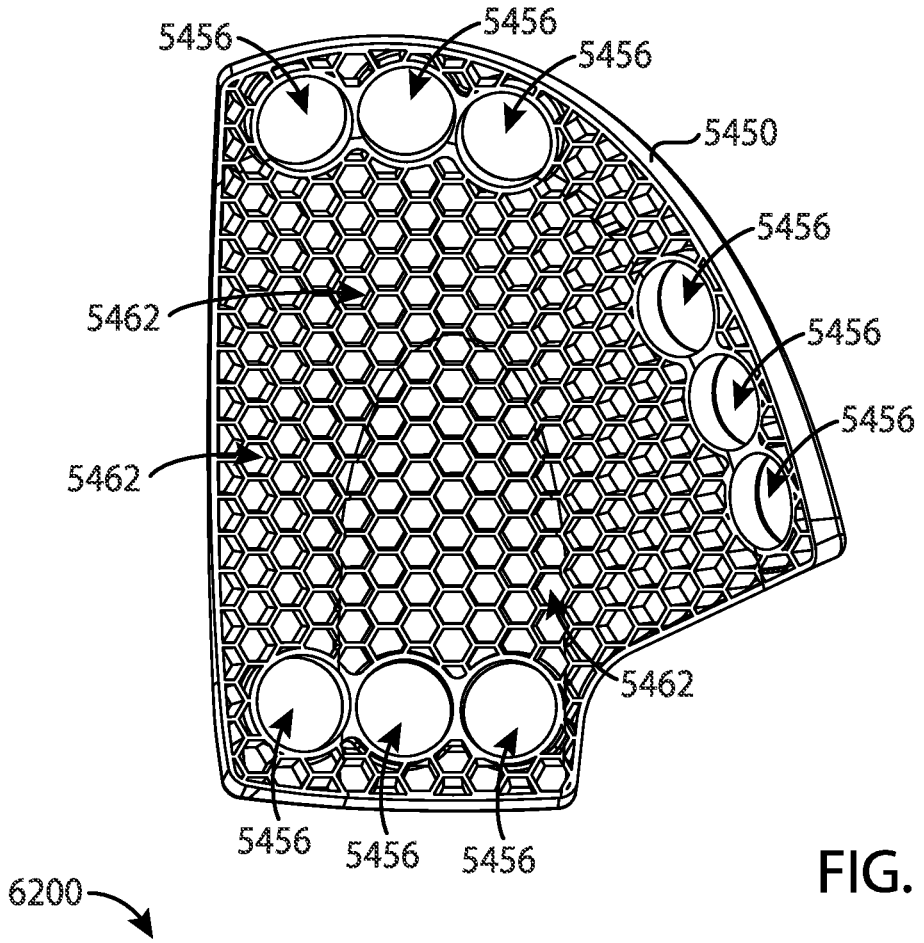
FIG. 54 depicts a top perspective view of an elastic polymer insert according to an embodiment of the apparatus, methods, and articles of manufacture described herein.

The insert 5450 may partially cover and/or fully cover the inner surface 4844 of the bottom portion 4840. In the example of FIGS. 52-55, the insert 5450 extends from the front portion 4870 to the rear portion 4880 and from a location at or near the heel portion 4860 to a location on the inner surface 4844 of the bottom portion 4840 near the toe portion 4850. In one example, the insert 5450 may not extend to the toe portion 4850. In another example (not shown), the insert 5450 may extend to the toe portion 4850. The insert 5450 may cover any portion of the inner surface 4844 of the bottom portion 4840 so that the insert 5450 surrounds and/or contacts all of the weight ports that may be on the bottom portion 4840. For example, as shown in FIG. 52, the insert 5450 extends from the heel portion 4860 until past the weight ports 4922 and 4936 to surround and/or contact all of the weight ports of the first set of weight ports 4911, second set of weight ports 4921 and/or third set of weight ports 4931. Accordingly, the insert 5450 may dampen vibration and/or dampen noise at or around each of the weight ports of the first set of weight ports 4911, second set of weight ports 4921 and/or third set of weight ports 4931 to provide a better feel and sound for the golf club head 4800 when striking a golf ball (not shown). The apparatus, methods, and articles of manufacture described herein are not limited in this regard.

The insert 5450 may have a thickness that may be similar or substantially similar to the height of any of the weight ports of the first set of weight ports 4911, second set of weight ports 4921 and/or third set of weight ports 4931. Accordingly, when the insert 5450 is in contact with the inner surface 4844 of the bottom portion 4840, the top portion of the insert 5450 at or proximate to the weight ports of the first set of weight ports 4911, second set of weight ports 4921 and/or third set of weight ports 4931 may be at the same or substantially the same height as the weight ports of the first set of weight ports 4911, second set of weight ports 4921 and/or third set of weight ports 4931. However, the thickness of the insert 5450 may vary such that the thickness of the insert 5450 at any location of the insert 5450 may be more or less than the height of any of the weight ports of the first set of weight ports 4911, second set of weight ports 4921 and/or third set of weight ports 4931. The insert 5450 may dampen vibration, dampen noise, lower the center of gravity and/or provide a better feel and sound for the golf club head 4800 when striking a golf ball (not shown). The apparatus, methods, and articles of manufacture described herein are not limited in this regard.

Any of the inserts described herein may be manufactured from an elastic polymer material as a one-piece continuous part. The insert 5450 may be a one-piece continuous part without any recesses and/or holes. According to the example shown in FIGS. 52-55, the insert 5450 may include a plurality of holes 5462 that may reduce the weight of the insert 5450. The insert 5450 may include any number of holes 5462 arranged in any configuration on the insert 5450. The insert 5450 includes a plurality of hexagonal holes 5462 that extend through the thickness of the insert 5450 and are arranged on the insert 5450 to define a pattern that is similar to a honeycomb pattern. The holes 5462 may have any shape or spacing. Although the above example may describe holes having a particular shape, the apparatus, methods, and articles of manufacture described herein may include holes of other suitable shapes (e.g., circular, triangular, octagonal, or other suitable geometric shape). Further, the openings may be similar or different in shape, size and or arrangement on the insert 5450. In one example, the insert 5450 may include a plurality of round holes (not shown). In another example, the insert 5450 may include a plurality of slots, grooves and/or slits (not shown). In yet another example, the insert 5450 may include recesses (not shown) instead of holes that do not extend through the insert 5450. The apparatus, methods, and articles of manufacture described herein are not limited in this regard.

The filler material and or the insert 5450 may be manufactured from any of the materials described herein. The filler material or the insert 5450 may be bonded, attached and/or connected to the body portion 4810 of the golf club head 4800 by a bonding portion (not shown) to improve adhesion and/or mitigate delamination between the body portion 4810 and the filler material or the insert 5450. The bonding portion may be any of the bonding portions described herein such as a bonding agent, an epoxy, a combination of bonding agents, a bonding structure or attachment device, a combination of bonding structures and/or attachment devices, and/or a combination of one or more bonding agents, one or more bonding structures and/or one or more attachment devices. Further, one or more inner support portions (not shown) may engage the insert 5450 to partially or fully maintain the position of the insert 5450 similar to any of the golf club heads described herein. The apparatus, methods, and articles of manufacture described herein are not limited in this regard.

In the example of FIGS. 56-61, a golf club head 5600 may include a body portion 5610 with a top portion 5630 having a crown portion 5635, a bottom portion 5640, a toe portion 5650, a heel portion 5660, a front portion 5670, and a rear portion 5680. The bottom portion 5640 may include a skirt portion (not shown) defined as a side portion of the golf club head 5600 between the top portion 5630 and the bottom portion 5640 excluding the front portion 5670 and extending across a periphery of the golf club head 5600 from the toe portion 5650, around the rear portion 5680, and to the heel portion 5660. The front portion 5670 may include a face portion 5675 to engage a golf ball (not shown). The body portion 5610 may also include a hosel portion 5665 that may be similar in many respects to any of the hosel portions described herein. Alternatively, the body portion 5610 may include a bore instead of the hosel portion 5665. The body portion 5610 may be made partially or entirely from any of the materials described herein. Further, the golf club head 5600 may be any type of golf club head having a club head volume similar to the club head volume of any of the golf club heads described herein. The apparatus, methods, and articles of manufacture described herein are not limited in this regard.

The crown portion 5635 may be a separate piece that may be attached to the top portion 5630. The crown portion 5635 may be constructed from one or more different materials than the body portion 5610. In one example (not shown), the crown portion 5635 may be at least partially constructed from a composite material such as a graphite-based composite material. In another example (not shown), the crown portion 5635 may include two outer layers constructed from a composite material, such as a graphite epoxy composite material, and an inner layer constructed from an elastic polymer material. The apparatus, methods, and articles of manufacture described herein are not limited in this regard.

The bottom portion 5640 may include a plurality of weight port regions, which are shown for example as a first weight port region 5710, a second weight port region 5720 and a third weight port region 5730. The first weight port region 5710 may be near the rear portion 5680 or be closer to the rear portion 5680 than the front portion 5670 and include a first set of weight ports 5711 (generally shown as weight ports 5712, 5714 and 5716). The second weight port region 5720 may be near the toe portion 5650 or be closer to the toe portion 5650 than the heel portion 5660 and include a second set of weight ports 5721 (generally shown as weight ports 5722, 5724 and 5726). The third weight port region 5730 may be near the front portion 5670 or be closer to the front portion 5670 than the rear portion 5680 and include a second set of weight ports 5731 (generally shown as weight ports 5732, 5734 and 5736).

The first weight port region 5710 may be wholly located less than or equal to 1.25, 1.0, 0.75, or 0.5 inch from a periphery of the body portion 5610 at or proximate the rear portion 5680. The second weight port region 5720 may be wholly located less than or equal to 1.25, 1.0, 0.75, or 0.5 inch from a periphery of the body portion 5610 at or proximate the toe portion 5650. The third weight port region 5730 may be wholly located less than or equal to 1.25, 1.0, 0.75, or 0.5 inch from a periphery of the body portion 5610 at or proximate the face portion 5675.

The first weight port region 5710 may be partially located less than or equal to 1.25, 1.0, 0.75, or 0.5 inch from a periphery of the body portion 5610 at or proximate the rear portion 5680. The second weight port region 5720 may be partially located less than or equal to 1.25, 1.0, 0.75, or 0.5 inch from a periphery of the body portion 5610 at or proximate the toe portion 5650. The third weight port region 5730 may be partially located less than or equal to 1.25, 1.0, 0.75, or 0.5 inch from a periphery of the body portion 5610 at or proximate the face portion 5675.

The bottom portion 5640 may include more than three weight port regions or less than three weight port regions with each weight port region including any number of weight ports. The body portion 5610 may include a plurality of weight portions, shown as a first set of weight portions 5760 (generally shown as weight portions 5762, 5764, and 5766), a second set of weight portions 5770 (generally shown as weight portions 5772, 5774, and 5776), and a third set of weight portions 5780 (generally shown as weight portions 5782, 5784 and 5786). Each weight port may receive a weight portion similar to any of the golf club heads described herein. In one example, one or more weight ports may not include weight portions. The characteristics (e.g., density, shape, volume, size, color, dimensions, depth, diameter, materials of construction, mass, method of formation, etc.) and/or any other properties of each weight portion of the plurality of weight portions and each weight port of the plurality of weight ports may be similar in many respects to each weight portion and weight port, respectively, of any of the golf club heads described herein. In one example, the weight ports and the weight portions of the golf club head of FIGS. 56-61 may have greater dimensions (i.e., length, width, diameter, depth, etc.) than any of the weight ports and/or weight portions, respectively, described herein. The apparatus, methods, and articles of manufacture described herein are not limited in this regard.

The weight portions of the first set of weight portions 5760, the second set of weight portions 5770 and/or the third set of weight portions 5780 may have similar or different masses. In one example, the overall mass of the first set of weight portions 5760 may be greater than the overall mass of the second set of weight portions 5770 and/or the third set of weight portions 5780. In another example, the overall mass of the second set of weight portions 5770 may be greater than the overall mass of the first set of weight portions 5760 and/or the third set of weight portions 5780. In yet another example, the overall mass of the third set of weight portions 5780 may be greater than the overall mass of the second set of weight portions 5770 and/or the first set of weight portions 5760. The masses of the weight portions in each of the first set of weight portion 5760, the second set of weight portions 5770 and/or the third set of weight portions 5780 may be similar or different. Accordingly, by using weight portions having similar or different masses in each of the weight port regions 5710, 5720 and/or 5730, the overall mass in each weight port region and/or the mass distribution in each weight port region may be adjusted to generally optimize and/or adjust the swing weight, center of gravity, moment of inertia, and/or an overall feel of the golf club head for an individual using the golf club head 5600. The apparatus, methods, and articles of manufacture described herein are not limited in this regard.

A rear vertical plane 5781 may define a rear boundary of the rear portion 5680 of the golf club head 5600. A front vertical plane 5771 may define a front boundary of the front portion 5670 of the golf club head 5600. The rear vertical plane 5781 may be substantially parallel to and offset from the front vertical plane.

One or more of the weight portions of the first set of weight portions 5760 (generally shown as weight portions 5762, 5764, and 5766) may be aligned with and offset from one or more of the weight portions of the second set of weight portions 5770 (generally shown as weight portions 5772, 5774, and 5776). A first weight portion of the first set of weight portions may be aligned with and offset from a first weight portion of the second set of weight portions. A second weight portion of the first set of weight portions may be aligned with and offset from a second weight portion of the second set of weight portions. A third weight portion of the first set of weight portions may be aligned with and offset from a third weight portion of the second set of weight portions.

A center 5705 of the bottom portion 5640 of the golf club head 5600 may be defined as a point located equidistant between the front vertical plane 5771 and the rear vertical plane 5781. The center 5705 may be located on a center vertical plane 5702 that intersects a center of the face portion 5675 of the golf club head 5600, the center vertical plane 5702 being perpendicular to the rear vertical plane 5781 and front vertical plane 5771. The center 5705 may be located on the outer surface 5642 of the bottom portion 5640.

A weight portion 5762 of the first set of weight portions 5760 may be located proximate the center vertical plane 5702 and in the first weight port region 5710. A weight portion 5784 of the third set of weight portions 5780 may be located proximate the center vertical plane 5702 and in the third weight port region 5730.

A weight port of the first set of weight ports 5711 may be located proximate the center vertical plane 5702 and in the first weight port region 5710. A weight port 5734 of the third set of weight ports 5731 may be located proximate the center vertical plane 5702 and in the third weight port region 5730.

A heel-side vertical plane 5701 may be parallel to and offset from the center vertical plane 5702. The heel-side vertical plane 5701 may be offset from the center vertical plane 5702 by about 0.25-0.55 or 0.35-0.75 in. A weight portion 5762 of the first set of weight portions 5760 may be located along the heel-side vertical plane 5701 and in the first weight port region 5710. A weight portion 5782 of the third set of weight portions 5780 may be located along the heel-side vertical plane 5701 and in the third weight port region 5730.

A toe-side vertical plane 5703 may be parallel to and offset from the center vertical plane 5702. The toe-side vertical plane 5703 may be offset from the center vertical plane 5702 by about 0.25-0.55 or 0.35-0.75 in. A weight portion 5766 of the first set of weight portions 5760 may be located along the toe-side vertical plane 5703 and in the first weight port region 5710. A weight portion 5786 of the third set of weight portions 5780 may be located along the toe-side vertical plane 5703 and in the third weight port region 5730.

Figure 57:
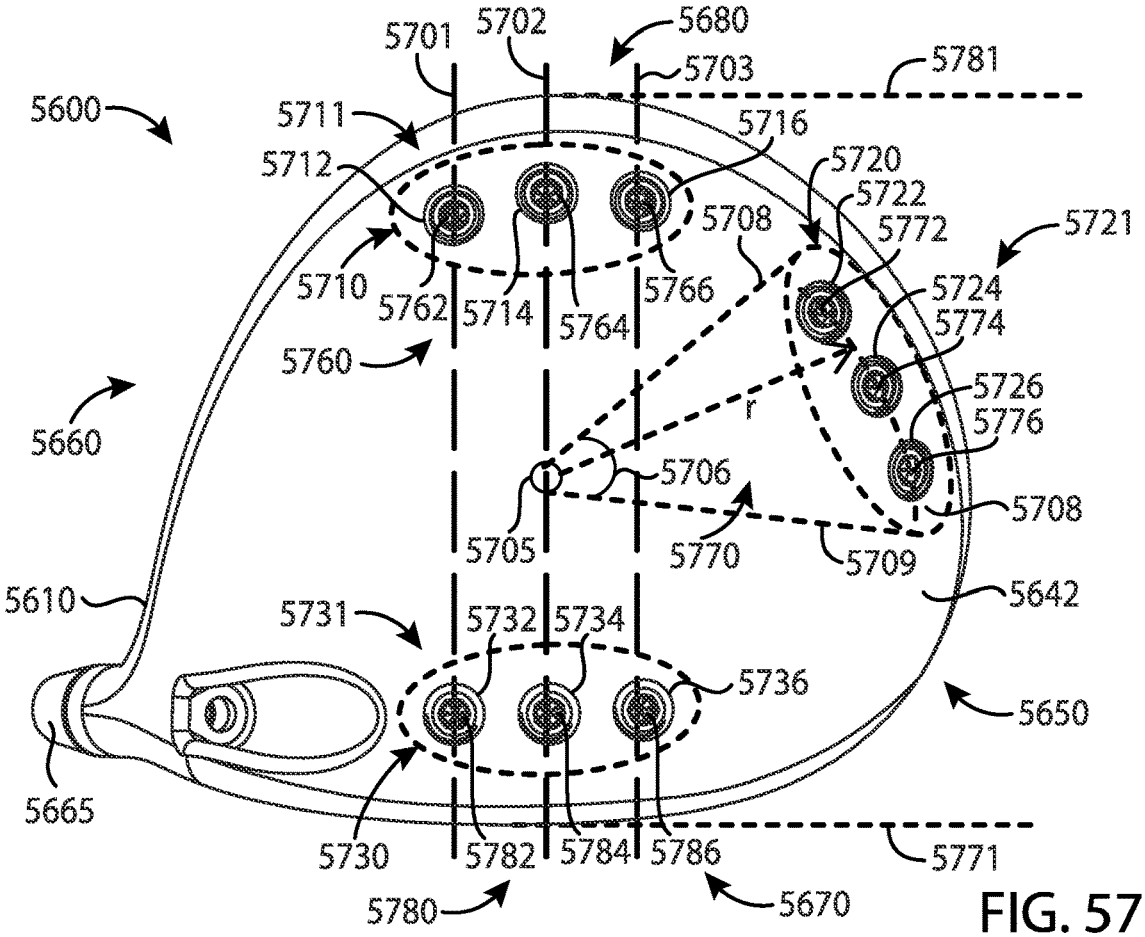
FIG. 57 is depicts a bottom view of the example golf club head of FIG. 56.
Figure 58:
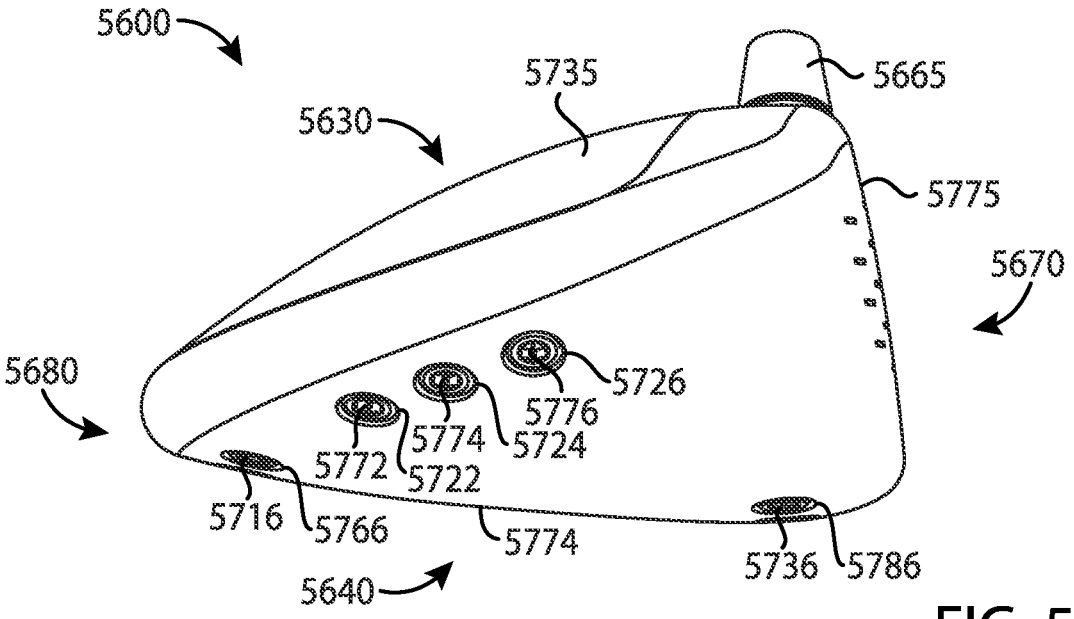
FIG. 58 depicts a toe view of the example golf club head of FIG. 56.
Figure 59:
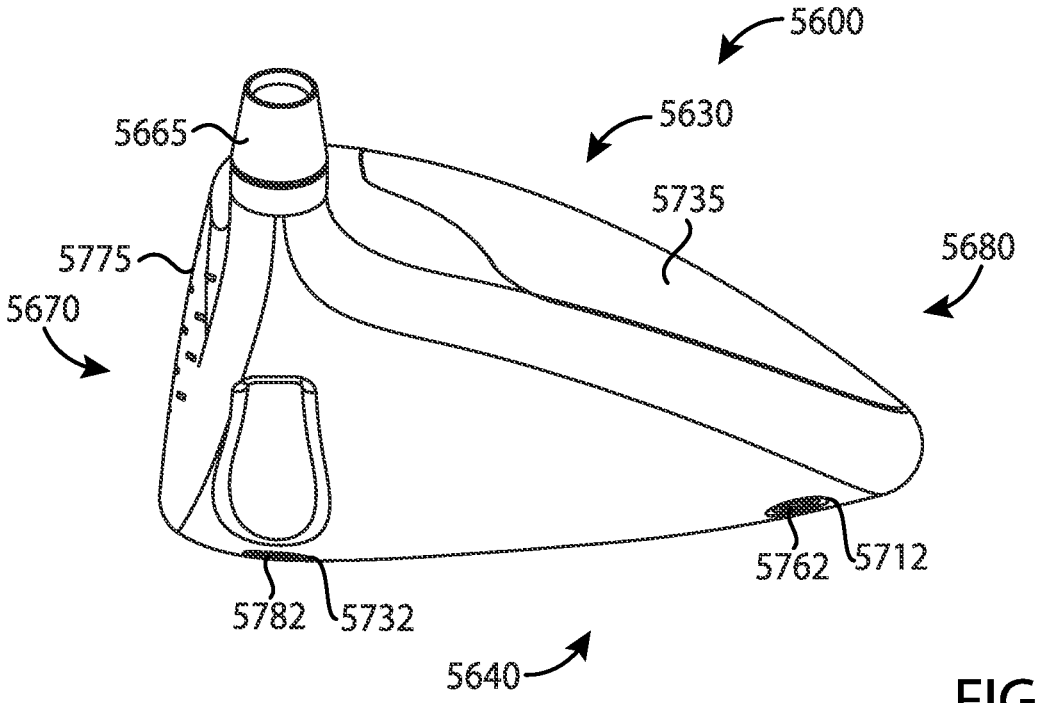
FIG. 59 depicts a heel view of the example golf club head of FIG. 56.
Figure 60:
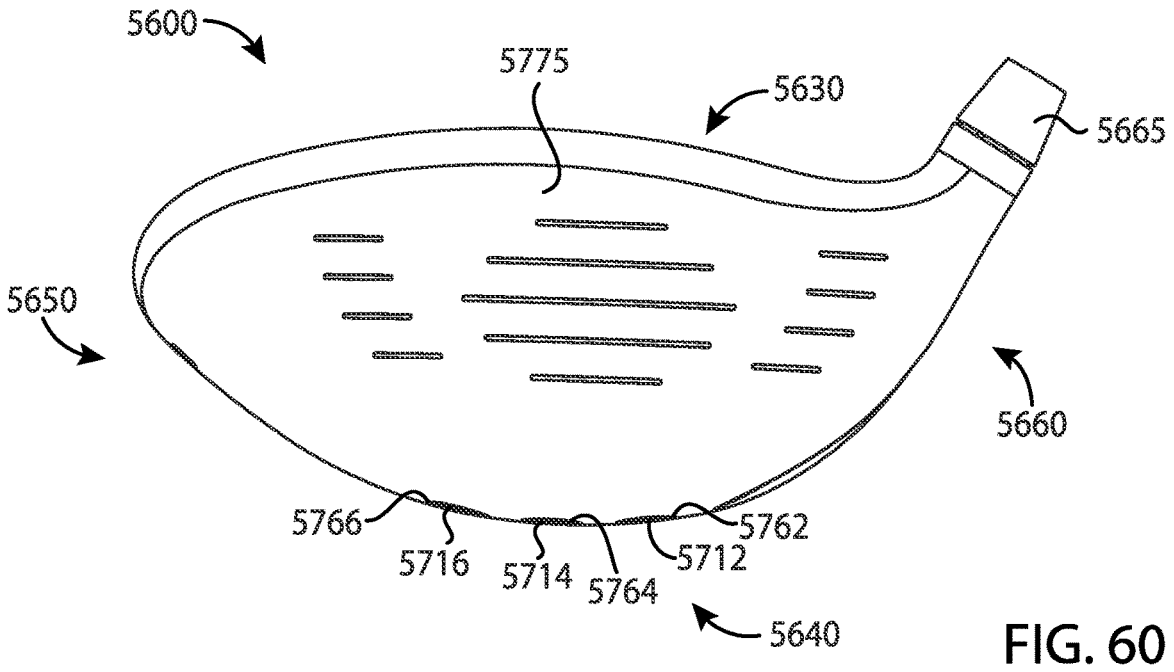
FIG. 60 depicts a front view of the example golf club head of FIG. 56.
Figure 61:
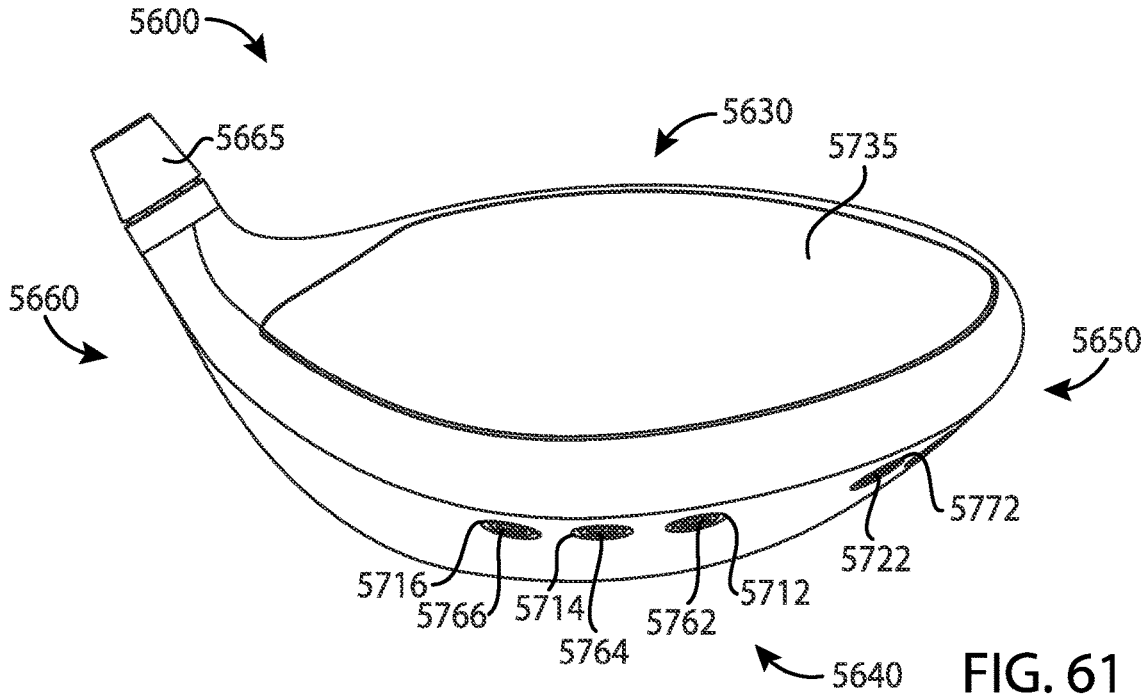
FIG. 61 depicts a rear view of the example golf club head of FIG. 56.

The second weight port region 5720 containing the second set of weight portions 5770 may be located in a bottom region defined by an angle 5706 between bounding lines (5708, 5709) that intersect the center 5705 of the golf club head 5600, as shown in FIG. 57. The angle 5706 may be about 20-35, 30-45, 40-55, or 50-65 degrees. The second set of weight portions 5770 may result in the center of gravity of the golf club head 5600 being located to the toe side of the center vertical plane 5702 resulting in a fade biased golf club head.

One or more of the weight portions (e.g. 5772, 5774, 5776) of the second set of weight portions 5770 may be located along an arc 5708 defined by a radius (r) extending outward from the center of the bottom portion 5640, as shown in FIG. 57. The radius (r) may have a length of about 1.25-2.5, 1.25-1.5, 1.4-1.7, 1.6-1.85, 1.75-1.95, 1.8-2.05, 2.0-2.25, 2.1-2.35, or 2.2-2.5 in.

The outer surface 5642 and/or the inner surface 5644 of the bottom portion 5640 may include one or more inner support portions (not shown) and/or one or more outer support portion (not shown) similar to any of the inner support portions and the outer support portions described herein. The apparatus, methods, and articles of manufacture described herein are not limited in this regard.

In the example of FIGS. 62-75, a golf club head 6200 may include a body portion 6210 with a top portion 6230, a crown portion 6235, a bottom portion 6240, a toe portion 6250, a heel portion 6260, a front portion 6270, and a rear portion 6280. The bottom portion 6240 may include a skirt portion 6290 defined as a side portion of the golf club head 6200 between the top portion 6230 and the bottom portion 6240 excluding the front portion 6270 and extending across a periphery of the golf club head 6200 from the toe portion 6250, around the rear portion 6280, and to the heel portion 6260. Alternatively, the golf club head 6200 may not include the skirt portion 6290. The front portion 6270 may include a face portion 6275 to engage a golf ball (e.g., one generally shown as 7601 in FIG. 76). The face portion 6275 may be integral to the body portion 6210 or may be a separate face portion that is coupled (e.g., welded) to the front portion 6270 to enclose an opening in the front portion 6270. The body portion 6210 may also include a hosel portion 6265 configured to receive a shaft portion (not shown). The hosel portion 6265 may be similar in many respects to any of the hosel portions described herein. The hosel portion 6265 may include an interchangeable hosel sleeve. Alternatively, the body portion 6210 may include a bore instead of the hosel portion 6265. The body portion 6210 may be made partially or entirely from any of the materials described herein. Further, the golf club head 6200 may be any type of golf club head having a club head volume similar to the club head volume of any of the golf club heads described herein. The apparatus, methods, and articles of manufacture described herein are not limited in this regard.

The top portion 6230 may include a forward portion 6231 extending between a front portion 6270 and the crown portion 6235. In one example, the forward portion 6231 may extend a distance 6234 of at least 12 mm in a front-to-rear direction. In another example, the forward portion 6231 may extend a distance 6234 of at least 16 mm in a front-to-rear direction. In yet another example, the forward portion 6231 may extend a distance 6234 of at least 20 mm in a front-to-rear direction. While the above examples may describe particular distances, the apparatus, methods, and articles of manufacture described herein may include a forward portion extending a distance less than 12 mm in a front-to-rear direction. The forward portion 6231 may enhance structural integrity of the golf club head 6200 and resist rearward deflection of the front portion 6270 during impact with a golf ball. The apparatus, methods, and articles of manufacture described herein are not limited in this regard.

Figure 74:
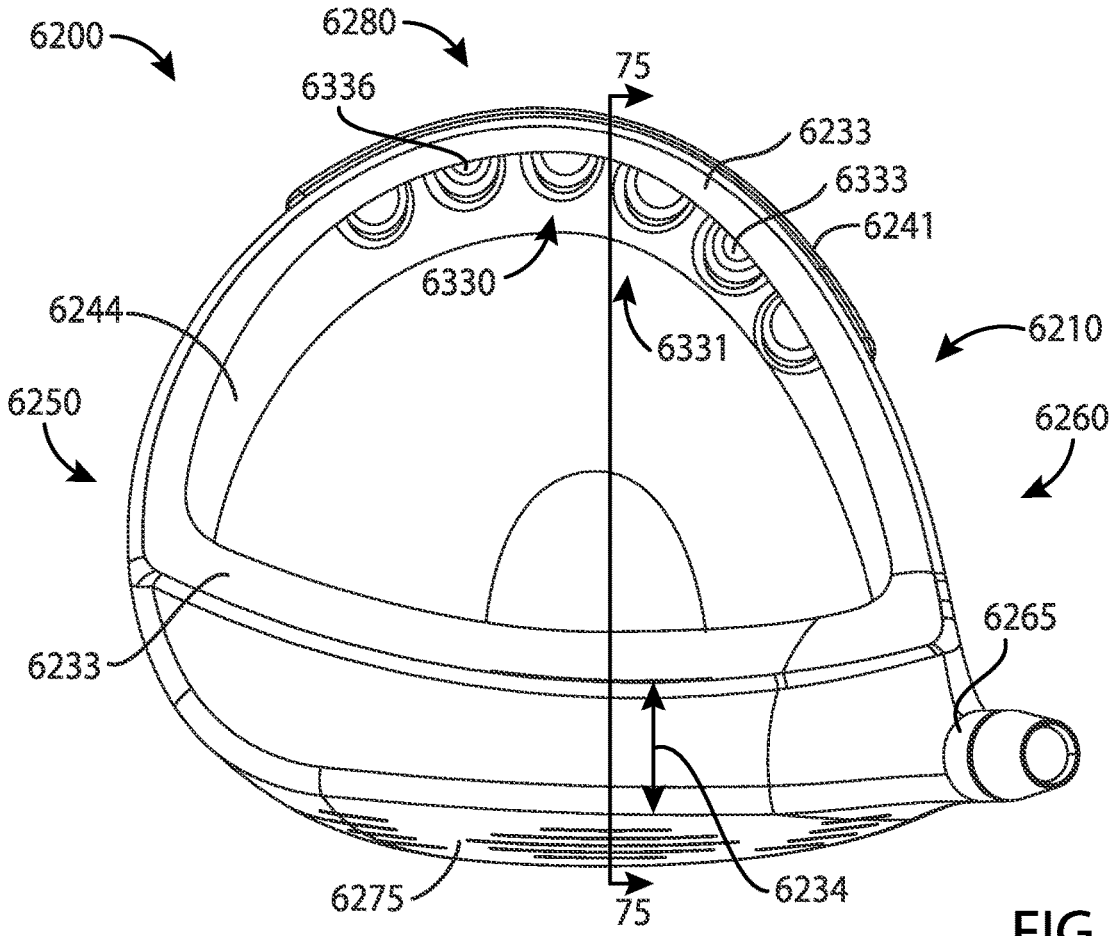
FIG. 74 depicts a top view of the example golf club head of FIG. 62 excluding the crown portion.
Figure 75:
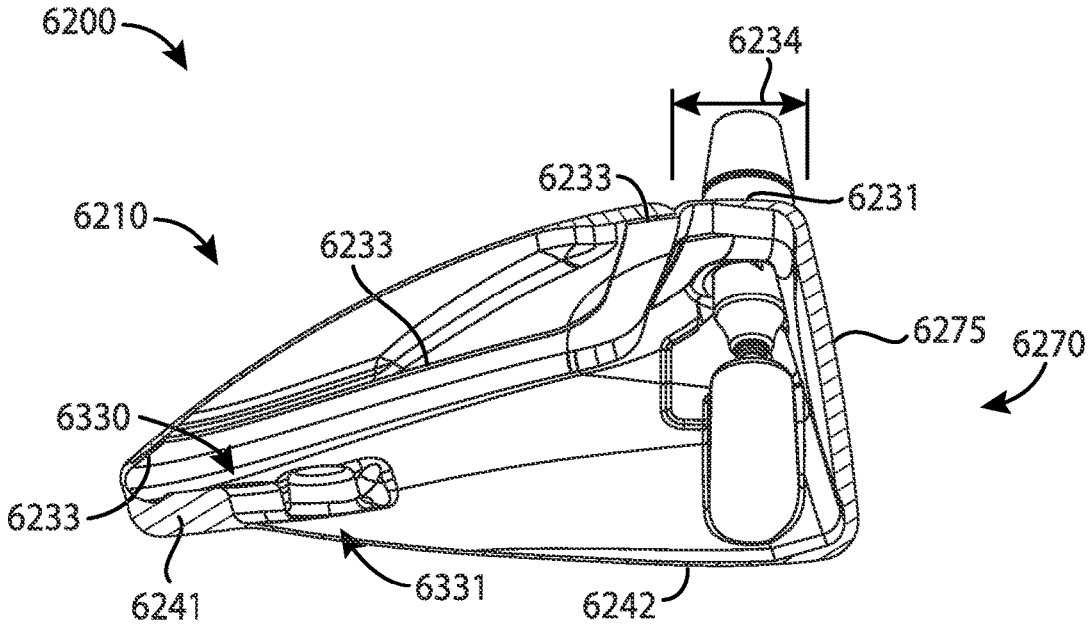
FIG. 75 depicts a cross-sectional view of the example golf club head of FIG. 62 taken at section line 75-75 of FIG. 74.

The crown portion 6235 may be a separate piece that may be attached to the top portion 6230. The crown portion 6235 may enclose an opening in the top portion 6230. As illustrated in FIG. 74, for example, the top portion 6230 of the golf club head 6200 may include the opening prior to installation of the crown portion 6235. The crown portion 6235 may be constructed from one or more materials, and those materials may be the same of different from the material of the body portion 6210. In one example, the crown portion 6235 may be at least partially constructed from a composite material such as a fiber-based composite material. The crown portion 6235 may be attached to a shoulder portion 6233 of the top portion 6230. The shoulder portion 6233 may extend along the opening in the top portion 6230. The shoulder portion 6233 may support the crown portion 6235. In one example, the shoulder portion 6233 may extend a distance 7033 of at least 2 mm inward toward the opening in the top portion 6230. In another example, the shoulder portion 6233 may extend a distance 7033 of at least 6 mm. In yet another example, the shoulder portion 6233 may extend a distance 7033 of at least 8 mm. While the above examples may describe particular distances, the apparatus, methods, and articles of manufacture described herein may include a shoulder portion 6233 may extend a distance less than 2 mm inward toward the opening in the top portion 6230. The shoulder portion 6233 may be a continuous portion encircling the opening in the top portion 6230. Alternately, the shoulder portion 6233 may include one or more discrete shoulder portions arranged to support the crown portion 6235. In another example, the shoulder portion 6233 may include a plurality of tabs arranged to support the crown portion 6235. In still another example, the shoulder portion 6233 may be omitted, and the crown portion 6235 may be adhered to an outer surface of the top portion 6230. In yet another example, the shoulder portion 6233 may be omitted, and the crown portion 6235 may include a protrusion extending from a bottom surface of the crown portion 6235 that provides an interference fit with a perimeter edge of the opening. The apparatus, methods, and articles of manufacture described herein are not limited in this regard.

The crown portion 6235 may include one or more thin portions, one generally shown as 7135. The thin portion 7135 may reduce the weight of the crown portion 6235, which may lower the CG of the golf club head 6200. In one example, the thin portion 7135 may have a thickness 7136 of less than 1.0 mm. In another example, the thin portion 7135 may have a thickness 7136 of less than 0.75 mm. In yet another example, the thin portion 7135 may have a thickness 7136 of less than 0.65 mm. While the above examples may describe particular thicknesses, the apparatus, methods, and articles of manufacture described herein may include one or more thin portions 7135 having a thickness greater than or equal to 1.0 mm. One or more thin portions 7135 may extend from one or more relatively thicker crown stiffening regions, one generally shown as 6236. In one example, the thin portion 7135 may form at least 50% of the crown portion 6235. In another example, the thin portion 7135 may form at least 75% of an exterior surface area of the crown portion 6235. In yet another example, the thin portion 7135 may form at least 85% of the exterior surface area of the crown portion 6235. In still yet another example, the thin portions 7135 may form at least 95% of the exterior surface area of the crown portion 6235. While the above examples may describe particular percentages of the crown portion 6235, the apparatus, methods, and articles of manufacture may include one or more thin portions 7135 forming less than 75% of the exterior surface area of the crown portion 6235. The apparatus, methods, and articles of manufacture described herein are not limited in this regard.

The crown stiffening portion 6236 may enhance stiffness of the crown portion 6235 and compensate for the presence of relatively less stiff portions elsewhere in the crown portion 6235. The crown stiffening portion 6236 may enhance overall stiffness of the golf club head 6200. The crown stiffening portion 6236 may distribute impact forces in response to the face portion 6275 impacting a golf ball. The crown stiffening portion 6236 may limit deflection of the face portion 6275 and/or forward portion 6231 of the top portion 6230 toward the rear portion 6280 in response to the face portion 6275 impacting a golf ball. The crown stiffening portion 6236 may limit physical compression of the crown portion 6235 in a front-to-rear direction in response to the face portion 6275 impacting a golf ball, which may reduce risk of cracking or delamination of the crown portion 6235 in examples where the crown portion 6235 is constructed of two or more layers of composite material. The crown stiffening portion 6236 may be part of a raised portion. The crown stiffening portion 6236 may be part of a contoured portion. The crown stiffening portion 6236 may serve as a visual alignment aid for a golfer aligning a golf shot. The crown stiffening portion 6236 may improve acoustic response of the golf club head 6200 in response to the face portion 6275 impacting a golf ball. The crown stiffening portion 6236 may have a thickness greater than an average thickness of the crown portion 6235. The crown stiffening portion 6236 may be either integral to the crown portion 6235 or one or more separate portions adhered or fastened to a surface of the crown portion 6235 to provide structural reinforcement. The apparatus, methods, and articles of manufacture described herein are not limited in this regard.

Figure 62:
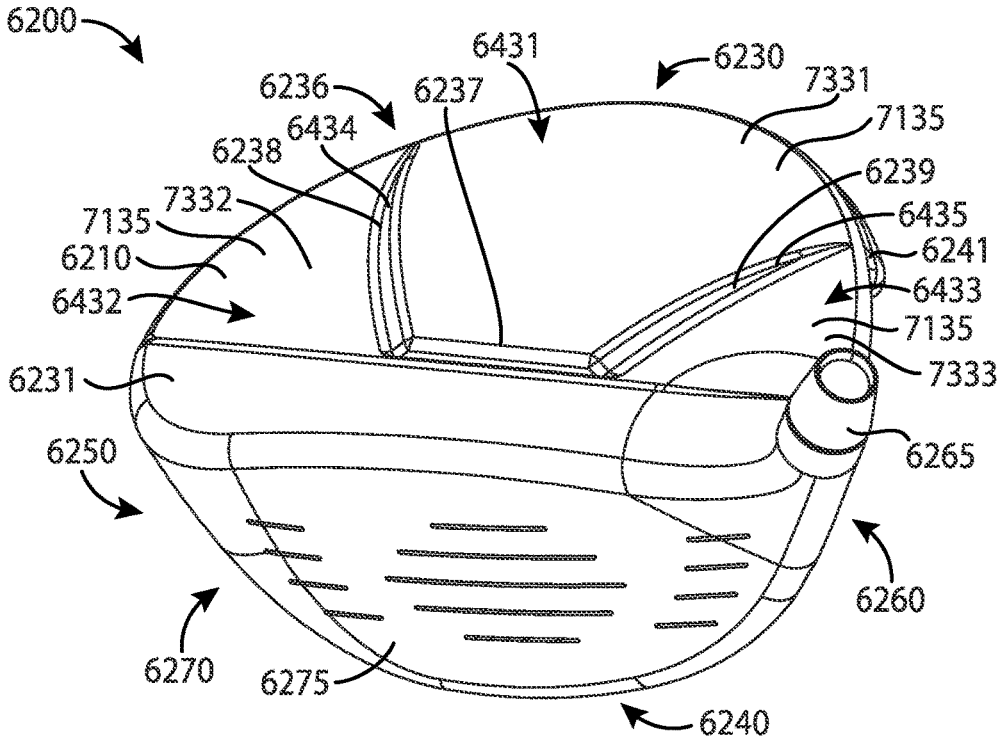
FIG. 62 is top perspective view of an example golf club head according to an embodiment of the apparatus, methods, and articles of manufacture described herein.
Figure 63:
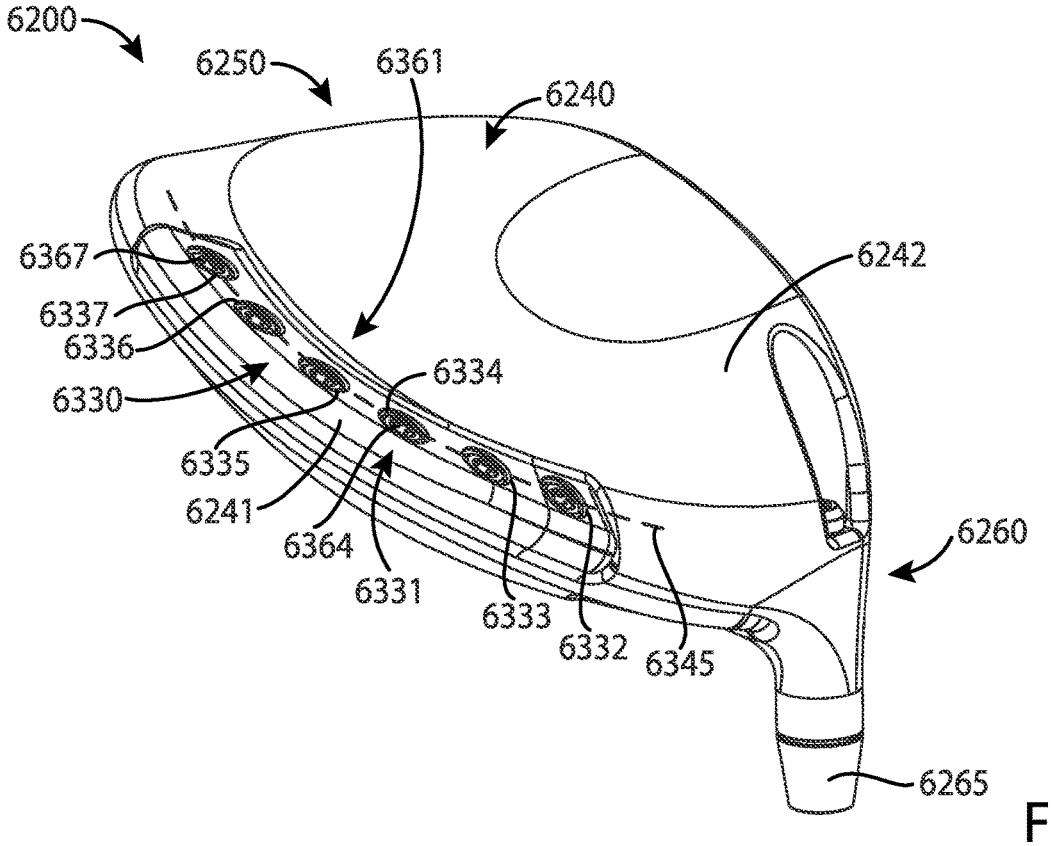
FIG. 63 depicts a bottom perspective view of the example golf club head of FIG. 62.

As mentioned above, the crown portion 6235 may include one or more crown stiffening portions, generally shown as a first crown stiffening portion 6237, a second crown stiffening portion 6238, and a third crown stiffening portion 6239 in FIG. 62. The first crown stiffening portion 6237 may be located adjacent to the forward portion 6231 of the top portion 6230. The first crown stiffening portion 6237 may extend along a junction 6232 formed between the crown portion 6235 and the forward portion 6231 of the top portion 6230. The first crown stiffening portion 6237 may have a thickness greater than an average thickness of the crown portion 6235. In one example, the first crown stiffening portion 6237 may have a thickness of greater than 2 mm. In another example, the first crown stiffening portion 6237 may have a thickness of greater than or equal to 2.2 mm. While the above examples may describe particular thickness, the apparatus, methods, and articles of manufacture described herein may include the first crown stiffening portion 6237 with a thickness of less than or equal to 2 mm. The first crown stiffening portion 6237 may include two or more plies of fiber-based composite material 7614 (e.g., such as three, four, five, six, seven, eight, or nine plies of fiber-based composite material 7614). In one example, the first crown stiffening portion 6237 may have a length of at least 1.25 cm. In another example, the first crown stiffening portion 6237 may have a length of at least 2 cm. In yet another example, the first crown stiffening portion 6237 may have a length of at least 3 cm. In still yet another example, the first crown stiffening portion 6237 may have a length of at least 4 cm. In another example, the first crown stiffening portion 6237 may have a length of between and including 4 and 4.5 cm. While the above examples may describe particular lengths, the apparatus, methods, and articles of manufacture describe herein may include the first crown stiffening portion 6237 having a length less than 3 cm. The first crown stiffening portion 6237 may reduce aerodynamic drag of the golf club head 6200. The apparatus, methods, and articles of manufacture described herein are not limited in this regard.

The second crown stiffening portion 6238 may extend from the first crown stiffening portion 6237 toward the rear portion 6280. The second crown stiffening portion 6238 may extend from the first crown stiffening portion 6237 toward the rear portion 6280 and toward the toe portion 6250. The second crown stiffening portion 6238 may extend from a toe-side end of the first crown stiffening portion 6237 to a rear perimeter of the crown portion 6235. The second crown stiffening portion 6238 may taper in a front-to-rear direction. The second crown stiffening portion 6238 may serve as a support structure between the forward portion 6231 and the rear portion 6280. The second crown stiffening portion 6238 may oppose rearward deflection of the forward portion 6231 in response to the face portion 6275 impacting a golf ball. The second crown stiffening portion 6238 may have a thickness greater than an average thickness of the crown portion 6235. The second crown stiffening portion 6238 may have a thickness of greater than 2 mm. The second crown stiffening portion 6238 may have a thickness of greater than or equal to 2.2 mm. While the above examples may describe particular thickness, the apparatus, methods, and articles of manufacture described herein may include the second crown stiffening portion 6238 with a thickness of less than or equal to 2 mm. The second crown stiffening portion 6238 may include two or more plies of fiber-based composite material 7614 (e.g., such as three, four, five, six, seven, eight, or nine plies of fiber-based composite material 7614). In one example, the second crown stiffening portion 6238 may have a length of at least 2 cm. In another example, the second crown stiffening portion 6238 may have a length of at least 4 cm. While the above examples may describe particular lengths, the apparatus, methods, and articles of manufacture describe herein may include the second crown stiffening portion 6238 having a length less than 2 cm. The second crown stiffening portion 6238 may reduce aerodynamic drag of the golf club head. The apparatus, methods, and articles of manufacture described herein are not limited in this regard.

The third crown stiffening portion 6239 may extend from the first crown stiffening portion 6237 toward the rear portion 6280. The third crown stiffening portion 6239 may extend from the first crown stiffening portion 6237 toward the rear portion 6280 and toward the heel portion 6260. The third crown stiffening portion 6239 may extend from a heel-side end of the first crown stiffening portion 6237 to a rear perimeter of the crown portion 6235. The third crown stiffening portion 6239 may taper in a front-to-rear direction. The third crown stiffening portion 6239 may serve as a support structure between the forward portion 6231 and the rear portion 6280. The third crown stiffening portion 6239 may oppose rearward deflection of the forward portion 6231 in response to the face portion 6275 impacting a golf ball. The third crown stiffening portion 6239 may have a thickness greater than an average thickness of the crown portion 6235. The third crown stiffening portion 6239 may have a thickness of greater than 2 mm. The third crown stiffening portion 6239 may have a thickness of greater than or equal to 2.2 mm. While the above examples may describe particular thicknesses, the apparatus, methods, and articles of manufacture described herein may include the third crown stiffening portion 6239 with a thickness of less than or equal to 2 mm. The third crown stiffening portion 6239 may include two or more plies of fiber-based composite material 7614 (e.g., such as three, four, five, six, seven, eight, or nine plies of fiber-based composite material 7614). The third crown stiffening portion 6239 may have a length of at least 2 cm. The third crown stiffening portion 6239 may have a length of at least 4 cm. The third crown stiffening portion 6239 may reduce aerodynamic drag of the golf club head. While the above example may describe a particular number of crown stiffening portions, the apparatus, methods, and articles of manufacture described herein may include more or fewer crown stiffening portions. The apparatus, methods, and articles of manufacture described herein are not limited in this regard.

The crown portion 6235 may include a central crown portion 6431, a toe-side crown portion 6432, and a heel-side crown portion 6433. The central crown portion 6431 may be a raised central crown portion. The raised central crown portion 6431 may be located between the heel-side crown portion 6433 and the toe-side crown portion 6432. The raised central crown portion 6431 may have a maximum height greater than a maximum height of the toe-side crown portion 6432. The raised central crown portion 6431 may have a maximum height greater than a maximum height of the heel-side crown portion 6433. The raised central crown portion 6431 may serve as a visual alignment aid. The raised central crown portion 6431 may improve aerodynamic performance of the golf club head 6200. The apparatus, methods, and articles of manufacture described herein are not limited in this regard.

The central crown portion 6431 may include a thin portion 7135. The toe-side crown portion 6432 may include a thin portion 7135. The heel-side crown portion 6433 may include a thin portion 7135. Thin portions 7135 may be desirable to reduce overall mass of the crown portion 6235, which may lower the CG of the golf club head 6200. The apparatus, methods, and articles of manufacture described herein are not limited in this regard.

The crown portion 6235 may include a plurality of contoured surfaces. The plurality of contoured surfaces may reduce aerodynamic drag of the golf club head 6200. The plurality of contoured surfaces may enhance structural integrity of the golf club head 6200. An outer surface of the central crown portion 6431 may be elevated above an outer surface of the toe-side crown portion 6432. The outer surface of the central crown portion 6431 may be elevated above an outer surface of the heel-side crown portion 6433. The crown portion 6235 may include a first contoured transition region 6434 located between the central crown portion 6431 and the toe-side crown portion 6432. The crown portion 6235 may include a second contoured transition region 6435 located between the central crown portion 6431 and the heel-side crown portion 6433. The location of the first contoured transition region 6434 may coincide with the location of the second crown stiffening portion 6238. The location of the second contoured transition region 6435 may coincide with the location of the third crown stiffening portion 6239. Together, the central crown portion 6431, toe-side crown portion 6432, heel-side crown portion 6433, first contoured transition region 6434, and second contoured transition region 6435 may form a multi-level crown portion 6235. Together, the central crown portion 6431, toe-side crown portion 6432, heel-side crown portion 6433, first contoured transition region 6434, and second contoured transition region 6435 may form a multi-thickness crown portion 6235. The apparatus, methods, and articles of manufacture described herein are not limited in this regard.

Figure 64:
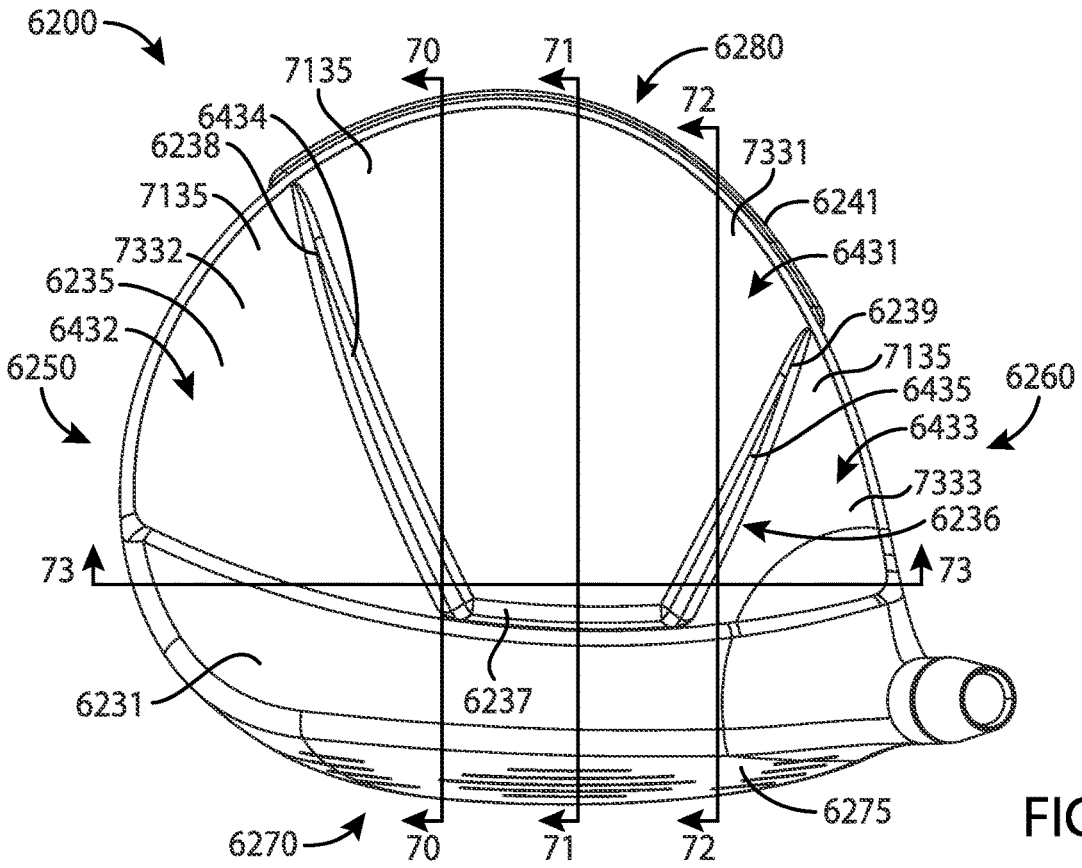
FIG. 64 depicts a top view of the example golf club head of FIG. 62.
Figure 65:
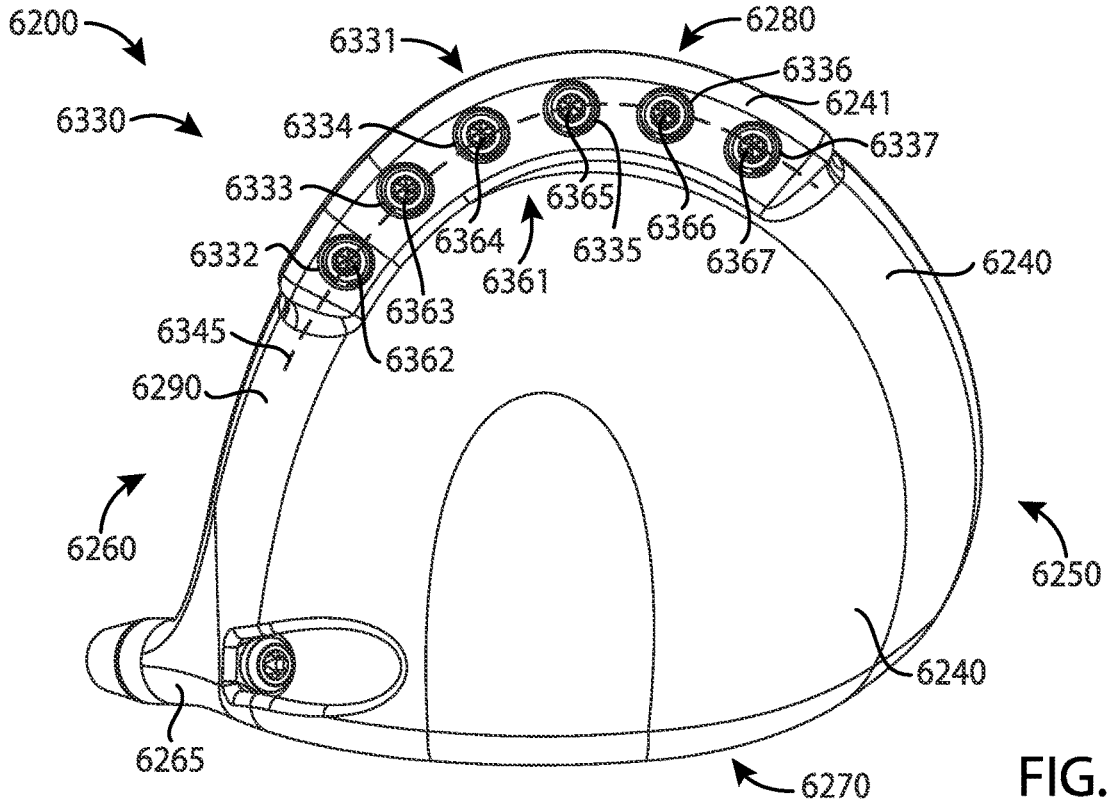
FIG. 65 depicts a bottom view of the example golf club head of FIG. 62.
Figure 66:
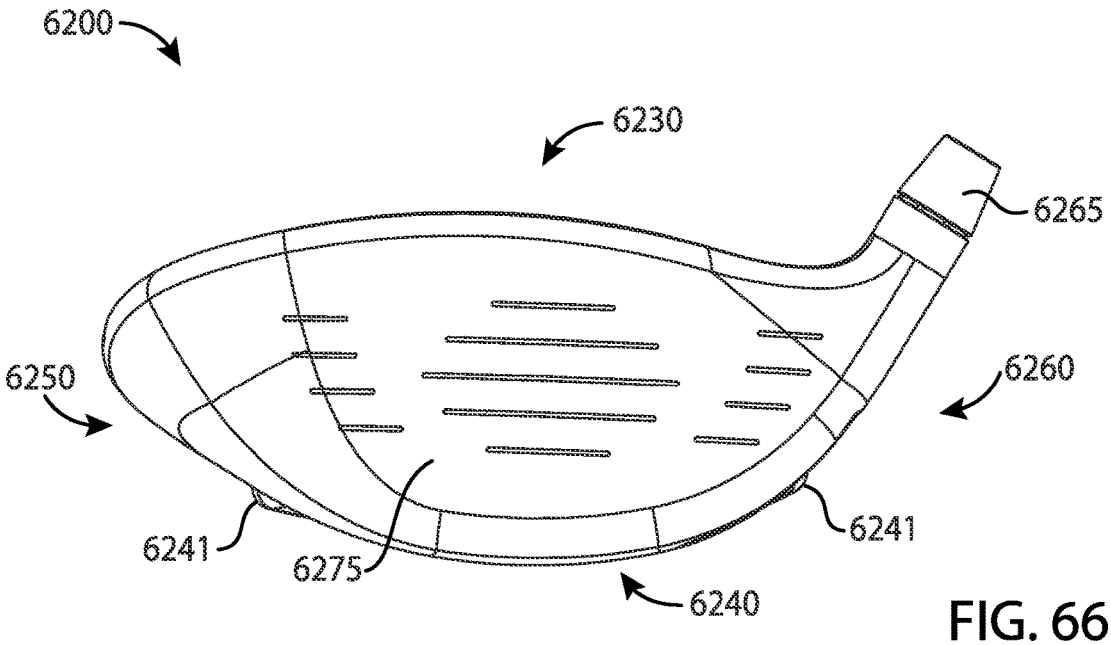
FIG. 66 depicts a front view of the example golf club head of FIG. 62.
Figure 67:
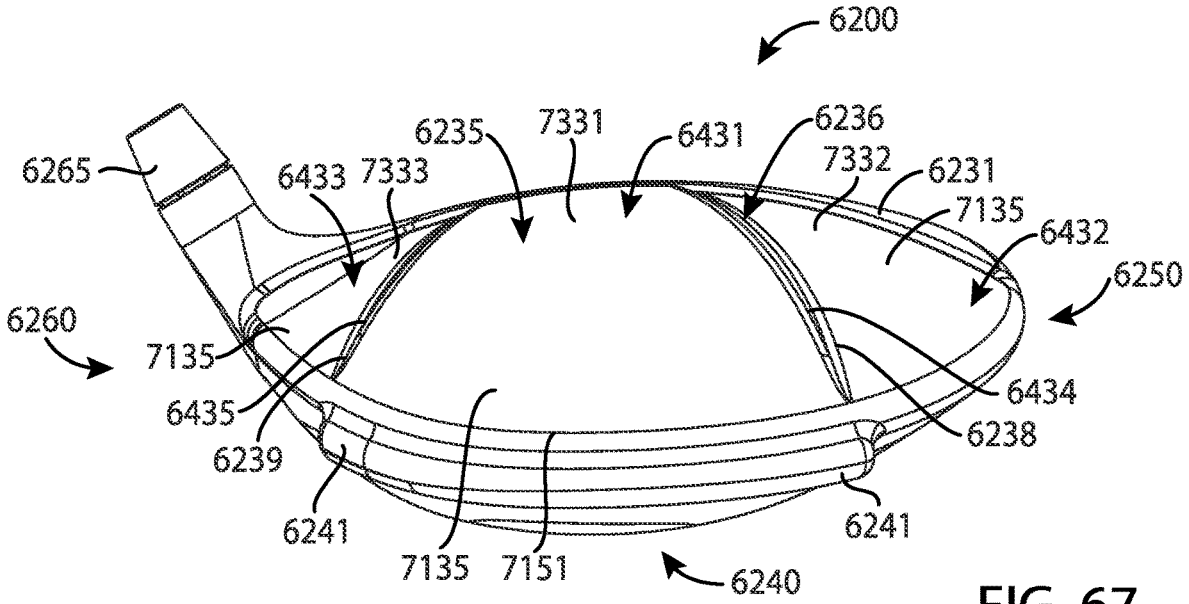
FIG. 67 depicts a rear view of the example golf club head of FIG. 62.
Figure 73:
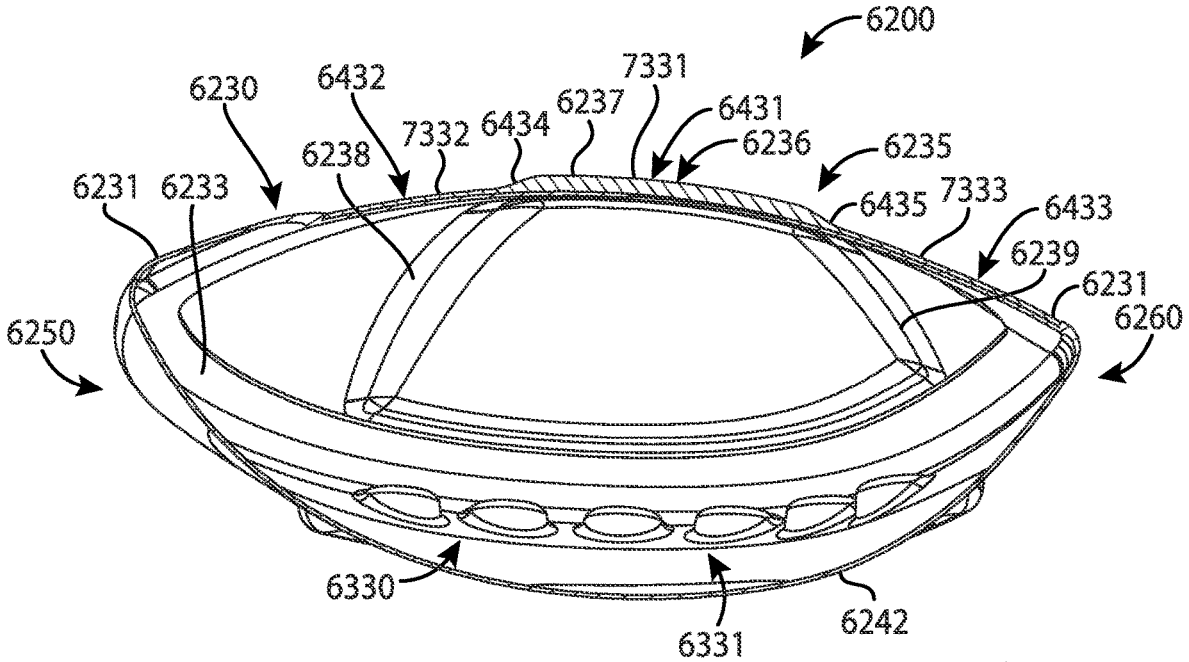
FIG. 73 depicts a cross-sectional view of the example golf club head of FIG. 62 taken at section line 73-73 of FIG. 64.

FIG. 73 depicts a cross-sectional view of the example golf club head of FIG. 62 taken at section line 73-73 of FIG. 64. The outer surface 7331 of the central crown portion 6431 may be elevated above an outer surface of the toe-side crown portion 6432. In one example, the outer surface 7331 of the central crown portion 6431 may be elevated above an outer surface of the toe-side crown portion 6432 by a height of greater than or equal to 0.5 mm. In another example, the outer surface 7331 of the central crown portion 6431 may be elevated above an outer surface of the toe-side crown portion 6432 by a height of greater than or equal to 1.0 mm. In yet another example, the outer surface 7331 of the central crown portion 6431 may be elevated above an outer surface of the toe-side crown portion 6432 by a height of greater than or equal to 2.0 mm. The outer surface 7331 of the central crown portion 6431 may be elevated above an outer surface 7333 of the heel-side crown portion 6433. In one example, the outer surface 7331 of the central crown portion 6431 may be elevated above an outer surface 7333 of the heel-side crown portion 6433 by a height of greater than or equal to 0.5 mm. In another example, the outer surface 7331 of the central crown portion 6431 may be elevated above an outer surface 7333 of the heel-side crown portion 6433 by a height of greater than or equal to 1.0 mm. In yet another example, the outer surface 7331 of the central crown portion 6431 may be elevated above an outer surface 7333 of the heel-side crown portion 6433 by a height of greater than or equal to 2.0 mm. While the above examples may describe particular heights, the apparatus, methods, and articles of manufacture described herein may include outer surfaces with a difference in height of less than 0.5 mm. The apparatus, methods, and articles of manufacture described herein are not limited in this regard.

Figure 72:
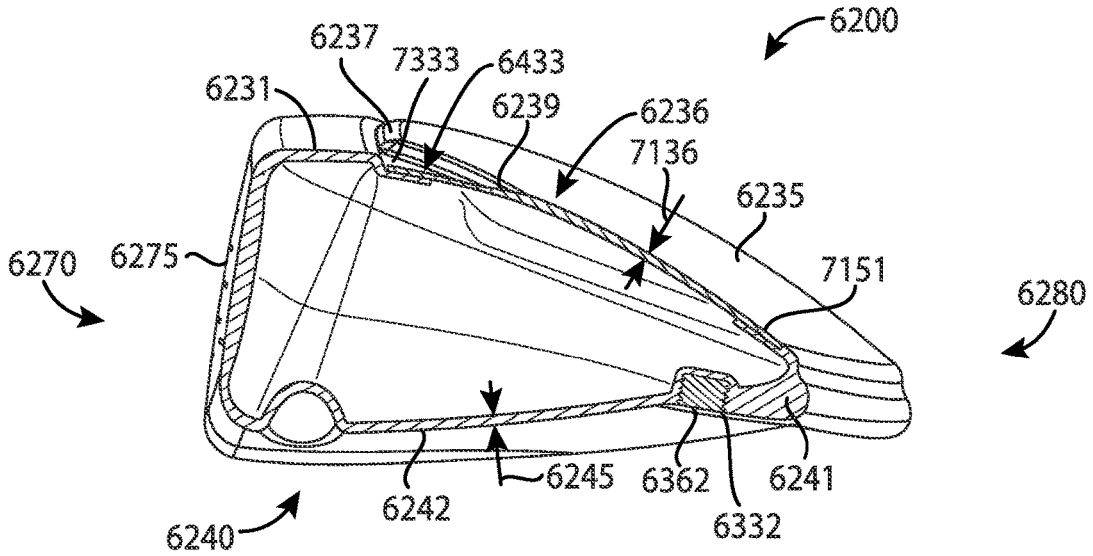
FIG. 72 depicts a cross-sectional view of the example golf club head of FIG. 62 taken at section line 72-72 of FIG. 64.

As shown in FIG. 72, the outer surface 7333 of the heel-side crown portion 6433 may be recessed below the forward portion 6231 proximate to the junction 6232. Likewise, the outer surface 7332 of the toe-side crown portion 6432 may be recessed below the forward portion 6231 proximate the junction 6232. In one example, the outer surface 7333 of the heel-side crown portion 6433 may be recessed below the forward portion 6231 proximate to the junction 6232 by a distance of greater than or equal to 0.5 mm. In another example, the outer surface 7333 of the heel-side crown portion 6433 may be recessed below the forward portion 6231 proximate to the junction 6232 by a distance of greater than or equal to 1.0 mm. In yet another example, the outer surface 7332 of the toe-side crown portion 6432 may be recessed below the forward portion 6231 proximate the junction 6232 by a distance of greater than or equal to 0.5 mm. The outer surface 7332 of the toe-side crown portion 6432 may be recessed below the forward portion 6231 proximate the junction 6232 by a distance of greater than or equal to 1.0 mm. While the above examples may describe particular distances, the apparatus, methods, and articles of manufacture described herein may include outer surfaces recessed by distances of less than 0.5 mm. The apparatus, methods, and articles of manufacture described herein are not limited in this regard.

Figure 76:
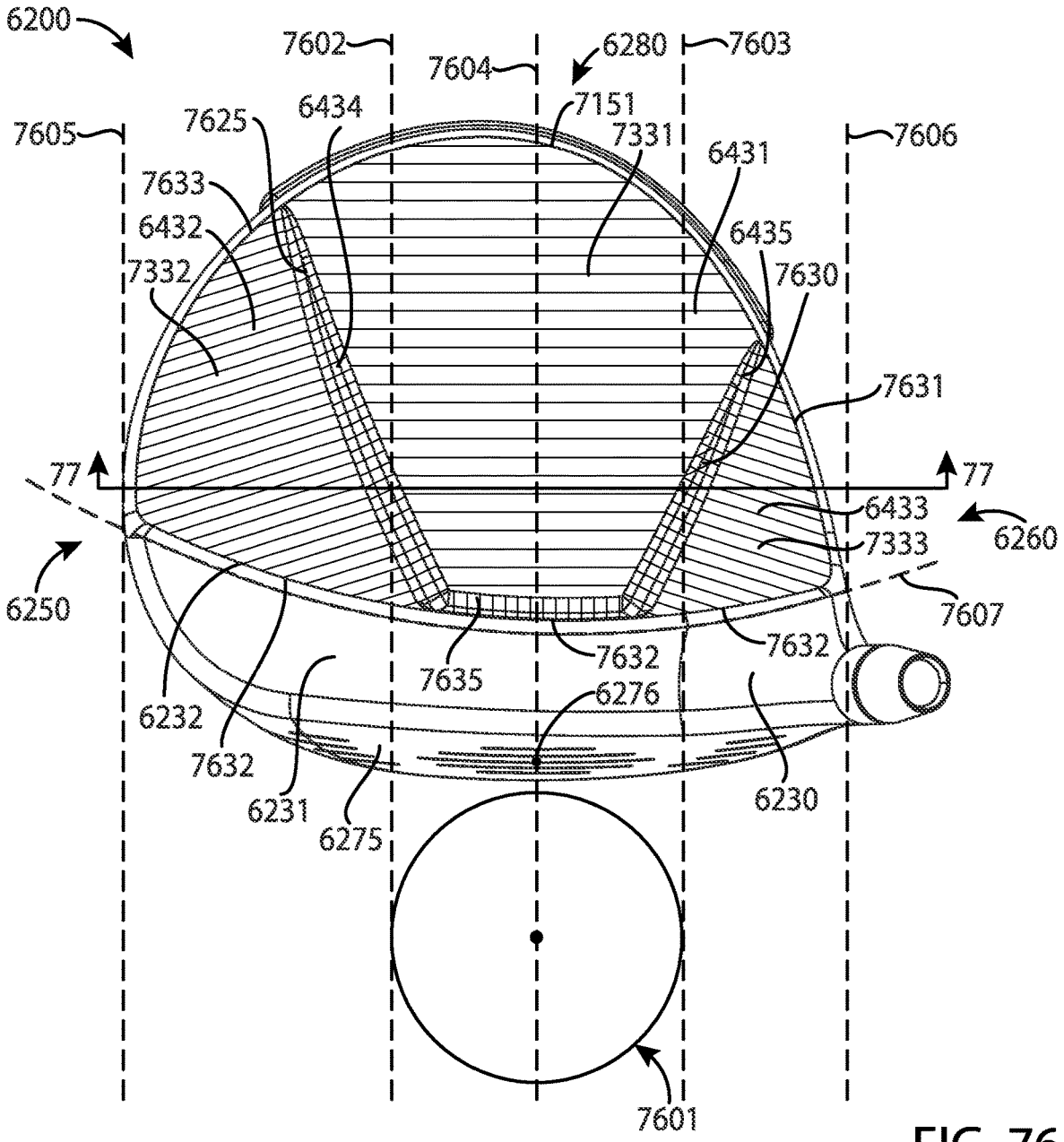
FIG. 76 depicts a top view of the example golf club head of FIG. 62 with a golf ball proximate to the face portion.

The central crown portion 6431 may be bounded by the first crown stiffening portion 6237, the second crown stiffening portion 6238, the third crown stiffening portion 6239, and a rear perimeter 7151 of the crown portion 6235. A front portion of the central crown portion 6431 may have a symmetrical shape relative to a vertical plane (e.g., one generally shown as 7604) that intersects the geometric center 6276 (e.g., at or proximate to a "sweet spot" of the golf club head 6200) on the face portion 6275 and is normal to a front vertical plane 6815. A front portion of the central crown portion 6431 may have a nonsymmetrical shape relative to the vertical plane 7604 that intersects the geometric center 6276 on the face portion 6275 and is normal to the front vertical plane 6815. In one example, the second crown stiffening portion 6238 and third crown stiffening portion 6239 may diverge in a front-to-rear direction, as shown in FIG. 76. The central crown portion 6431 may have an irregular polygon-like shape (e.g., a quadrilateral-like shape). The distance between the second and third crown stiffening portions 6238 and 6239 at or proximate to the front portion 6270 may be less than the distance between the second and third crown stiffening portions 6238 and 6239 at or proximate to the rear portion 6280. In another example, the second crown stiffening portion 6238 and third crown stiffening portion 6239 may converge in a front-to-rear direction. The distance between the second and third crown stiffening portions 6238 and 6239 at or proximate to the front portion 6270 may be greater than the distance between the second and third crown stiffening portions 6238 and 6239 at or proximate to the rear portion 6280. In yet another example, the second crown stiffening portion 6238 and third crown stiffening portion 6239 may converge and then diverge in a front-to-rear direction (see, e.g., FIG. 101). In another example, the second crown stiffening portion 6238 and third crown stiffening portion 6239 may diverge and then converge in a front-to-rear direction (see, e.g., FIG.

102). In still another example, the second crown stiffening portion 6238 and third crown stiffening portion 6239 may be substantially parallel in a front-to-rear direction. The distance between the second and third crown stiffening portions 6238 and 6239 at or proximate to the front portion 6270 may equal or may be substantially the same as the distance between the second and third crown stiffening portions 6238 and 6239 at or proximate to the rear portion 6280. The apparatus, methods, and articles of manufacture described herein are not limited in this regard.

In one example, as shown in FIG. 62, the central crown portion 6431 may be raised relative to the toe-side crown portion 6432 and the heel-side crown portion 6433. In another example, the central crown portion 6431 may be depressed relative to the toe-side crown portion 6432 and the heel-side crown portion 6433. Variations in relative heights of the central crown portion 6431, toe-side crown portion 6432, and heel-side crown portion 6433 may improve aerodynamic performance by reducing a drag coefficient associated with the golf club head 6200. Variations in relative heights of the central crown portion 6431, toe-side crown portion 6432, and heel-side crown portion 6433 may provide a visual alignment aid. Variations in relative heights of the central crown portion 6431, toe-side crown portion 6432, and heel-side crown portion 6433, together with contoured transition regions with integral ribs, may enhance structural integrity of the crown portion 6235. The apparatus, methods, and articles of manufacture described herein are not limited in this regard.

The total surface area of the crown portion 6235 may include surface areas of the central crown portion 6431, toe-side crown portion 6432, heel-side crown portion 6433, first contoured transition region 6434, and second contoured transition region 6435. In one example, the surface area of the central crown portion 6431 may be at least 10% of the total surface area of the crown portion 6235. In another example, the surface area of the central crown portion 6431 may be at least 20% of the total surface area of the crown portion 6235. In yet another example, the surface area of the central crown portion 6431 may be at least 30% of the total surface area of the crown portion 6235. In still yet another example, the surface area of the central crown portion 6431 may be at least 40% of the total surface area of the crown portion 6235. In still yet another example, the surface area of the central crown portion 6431 may be at least 50% of the surface area of the crown portion 6235. In still yet another example, the surface area of the central crown portion 6431 may be at least 60% of the total surface area of the crown portion 6235. In still yet another example, the surface area of the central crown portion 6431 may be at least 70% of the total surface area of the crown portion 6235. In still yet another example, the surface area of the central crown portion 6431 may be at least 80% of the total surface area of the crown portion 6235. In still yet another example, the surface area of the central crown portion 6431 may be at least 90% of the total surface area of the crown portion 6235. The apparatus, methods, and articles of manufacture described herein are not limited in this regard.

The toe-side crown portion 6432 may be bounded by the second crown stiffening portion 6238, a toe-side perimeter 7633 of the crown portion 6235, and a front perimeter of the crown portion 6235. In one example, the surface area of the toe-side crown portion 6432 may be at least 5% of the total surface area of the crown portion 6235. In another example, the surface area of the toe-side crown portion 6432 may be at least 10% of the total surface area of the crown portion 6235. In yet another example, the surface area of the toe-side crown portion 6432 may be at least 15% of the total surface area of the crown portion 6235. In still yet another example, the surface area of the toe-side crown portion 6432 may be at least 20% of the surface area of the crown portion 6235. In still yet another example, the surface area of the toe-side crown portion 6432 may be at least 25% of the total surface area of the crown portion 6235. In still yet another example, the surface area of the toe-side crown portion 6432 may be at least 30% of the total surface area of the crown portion 6235. In still yet another example, the surface area of the toe-side crown portion 6432 may be at least 35% of the total surface area of the crown portion 6235. In still yet another example, the surface area of the toe-side crown portion 6432 may be at least 40% of the total surface area of the crown portion 6235. The apparatus, methods, and articles of manufacture described herein are not limited in this regard.

The heel-side crown portion 6433 may be bounded by the third crown stiffening portion 6239, a heel-side perimeter of the crown portion 6235, and a front perimeter of the crown portion 6235. In one example, the surface area of the heel-side crown portion 6433 may be at least 5% of the total surface area of the crown portion 6235. In another example, the surface area of the heel-side crown portion 6433 may be at least 10% of the total surface area of the crown portion 6235. In yet another example, the surface area of the heel-side crown portion 6433 may be at least 15% of the total surface area of the crown portion 6235. In still yet another example, the surface area of the heel-side crown portion 6433 may be at least 20% of the total surface area of the crown portion 6235. In still yet another example, the surface area of the heel-side crown portion 6433 may be at least 25% of the total surface area of the crown portion 6235. In still yet another example, the surface area of the heel-side crown portion 6433 may be at least 30% of the total surface area of the crown portion 6235. The apparatus, methods, and articles of manufacture described herein are not limited in this regard.

In one example, the central crown portion 6431 may have an outer surface area 7331 that is greater than or equal to 40% of a total outer surface area of the crown portion, the toe-side crown portion 6432 may have an outer surface area 7332 that is less than or equal to 30% of the total outer surface area of the crown portion, and the heel-side crown portion 6433 may have an outer surface area 7333 that is less than or equal to 15% of the total outer surface area of the crown portion. In another example, the central crown portion 6431 may have an outer surface area 7331 that is greater than or equal to 50% of a total outer surface area of the crown portion, the toe-side crown portion 6432 may have an outer surface area 7332 that is greater than or equal to 15% of the total outer surface area of the crown portion, and the heel-side crown portion 6433 may have an outer surface area 7333 that is greater than or equal to 5% of the total outer surface area of the crown portion. In still another example, the central crown portion 6431 may have an outer surface area 7331 that is greater than or equal to 40% of a total outer surface area of the crown portion, the toe-side crown portion 6432 may have an outer surface area 7332 that is greater than or equal to 10% of the total outer surface area of the crown portion, and the heel-side crown portion 6433 may have an outer surface area 7333 that is greater than or equal to 5% of the total outer surface area of the crown portion. The apparatus, methods, and articles of manufacture described herein are not limited in this regard.

FIG. 76 depicts a top view of the example golf club head 6200 of FIG. 62 with a golf ball 7601 proximate to the face portion 6275. The golf ball 7601 may be aligned with a geometric center 6276 of the face portion 6275. The golf ball 7601 may have a diameter of about 1.68 inches. A central plane 7604 bisects the golf ball 7601 and the golf club head 6200. A toe-side plane 7605 bounds a toe side of the golf club head 6200. A heel-side plane 7606 bounds a heel side of the golf club head 6200. A toe-side golf ball perimeter plane 7602 bounds a toe-side of the golf ball 7601. A heel-side golf ball perimeter plane 7603 bounds a toe-side of the golf ball 7601. The crown portion 6235 may include a perimeter that includes a toe-side perimeter 7633, a heel-side perimeter 7631, a front perimeter 7632, and a rear perimeter 7151. The apparatus, methods, and articles of manufacture described herein are not limited in this regard.

Figure 77:
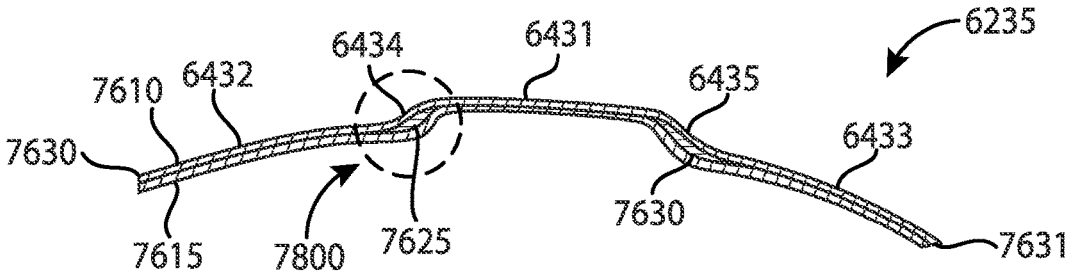
FIG. 77 depicts a cross-sectional view of an example crown portion of the example golf club head of FIG. 62 taken at section line 77-77 of FIG. 76.

FIG. 77 depicts a cross-sectional view of the crown portion 6235 of the example golf club head 6200 of FIG. 76 taken at section line 77-77. The crown portion 6235 may include two or more layers of composite material. The crown portion 6235 may include an outer layer of composite material 7610 and an inner layer of composite material 7615. The crown portion 6235 may include a plurality of integral ribs. Each integral rib may include a plurality of layers of composite material. The integral ribs (e.g., generally shown as 7625, and 7630) may be disposed between the inner layer 7615 and outer layer 7610 of composite material. The integral ribs 7625 and 7630 may form the crown stiffening portion 6236. The apparatus, methods, and articles of manufacture described herein are not limited in this regard.

Figure 78:
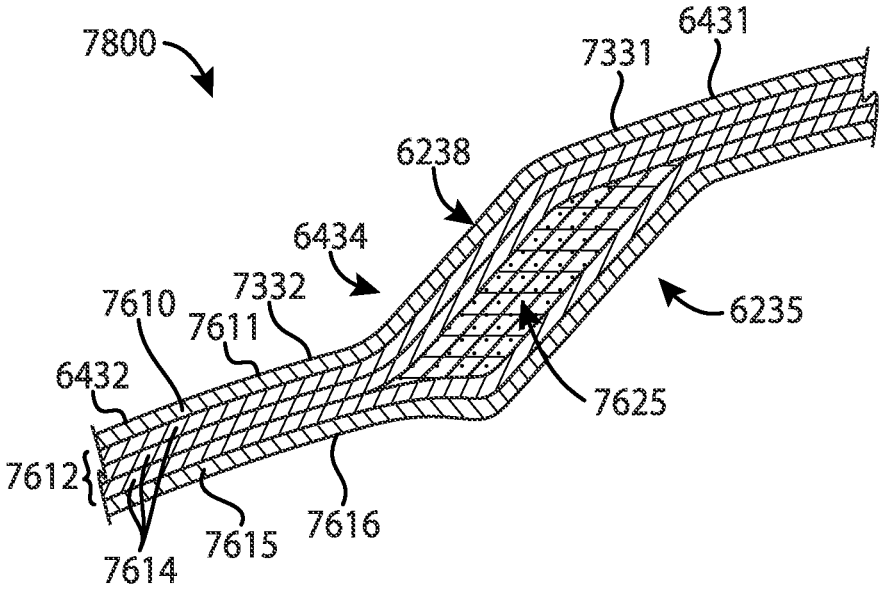
FIG. 78 depicts an enlarged view of a portion of the example crown portion of FIG. 77.

The toe-side integral rib 7625 may extend from a front perimeter 7632 of the crown portion 6235 to a rear perimeter 7151 of the crown portion. The toe-side integral rib 7625 may include a plurality of layers of composite material 7614, as shown in FIG. 78. The toe-side integral rib 7625 may include two or more layers of composite material 7614 disposed between the inner layer 7615 and the outer layer 7610 of the crown portion. The toe-side integral rib 7625 may extend rearward from the forward portion 6231. The toe-side integral rib 7625 may extend rearward from a starting location between the central plane 7604 and the toe-side golf ball plane 7602 and terminate at an ending location between the toe-side plane 7605 and the toe-side golf ball plane 7602. In one example, the toe-side integral rib 7625 may have a maximum thickness greater than or equal to 2.0 mm. In another example, the toe-side integral rib 7625 may have a maximum thickness greater than or equal to 2.1 mm. In yet another example, the toe-side integral rib 7625 may have a maximum thickness greater than or equal to 2.2 mm. The apparatus, methods, and articles of manufacture described herein are not limited in this regard.

FIG. 78 depicts an enlarged view of a region 7800 of the crown portion 6235 depicted in FIG. 77. The crown portion 6235 may include a plurality of layers of composite material. The crown portion 6235 may include an outer layer of composite material 7610 and an inner layer of composite material 7615. In one example, the inner layer of composite material 7615 may include glass fiber composite material, and the outer layer of composite material 7610 may include an aramid fiber composite material.

The crown portion 6235 may include a stack of composite layers forming an integral rib 7625. The integral rib 7625 may be positioned between the outer layer of composite material 7610 and the inner layer of composite material 7615. The crown portion 6235 may include one or more layers of composite material 7614 that are arranged in parallel or substantially parallel planes. The crown portion 6235 may include one or more layers of composite material 7614 that are arranged in nonparallel planes. The tensile strength of the crown portion 6235, as determined along certain axes, may be enhanced by having layers of composite material 7614 that are arranged in nonparallel planes (i.e., nonuniform orientations). The apparatus, methods, and articles of manufacture described herein are not limited in this regard.

The integral ribs (e.g., generally shown as 7625, 7630, and 7635) may provide embedded structural supports within the crown portion 6235. Each integral rib may be located in a crown stiffening region adjacent to one or more thin portions 7135. The crown portion 6235 may have contoured transition regions (e.g., generally shown as 6434, and 6435) between the thin portions 7135 and the thicker crown stiffening portions where the integral ribs 7625 and 7630 reside. Contoured transition regions 6434 and 6435 may prevent or mitigate unwanted stress concentrations within the crown portion 6235 by avoiding distinct edges between thin portions 7135 and adjacent thicker portions (e.g., such as 6237, 6238, or 6239). Stress concentrations may be undesirable as they may result in cracking or delaminating of layers of the crown portion 6235 during use of the golf club head 6200. For example, in an alternative embodiment having non-integral ribs attached to either an inner or outer surface of the crown portion, a distinct edge may exist at a junction formed between a non-integral rib and a surface of the crown portion 6235, and that edge may introduce an unwanted stress concentration. After numerous ball strikes, presence of the stress concentration may result in cracking or delaminating of layers of the crown portion 6235 proximate to the non-integral rib. This physical deterioration of the crown portion 6235 may negatively impact performance of the golf club head 6200. For instance, as the crown portion 6235 physically deteriorates, shot-to-shot variability may increase. Shot-to-shot variability may be unacceptable to an individual who requires consistent performance from the golf club head 6200. For the sake of long-term durability and consistency, it is therefore desirable to have a crown portion 6235 having contoured transition regions between the thin portions 7135 and the thicker portions containing integral ribs 7625 and 7630. The apparatus, methods, and articles of manufacture described herein are not limited in this regard.

The crown portion 6235 may include a plurality of composite layers 7612 positioned between the inner structural layer 7615 and the outer structural layer 7610. The term "structural layer" as used herein may describe any suitable layer or layers having any suitable shape or shapes (e.g. flat, curved, or complexly curved) and any suitable dimensions. Together, the plurality of composite layers 7612 and the inner and outer structural layers (e.g., generally shown as 7610, and 7615) may form a crown portion 6235 that, when coupled to the body portion 6210 to enclose the opening in the top portion 6230, may improve the ability of the golf club head 6200 to withstand torsional or compressive forces imparted during impact with a golf ball, which may improve performance or reduce mishits. The apparatus, methods, and articles of manufacture described herein are not limited in this regard.

The plurality of composite layers 7612 may include a plurality of layers of composite materials in a stacked arrangement. A layer of composite material 7614 may include a layer of fabric combined with an amount of resin. The fabric may be constructed from graphite fiber (commonly referred to as "carbon fiber"), glass fiber, aramid fiber, carbon nanotubes, or any other suitable high-performance fiber, combination of fibers, or material. In some examples, the fabric may be a hybrid of two or more types of fibers, such as a hybrid fabric made of carbon fibers and aramid fibers. Examples of aramid fibers include KEVLAR, TWARON, NOMEX, NEW STAR, TECHNORA, and TEIJINCONEX fibers. The fabric may be constructed as a woven, knitted, stitched, or nonwoven (e.g. uni-directional) fabric. Examples of suitable woven fabrics include Style 7725 Bi-directional E-Glass (Item No. 1094), Twill Weave Carbon Fiber Fabric (Item No. 1069), and KEVLAR Plain Weave Fabric (Item No. 2469), all available from Fibre Glast Developments Corporation of Brookville, Ohio.

In some instances, resin may be applied to the fabric during a lamination process, either by hand or through an infusion process. In other instances, the fabric may be pre-impregnated with resin. These fabrics are commonly referred to as "prepreg" fabrics. Prepreg fabrics may require cold storage to ensure the resin does not cure prematurely. During manufacturing, heating the crown portion 6235 (e.g. in an oven or autoclave) may be required to fully cure (i.e. polymerize) the resin such that the crown portion 6235 takes on desirable structural attributes as the resin hardens. The apparatus, methods, and articles of manufacture described herein are not limited in this regard.

In some examples, the resin may be a thermosetting resin, such as an epoxy resin, vinyl-ester resin, polyester resin, or other suitable resin. Resin selection may be based, at least in part, on fabric compatibility and the characteristics of the composite layers. Epoxy resins are suitable since they may be used to form a strong, lightweight composite crown portion 6235 that is dimensionally stable. A suitable epoxy resin is System 2000 Epoxy Resin (Item No. 2000-A) available from Fibre Glast Developments Corporation.

The epoxy resin may be mixed with a suitable epoxy hardener, such as 2020 Epoxy Hardener (Item No. 2020-A), 2060 Epoxy Hardener (Item No. 2060-A), or 2120 Epoxy Hardener (Item No. 2120-A) from Fibre Glast Developments Corporation. Selection of an epoxy hardener may be based, at least in part, on desired pot life and working time, which may be dictated by the size and complexity of the composite crown portion 6235 being manufactured. Epoxy hardener selection may also be based on desired cure temperature and cure time. An epoxy hardener may be selected that is compatible with the chosen manufacturing temperature and time. The apparatus, methods, and articles of manufacture described herein are not limited in this regard.

The crown portion 6235 may be formed by any suitable process, such as a wet layup process where liquid resin is distributed over a fabric made of fibers to wet out the fabric. The liquid resin may be distributed by hand, by a resin infusion process, or by any other suitable process. The wet layup process may utilize a peel ply layer or mold release agent to prevent the composite crown portion 6235 from adhering to a vacuum bagging film during a vacuum bagging process. An example of a suitable peel ply layer is Peel Ply Release Fabric (Catalog No. VB-P56150) available from U.S. Composites, Inc. of West Palm Beach, Fla.

During the layup process, fabric may be trimmed to an appropriate size and then laid down over a mold. Resin may then be applied to the surface of the fabric using any suitable tool, such as a roller or brush. Through a lamination process, the resin may be forced into the fabric to impregnate the fabric with resin. When prepreg fabrics are used in the layup, the step of applying resin may be omitted, since the fabric already contains a suitable amount of resin to facilitate the lamination process. A peel ply layer may be inserted between the prepreg fabric and the vacuum bagging film to prevent the composite carbon crown 6235 from adhering to the vacuum bagging film. The apparatus, methods, and articles of manufacture described herein are not limited in this regard.

Figure 79:
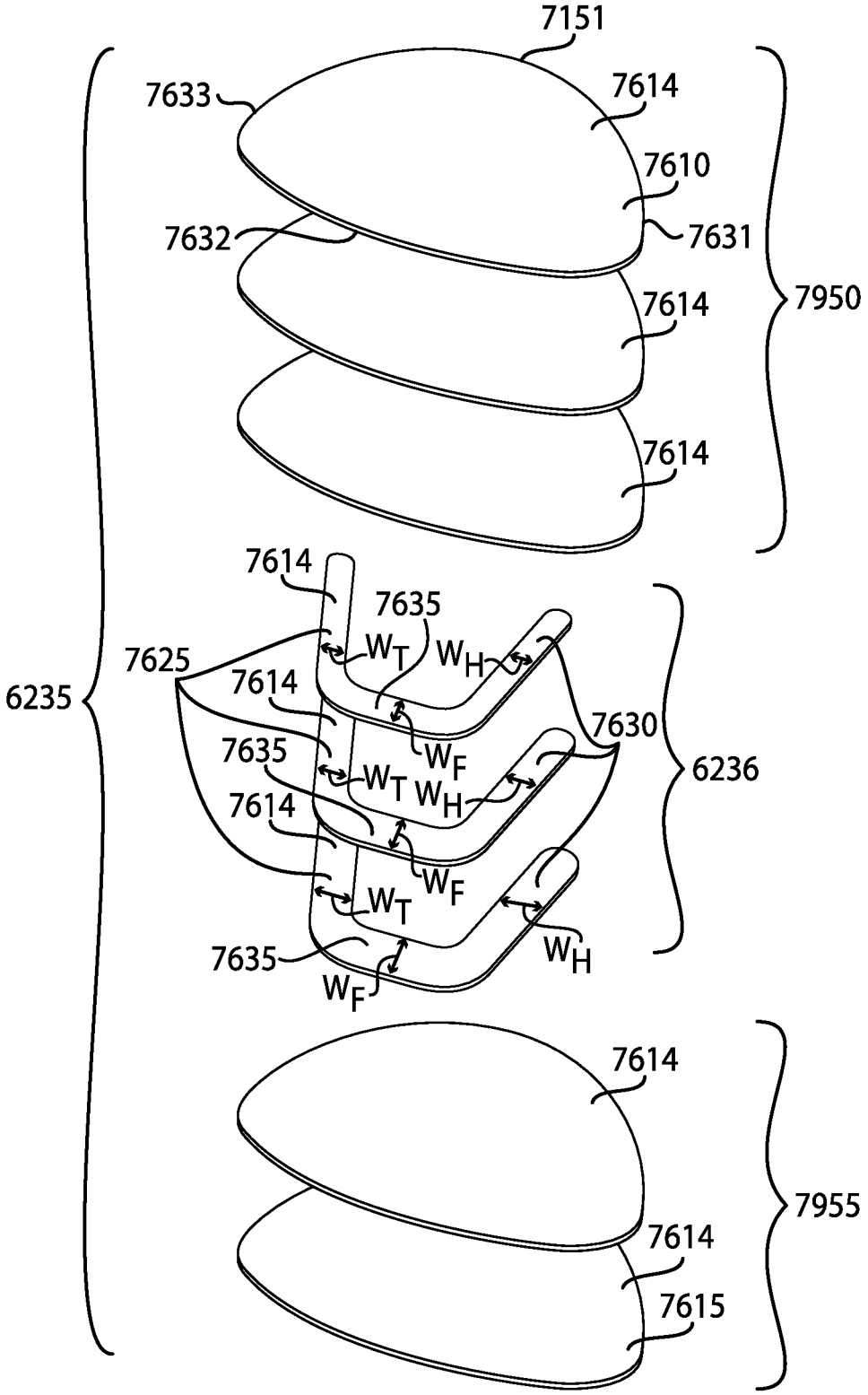
FIG. 79 depicts an exploded view of an example crown portion for the example golf club head of FIG. 62.
Figure 80:
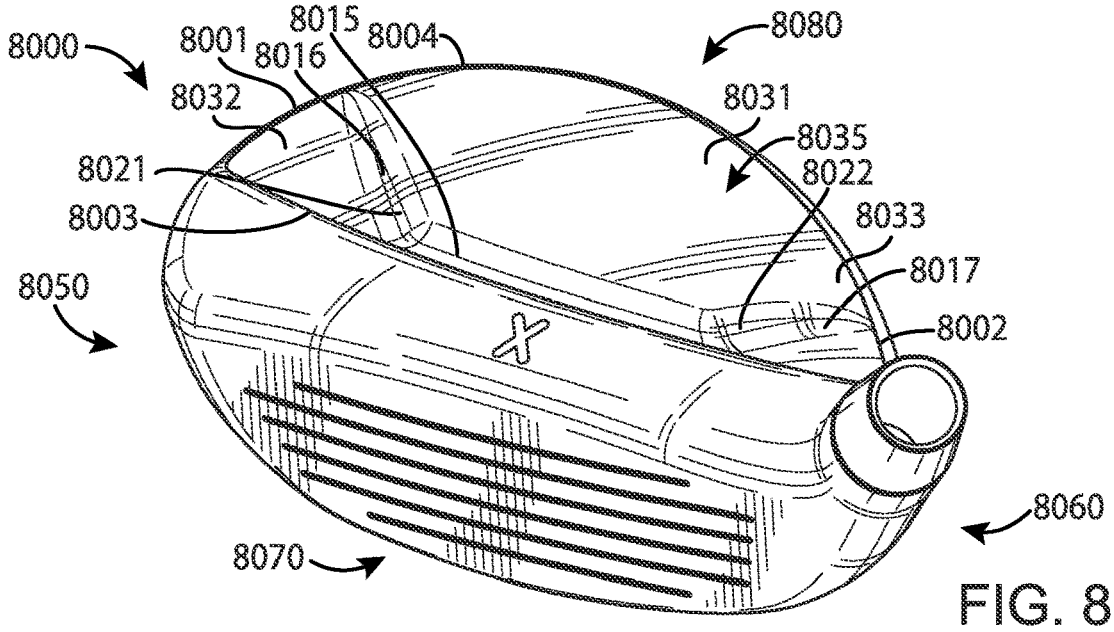
FIG. 80 is top perspective view of an example golf club head according to an embodiment of the apparatus, methods, and articles of manufacture described herein.
Figure 81:
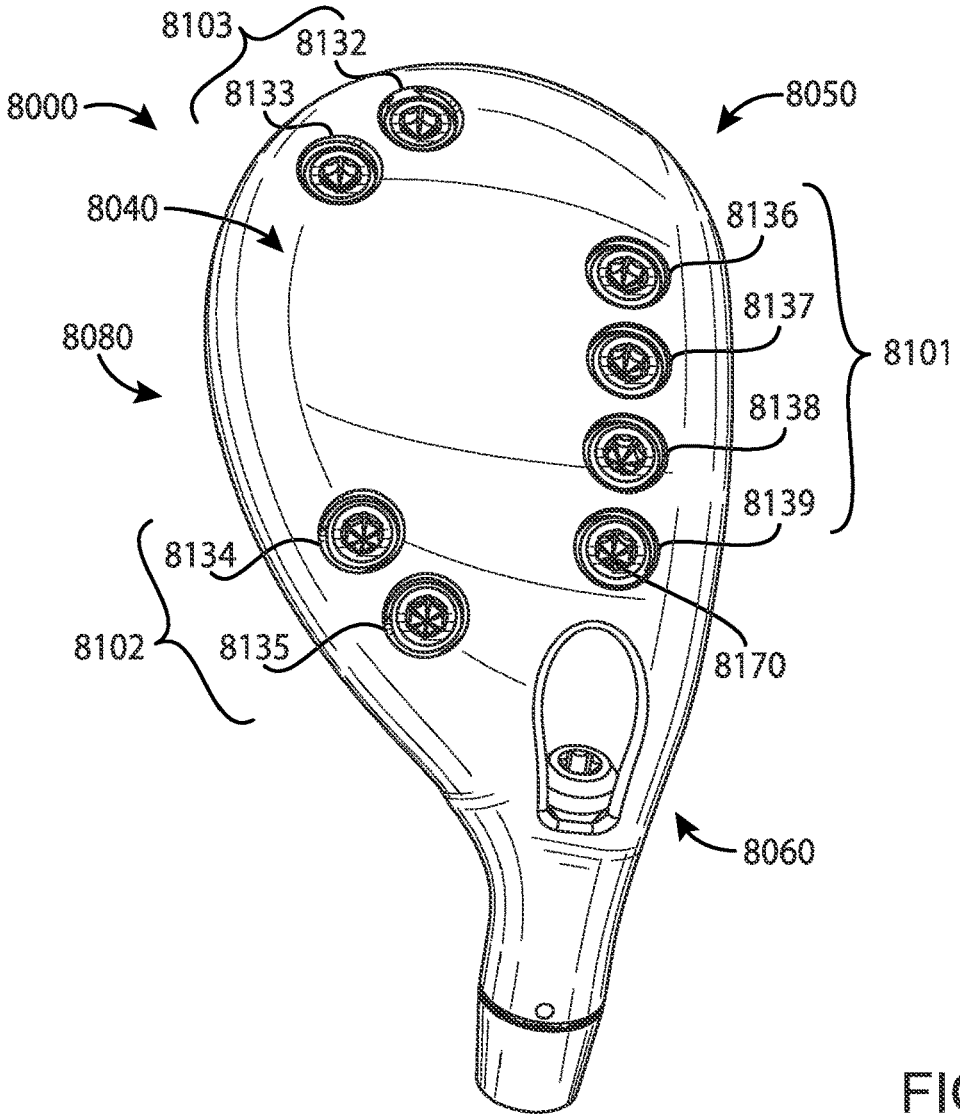
FIG. 81 depicts a bottom perspective view of the example golf club head of FIG. 80.
Figure 82:
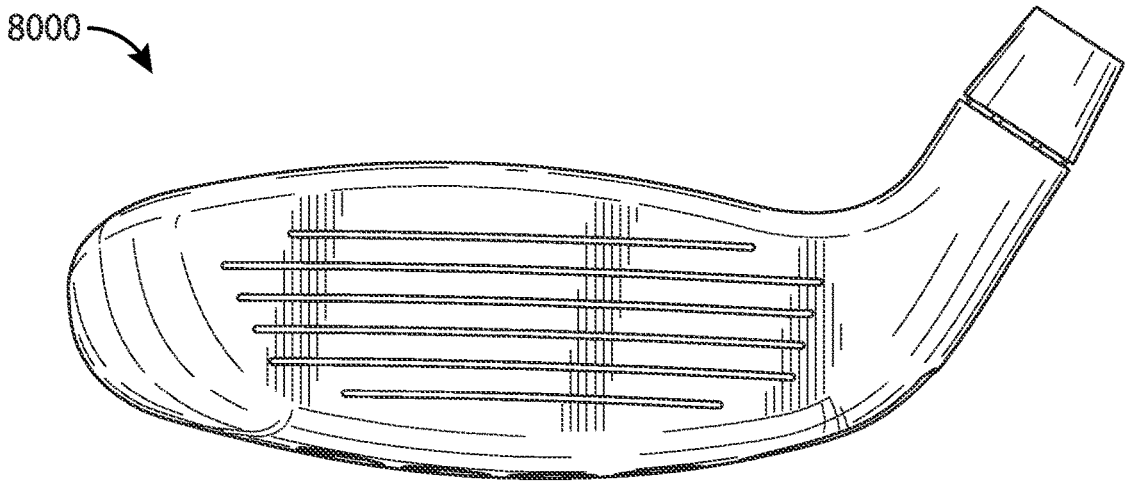
FIG. 82 depicts a front view of the example golf club head of FIG. 80.
Figure 83:
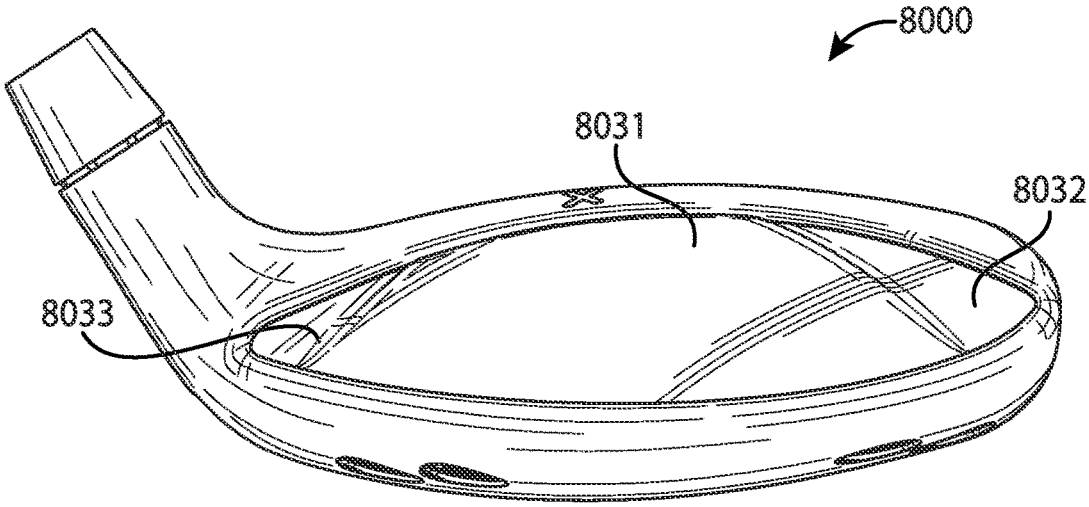
FIG. 83 depicts a rear view of the example golf club head of FIG. 80.
Figure 84:
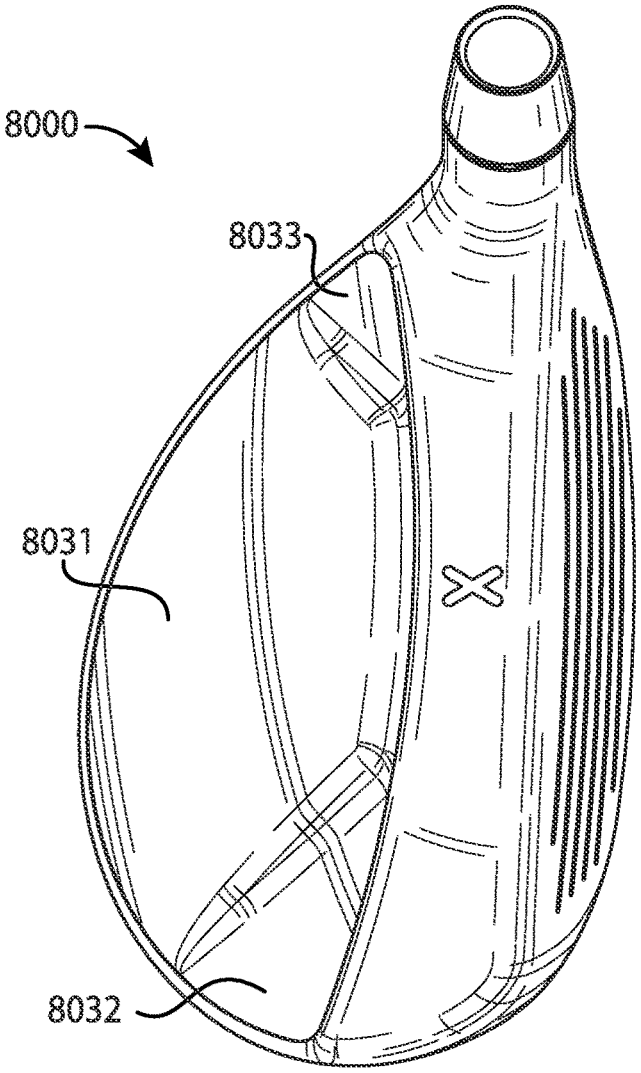
FIG. 84 depicts a top view of the example golf club head of FIG. 80.
Figure 85:
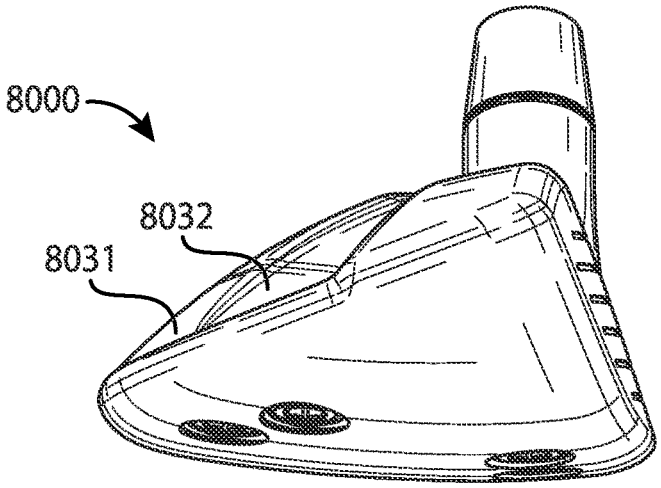
FIG. 85 depicts a toe view of the example golf club head of FIG. 80.
Figure 86:
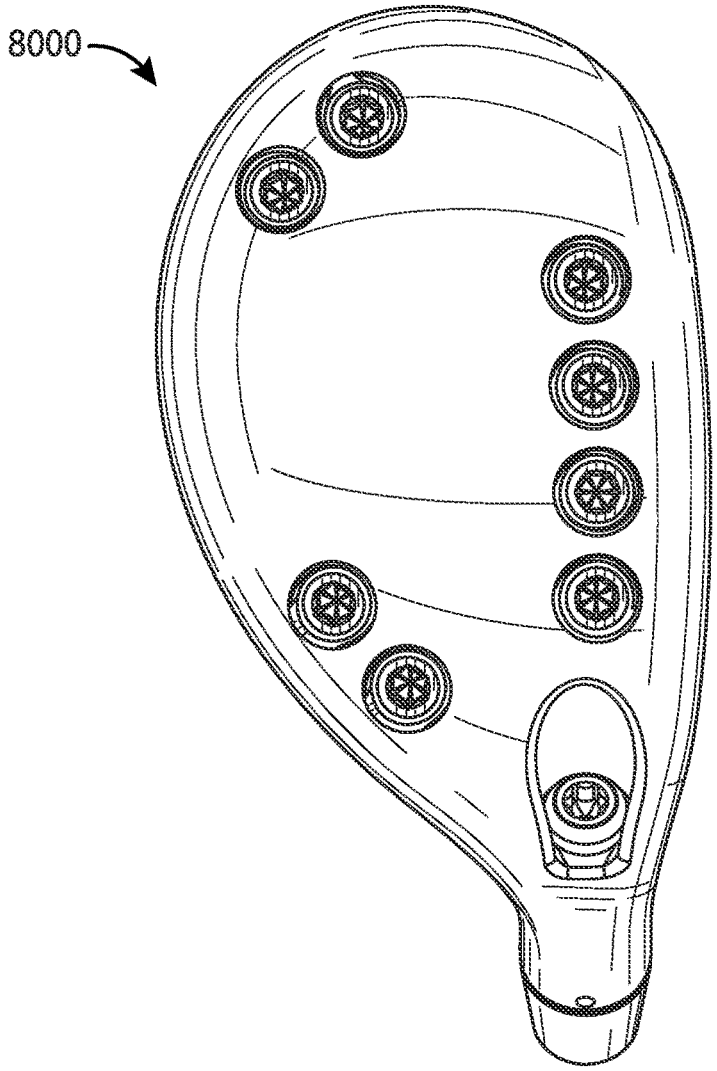
FIG. 86 depicts a bottom view of the example golf club head of FIG. 80.
Figure 87:
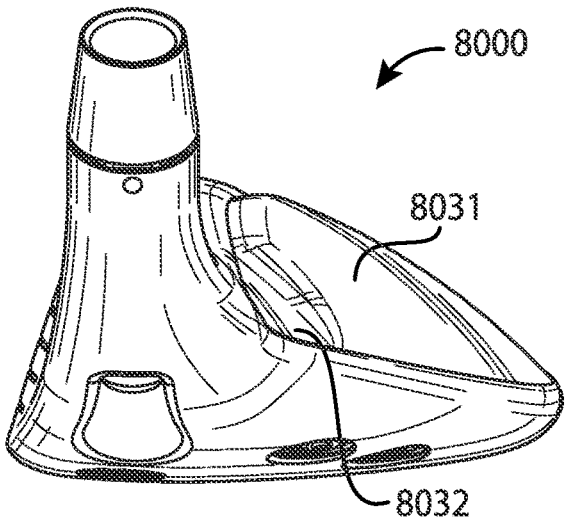
FIG. 87 depicts a heel view of the example golf club head of FIG. 80.
Figure 88:
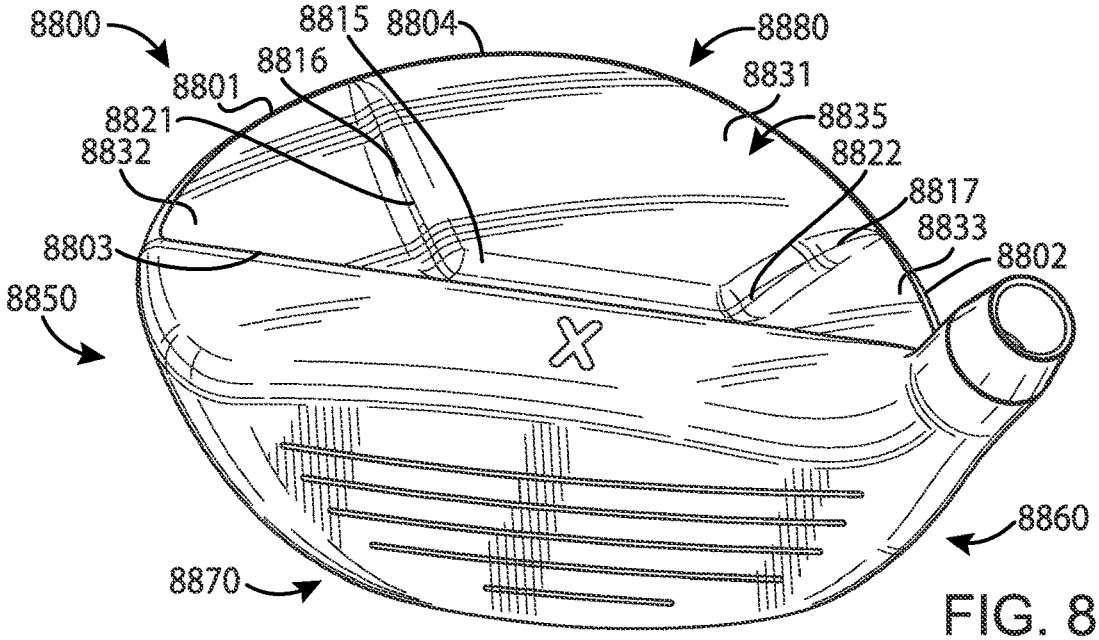
FIG. 88 is top perspective view of an example golf club head according to an embodiment of the apparatus, methods, and articles of manufacture described herein.
Figure 89:
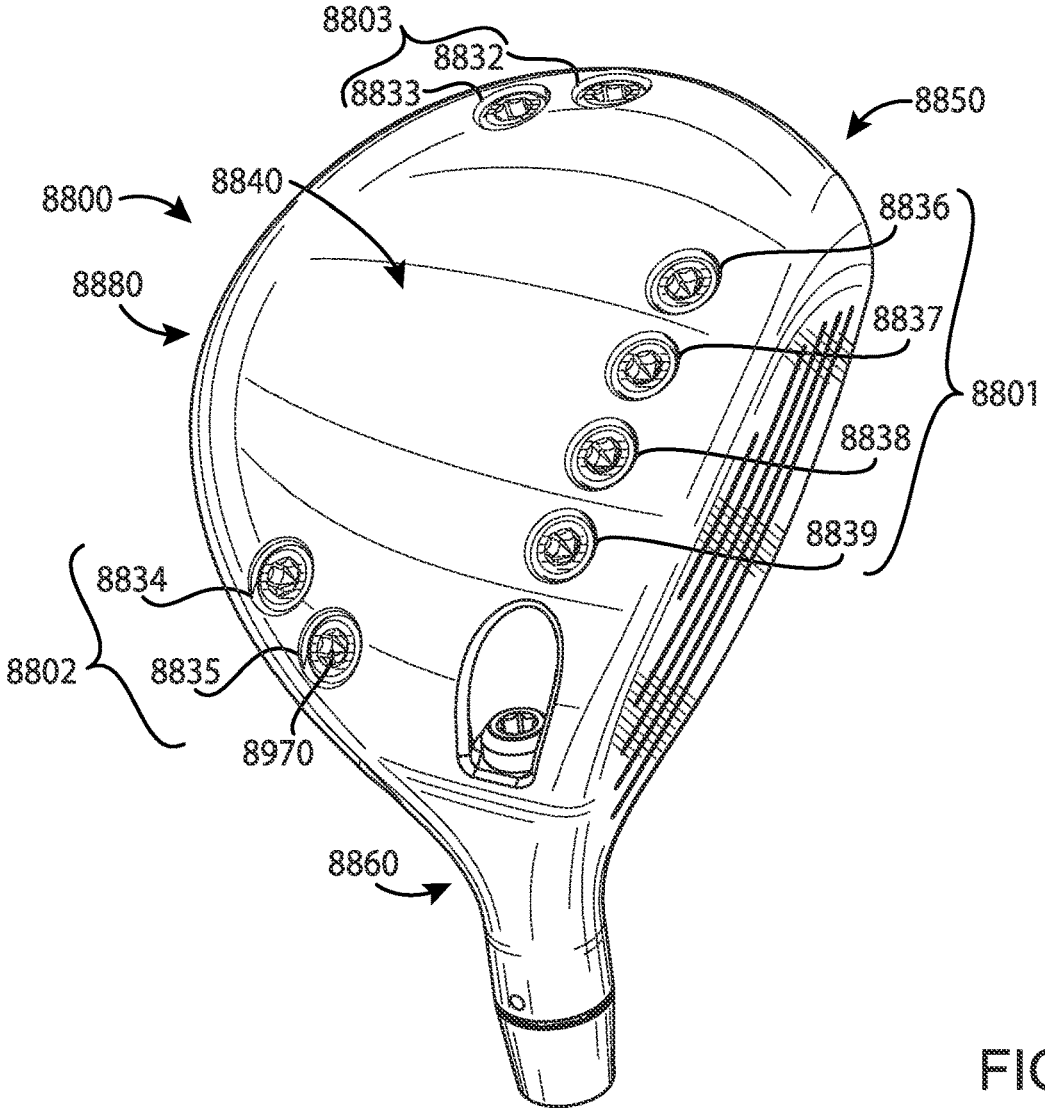
FIG. 89 depicts a bottom perspective view of the example golf club head of FIG. 88.
Figure 90:
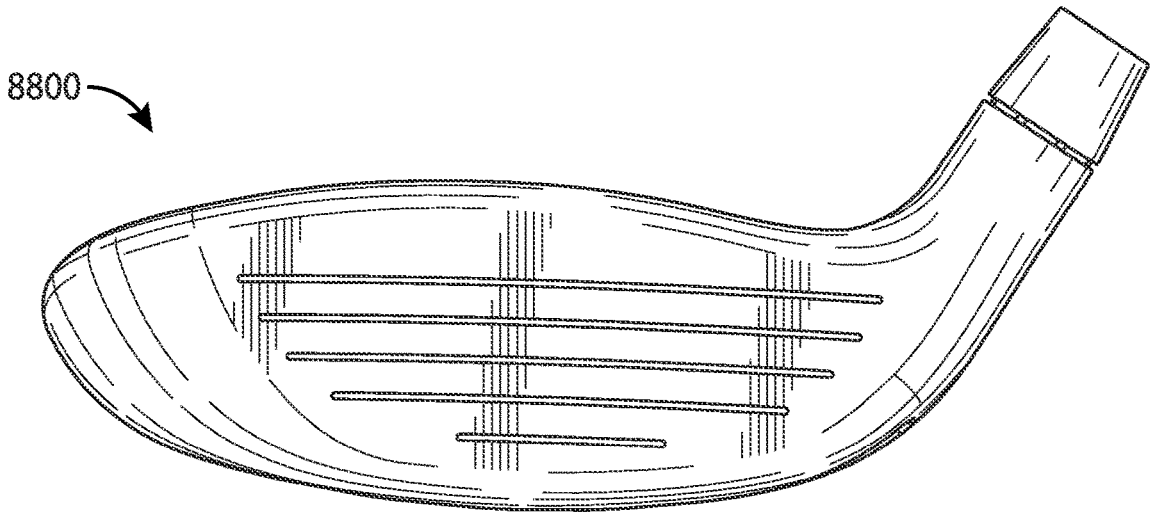
FIG. 90 depicts a front view of the example golf club head of FIG. 88.
Figure 91:
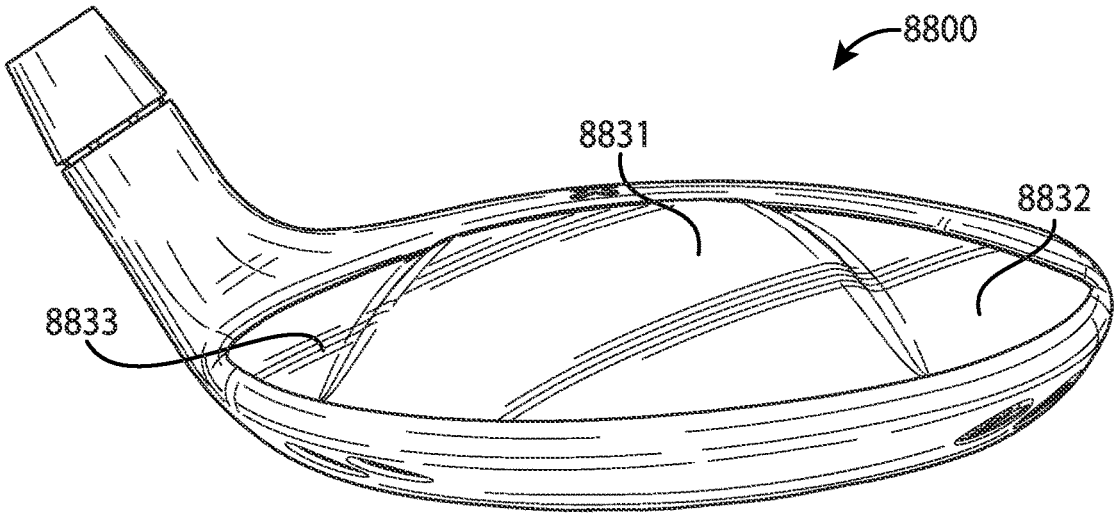
FIG. 91 depicts a rear view of the example golf club head of FIG. 88.
Figure 92:
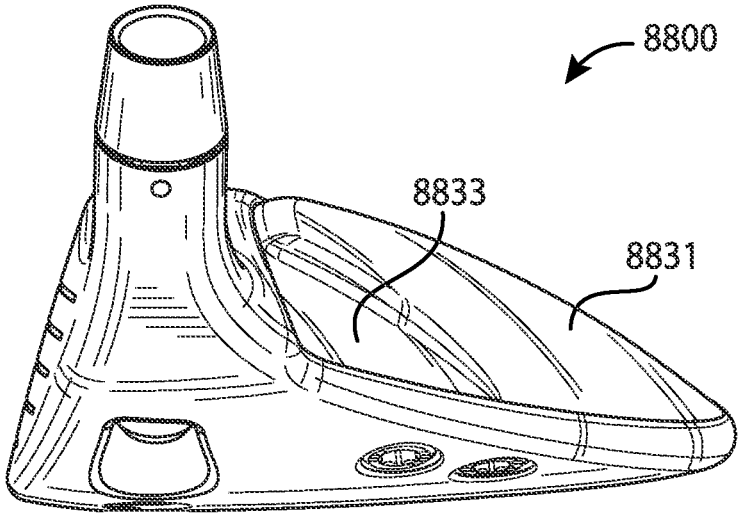
FIG. 92 depicts a heel view of the example golf club head of FIG. 88.
Figure 93:
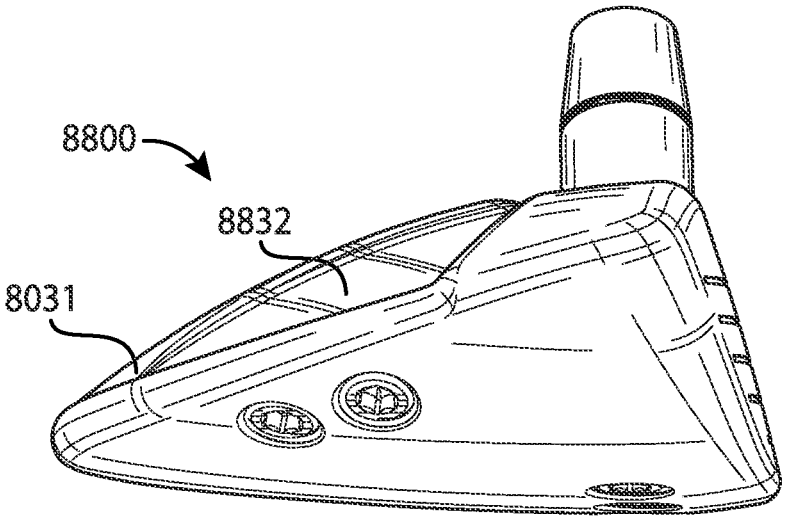
FIG. 93 depicts a toe view of the example golf club head of FIG. 88.
Figure 94:
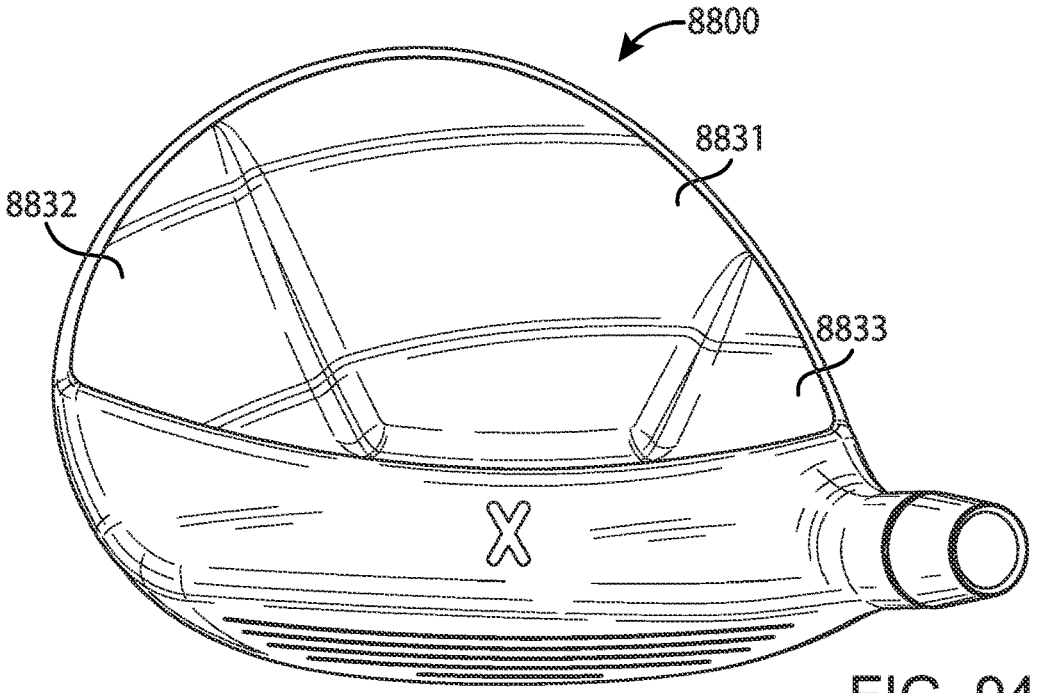
FIG. 94 depicts a top view of the example golf club head of FIG. 88.
Figure 95:
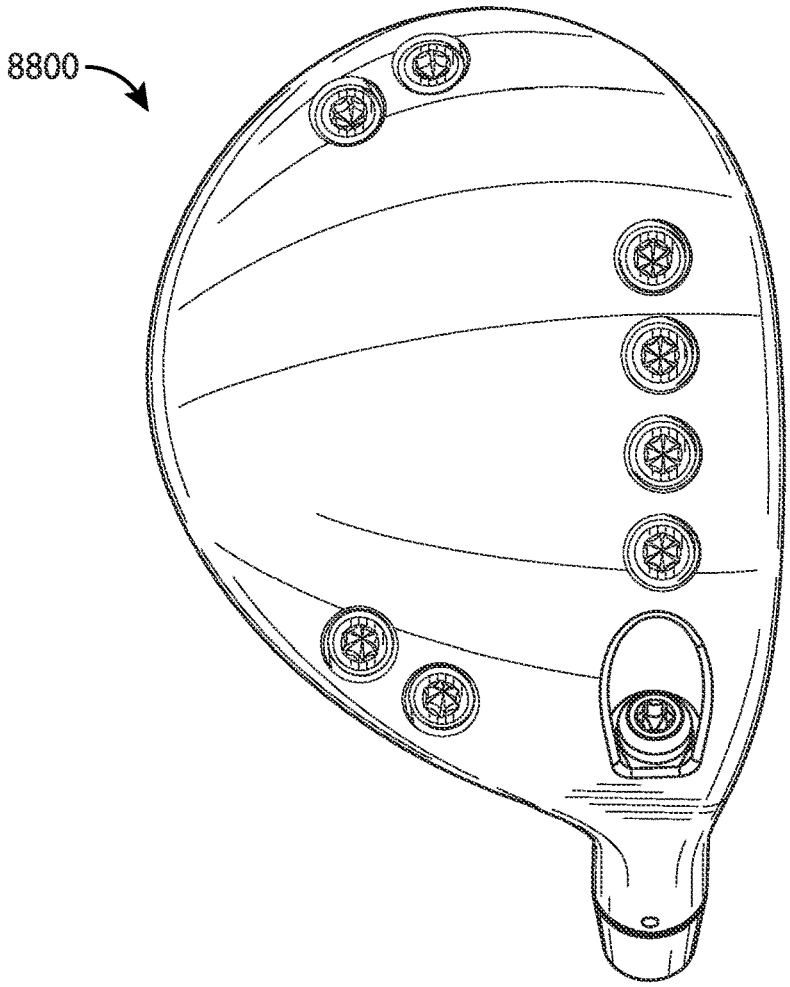
FIG. 95 depicts a bottom view of the example golf club head of FIG. 88.

FIG. 79 shows an exploded view of layers of an example crown portion 6235 prior to execution of a manufacturing process that yields the contoured crown portion 6235 shown in FIG. 62. The crown portion 6235 may include an upper plurality of composite layers 7950, a lower plurality of composite layers 7955, and a crown stiffening portion 6236 disposed between the upper and lower pluralities of composite layers. The presence of the crown stiffening portion 6236 may allow lightweight thin portions 7135 to be utilized adjacent to the crown stiffening portion 6236, as shown in FIG. 62. Together, the crown stiffening portion 6236 and adjacent thin portions 7135 may yield a crown portion 6235 that is lighter and/or stiffer than a crown portion having a uniform thickness (e.g., one generally shown as 4835). A thin portion 7135 may be any region in the crown portion 6235 that does not include a crown stiffening portion 6236. The crown stiffening portion 6236 may include a plurality of layers of composite material arranged in a stacked configuration. Each layer of composite material 7614 may include a layer of fabric combined with resin. The fabric may be constructed from carbon fiber, glass fiber, aramid fiber, carbon nanotubes, or any other suitable high-performance fiber, combination of fibers, or material. In some examples, the fabric may be a hybrid of two or more types of fibers, such as a hybrid fabric made of carbon fibers and aramid fibers. The fabric may be constructed as a woven, knitted, stitched, or uni-directional fabric. The apparatus, methods, and articles of manufacture described herein are not limited in this regard.

During manufacturing of the crown portion 6235, a plurality of composite layers 7614, such as those depicted in FIG. 79, may be laid in a contoured mold. Pressure may be applied to the layers 7614 to encourage bonding of adjacent layers to form the contoured composite crown portion 6235. Heat may be applied to the layers to encourage bonding of adjacent layers to form the crown portion 6235. Pressing the composite layers 7614 against contoured surfaces of the mold may produce a raised central crown portion 6431 and contoured transition regions (e.g., generally shown as 6434, and 6435) adjacent to the raised central crown portion, as shown in FIG. 62. To ensure smooth transition regions adjacent to the raised central crown portion 6431, each subsequent composite layer in the stack of composite layers forming the crown stiffening portion 6236 may become gradually wider (e.g. in descending order in the stack) to yield smooth transition regions 6434 and 6435 in the manufactured crown portion 6235. In the example shown in FIG. 79, each composite layer of the crown stiffening portion 6236 may have a front width ($w_F$), a heel-side width ($w_H$), and a toe-side width ($w_T$). In one example, a composite layer 7614 in the crown stiffening portion 6236 may have a width ($w_F$, $w_H$, or $w_T$) that is at least 1% greater than an adjacent composite layer 7614 in the crown stiffening portion 6236. In another example, a composite layer 7614 in the crown stiffening portion 6236 may have a width ($w_F$, $w_H$, or $w_T$) that is at least 5% greater than an adjacent composite layer 7614 in the crown stiffening portion 6236. In yet another example, a composite layer 7614 in the crown stiffening portion 6236 may have a width ($w_F$, $w_H$, or $w_T$) that is at least 10% greater than an adjacent composite layer 7614 in the crown stiffening portion 6236. In still another example, a composite layer 7614 in the crown stiffening portion 6236 may have a width ($w_F$, $w_H$, or $w_T$) that is at least 15% greater than an adjacent composite layer 7614 in the crown stiffening portion 6236. In yet another example, a composite layer 7614 in the crown stiffening portion 6236 may have a width ($w_F$, $w_H$, or $w_T$) that is at least 30% greater than an adjacent composite layer 7614 in the crown stiffening portion 6236. While the above examples may describe particular percentages, the composite layer 7614 in the crown stiffening portion 6236 may have a width less than 1% of an adjacent composite layer 7614 in the crown stiffening portion 6236. The apparatus, methods, and articles of manufacture described herein are not limited in this regard.

The inner structural layer 7615 may include a layer of fabric combined with resin. The fabric may be constructed from carbon fiber, glass fiber, aramid fiber, carbon nanotubes, or any other suitable high-performance fiber, combination of fibers, or material. In some examples, the fabric may be a hybrid of two or more types of fibers, such as a hybrid fabric made of carbon fibers and aramid fibers. The fabric may be constructed as a woven, knitted, stitched, or uni-directional fabric. In one example, the inner structural layer 7615 may include a layer of glass fiber fabric impregnated with epoxy resin. The apparatus, methods, and articles of manufacture described herein are not limited in this regard.

The outer structural layer 7610 may include a layer of fabric combined with resin. The fabric may be constructed from carbon fiber, glass fiber, aramid fiber, carbon nanotubes, or any other suitable high-performance fiber, combination of fibers, or material. In some examples, the fabric may be a hybrid of two or more types of fibers, such as a hybrid fabric made of carbon fibers and aramid fibers. The fabric may be constructed as a woven, knitted, stitched, or uni-directional fabric. In one example, the outer structural layer 7610 may include a woven layer of KEVLAR fiber fabric impregnated with epoxy resin. The apparatus, methods, and articles of manufacture described herein are not limited in this regard.

The plurality of composite layers 7612 may include a plurality of layers of composite materials arranged in a stacked configuration. In one example, the plurality of composite layers 7612 may include two or more layers of prepreg uni-directional fabric. In another example, the plurality of composite layers 7612 may include three or more layers of prepreg uni-directional fabric. In still another example, the plurality of composite layers 7612 may include four or more layers of prepreg uni-directional fabric where four layers are arranged in a 0/90/0/90 configuration to increase tensile strength along two perpendicular axes. The apparatus, methods, and articles of manufacture described herein are not limited in this regard.

An outer surface 7611 of the crown portion 6235 may have an anti-glare finish. An outer surface of the crown portion 6235 may have a medium or low gloss appearance to reduce the amount of light reflected upward at an individual's eyes when aligning the golf club head 6200 with a golf ball and performing a golf shot. A relative gloss value may be determined by projecting a beam of light at a fixed intensity and angle onto the outer surface 7611 of the crown portion 6235 and measuring the amount of light reflected at an equal but opposite angle upward at the individual. On a measurement scale, a specular reflectance of 0 gloss units (GU) may be associated with a perfectly matte surface, and a specular reflectance of 100 GU may be associated with a highly polished black glass material. Providing a crown portion 6235 with a relatively low specular reflectance may be desirable to reduce distraction perceived by the individual of the golf club head 6200, which may reduce mishits. In one example, an outer surface 7611 of the crown portion 6235 may have a specular reflectance of less than 55 GU. In another example, the outer surface 7611 of the crown portion 6235 may have a specular reflectance of less than 40 GU. In yet another example, the outer surface 7611 of the crown portion 6235 may have a specular reflectance of less than 25 GU. In still another example, the outer surface 7611 of the crown portion 6235 may have a specular reflectance of less than 10 GU. While the above examples may describe particular specular reflectance, the apparatus, methods, and article of manufacture may include the outer surface 7611 of the crown portion 6235 with a specular reflectance greater than or equal to 55 GU. The apparatus, methods, and articles of manufacture described herein are not limited in this regard.

In some examples, the outer surface of the crown portion 6235 may include an antireflective coating. In one example, the antireflective coating may have a specular reflectance of less than 55 GU. In another example, the antireflective coating may have a specular reflectance of less than 40 GU. In yet another example, the antireflective coating may have a specular reflectance of less than 25 GU. In still another example, the antireflective coating may have a specular reflectance of less than 10 GU. The apparatus, methods, and articles of manufacture described herein are not limited in this regard.

To encourage the inner structural layer 7615 to adhere to an adjacent internal composite layer 7614 during the manufacturing process, it may be necessary to insert a resin or film adhesive layer between the inner structural layer 7615 and the adjacent composite layer. To encourage the outer structural layer 7610 to adhere to an adjacent internal composite layer 7614 during the manufacturing process, it may be necessary to insert a resin or film adhesive layer between the outer structural layer 7610 and the adjacent composite layer. The resin or film adhesive may be an epoxy, epoxy foam, liquid resin, or any suitable film adhesive available from Collano AG, located in Germany. In one example, the crown portion 6235 may include a first film adhesive layer between an inner structural layer 7615 and an adjacent composite layer 7614. The first film adhesive layer may adhere the outer structural layer 7610 to the top surface of the adjacent composite layer 7614 in the upper plurality of composite layers 7950. The crown portion 6235 may include a second film adhesive film layer between the inner structural layer 7615 and an adjacent composite layer 7614. The second film adhesive layer may adhere the inner structural layer 7615 to a bottom surface of the adjacent composite layer 7614 in the lower plurality of composite layers 7955. The apparatus, methods, and articles of manufacture described herein are not limited in this regard.

FIG. 78 shows an enlarged view of a portion 7800 of the cross-sectional view shown in FIG. 77. The crown portion 6235 may include an integral rib 7625 disposed between the inner layer 7615 and the outer layer 7610. The integral rib 7625 may include a plurality of layers of composite material 7612. The integral rib 7625 may include two or more layers of composite material. The integral rib 7625 may include two or more layers of carbon fiber composite material. The integral rib 7625 may include three or more layers of composite material. The integral rib 7625 may include four or more layers of composite material. The integral rib 7625 may include five or more layers of composite material. The integral rib 7625 may include six or more layers of composite material. The integral rib 7625 may include seven or more layers of composite material. The integral rib 7625 may include eight or more layers of composite material. The apparatus, methods, and articles of manufacture described herein are not limited in this regard.

The integral rib may be a toe-side integral rib 7625. The toe-side integral rib 7625 may extend from a front perimeter 7632 of the crown portion 6235 to a rear perimeter 7151 of the crown portion 6235. The toe-side integral rib 7625 may include a plurality of layers of composite material 7614. The toe-side integral rib 7625 may include two or more layers of composite material disposed between the inner layer 7615 and the outer layer 7610 of the crown portion 6235. The toe-side integral rib 7625 may extend rearward from the forward portion 6231. The toe-side integral rib 7625 may extend rearward from a starting location between the central plane 7604 and the toe-side golf ball plane 7602 and terminate at an ending location between the toe-side plane 7605 and the toe-side golf ball plane 7602. In one example, the toe-side integral rib 7625 may have a maximum thickness greater than or equal to 2 mm. In another example, the toe-side integral rib 7625 may have a maximum thickness greater than or equal to 2.1 mm. In yet another example, the toe-side integral rib 7625 may have a maximum thickness greater than or equal to 2.4 mm. While the above examples may describe particular thicknesses, the apparatus, methods, and article of manufacture described herein may include the toe-side integral rib 7625 with a maximum thickness of less than 2 mm. The apparatus, methods, and articles of manufacture described herein are not limited in this regard.

The crown portion 6235 may include a heel-side integral rib 7630. The heel-side integral rib 7630 may extend from a front perimeter 7632 of the crown portion 6235 to a rear perimeter 7151 of the crown portion. The heel-side integral rib 7630 may include a plurality of layers of composite material 7614. The heel-side integral rib 7630 may include two or more layers of composite material disposed between the inner layer 7615 and the outer layer 7610 of the crown portion. The heel-side integral rib 7630 may extend rearward from the forward portion 6231. The heel-side integral rib 7630 may extend rearward from a starting location between the central plane 7604 and the heel-side golf ball plane 7603 and terminate at an ending location between the heel-side plane 7606 and the heel-side golf ball plane 7603. In one example, the heel-side integral rib 7630 may have a maximum thickness greater than or equal to 2.0 mm. In another example, the heel-side integral rib 7630 may have a maximum thickness greater than or equal to 2.1 mm. In yet another example, the heel-side integral rib 7630 may have a maximum thickness greater than or equal to 2.4 mm. While the above examples may describe particular thicknesses, the apparatus, methods, and article of manufacture described herein may include the heel-side integral rib 7630 with a maximum thickness of less than 2 mm. The apparatus, methods, and articles of manufacture described herein are not limited in this regard.

The crown portion 6235 may include a central integral rib 7635. The central integral rib 7635 may extend along the front perimeter 7632 of the crown portion 6235. The central integral rib 7635 may extend from the toe-side integral rib 7625 to the heel-side integral rib 7630. The central integral rib 7635 may extend from a forward-most end of the toe-side integral rib 7625 to a forward-most end of the heel-side integral rib 7630. The central integral rib may extend a distance of at least 3 centimeters beside the junction 6232 formed between the front perimeter 7632 of the crown portion 6235 and the forward portion 6231 of the top portion 6230. The central integral rib 7635 may include a plurality of layers of composite material 7614. The central integral rib 7635 may include two or more layers of composite material disposed between the inner layer 7615 and the outer layer 7610 of the crown portion 6235. The central integral rib 7635 may be located between the toe-side golf ball plane 7602 and the heel-side golf ball plane 7603. In one example, the central integral rib 7635 may have a maximum thickness greater than or equal to 2.0 mm. In another example, the central integral rib 7635 may have a maximum thickness greater than or equal to 2.1 mm. In yet another example, the central integral rib 7635 may have a maximum thickness greater than or equal to 2.4 mm. While the above examples may describe particular thicknesses, the apparatus, methods, and article of manufacture described herein may include the central integral rib 7635 with a maximum thickness of less than 2 mm. The apparatus, methods, and articles of manufacture described herein are not limited in this regard.

The integral ribs (e.g., generally shown as 7625, 7630, and 7635) may enhance the flexural strength of the crown portion 6235. The integral ribs 7625, 7630, and 7635 may enhance the compressive strength of the crown portion 6235. The integral ribs 7625, 7630, and 7635 may reduce outward deflection (e.g., bulging) of the crown portion 6235 in response to an impact force transferred from the body portion 6210 to the crown portion 6235 during impact with a golf ball. Likewise, the integral ribs 7625, 7630, and 7635 may reduce deflection of the crown portion 6235 inward toward the interior cavity of the golf club head 6200 in response to a downward force applied to an outer surface of the crown portion 6235. Inward deflection may be easier to measure repeatably in a test environment than outward deflection, and inward deflection may correlate to outward deflection. Inward deflection may be measured by applying a downward force to an outer surface of the crown portion and measuring physical deflection with a suitable measuring device. In one example, when a downward force of 200 pound-force (lbf) is applied to the central crown portion 6431, the central crown portion 6431 may deflect less than 0.025 inch. In another example, when a downward force of 200 lbf is applied to the central crown portion 6431, the central crown portion 6431 may deflect less than 0.015 inch. In another example, when a downward force of 200 lbf is applied to the central crown portion 6431, the central crown portion 6431 may deflect less than 0.012 inch. The apparatus, methods, and articles of manufacture described herein are not limited in this regard.

Figure 48:
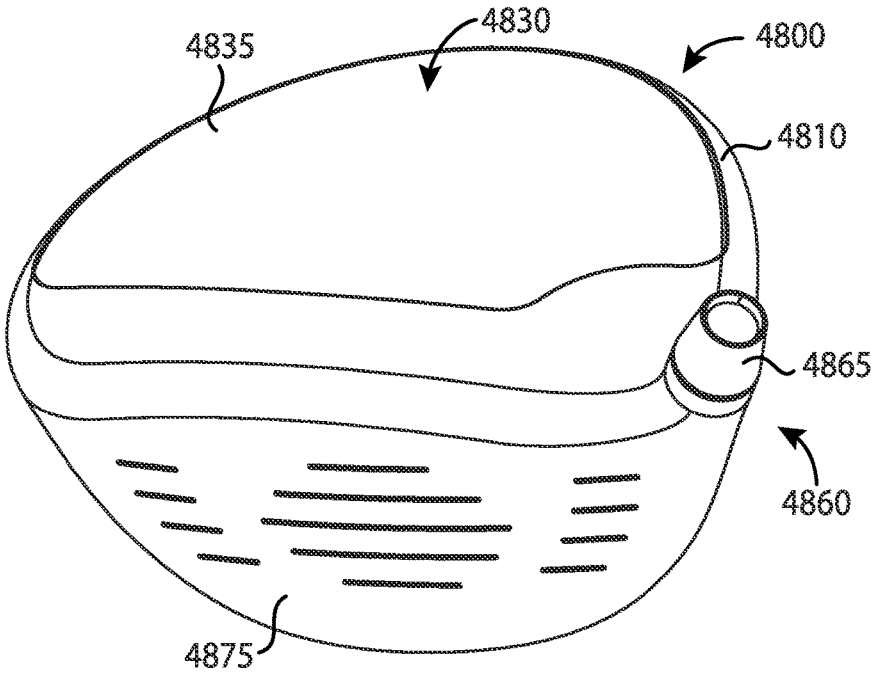
FIG. 48 is a top perspective view of an example golf club head according to an embodiment of the apparatus, methods, and articles of manufacture described herein.
Figure 49:
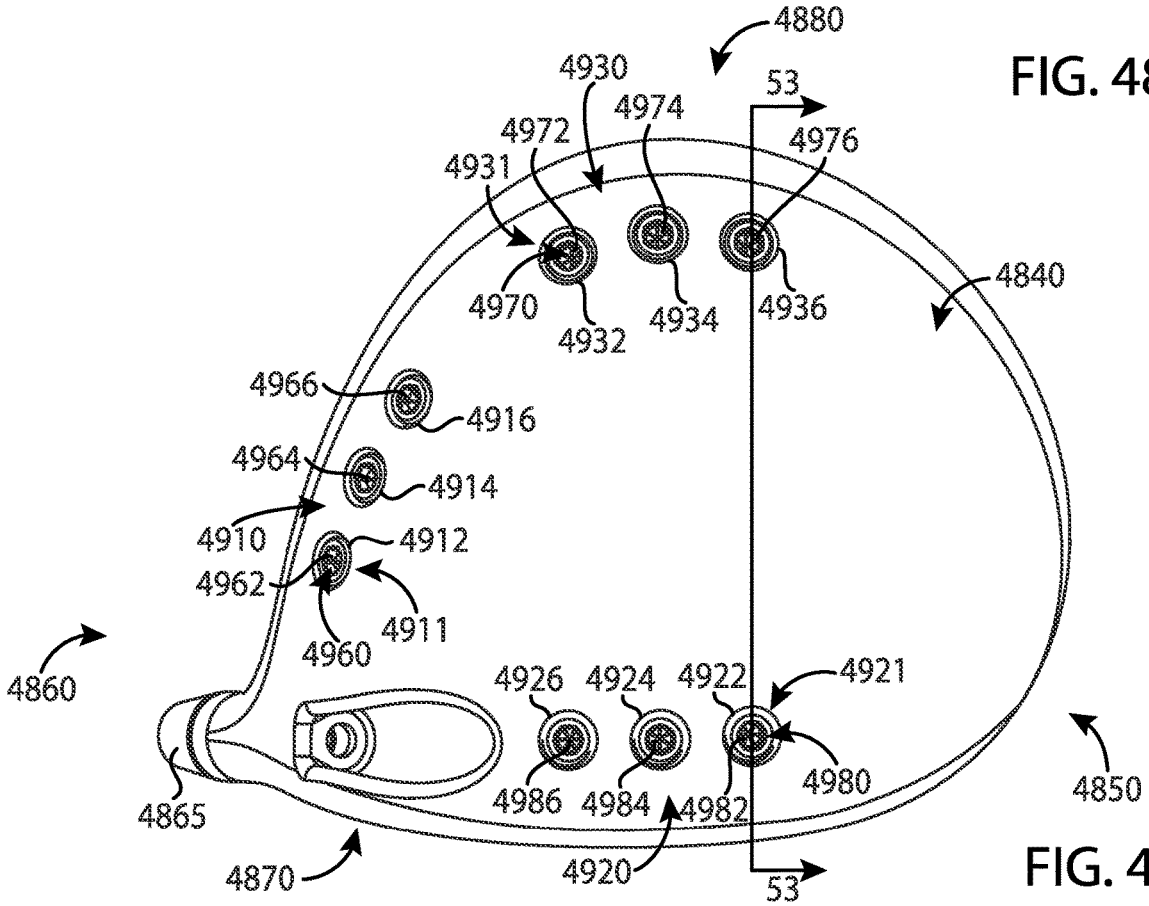
FIG. 49 depicts a bottom view of the example golf club head of FIG. 48.
Figure 50:
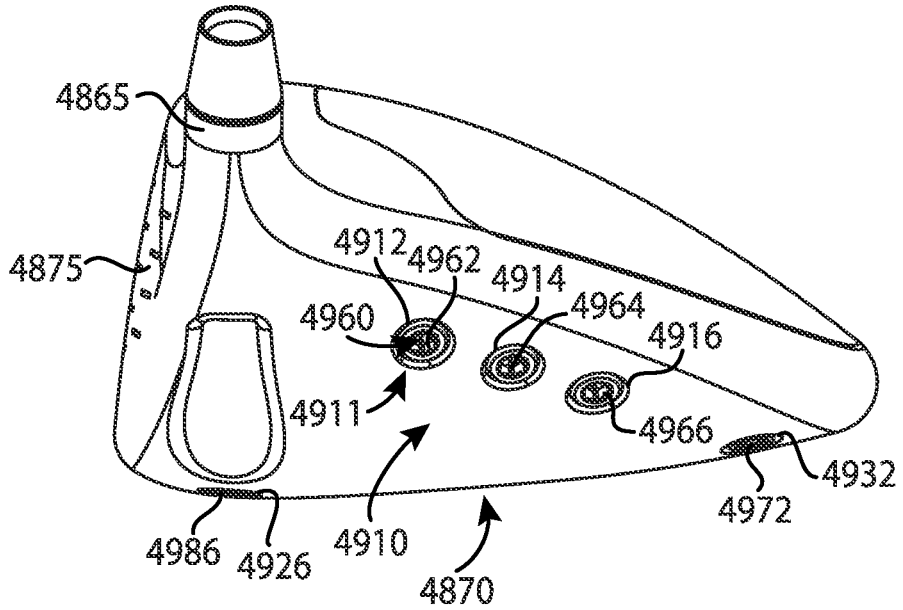
FIG. 50 depicts a toe view of the example golf club head of FIG. 48.
Figure 51:
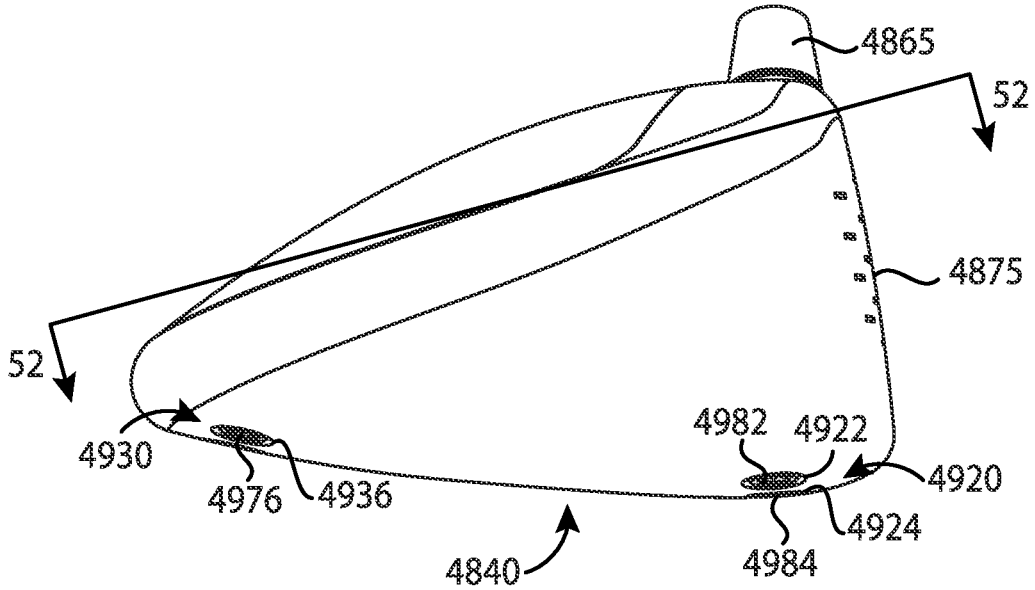
FIG. 51 depicts a heel view of the example golf club head of FIG. 48.

The integral ribs (e.g., 7625, 7630, and 7635) may allow the crown portion 6235 to resist deflection better than a similar crown portion without integral ribs (e.g., one generally shown as 4835 in FIG. 48). In one example, the crown portion 6235 with integral ribs may deflect inward about 0.012 inch whereas the crown portion 4835 without integral ribs may deflect about 0.020 inch in response to applying a downward force of 200 lbf to the respective crown portions. In another example, the crown portion 8835 with integral ribs (e.g., 8815, 8816, and 8817) of a fairway wood-type golf club head 8800 may deflect inward about 0.007 inch whereas a crown portion without integral ribs of a similar golf club head may deflect about 0.013 inch in response to applying a downward force of 200 lbf to the respective crown portions. In yet another example, the crown portion 8035 with integral ribs (e.g., 8015, 8016, and 8017) of a hybrid-type golf club head 8000 may deflect about 0.005 inch whereas the crown portion without integral ribs of a similar golf club head may deflect about 0.009 inch in response to applying a downward force of 200 lbf to the respective crown portions. The apparatus, methods, and articles of manufacture described herein are not limited in this regard.

Figure 100:
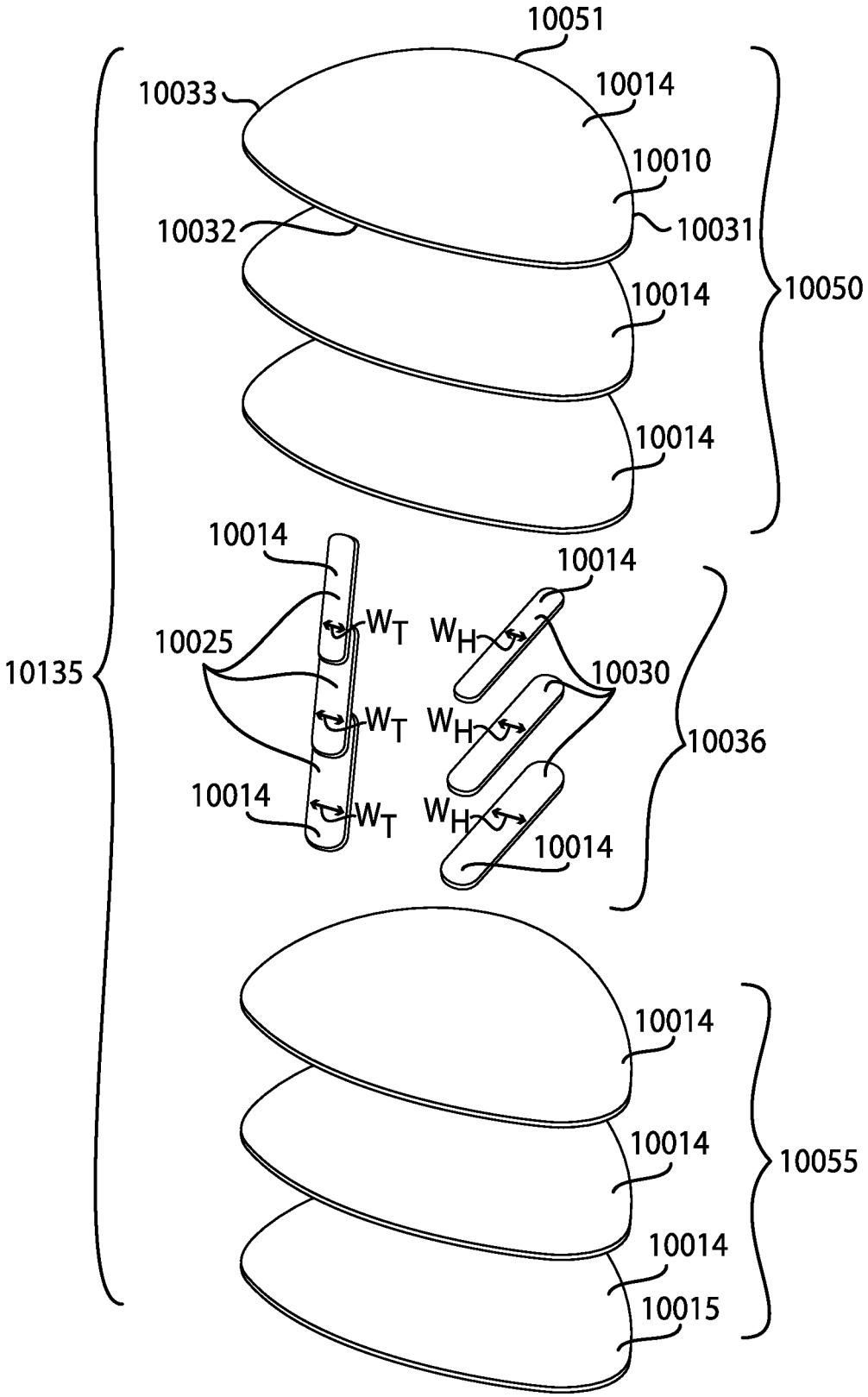
FIG. 100 depicts an exploded view of an example crown portion for an example golf club head.
Figure 101:
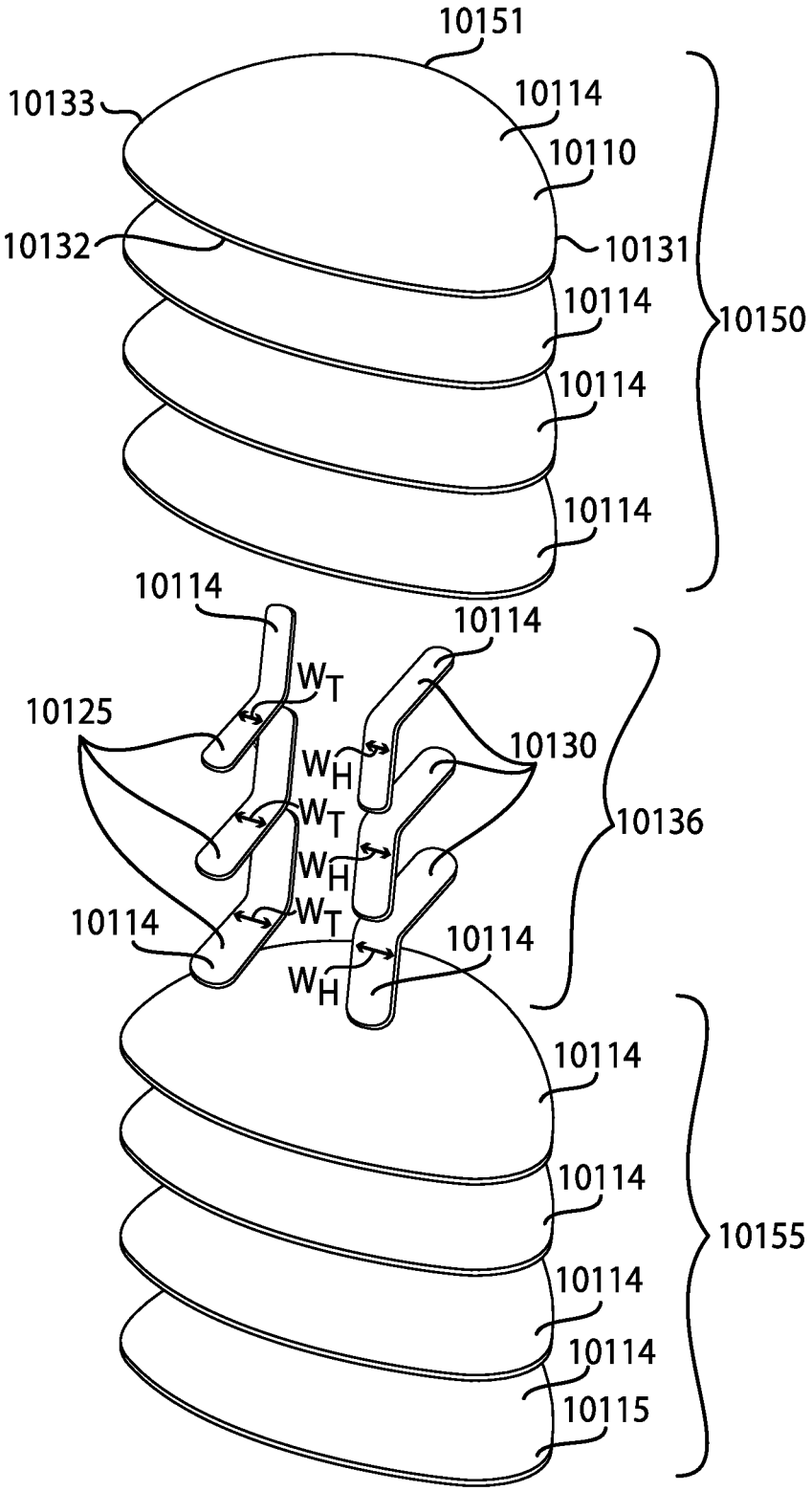
FIG. 101 depicts an exploded view of an example crown portion for an example golf club head.
Figure 102:
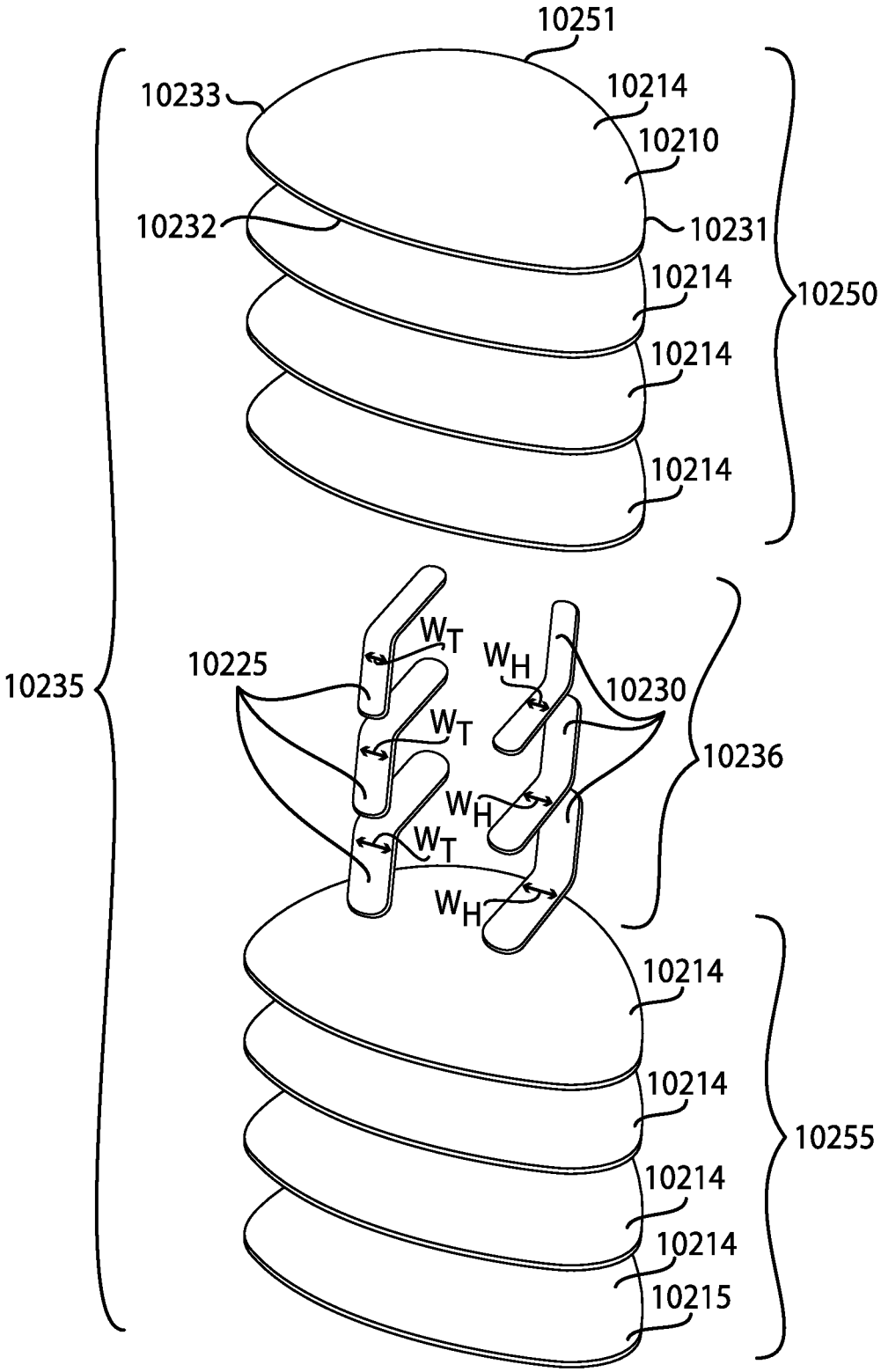
FIG. 102 depicts an exploded view of an example crown portion for an example golf club head.

In the example of FIG. 79, the crown portion 6235 may include a central integral rib 7635, a toe-side integral rib 7625, and a heel-side integral rib 7630. The toe-side integral rib 7625 and the heel-side integral rib 7630 may diverge in a front-to-rear direction along the crown portion 6235. In another example, as shown in FIG. 100, a toe-side integral rib 10025 and a heel-side integral rib 10030 may diverge in a front-to-rear direction along a crown portion 10030. In yet another example, a toe-side integral rib 10125 and a heel-side integral rib 10130 may converge and then diverge in a front-to-rear direction along a crown portion 10135, as shown in FIG. 101. In still another example, a toe-side integral rib 10225 and heel-side integral rib 10230 may diverge and then converge in a front-to-rear direction along a crown portion 10235, as shown in FIG. 102. In another example, the toe-side integral rib and heel-side integral rib may be substantially parallel in a front-to-rear direction along a crown portion. The apparatus, methods, and articles of manufacture described herein are not limited in this regard.

FIG. 100 shows an exploded view of layers 10014 of an example crown portion 10035 prior to executing a manufacturing process that yields a contoured crown portion. In one example, the crown portion 10035 may replace the crown portion 6235 in the golf club head 6200 of FIG. 62. The crown portion 10035 may include an upper plurality of composite layers 10050, a lower plurality of composite layers 10055, and a crown stiffening portion 10036 between the upper and lower pluralities of composite layers. The presence of the crown stiffening portion 10036 may allow for lightweight thin portions to be utilized adjacent to the crown stiffening portion 10036, which together may provide a crown portion 10035 that is lighter and/or stiffer than a crown portion having uniform thickness (e.g., one generally shown as 4835 in FIG. 48). A thin portion 7135 may be any region in the crown portion 10035 that does not include a crown stiffening portion 10036. The crown stiffening portion 10036 may include a toe-side integral rib 10025 and a heel-side integral rib 10030. The toe-side integral rib 10025 may be disposed between the inner layer 10010 and the outer layer 10015. The toe-side integral rib 10025 may be disposed between the upper plurality of composite layers 10050 and the lower plurality of composite layers 10055. The toe-side integral rib 10025 may include one or more layers of composite material 10014. The toe-side integral rib 10025 may include two or more layers of composite material 10014. The toe-side integral rib 10025 may extend from a front portion of the crown portion 10035 to a rear portion of the crown portion 10035. The toe-side integral rib 10025 may extend from a location at or proximate to a front perimeter 10032 of the crown portion 10035 to a location at or proximate to a rear perimeter 10051 of the crown portion 10035. The toe-side integral rib 10025 may extend from a location at or proximate to a front perimeter 10032 of the crown portion 10035 toward a toe-side perimeter 10033 of the crown portion 10035. The heel-side integral rib 10030 may be disposed between the inner layer 10010 and the outer layer 10015. The heel-side integral rib 10030 may be disposed between the upper plurality of composite layers 10050 and the lower plurality of composite layers 10055. The heel-side integral rib 10030 may include one or more layers of composite material 10014. The heel-side integral rib 10030 may include two or more layers of composite material 10014. The heel-side integral rib 10030 may extend from a front portion of the crown portion 10035 to a rear portion of the crown portion 10035. The heel-side integral rib 10030 may extend from a location at or proximate to a front perimeter 10032 of the crown portion 10035 to a location at or proximate to a rear perimeter 10051 of the crown portion 10035. The heel-side integral rib 10030 may extend from a location at or proximate to a front perimeter 10032 of the crown portion 10035 toward a heel-side perimeter 10031 of the crown portion 10035. The toe-side integral rib 10025 and the heel-side integral rib 10036 may diverge in a front-to-rear direction in the crown portion 10035. The upper plurality of composite layers 10050 may be similar to the upper plurality of composite layers 7950 described herein. The lower plurality of composite layers 10055 may be similar to the lower plurality of composite layers 7955 described herein. The outer layer 10010 may be similar to the outer layer 7910 described herein. The inner layer 10015 may be similar to the inner layer 7915 described herein. The crown portion 10035 may be incorporated into any of the golf club heads described herein. The apparatus, methods, and articles of manufacture described herein are not limited in this regard.

During manufacturing of the crown portion 10035, a plurality of composite layers 10014, such as those depicted in FIG. 100, may be laid in a contoured mold. Pressure may be applied to the composite layers 10014 to encourage bonding of adjacent layers to form a contoured composite crown portion 10035. Heat may be applied to the layers 10014 to encourage bonding of adjacent layers to form the crown portion 10035. Pressing the composite layers 10014 against contoured surfaces of the mold may produce a raised central crown portion and contoured transition regions adjacent to the raised central crown portion. To ensure smooth transition regions adjacent to the raised central crown portion, each subsequent composite layer in the stack of composite layers forming the crown stiffening portion 10036 may become gradually wider (in descending order in the stack) to yield smooth transition regions in the manufactured crown portion 10035. In the example shown in FIG. 100, each composite layer of the toe-side integral rib 10025 may have a toe-side width ($w_T$). Each composite layer of the heel-side integral rib 10030 may have a heel-side width ($w_H$). In one example, a composite layer 10014 in the integral rib 10025 or 10030 may have a width (e.g. $w_H$ or $w_T$) that is at least 1% greater than an adjacent composite layer 10014 in the integral rib 10025 or 10030. In another example, a composite layer 10014 in the integral rib 10025 or 10030 may have a width (e.g. $w_H$ or $w_T$) that is at least 5% greater than an adjacent composite layer 10014 in the integral rib 10025 or 10030. In still another example, a composite layer 10014 in the integral rib 10025 or 10030 may have a width (e.g. $w_H$ or $w_T$) that is at least 10% greater than a width of an adjacent composite layer 10014 in the integral rib 10025 or 10030. In yet another example, a composite layer 10014 in the integral rib 10025 or 10030 may have a width ($w_H$ or $w_T$) that is at least 15% greater than an adjacent composite layer 10014 in the integral rib 10025 or 10030. In still yet another example, the composite layer 10014 in the integral rib 10025 or 10030 may have a width ($w_H$ or $w_T$) that is at least 30% greater than an adjacent composite layer 10014 in the integral rib 10025 or 10030. The apparatus, methods, and articles of manufacture described herein are not limited in this regard.

FIG. 101 shows an exploded view of layers of an example crown portion 10135 prior to execution of a manufacturing process that yields a contoured crown portion. In one example, the crown portion 10135 may replace the crown portion 6235 in the golf club head 6200 of FIG. 62. The crown portion 10135 may include an upper plurality of composite layers 10150, a lower plurality of composite layers 10155, and a crown stiffening portion 10136 between the upper and lower pluralities of composite layers. The presence of the crown stiffening portion 10136 may allow for lightweight thin portions to be utilized adjacent to the crown stiffening portion 10136, which together may provide a crown portion 10135 that is lighter and/or stiffer than a crown portion with uniform thickness (e.g., one generally shown as 4835 in FIG. 48). A thin portion may be any region in the crown portion 10135 that does not include a crown stiffening portion 10136. The crown stiffening portion 10136 may include a toe-side integral rib 10125 and a heel-side integral rib 10130. The toe-side integral rib 10125 may be disposed between the inner layer 10110 and the outer layer 10115. The toe-side integral rib 10125 may be disposed between the upper plurality of composite layers 10150 and the lower plurality of composite layers 10155. The toe-side integral rib 10125 may include one or more layers of composite material 10114. The toe-side integral rib 10125 may include two or more layers of composite material 10114. The toe-side integral rib 10125 may extend from a front portion of the crown portion 10135 to a rear portion of the crown portion 10135. The toe-side integral rib 10125 may extend from a location at or proximate to a front perimeter 10132 of the crown portion 10135 to a location at or proximate to a rear perimeter 10151 of the crown portion 10135. The toe-side integral rib 10125 may extend from a location at or proximate to a front perimeter 10132 of the crown portion 10135 toward a toe-side perimeter 10133 of the crown portion 10135. The heel-side integral rib 10130 may be disposed between the inner layer 10110 and the outer layer 10115. The heel-side integral rib 10130 may be disposed between the upper plurality of composite layers 10150 and the lower plurality of composite layers 10155. The heel-side integral rib 10130 may include one or more layers of composite material 10114. The heel-side integral rib 10130 may include two or more layers of composite material 10114. The heel-side integral rib 10130 may extend from a front portion of the crown portion 10135 to a rear portion of the crown portion 10135. The heel-side integral rib 10130 may extend from a location at or proximate to a front perimeter 10132 of the crown portion 10135 to a location at or proximate to a rear perimeter 10151 of the crown portion 10135. The heel-side integral rib 10130 may extend from a location at or proximate to a front perimeter 10132 of the crown portion 10135 toward a heel-side perimeter 10131 of the crown portion 10135. The toe-side integral rib 10125 and the heel-side integral rib 10136 may converge and then diverge in a front-to-rear direction in the crown portion 10135. The toe-side integral rib 10125 may have a converging front portion and a diverging rear portion. The heel-side integral rib 10130 may have a converging front portion and a diverging rear portion. The upper plurality of composite layers 10150 may be similar to the upper plurality of composite layers 7950 described herein. The lower plurality of composite layers 10155 may be similar to the lower plurality of composite layers 7955 described herein. The outer layer 10110 may be similar to the outer layer 7910 described herein. The inner layer 10115 may be similar to the inner layer 7915 described herein. The crown portion 10135 may be incorporated into any of the golf club heads described herein. The apparatus, methods, and articles of manufacture described herein are not limited in this regard.

During manufacturing of the crown portion 10135, a plurality of composite layers 10114, such as those depicted in FIG. 101, may be laid in a contoured mold. Pressure may be applied to the composite layers 10114 to encourage bonding of adjacent layers to form a contoured composite crown portion 10135. Heat may be applied to the layers 10114 to encourage bonding of adjacent layers to form the crown portion 10135. Pressing the composite layers 10114 against contoured surfaces of the mold may produce a raised central crown portion and contoured transition regions adjacent to the raised central crown portion. To ensure smooth transition regions adjacent to the raised central crown portion, each subsequent composite layer in the stack of composite layers forming the crown stiffening portion 10136 may become gradually wider (in descending order in the stack) to yield smooth transition regions in the manufactured crown portion 10135. In the example shown in FIG. 101, each composite layer of the toe-side integral rib 10125 may have a toe-side width ($w_T$). Each composite layer of the heel-side integral rib 10130 may have a heel-side width ($w_H$). In one example, a composite layer 10114 in the integral rib 10125 or 10130 may have a width (e.g. $w_H$ or $w_T$) that is at least 1% greater than an adjacent composite layer 10114 in the integral rib 10125 or 10130. In another example, a composite layer 10114 in the integral rib 10125 or 10130 may have a width (e.g. $w_H$ or $w_T$) that is at least 5% greater than an adjacent composite layer 10114 in the integral rib 10125 or 10130. In still another example, a composite layer 10114 in the integral rib 10125 or 10130 may have a width (e.g. $w_H$ or $w_T$) that is at least 10% greater than a width of an adjacent composite layer 10114 in the integral rib 10125 or 10130. In yet another example, a composite layer 10114 in the integral rib 10125 or 10130 may have a width ($w_H$ or $w_T$) that is at least 15% greater than an adjacent composite layer 10014 in the integral rib 10125 or 10130. In still yet another example, the composite layer 10014 in the integral rib 10125 or 10130 may have a width ($w_H$ or $w_T$) that is at least 30% greater than an adjacent composite layer 10014 in the integral rib 10125 or 10130. The apparatus, methods, and articles of manufacture described herein are not limited in this regard.

FIG. 102 shows an exploded view of layers of an example crown portion 10235 prior to execution of a manufacturing process that yields a contoured crown portion. In one example, the crown portion 10235 may replace the crown portion 6235 in the golf club head 6200 of FIG. 62. The crown portion 10235 may include an upper plurality of composite layers 10250, a lower plurality of composite layers 102155, and a crown stiffening portion 10236 between the upper and lower pluralities of composite layers. The presence of the crown stiffening portion 10236 may allow for lightweight thin portions to be utilized adjacent to the crown stiffening portion 10236, which together may provide a crown portion 10235 that is lighter and/or stiffer than a crown portion with uniform thickness (e.g. 4835). A thin portion may be any region in the crown portion 10235 that does not include a crown stiffening portion 10236. The crown stiffening portion 10236 may include a toe-side integral rib 10225 and a heel-side integral rib 10230. The toe-side integral rib 10225 may be disposed between the inner layer 10210 and the outer layer 10215. The toe-side integral rib 10225 may be disposed between the upper plurality of composite layers 10250 and the lower plurality of composite layers 10255. The toe-side integral rib 10225 may include one or more layers of composite material 10214. The toe-side integral rib 10225 may include two or more layers of composite material 10214. The toe-side integral rib 10225 may extend from a front portion of the crown portion 10235 to a rear portion of the crown portion. The toe-side integral rib 10225 may extend from a location at or proximate to a front perimeter 10232 of the crown portion 10235 to a location at or proximate to a rear perimeter 10251 of the crown portion 10235. The toe-side integral rib 10225 may extend from a location at or proximate to a front perimeter 10232 of the crown portion 10235 toward a toe-side perimeter 10233 of the crown portion 10235. The heel-side integral rib 10230 may be disposed between the inner layer 10210 and the outer layer 10215. The heel-side integral rib 10230 may be disposed between the upper plurality of composite layers 10250 and the lower plurality of composite layers 10255. The heel-side integral rib 10230 may include one or more layers of composite material 10214. The heel-side integral rib 10230 may include two or more layers of composite material 10214. The heel-side integral rib 10230 may extend from a front portion of the crown portion 10235 to a rear portion of the crown portion. The heel-side integral rib 10230 may extend from a location at or proximate to a front perimeter 10232 of the crown portion 10235 to a location at or proximate to a rear perimeter 10251 of the crown portion 10235. The heel-side integral rib 10230 may extend from a location at or proximate to a front perimeter 10232 of the crown portion 10235 toward a heel-side perimeter 10231 of the crown portion 10235. The toe-side integral rib 10225 and the heel-side integral rib 10236 may diverge and then converge in a front-to-rear direction in the crown portion 10235. The toe-side integral rib 10225 may have a diverging front portion and a converging rear portion. The heel-side integral rib 10230 may have a diverging front portion and a converging rear portion. The upper plurality of composite layers 10250 may be similar to the upper plurality of composite layers 7950 described herein. The lower plurality of composite layers 10255 may be similar to the lower plurality of composite layers 7955 described herein. The outer layer 10210 may be similar to the outer layer 7910 described herein. The inner layer 10215 may be similar to the inner layer 7915 described herein. The crown portion 10235 may be incorporated into any of the golf club heads described herein. The apparatus, methods, and articles of manufacture described herein are not limited in this regard.

During manufacturing of the crown portion 10235, a plurality of composite layers 10214, such as those depicted in FIG. 102, may be laid in a contoured mold. Pressure may be applied to the composite layers 10214 to encourage bonding of adjacent layers to form a contoured composite crown portion 10235. Heat may be applied to the layers 10214 to encourage bonding of adjacent layers to form the crown portion 10135. Pressing the composite layers 10214 against contoured surfaces of the mold may produce a raised central crown portion and contoured transition regions adjacent to the raised central crown portion. To ensure smooth transition regions adjacent to the raised central crown portion, each subsequent composite layer in the stack of composite layers forming the crown stiffening portion 10236 may become gradually wider (in descending order in the stack) to yield smooth transition regions in the manufactured crown portion 10235. In the example shown in FIG. 102, each composite layer of the toe-side integral rib 10225 may have a toe-side width ($w_T$). Each composite layer of the heel-side integral rib 10230 may have a heel-side width ($w_H$). In one example, a composite layer 10214 in the integral rib (e.g. 10225, 10230) may have a width (e.g. $w_H$ or $w_T$) that is at least 1% greater than an adjacent composite layer 10214 in the integral rib. In another example, a composite layer 10214 in the integral rib 10225 or 10230 may have a width (e.g. $w_H$ or $w_T$) that is at least 5% greater than an adjacent composite layer 10214 in the integral rib 10225 or 10230. In still another example, a composite layer 10214 in the integral rib 10225 or 10230 may have a width (e.g. $w_H$ or $w_T$) that is at least 10% greater than a width of an adjacent composite layer 10214 in the integral rib 10225 or 10230. In yet another example, a composite layer 10214 in the integral rib 10225 or 10230 may have a width ($w_H$ or $w_T$) that is at least 15% greater than an adjacent composite layer 7614 in the integral rib 10225 or 10230. In still yet another example, the composite layer 10214 in the integral rib 10225 or 10230 may have a width ($w_H$ or $w_T$) that is at least 30% greater than an adjacent composite layer 10214 in the integral rib 10225 or 10230. The apparatus, methods, and articles of manufacture described herein are not limited in this regard.

Referring back to FIGS. 62-75, the body portion 6210 may include a protruding portion 6241. The protruding portion 6241 may serve to lower the CG of the golf club head 6200. The protruding portion 6241 may serve to shift the CG rearward from the face portion toward the rear portion 6280. The protruding portion 6241 may have an arcuate shape that follows a contour of the rear portion 6280 of the body portion 6210. The protruding portion 6241 may extend from the skirt portion 6290. The protruding portion 6241 may extend from the bottom portion 6240. The protruding portion 6241 may extend from the rear portion 6280. The protruding portion 6241 may extend from the bottom portion 6240 and the skirt portion 6290. The protruding portion 6241 may extend from the rear portion 6280 and the bottom portion 6240. The protruding portion 6241 may extend from the rear portion 6280 and the skirt portion 6290. The protruding portion 6241 may extend from the bottom portion 6240, the skirt portion 6290, and the rear portion 6280. The apparatus, methods, and articles of manufacture described herein are not limited in this regard.

Figure 68:
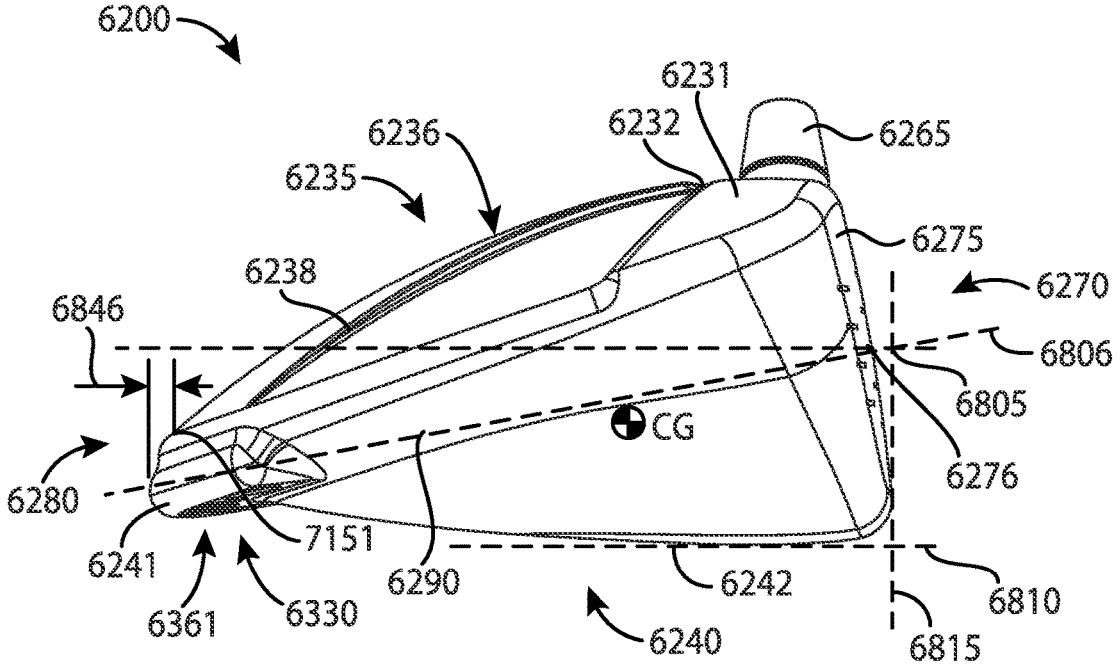
FIG. 68 depicts a toe view of the example golf club head of FIG. 62.
Figure 69:
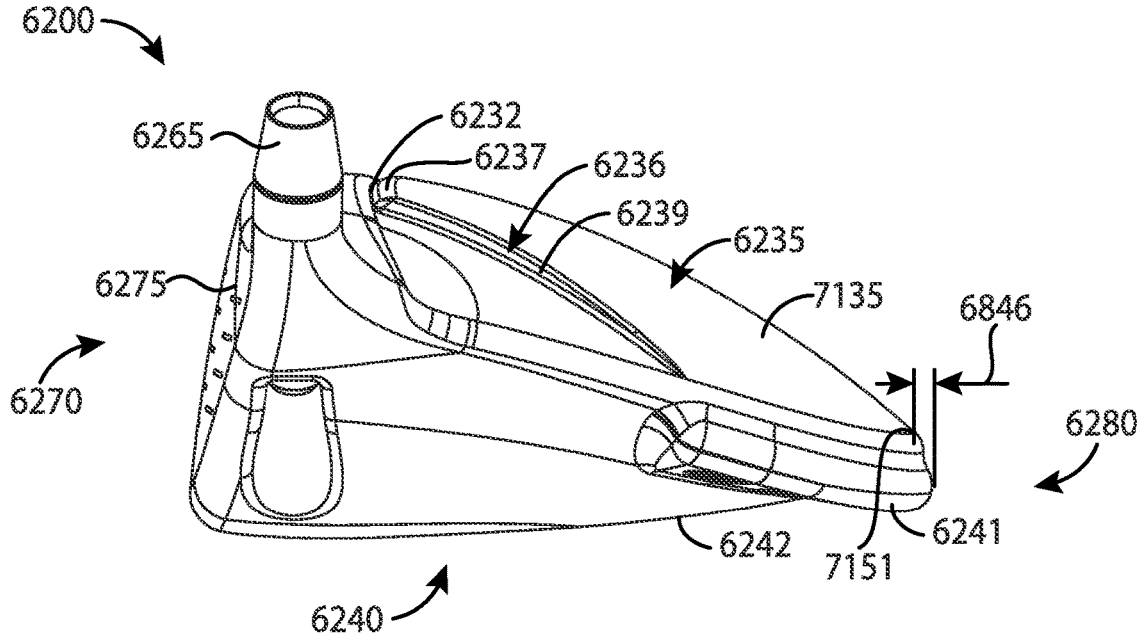
FIG. 69 depicts a heel view of the example golf club head of FIG. 62.
Figure 70:
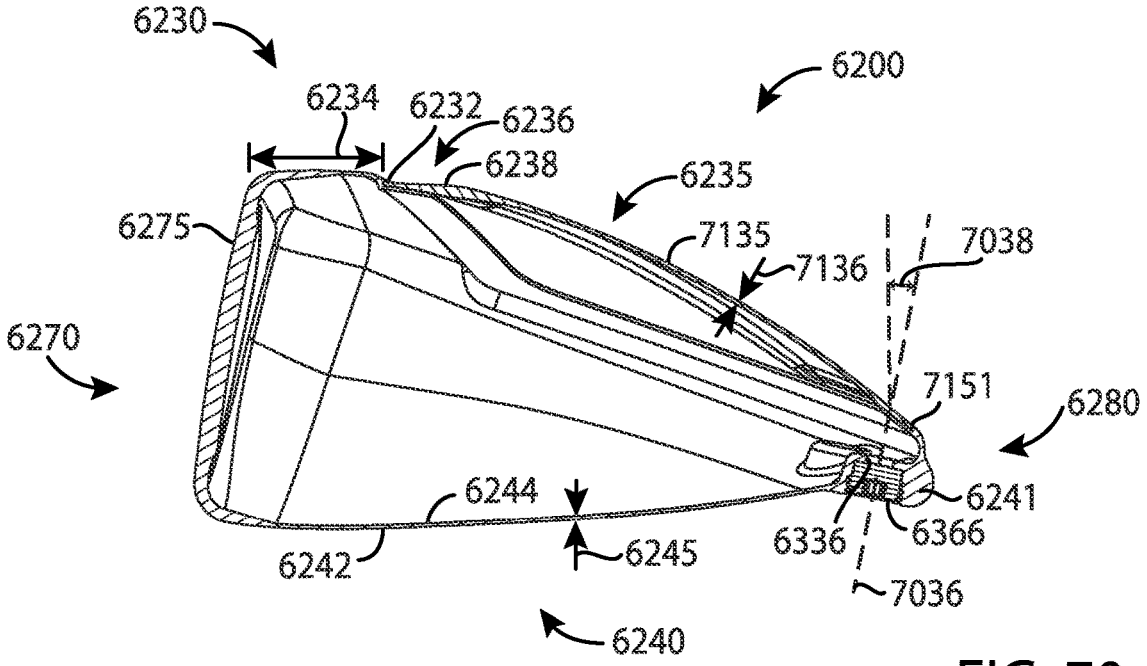
FIG. 70 depicts a cross-sectional view of the example golf club head of FIG. 62 taken at section line 70-70 of FIG. 64.
Figure 71:
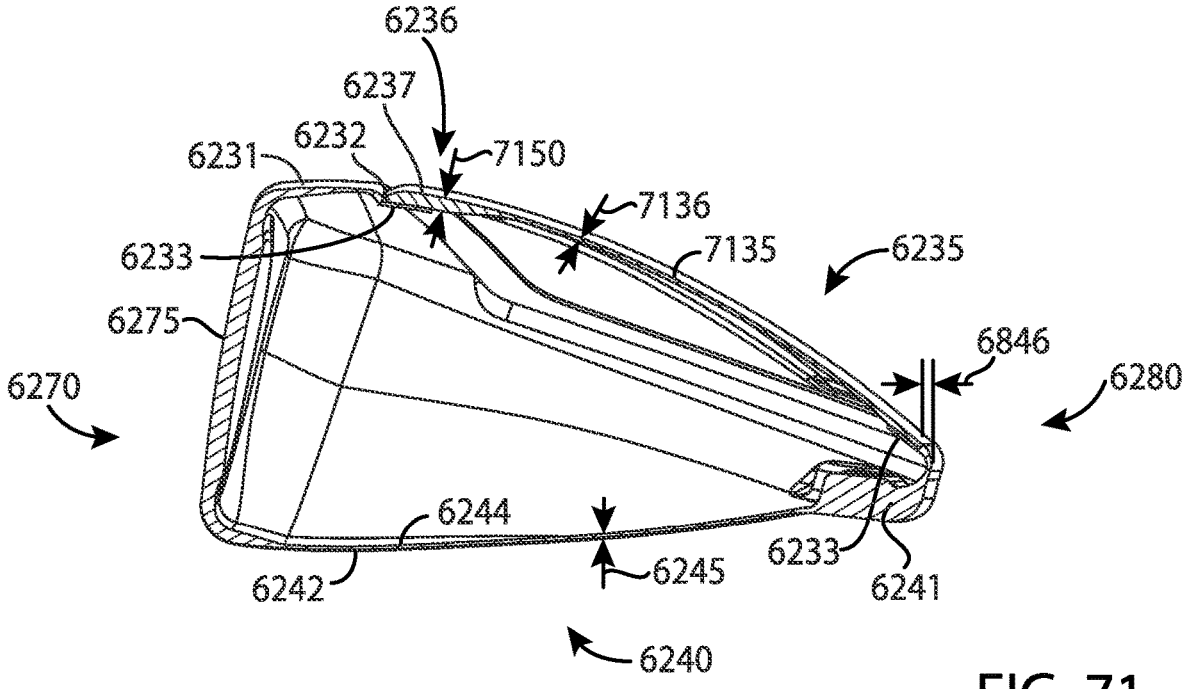
FIG. 71 depicts a cross-sectional view of the example golf club head of FIG. 62 taken at section line 71-71 of FIG. 64.

The protruding portion 6241 may extend a distance 6846 beyond a rear perimeter 7151 of the crown portion 6235, as shown in FIG. 69. In one example, the protruding portion 6241 may extend rearward beyond a rear perimeter 7151 of the crown portion 6235 a distance of at least 2 mm. In another example, the protruding portion 6241 may extend rearward beyond a rear perimeter 7151 of the crown portion 6235 a distance of at least 3 mm. In yet another example, the protruding portion 6241 may extend rearward beyond a rear perimeter 7151 of the crown portion 6235 a distance of at least 5 mm. The protruding portion 6241 may be located within a rear half of the golf club head 6200. The neutral axis 6806 of the golf club head 6200 may intersect the protruding portion 6241, as shown in FIG. 68. The protruding portion 6241 may be located within a rear third of the golf club head 6200. The protruding portion 6241 may be located below a horizontal mid-plane 6805 of the golf club head 6200. The horizontal mid-plane 6805 may be parallel to and vertically offset from a ground plane 6810 and may intersect the geometric center 6276 of the face portion 6275. The geometric center 6276 may correspond to a midpoint of the face portion 6275. The apparatus, methods, and articles of manufacture described herein are not limited in this regard.

Due to the location and mass of the protruding portion 6241, the golf club head 6200 may have a CG that is relatively low compared to other golf club heads. The low CG height may generate relatively low ball spin, which may be desirable to some individuals. In one example, the CG may be located along or proximate to a neutral axis 6806 of the golf club head 6200. In another example, the CG may be located below the neutral axis 6806, as shown in FIG. 68. The CG may be located below and within 0.2 inch of the neutral axis 6806. The CG may be located between and including about 0.1 inch and about 0.2 inch below the neutral axis 6806. The CG may be located at least 0.1 inch below the neutral axis 6806. The CG may be located at least 0.15 inch below the neutral axis 6806.

The protruding portion 6241 may include one or more weight port regions, and each weight port region may include one or more weight ports. In one example, the protruding portion 6241 may include a weight port region 6330. The weight port region 6330 may include a set of weight ports 6331 (e.g., generally shown as weight ports 6332, 6333, 6334, 6335, 6336, and 6337). In one example, the weight ports 6331 may be arranged along an arc 6345. The arc 6345 may follow a contour of the rear portion 6280. The arc 6345 may be concave relative to the front vertical plane 6815. The golf club head 6200 may include a plurality of weight portions, shown as a set of weight portions 6361 (generally shown as weight portions 6362, 6363, 6364, 6365, 6366, and 6367). One or more weight port of the set of weight ports 6331 may receive a weight portion similar to any of the golf club heads described herein. In one example, one or more weight ports of the set of weight ports 6331 may not include a weight portion. The apparatus, methods, and articles of manufacture described herein are not limited in this regard.

The characteristics (e.g., density, shape, volume, size, color, dimensions, depth, diameter, materials of construction, mass, method of formation, etc.) and/or any other properties of each weight portion of the plurality of weight portions and each weight port of the plurality of weight ports may be similar in any respect to any weight portion and weight port, respectively, of any of the golf club heads described herein. In one example, the weight ports and the weight portions of the golf club head of FIGS. 62-75 may have greater dimensions (e.g., length, width, diameter, depth, etc.) than any of the weight ports and/or weight portions, respectively, described herein. The apparatus, methods, and articles of manufacture described herein are not limited in this regard.

The set of weight portions 6361 (e.g., generally shown as weight portions 6362, 6363, 6364, 6365, 6366, and 6367) may have similar or different masses. By using weight portions having similar or different masses in each of the weight ports, the overall mass in the weight port region 6330 and/or the mass distribution in the weight port region 6330 may be adjusted to generally optimize and/or adjust the swing weight, center of gravity, moment of inertia, and/or an overall feel of the golf club head 6200 for an individual using the golf club head 6200. In one example, the set of weight portions 6361 may have a mass of at least 8 grams. In another example, the set of weight portions 6361 may collectively have a mass of at least 12 grams. In yet another example, the set of weight portions 6361 may collectively have a mass of between and including 8 grams and 13 grams. In still yet another example, the set of weight portions 6361 may collectively have a mass of between and including 12 grams and 16 grams. In still yet another example, the set of weight portions 6361 may collectively have a mass of between and including 15 grams and 19 grams. In still yet another example, the set of weight portions 6361 may collectively have a mass of between and including 18 grams and 22 grams. While the above examples may describe particular masses, the apparatus, methods, and articles of manufacture described herein may include the set of weight portions 6361 to have an aggregate mass of less than 8 grams or an aggregate mass of greater than 19 grams. Further, the protruding portion 6241, in combination with the set of weight portions 6361, may have a mass of at least 15 grams. In another example, the protruding portion 6241, in combination with the set of weight portions 6361, may have a mass of at least 18 grams. In yet another example, the protruding portion 6241, in combination with the set of weight portions 6361, may have a mass of at least 24 grams. While the above examples may describe particular masses, the apparatus, methods, and articles of manufacture described herein may include the protruding portion 6241 in combination with the set of weight portions 6361 to have an aggregate mass of less than 15 grams. The apparatus, methods, and articles of manufacture described herein are not limited in this regard.

One or more of the weight ports 6331 may have an axis that is tilted rearward of vertical. As shown by way of example in FIG. 70, the weight port 6336 may have an axis 7036 that is tilted rearward of vertical by an angle 7038. This rearward tilted orientation of the weight port 6336 may allow the weight portion 6366 to be positioned lower than if the weight port 6336 were perpendicular to the bottom portion 6240, as in the golf club head 5600 of FIG. 58. The rearward tilted orientation of the weight port 6336 may lower the CG of the golf club head 6200. The rearward tilted orientation of the weight port 6336 may shift the CG of the golf club head 6200 rearward. In one example, the angle 7038 may be at least 5 degrees. In another example, the angle 7038 may be at least 10 degrees. In yet another example, the angle 7038 may be at least 15 degrees. While the above examples may describe particular angles, the apparatus, methods, and article of manufacture may include the weight port 6336 having a rearward tilted orientation of less than 5 degrees. The apparatus, methods, and articles of manufacture described herein are not limited in this regard.

The outer surface 6242 and/or the inner surface 6244 of the bottom portion 6240 may include one or more inner support portions (not shown) and/or one or more outer support portion (not shown) similar to any of the inner support portions and the outer support portions described herein. The bottom portion 6240 may have a thickness 6245 of less than 1 mm. The bottom portion 6240 may have a thickness 6245 of less than 0.7 mm. The bottom portion 6240 may have a thickness 6245 of less than 0.6 mm. The apparatus, methods, and articles of manufacture described herein are not limited in this regard.

Certain regions of the interior of the body portion 2310 of the golf club head 6200 may include an elastic polymer material or an elastomer material, which may be referred to herein as the filler material. The filler material may dampen vibration, dampen noise, lower the center of gravity and/or provide a better feel and sound in response to the golf club head 6200 striking a golf ball. The golf club head 6200, may have one or more interior regions that may include a filler material as described herein. In one example, the filler material may be injected into the body portion 6210 from one or more of the weight ports (e.g., generally shown as weight ports 6332, 6333, 6334, 6335, 6336, and 6337) as described herein. The apparatus, methods, and articles of manufacture described herein are not limited in this regard.

Although the crown portion 6235 is depicted in conjunction with a driver-type golf club head in certain figures, it is not limited in this regard. The crown portion 6235 may be resized for use in hybrid-type golf clubs as shown, for example, in FIGS. 80-87 and fairway wood-type golf clubs as shown, for example, in FIGS. 88-95. Any of the golf club heads described herein may include a crown portion with a crown stiffening portion as described herein. Any of the golf club heads described herein may include a crown portion with one or more integral ribs as described herein. Any of the golf club heads described herein may include a crown portion with a toe-side crown portion and a heel-side crown portion as described herein. Any of the golf club heads described herein may include a crown portion with a central crown portion, toe-side crown portion, and heel-side crown portion as described herein. Any of the golf club heads described herein may include a crown portion with one or more contoured transition regions as described herein. Any of the golf club heads described herein may include a multi-level crown portion as described herein. Any of the golf club heads described herein may include a raised central crown portion as described herein. Any of the golf club heads described herein may include a crown portion with multi-layer composite construction as described herein. The apparatus, methods, and articles of manufacture described herein are not limited in this regard.

In the example of FIGS. 80-87 and 98, the hybrid-type golf club head 8000 may include a body portion 8010 with a top portion 8030, a crown portion 8035, a bottom portion 8040, a toe portion 8050, a heel portion 8060, a front portion 8070, and a rear portion 8080. The bottom portion 8040 may include a skirt portion 8090 defined as a side portion of the golf club head 8000 between the top portion 8030 and the bottom portion 8040 excluding the front portion 8070 and extending across a periphery of the golf club head 8000 from the toe portion 8050, around the rear portion 8080, and to the heel portion 8060. Alternatively, the golf club head 8000 may not include the skirt portion 8090. The front portion 8070 may include a face portion 8075 to engage a golf ball (not shown). The face portion 8075 may be either integral to the body portion 8010 or a separate face portion that is coupled (e.g. welded) to the front portion 8070 to enclose an opening in the front portion 8070. The body portion 8010 may also include a hosel portion 8065 configured to receive a shaft portion. The hosel portion 8065 may be similar in many respects to any of the hosel portions described herein. The hosel portion 8065 may include an interchangeable hosel sleeve. Alternatively, the body portion 8010 may include a bore instead of the hosel portion 8065. The body portion 8010 may be made partially or entirely from any of the materials described herein. Further, the golf club head 8000 may be any type of golf club head having a club head volume similar to the club head volume of any of the golf club heads described herein. The apparatus, methods, and articles of manufacture described herein are not limited in this regard.

The crown portion 8035 may include a central crown portion 8031, a toe-side crown portion 8032, and a heel-side crown portion 8033. A first contoured transition region 8021 may separate the central crown portion 8831 and the toe-side crown portion 8032. A second contoured transition region 8022 may separate the central crown portion 8031 and the heel-side crown portion 8033. The crown portion 8035 may include a central integral rib 8015, a toe-side integral rib 8016, and a heel-side integral rib 8017. The central integral rib 8015 may be disposed within the crown portion 8035 proximate to a front perimeter 8003 of the crown portion. The toe-side integral rib 8016 may be disposed within the crown portion 8035 proximate to the first contoured transition region 8021. The heel-side integral rib 8017 may be disposed within the crown portion 8035 proximate to the second contoured transition region 8022. The toe-side crown portion 8032 may be bounded by a front perimeter 8003 of the crown portion 8035, a toe-side perimeter 8001 of the crown portion, and the first contoured transition region 8021. The heel-side crown portion 8033 may be bounded by the front perimeter 8003, a heel-side perimeter 8002 of the crown portion, and the second contoured transition region 8022. The central crown portion 8031 may extend between the first contoured transition region 8021 and the second contoured transition region 8022. The central crown portion 8831 may be bounded by a rear perimeter 8004 of the crown portion. In one example, the central crown portion 8031 may have a surface area greater than 2 square inches. In another example, the central crown portion 8031 may have a surface area between and including 2 and 4 square inches. In yet another example, the central crown portion 8031 may have a surface area between and including 2.2 and 3.5 square inches. In still another example, the central crown portion 8031 may have a surface area between and including 2.5 and 3.2 square inches. In one example, the toe-side crown portion 8032 may have a surface area between and including 0.2 and 1.5 square inches. In another example, the toe-side crown portion 8032 may have a surface area between and including 0.2 and 1.2 square inches. In yet another example, the toe-side crown portion 8032 may have a surface area between and including 0.3 and 0.8 square inches. In still another example, the toe-side crown portion 8032 may have a surface area between and including 0.4 and 0.5 square inches. While the above examples may describe particular surface areas, the apparatus, methods, and articles of manufacture described herein may include the toe-side crown portion 8032 having a surface area greater than 4 square inches. The apparatus, methods, and articles of manufacture described herein are not limited in this regard.

Figure 98:
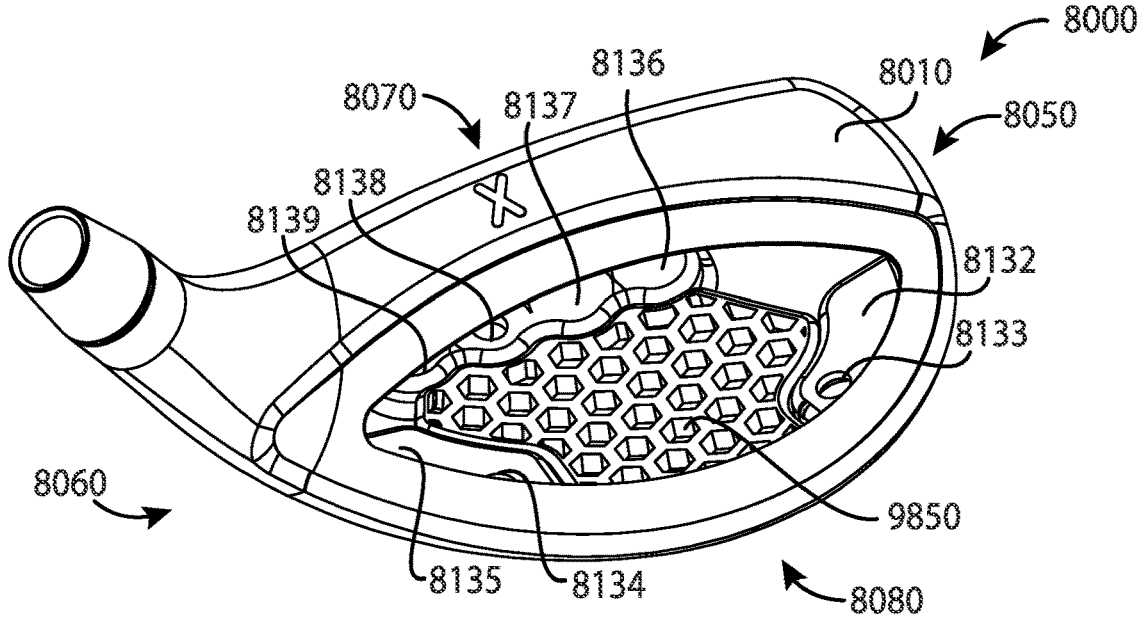
FIG. 98 depicts a rear perspective view of the example golf club head of FIG. 80 prior to attachment of a crown portion.

In the example in FIG. 98, the hybrid-type golf club head 8000 is shown prior to attachment of a crown portion to the body portion 8010. An insert 9850 is provided within an interior region of the golf club head 8000. The insert 9850 may dampen vibrations within the golf club head 8000 resulting from impact with a golf ball, which may improve sound or feel perceived by an individual. The golf club head 8000 may include a set of weight ports (e.g. 8132-8139) located in a bottom portion 8040 of the golf club head 8000. Each weight port may contain a weight portion (e.g. 8170). The set of weight ports may include a first plurality of weight ports 8101, a second plurality of weight ports 8102, and a third plurality of weight ports 8103. The first set of weight ports 8101 may be located closer to a front portion 8070 than a rear portion 8080. The second set of weight ports 8102 may be located closer to a heel portion 8060 than a toe portion 8050. The third set of weight portions 8103 may be located closer to the toe portion 8050 than the heel portion 8060. The first set of weight ports 8101 may include one or more weight portions having a mass greater than or equal to about 3.5 grams. The first set of weight ports 8101 may include one or more weight portions having a mass greater than or equal to about 4 grams. The second set of weight ports 8102 may include one or more weight portions having a mass greater than or equal to about 0.5 gram. The second set of weight ports 8102 may include one or more weight portions having a mass greater than or equal to about 0.75 gram. The third set of weight ports 8103 may include one or more weight portions having a mass greater than or equal to about 0.5 gram. The third set of weight ports 8103 may include one or more weight portions having a mass greater than or equal to about 0.75 gram. As shown in FIG. 98, the insert 9850 may extend from the first set of weight ports 8101 toward the rear portion 8080 of the golf club head 8000. The insert 9850 may extend from the first set of weight ports 8101 to the rear portion 8080 of the golf club head 8000. The insert 9850 may extend between the second set of weight ports 8102 and the third set of weight ports 8103. The insert 9850 may extend to the first set of weight ports 8101, the second set of weight ports 8102, and the third set of weight ports 8103. The insert 9850 may include a plurality of hexagonal holes that extend through or partially through the thickness of the insert 9850. The hexagonal holes may be arranged on the insert 9850 to define a pattern similar to a honeycomb pattern. The apparatus, methods, and articles of manufacture described herein are not limited in this regard.

In the example of FIGS. 88-95 and 99, the fairway wood-type golf club head 8800 may include a body portion 8810 with a top portion 8830, a crown portion 8835, a bottom portion 8840, a toe portion 8850, a heel portion 8860, a front portion 8870, and a rear portion 8880. The bottom portion 8840 may include a skirt portion 8890 defined as a side portion of the golf club head 8800 between the top portion 8830 and the bottom portion 8840 excluding the front portion 8870 and extending across a periphery of the golf club head 8800 from the toe portion 8850, around the rear portion 8880, and to the heel portion 8860. Alternatively, the golf club head 8800 may not include the skirt portion 8890. The front portion 8870 may include a face portion 8875 to engage a golf ball (not shown). The face portion 8875 may be either integral to the body portion 8810 or a separate face portion that is coupled (e.g., welded) to the front portion 8870 to enclose an opening in the front portion 8870. The body portion 8810 may also include a hosel portion 8865 configured to receive a shaft portion. The hosel portion 8865 may be similar in many respects to any of the hosel portions described herein. The hosel portion 8865 may include an interchangeable hosel sleeve. Alternatively, the body portion 8810 may include a bore instead of the hosel portion 8865. The body portion 8810 may be made partially or entirely from any of the materials described herein. Further, the golf club head 8800 may be any type of golf club head having a club head volume similar to the club head volume of any of the golf club heads described herein. In one example, the heel-side crown portion 8833 may have a surface area less than 0.5 square inches. In another example, the heel-side crown portion 8833 may have a surface area between and including 0.05 and 0.4 square inches. In yet another example, the heel-side crown portion 8833 may have a surface area between and including 0.1 and 0.3 square inches. In still another example, the heel-side crown portion 8833 may have a surface area between and including 0.1 and 0.2 square inches. While the above examples may describe particular surface areas, the apparatus, methods, and articles of manufacture described herein may include the heel-side crown portion 8833 having a surface area greater than 0.4 square inches. The apparatus, methods, and articles of manufacture described herein are not limited in this regard.

The crown portion 8835 may include a central crown portion 8831, a toe-side crown portion 8832, and a heel-side crown portion 8833. A first contoured transition region 8821 may separate the central crown portion 8831 and the toe-side crown portion 8832. A second contoured transition region 8822 may separate the central crown portion 8831 and the heel-side crown portion 8833. The crown portion 8835 may include a central integral rib 8815, a toe-side integral rib 8816, and a heel-side integral rib 8817. The central integral rib 8815 may be disposed within the crown portion 8835 proximate to a front perimeter 8803 of the crown portion. The toe-side integral rib 8816 may be disposed within the crown portion 8835 proximate to the first contoured transition region 8821. The heel-side integral rib 8817 may be disposed within the crown portion 8835 proximate to the second contoured transition region 8822. The toe-side crown portion 8832 may be bounded by a front perimeter 8803 of the crown portion 8835, a toe-side perimeter 8801 of the crown portion 8835, and the first contoured transition region 8821. The heel-side crown portion 8833 may be bounded by the front perimeter 8803 of the crown portion 8835, a heel-side perimeter 8802 of the crown portion, and the second contoured transition region 8822. The central crown portion 8831 may extend between the first contoured transition region 8821 and the second contoured transition region 8822. The central crown portion 8831 may be bounded by a rear perimeter 8804 of the crown portion 8835. The central crown portion 8831 may be raised relative to the toe-side crown portion 8832 and the heel-side crown portion 8833. In one example, the central crown portion 8831 may have a surface area greater than 3 square inches. In another example, the central crown portion 8831 may have a surface area between and including 2.5 and 6 square inches. In yet another example, the central crown portion 8831 may have a surface area between and including 3.0 and 4.5 square inches. In still another example, the central crown portion 8831 may have a surface area between and including 3.2 and 4.2 square inches. In one example, the toe-side crown portion 8832 may have a surface area between and including 0.4 and 2.3 square inches. In another example, the toe-side crown portion 8832 may have a surface area between and including 0.8 and 1.5 square inches. In yet another example, the toe-side crown portion 8832 may have a surface area between and including 1.0 and 1.4 square inches. In still another example, the toe-side crown portion 8832 may have a surface area between and including 1.1 and 1.3 square inches. The heel-side crown portion 8833 may have a surface area less than 2 square inches. In another example, the heel-side crown portion 8833 may have a surface area between and including 0.2 and 1 square inches. In yet another example, the heel-side crown portion 8833 may have a surface area between and including 0.2 and 0.8 square inches. In still another example, the heel-side crown portion 8833 may have a surface area between and including 0.3 and 0.6 square inches. While the above examples may describe particular surface areas, the apparatus, methods, and articles of manufacture described herein may include the heel-side crown portion 8833 having a surface area greater than 6 square inches. The apparatus, methods, and articles of manufacture described herein are not limited in this regard.

Figure 99:
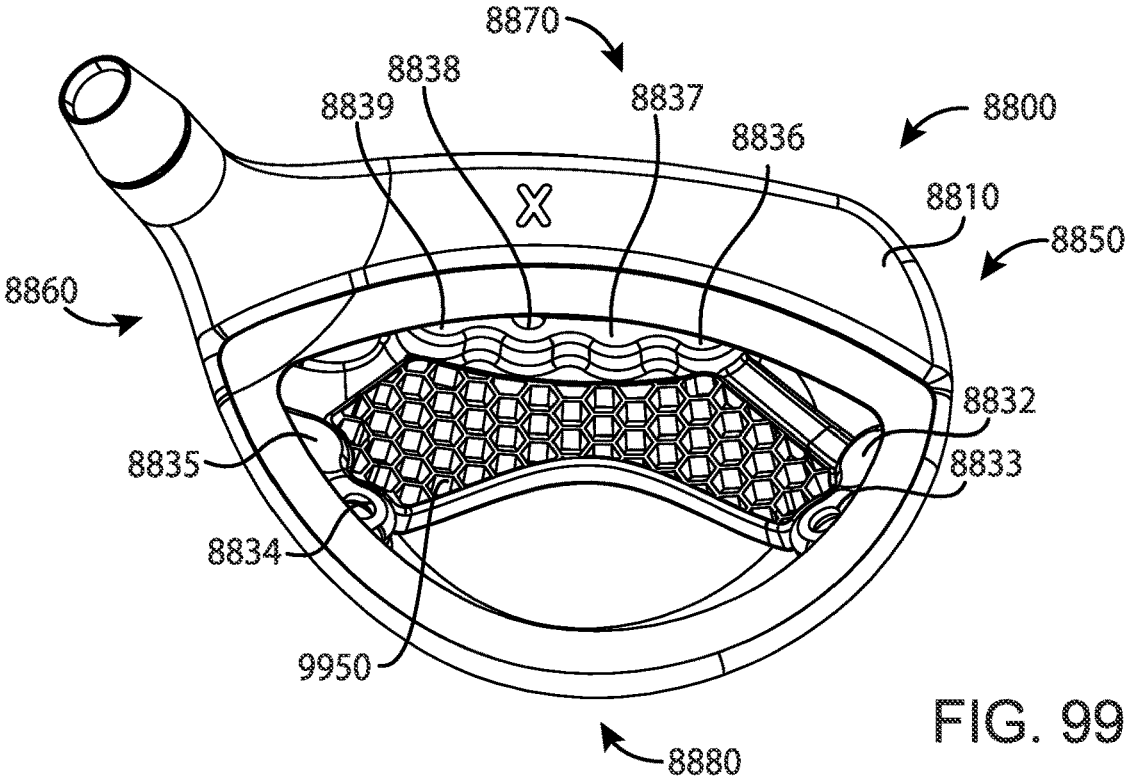
FIG. 99 depicts a rear perspective view of the example golf club head of FIG. 88 prior to attachment of a crown portion.

In the example in FIG. 99, the fairway wood-type golf club head 8800 is shown prior to attachment of a crown portion to the body portion 8810. An insert 9950 is provided within an interior region of the golf club head 8800. The insert 9950 may dampen vibrations within the golf club head 8800 resulting from impact with a golf ball, which may improve sound or feel perceived by an individual. The golf club head 8800 may include a set of weight ports (e.g. 8832-8839) located in a bottom portion 8840 of the golf club head 8800. Each weight port may contain a weight portion (e.g. 8970). The set of weight ports may include a first plurality of weight ports 8801, a second plurality of weight ports 8802, and a third plurality of weight ports 8803. The first set of weight ports 8801 may be located closer to a front portion 8870 than a rear portion 8880. The second set of weight ports 8802 may be located closer to a heel portion 8860 than a toe portion 8850. The third set of weight portions 8803 may be located closer to the toe portion 8850 than the heel portion 8860. The first set of weight ports 8801 may include one or more weight portions having a mass greater than or equal to about 3.5 grams. The first set of weight ports 8801 may include one or more weight portions having a mass greater than or equal to about 4 grams. The second set of weight ports 8802 may include one or more weight portions having a mass greater than or equal to about 0.5 gram. The second set of weight ports 8802 may include one or more weight portions having a mass greater than or equal to about 0.75 gram. The third set of weight ports 8803 may include one or more weight portions having a mass greater than or equal to about 0.5 gram. The third set of weight ports 8803 may include one or more weight portions having a mass greater than or equal to about 0.75 gram. As shown in FIG. 99, for example, the insert 9950 may extend from the first set of weight ports 8801 toward the rear portion 8880 of the golf club head 8800. The insert 9950 may extend between the second set of weight ports 8802 and the third set of weight ports 8803. The insert 9950 may have a front surface that abuts the first set of weight ports 8801. The insert 9950 may have a heel-side surface that abuts the second set of weight ports 8102. The insert 9950 may have a toe-side surface that abuts the third set of weight ports 8103. The insert 9950 may have a rear surface that extends between the second set of weight ports 8802 and the third set of weight ports 8803 and is concave relative to the rear portion 8880 of the golf club head 8800. The insert 9950 may extend to the first set of weight ports 8801, the second set of weight ports 8802, and the third set of weight ports 8803. The insert 9950 may include a plurality of hexagonal holes that extend through or partially through the thickness of the insert 9950. The plurality of hexagonal holes may be arranged on the insert 9950 to define a pattern similar to a honeycomb pattern. The apparatus, methods, and articles of manufacture described herein are not limited in this regard.

Any of the golf club heads described herein may be part of a golf club. The golf club may include a shaft (not shown) extending from the golf club head. The shaft may have a first end attached to a hosel of the golf club head and a second end opposite the first end. The golf club may include a grip at or proximate to the second end of the shaft. The shaft may be formed from metal material, composite material, or any other suitable material or combination of materials. The grip may be formed from rubber material, polymer material, or any other suitable material or combination of materials. The apparatus, methods, and articles of manufacture described herein are not limited in this regard.

The terms "and" and "or" may have both conjunctive and disjunctive meanings. The terms "a" and "an" are defined as one or more unless this disclosure indicates otherwise. The term "coupled" and any variation thereof refer to directly or indirectly connecting two or more elements chemically, mechanically, and/or otherwise. The phrase "removably connected" is defined such that two elements that are "removably connected" may be separated from each other without breaking or destroying the utility of either element.

The term "substantially" when used to describe a characteristic, parameter, property, or value of an element may represent deviations or variations that do not diminish the characteristic, parameter, property, or value that the element may be intended to provide. Deviations or variations in a characteristic, parameter, property, or value of an element may be based on, for example, tolerances, measurement errors, measurement accuracy limitations and other factors. The term "proximate" is synonymous with terms such as "adjacent," "close," "immediate," "nearby", "neighboring", etc., and such terms may be used interchangeably as appearing in this disclosure.

The apparatus, methods, and articles of manufacture described herein may be implemented in a variety of embodiments, and the foregoing description of some of these embodiments does not necessarily represent a complete description of all possible embodiments. Instead, the description of the drawings, and the drawings themselves, disclose at least one embodiment, and may disclosure alternative embodiments.

As the rules of golf may change from time to time (e.g., new regulations may be adopted or old rules may be eliminated or modified by golf standard organizations and/or governing bodies such as the USGA, the R&A, etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Further, while the above examples may be described with respect to golf clubs, the apparatus, methods and articles of manufacture described herein may be applicable to other suitable types of sports equipment such as a fishing pole, a hockey stick, a ski pole, a tennis racket, etc.

Although certain example apparatus, methods, and articles of manufacture have been described herein, the scope of coverage of this disclosure is not limited thereto. On the contrary, this disclosure covers all apparatus, methods, and articles of articles of manufacture fairly falling within the scope of the appended claims either literally or under the doctrine of equivalents.

What is claimed is:

1. A golf club head comprising:

a body portion comprising a front portion, a rear portion, a toe portion, a heel portion, a bottom portion, an interior cavity, and a top portion having an opening to the interior cavity; and a crown portion attached to the top portion and covering the opening in the top portion and enclosing the interior cavity, the crown portion comprising:

an inner composite layer, the inner composite layer being an inner structural layer;

an outer composite layer, the outer composite layer being an outer structural layer;

a first integral rib disposed between the inner composite layer and the outer composite layer, the first integral rib being located on a toe side of the crown portion;

a second integral rib disposed between the inner composite layer and the outer composite layer, the second integral rib being located on a heel side of the crown portion; and a raised central crown portion located between the first integral rib and the second integral rib.

2. A golf club head as defined in claim 1, wherein the first integral rib and the second integral rib converge in a front-to-rear direction within the crown portion.

3. A golf club head as defined in claim 1, wherein the first integral rib and the second integral rib converge and then diverge in a front-to-rear direction within the crown portion.

4. A golf club head as defined in claim 1, wherein the first integral rib and the second integral rib diverge and then converge in a front-to-rear direction within the crown portion.

5. A golf club head as defined in claim 1, wherein the first integral rib and the second integral rib are substantially parallel in a front-to-rear direction within the crown portion.

6. A golf club head as defined in claim 1, wherein the raised central crown portion is formed by placing the crown portion into a mold and applying heat and pressure to the crown portion.

7. A golf club head as defined in claim 1, wherein the raised central crown portion is located between a toe-side crown portion and a heel-side crown portion, the crown portion further comprising:

a first contoured transition region proximate to the first integral rib and located between the raised central crown portion and the toe-side crown portion; and a second contoured transition region proximate to the second integral rib and located between the raised central crown portion and the heel-side crown portion.

8. A golf club head comprising:

a body portion comprising a front portion, a rear portion, a toe portion, a heel portion, a bottom portion, an interior cavity, a top portion having an opening that accesses the interior cavity; and a contoured crown portion attached to the top portion to close the opening in the top portion, the contoured crown portion comprising:

a toe-side crown portion bounded in part by a front perimeter of the contoured crown portion and a toe-side perimeter of the contoured crown portion;

a heel-side crown portion bounded in part by the front perimeter of the contoured crown portion and a heel-side perimeter of the contoured crown portion;

a raised central crown portion between the toe-side crown portion and the heel-side crown portion;

a toe-side integral rib spaced from the raised central crown portion and disposed within the contoured crown portion; and a heel-side integral rib spaced from the raised central crown portion and disposed within the contoured crown portion;

wherein the raised central crown portion is located between the toe-side integral rib and the heel-side integral rib.

9. A golf club head as defined in claim 8, the toe-side integral rib comprising a plurality of composite layers arranged in a stack, wherein each composite layer in the stack is wider than an adjacent composite layer in the stack.

10. A golf club head as defined in claim 8, wherein the raised central crown portion has an outer surface area that is greater than or equal to 40% of a total outer surface area of the contoured crown portion.

11. A golf club head as defined in claim 8, wherein the contoured crown portion further comprises:

a first contoured transition region located between the raised central crown portion and the toe-side crown portion; and a second contoured transition region located between the raised central crown portion and the heel-side crown portion.

12. A golf club head as defined in claim 8, wherein the toe-side crown portion is further bounded by a first contoured transition region located between the toe-side crown portion and the raised central crown portion, the toe-side integral rib being disposed within the first contoured transition region.

13. A golf club head as defined in claim 8, wherein the heel-side crown portion is further bounded by a second contoured transition region located between the heel-side crown portion and the raised central crown portion, the heel-side integral rib being disposed within the second contoured transition region.

14. A golf club head as defined in claim 8, the contoured crown portion further comprising a central integral rib connecting the toe-side integral rib to the heel-side integral rib to form a crown stiffening portion, the central integral rib located at or proximate to the front perimeter of the contoured crown portion.

15. A golf club comprising:

a shaft portion having a first end and a second end opposite the first end;

a grip attached at or proximate to the first end of the shaft portion;

a golf club head comprising a body portion, the body portion comprising a front portion, a rear portion, a toe portion, a heel portion, a bottom portion, a top portion having an opening, and a hosel portion, the hosel portion being attached to the second end of the shaft portion; and a composite crown portion covering the opening in the top portion, the composite crown portion comprising:

an inner structural layer comprising one or more layers of woven fabric impregnated with epoxy resin;

an outer structural layer comprising one or more layers of woven fabric impregnated with epoxy resin;

a first integral rib disposed between the inner structural layer and the outer structural layer, the first integral rib comprising a first stack of composite layers;

a second integral rib disposed between the inner structural layer and the outer structural layer, the second integral rib comprising a second stack of composite layers and; a raised central crown portion located between the first integral rib and the second integral rib, the raised central crown portion configured to serve as an alignment aid.

16. A golf club as defined in claim 15, wherein the composite crown portion comprises a central crown portion that is depressed relative to a heel-side crown portion and a toe-side crown portion.

17. A golf club as defined in claim 15, further comprising a third integral rib extending from the first integral rib to the second integral rib, the first integral rib, second integral rib, and third integral rib together forming a crown stiffening portion.

18. A golf club as defined in claim 15, wherein the first integral rib has a thickness greater than or equal to 2.0 mm, and the second integral rib has a thickness greater than or equal to 2.0 mm.

19. A golf club as defined in claim 15, wherein forming the composite crown portion comprises heating the composite crown portion to cure the epoxy resin in the inner structural layer and the epoxy resin in the outer structural layer.

* * * * *